US006129122A

United States Patent [19]

Bilisik

[11] Patent Number: 6,129,122

[45] Date of Patent: Oct. 10, 2000

[54] MULTIAXIAL THREE-DIMENSIONAL (3-D) CIRCULAR WOVEN FABRIC

[75] Inventor: A. Kadir Bilisik, Raleigh, N.C.

[73] Assignee: 3TEX, Inc., Cary, N.C.

[21] Appl. No.: 09/334,406

[22] Filed: Jun. 16, 1999

[51] Int. Cl.[7] ..... B03D 41/00

[52] U.S. Cl. ..... 139/11; 139/1 R; 139/DIG. 1

[58] Field of Search ..... 139/1 R, 11, DIG. 1

[56] References Cited

U.S. PATENT DOCUMENTS

| | | |
|---|---|---|
| 3,719,210 | 3/1973 | Emerson et al. . |
| 3,719,212 | 3/1973 | Emerson et al. . |
| 3,993,817 | 11/1976 | Schultz . |
| 4,080,915 | 3/1978 | Bompard et al. . |
| 4,183,232 | 1/1980 | Banos et al. . |
| 4,346,741 | 8/1982 | Banos et al. . |
| 5,085,252 | 2/1992 | Mohamed et al. . |
| 5,091,246 | 2/1992 | Yasui et al. . |
| 5,465,760 | 11/1995 | Mohamed et al. . |

OTHER PUBLICATIONS

A. Kadir Bilisik, "Multiaxial Three–Dimensional (3–D) Circular Weaving and Multiaxial 3–D Circular Woven Preforms for Composite," Advanced Multilayered and Fibre–Reinforced Composites, p. 477–487, (Jan. 16, 1998).

M.H. Mohamed et al., "Design of a Multiaxial 3–D Weaving Machine," International Conference on Recent Advances in Mechatronics, (Aug. 14, 1995).

A. Kadir Bilisik et al., "Properties of Multiaxial and 3–D Orthogonal Woven Carbon/Epoxy Composites," Textile and Fiber Reinforced Composites, p. 85–92.

A. Kadir Bilisik et al., "Multiaxial 3–D Weaving Machine and Properties of Multiaxial 3–D Woven Carbon/Epoxy Composites," 39th International SAMPE Symposium, p. 868–883 (Apr. 11, 1994).

A. Kadir Bilisik et al., "Textile Structural Composites: Properties of Multiaxial Three Dimensional Woven Carbon/Eposy Composites," p. 448–455, (Jun. 16, 1997).

A. Kadir Bilisik, "Balistik Kumaslarda Yapi—Ozellik Iliskileri," p. 40–47.

Paul G. Rolincik, Jr., "Autoweave™—A Unique Automated 3D Weaving Technology", SAMPE Journal, p. 40–47, (Sep./Oct., 1987).

*Primary Examiner*—John J. Calvert
*Assistant Examiner*—Robert H. Muromoto, Jr.

[57] ABSTRACT

A three-dimensional multiaxial circular woven fabric of a generally cylindrical shape having a core defined therein about a central axis. A plurality of concentric axial yarn layers extend radially outwardly in spaced-apart relationship from the central axis, and each of the layers comprises a plurality of axial yarns extending parallel to the central axis of the fabric. A plurality of radially spaced-apart circumferential yarns extend outwardly from the central axis of the fabric and define a plane substantially perpendicular thereto, and each of a selected number of the plurality of circumferential yarns is woven between a corresponding plurality of next adjacent and successive concentric axial yarn layers. A plurality of radial yarns is provided in the fabric wherein each of a selected number of the radial yarns is woven between a corresponding plurality of next adjacent and successive axial yarns and each axial yarn layer of a plurality of concentric yarn layers. Thus, each pair of radial yarns contains a radially extending row of axial yarns therebetween that includes a single axial yarn from each of a plurality of next adjacent radially spaced-apart axial yarn layers.

15 Claims, 127 Drawing Sheets

(X·1·1·

MULTIAXIAL THREE-DIMENSIONAL (3-D) CIRCULAR WOVEN FABRIC

TECHNICAL FIELD

The present invention relates generally to a three-dimensional fabric. More particularly, the invention relates to a multiaxial three-dimensional woven fabric comprising a generally cylindrical fabric structure formed from axial, circumferential, and radial yarns in such a manner as to provide high torsional and shear strength and high modulus to prevent delamination.

BACKGROUND ART

Presently known circular woven preforms suffer shortcomings with regard to fiber orientation both in the in-plane and out-of-plane directions. Shortcomings of presently known circular woven preforms can result in low torsional and shear properties in the composite that is ultimately formed from the preform. Also, large complex shapes are difficult to produce with multiaxial constructions presently known in the art, and the process for constructing large complex shapes is not believed to be one step and continuous in the present state of the art.

Several processes have been developed on three-dimensional (3-D) circular weaving. A 3-D circular orthogonal woven preform has been developed using three sets of fibers: circumferential; radial; and axial. This preform disclosed in U.S. Pat. No. 3,993,817 is not a true orthogonal woven preform due to radial fiber placement and is not suitable for continuous and complex sectional preform fabrication.

Another 3-D circular orthogonal woven preform has been developed using three sets of fibers as axial, radial and circumferential and is disclosed in U.S. Pat. No. 4,346,741. The process includes weaving-knitting principles and is suitable for part manufacturing. However, the process is two steps and requires a long set-up time and is labor intensive. Further, it is difficult to arrange directional fiber volume fraction in the preform.

Yet another form of 3-D orthogonal circular woven preform has been developed that is formed from three sets of fibers: axial; circumferential; and radial. The process disclosed in U.S. Pat. No. 4,080,915 includes winding and insertion units. The large dimensional preform can be produced easily, but the process has several steps and requires a pre-stiffened rod for radial reinforcements.

DISCLOSURE OF THE INVENTION

In accordance with the present invention, applicants provide a three-dimensional (3-D) fabric of a generally cylindrical shape with a core defined therein having a central axis. The fabric comprises a plurality of concentric axial yarn layers that extend radially outwardly in spaced-apart relationship from the central axis of the fabric such that each of the layers includes a plurality of axial yarns extending parallel to the central axis of the fabric. A plurality of radially spaced-apart circumferential yarns extend outwardly from the central axis of the fabric and define a plane substantially perpendicular to the fabric central axis, and a selected number of the plurality of circumferential yarns is woven between a corresponding plurality of next adjacent and successive axial yarn layers. A plurality of radial yarns are provided such that each of a selected number of the plurality of radial yarns is woven between a corresponding plurality of next adjacent and successive axial yarns in each axial yarn layer of a plurality of concentric axial yarn layers. Thus, each pair of radial yarns contains a radially extending row of axial yarns therebetween that includes a single axial yarn from each of a plurality of next adjacent and radially spaced-apart axial yarn layers.

It is therefore the object of the present invention to provide a three-dimensional circular woven fabric which is oriented multiaxially both in the in-plane and the out-of-plane directions so as to provide high torsional strength, shear strength and high modulus without delaminating.

It is another object of the present invention to provide a three-dimensional multiaxial circular woven fabric that is particularly well adapted to produce woven preforms of complex shapes.

It is another object of the present invention to provide a three-dimensional multiaxial circular woven fabric that is formed with out-of-plane yarn orientation so as to substantially eliminate delamination.

It is still another object of the present invention to provide a three-dimensional multiaxial circular woven fabric for use in a preform that provides better torsional and shear properties than known heretofore.

It is still another object of the present invention to provide a three-dimensional multiaxial circular woven fabric for use as a preform that can be constructed with fiber content in each direction of the preform that is tailored to correspond to the required properties of the preform.

It is still another object of the present invention to provide a three-dimensional multiaxial circular woven fabric for use in complex cross-sectional configured preforms for selected composite applications.

Some of the objects of the invention having been stated, other objects will become evident as the description proceeds, when taken in connection with the accompanying drawings described hereinbelow.

BRIEF DESCRIPTION OF THE DRAWINGS

FIG. 1(*a*) is a vertical cross-sectional view of the three-dimensional multiaxial circular woven fabric F taken along the longitudinal direction;

FIG. 1(*b*) is FIG. 1 with parts broken away;

FIG. 2(*a*) is a vertical cross-sectional view of the three-dimensional multiaxial circular fabric F1 taken along the longitudinal direction;

FIG. 3(*a*) is a vertical cross-sectional view of the three-dimensional multiaxial circular fabric F2 taken along the longitudinal direction;

FIG. 3(*b*) is FIG. 3 with parts broken away,

FIG. 3(*c*) is a perspective view of still another form of the three-dimensional multiaxial circular woven fabric constructed as a preform (F2*a*);

FIG. 3(*d*) is a vertical cross-sectional view of the three-dimensional multiaxial circular woven fabric F2*a* taken along the longitudinal direction;

FIG. 5(*a*) is a vertical cross-sectional view of the three-dimensional multiaxial woven fabric F4 taken along the longitudinal direction;

FIG. 6(*a*) is a schematic side view of the surface of the inner section of the preform F5;

FIG. 6(*b*) is a schematic perspective partial view of the preform F5;

FIG. 6(*c*) is a schematic side view of the surface of the inner section of the preform F5;

FIG. 7(*a*) is a cross-sectional view of the shaped structure F5 seen in FIG. 7;

FIG. 9(*a*) is a schematic side elevation view of the three-dimensional multiaxial circular weaving apparatus shown in FIG. 9;

FIG. 9(*b*) is a schematic cross-sectional view of the three-dimensional multiaxial circular weaving apparatus shown in FIG. 9;

FIG. 10(*a*) is a schematic cross-sectional view of the radial corridor for a radial yarn carrier in the machine bed taken along line B–B' shown in FIG. 10;

FIG. 10(*b*) is a schematic cross-sectional view of the machine bed taken along line C–C' shown in FIG. 10;

FIG. 10(*c*) is a schematic perspective view of the back side of the machine bed shown in FIG. 10;

FIG. 11(*a*) is a schematic perspective partial view of the circular ring shown in FIG. 11;

FIG. 11(*b*) is a schematic side view of the circular ring shown in FIG. 11;

FIG. 11(*c*) is a schematic side view of the circumferential yarn carrier of the weaving apparatus of FIG. 9;

FIG. 14 is a schematic view of starting position of the weaving apparatus for producing the preform (F) wherein;

o means axial yarn;

r1 means radial yarn carrier (r, r2, r3, r4, r5, r6);

c means circumferential yarn carrier (c1, c2, c3, c4, c5, c6); and b+/− means Bias yarn carrier (b+/−1, b+/−2, b+/−3, b+/−4, b+/−5, b+/−6).

Figure 9:
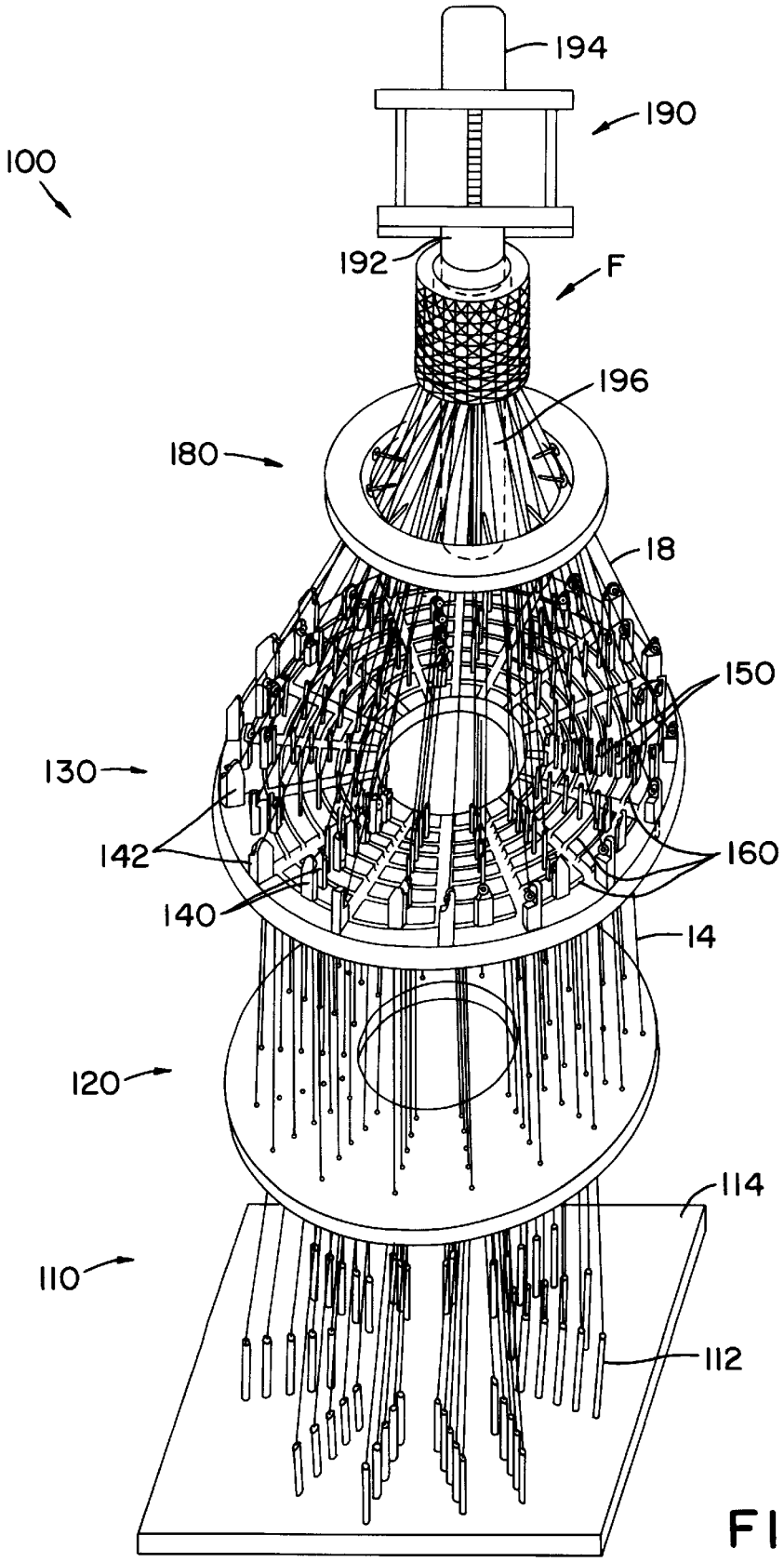
FIG. 9 is a schematic perspective view of the three-dimensional multiaxial circular weaving apparatus according to the present invention.
Figure 9A:
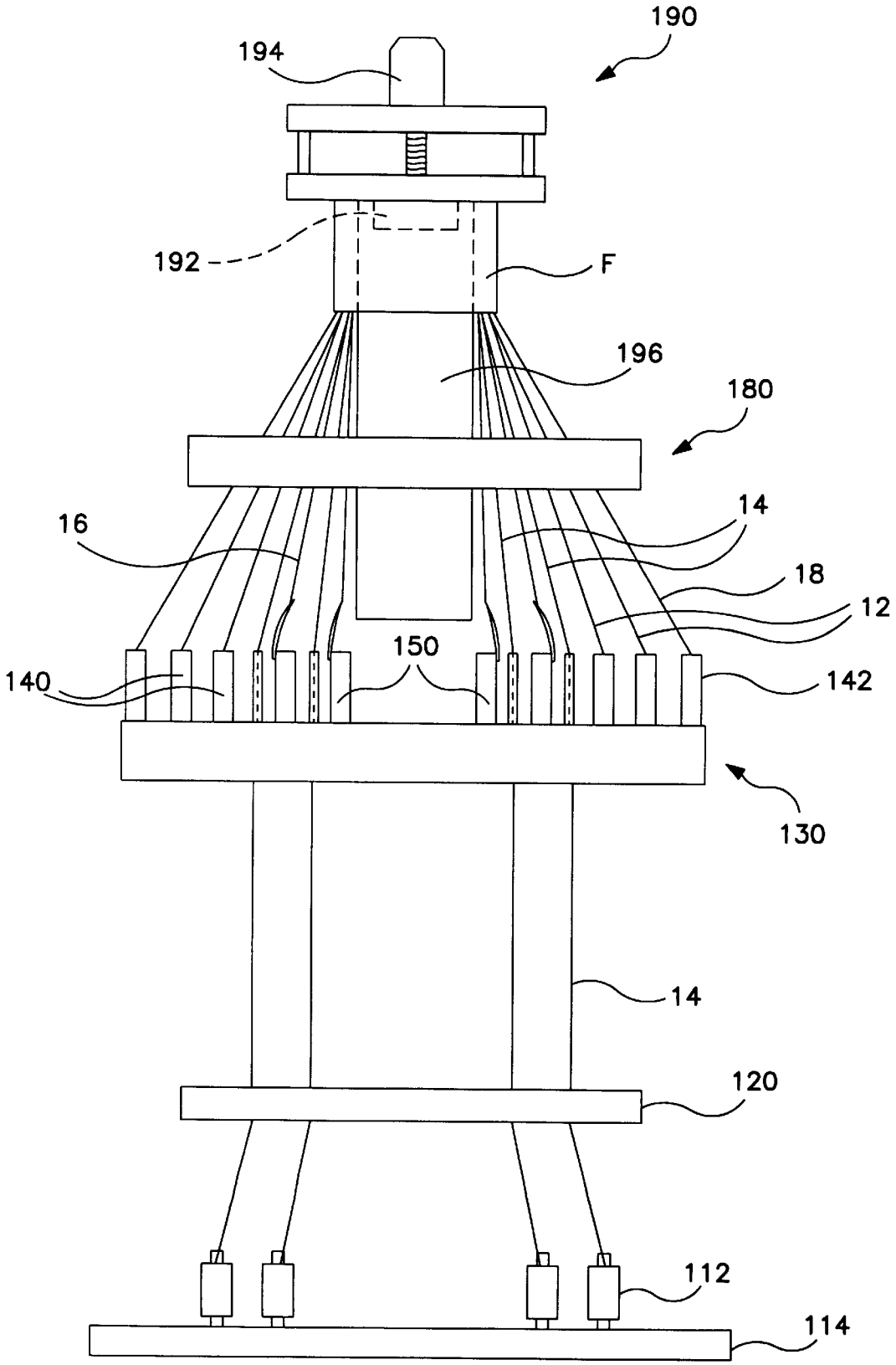
Figure 9B:
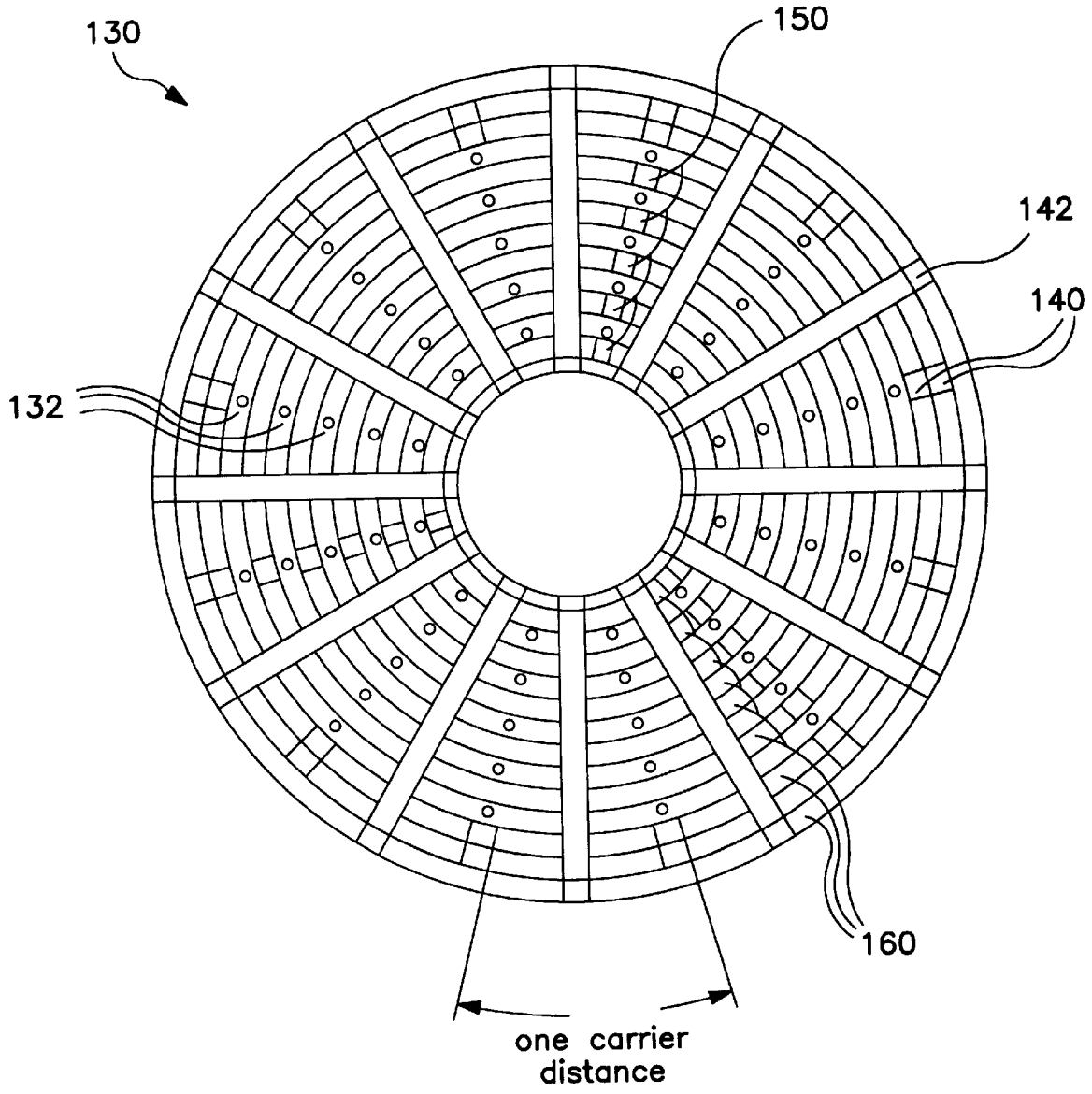
Figures 1, 14:
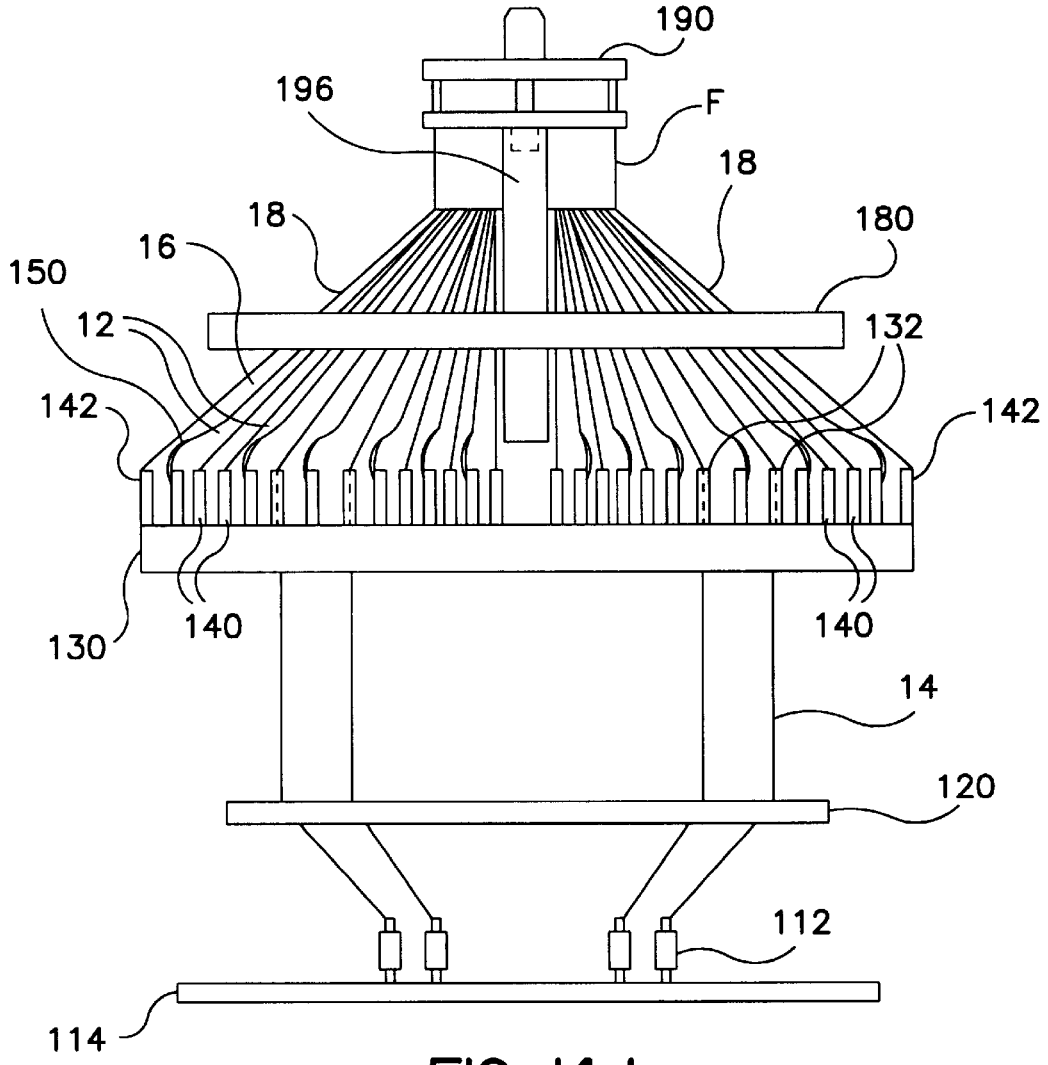
Figures 2, 14:
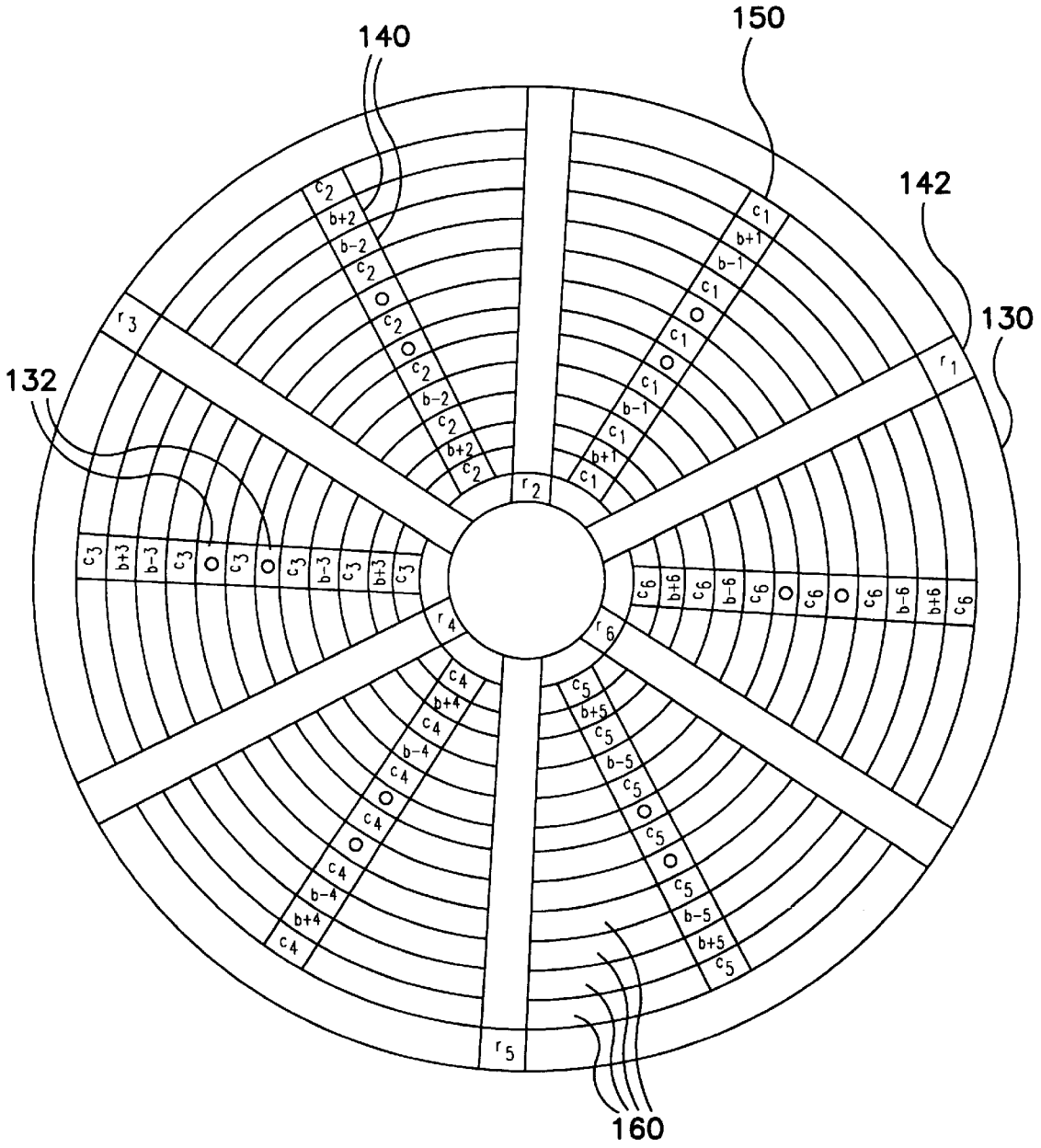
Figures 1, 14A:
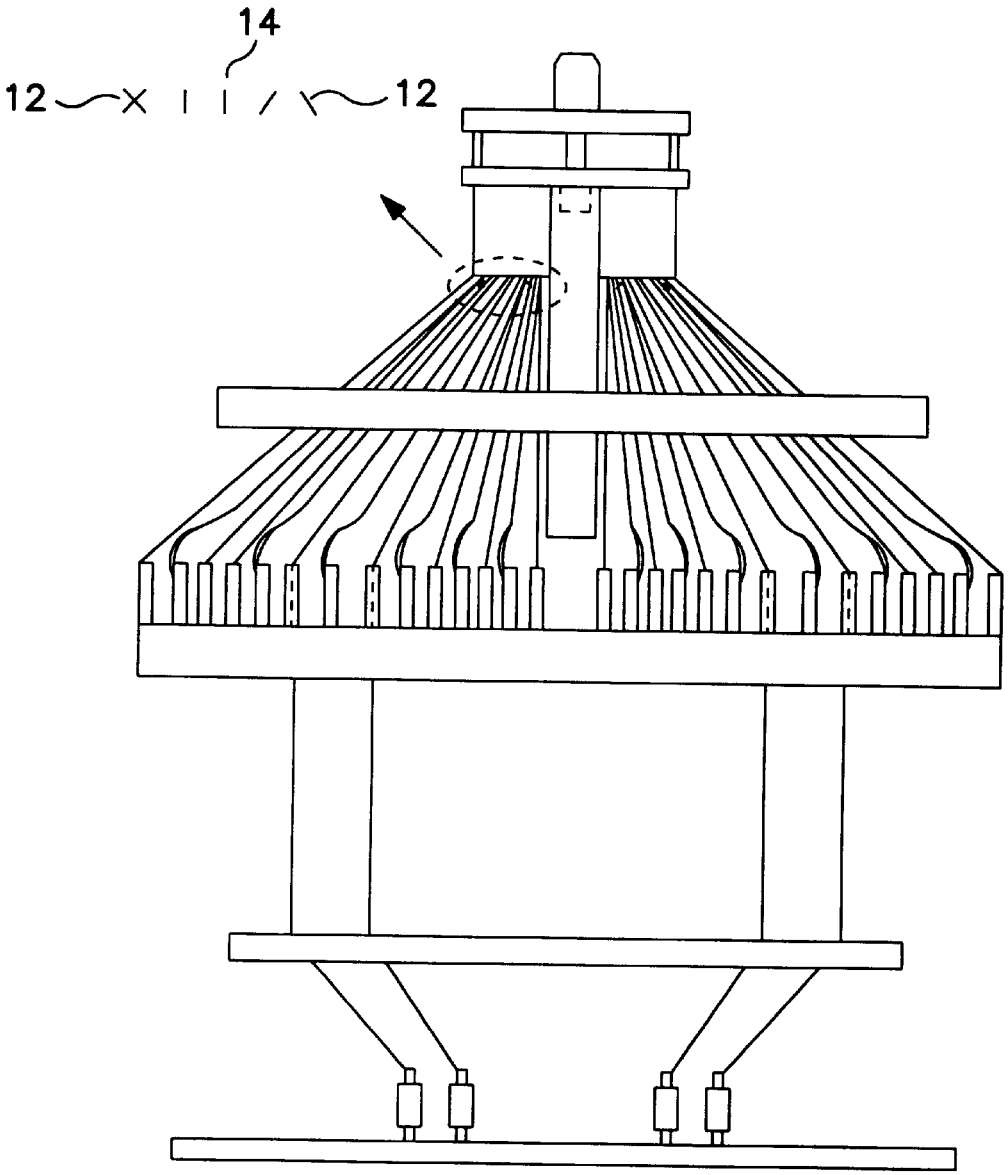
Figures 2, 14A:
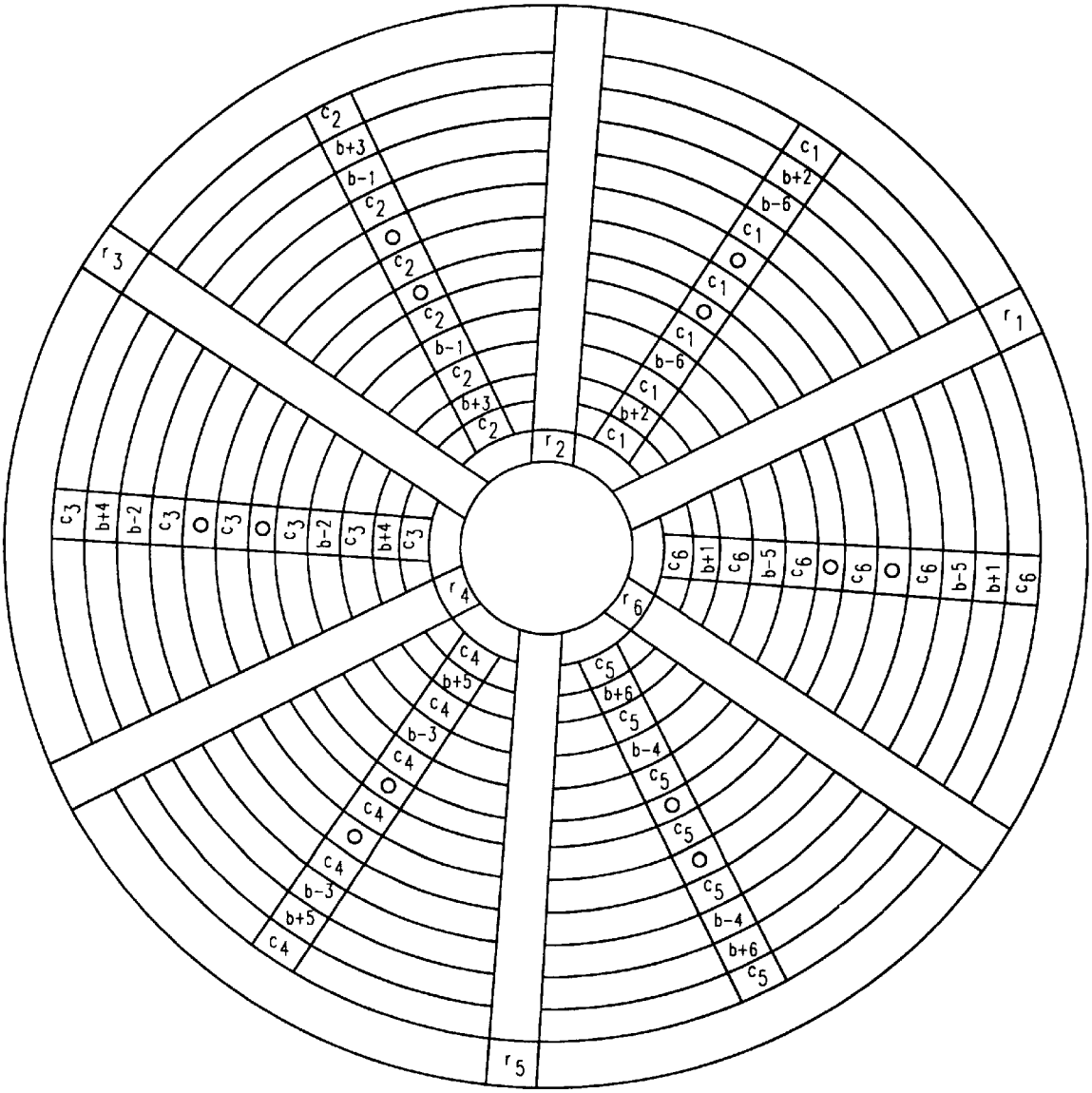
Figures 1, 14B:
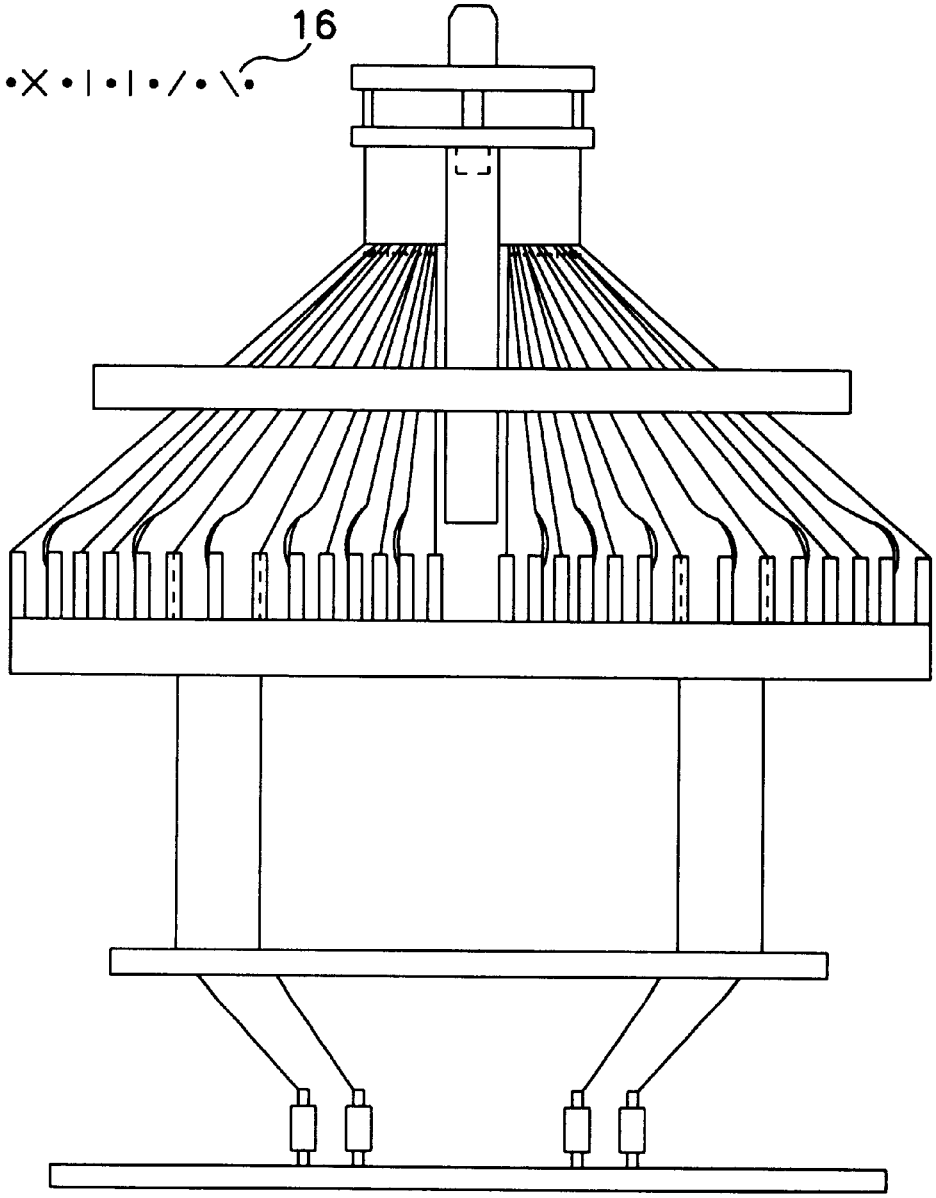
Figures 2, 14B:
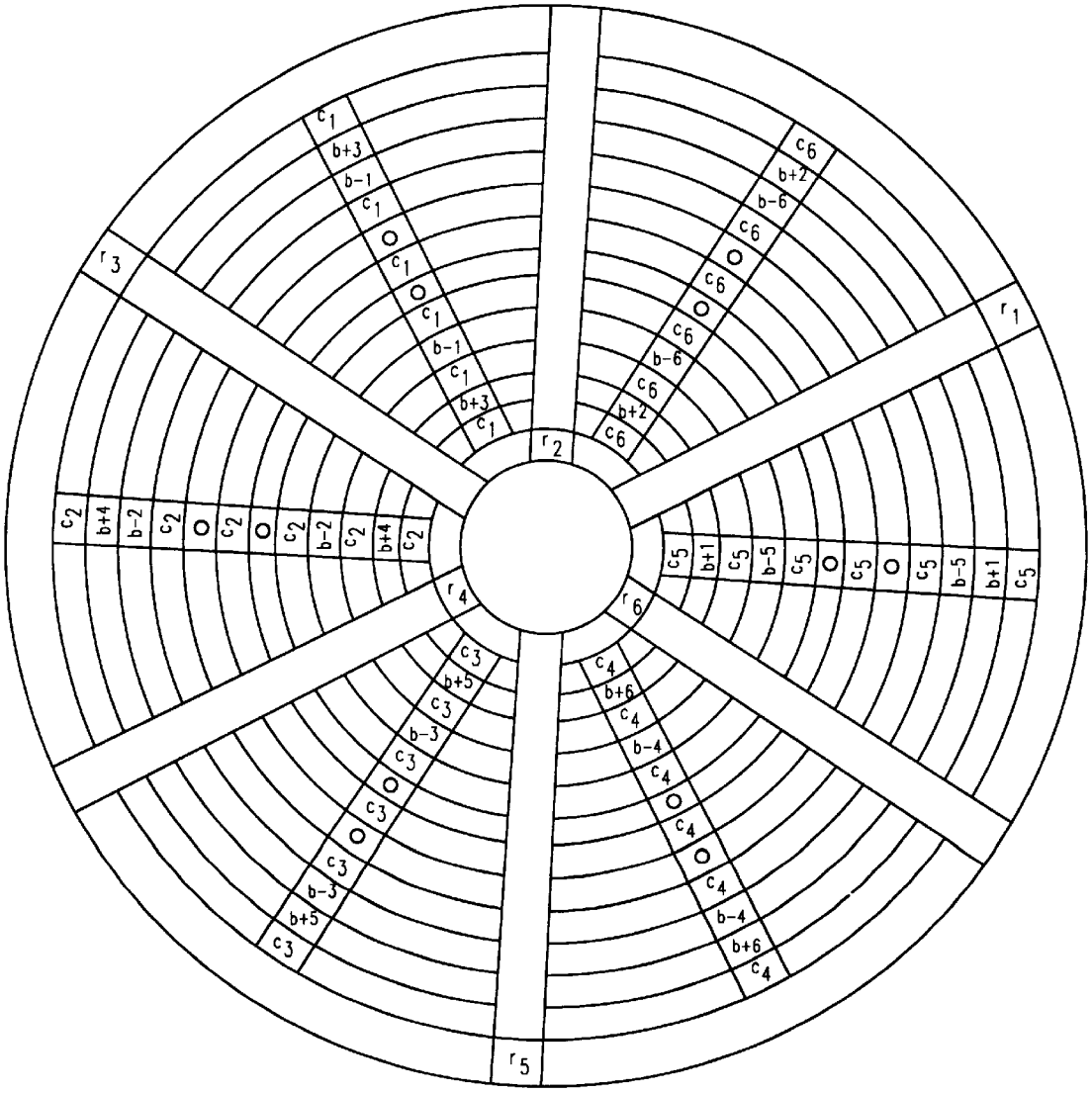
Figures 1, 14C:
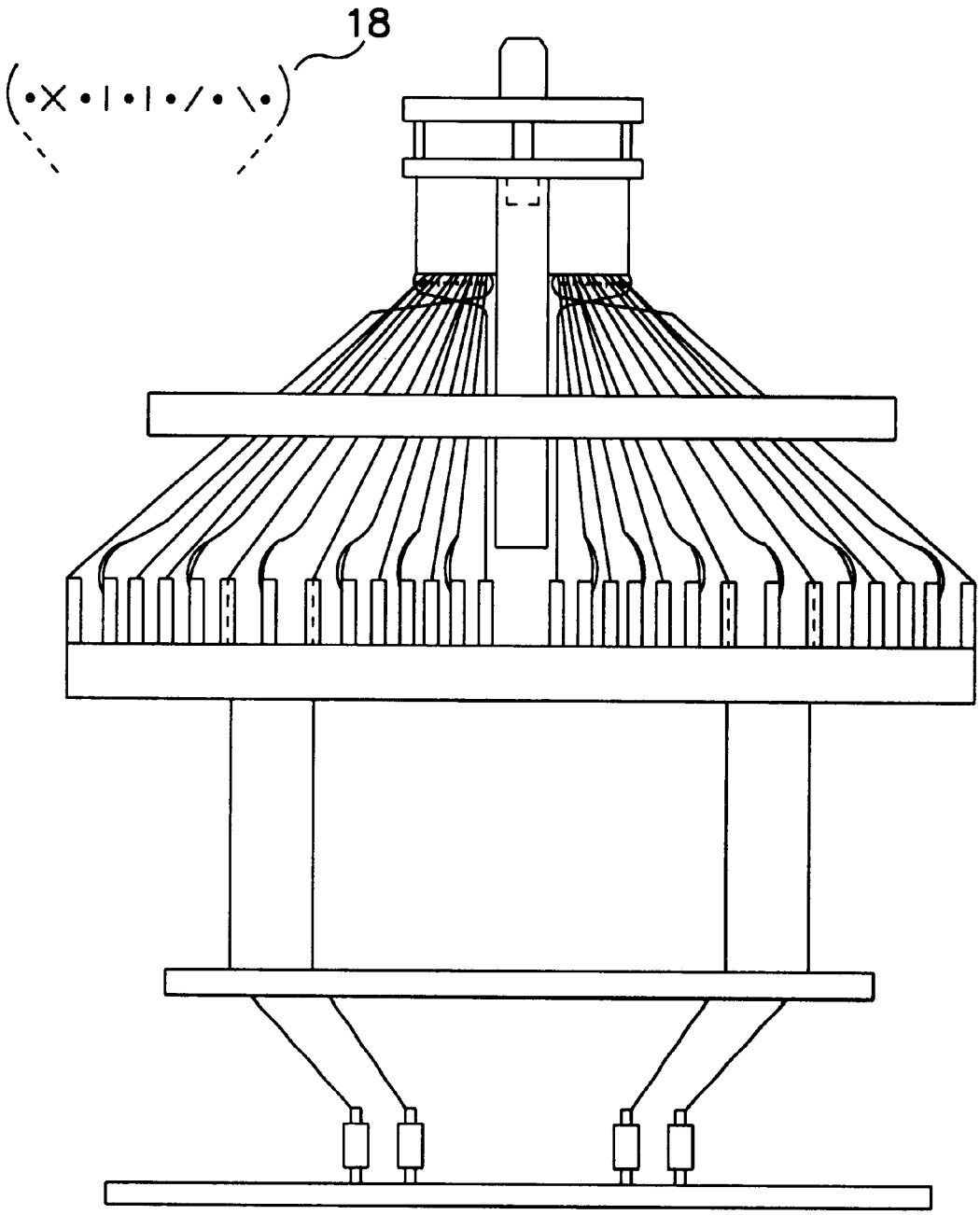
Figures 2, 14C:
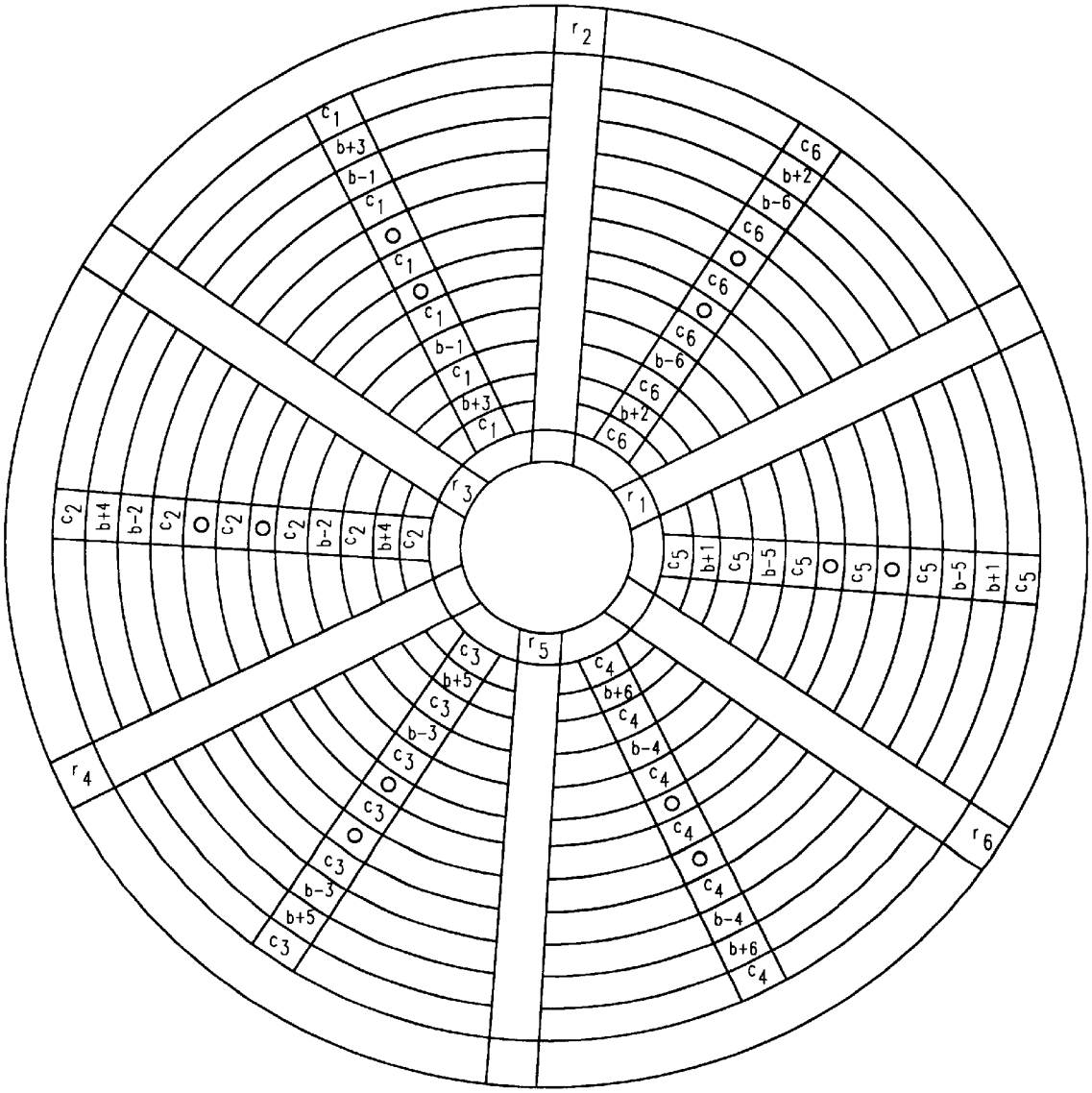
Figures 1, 14D:
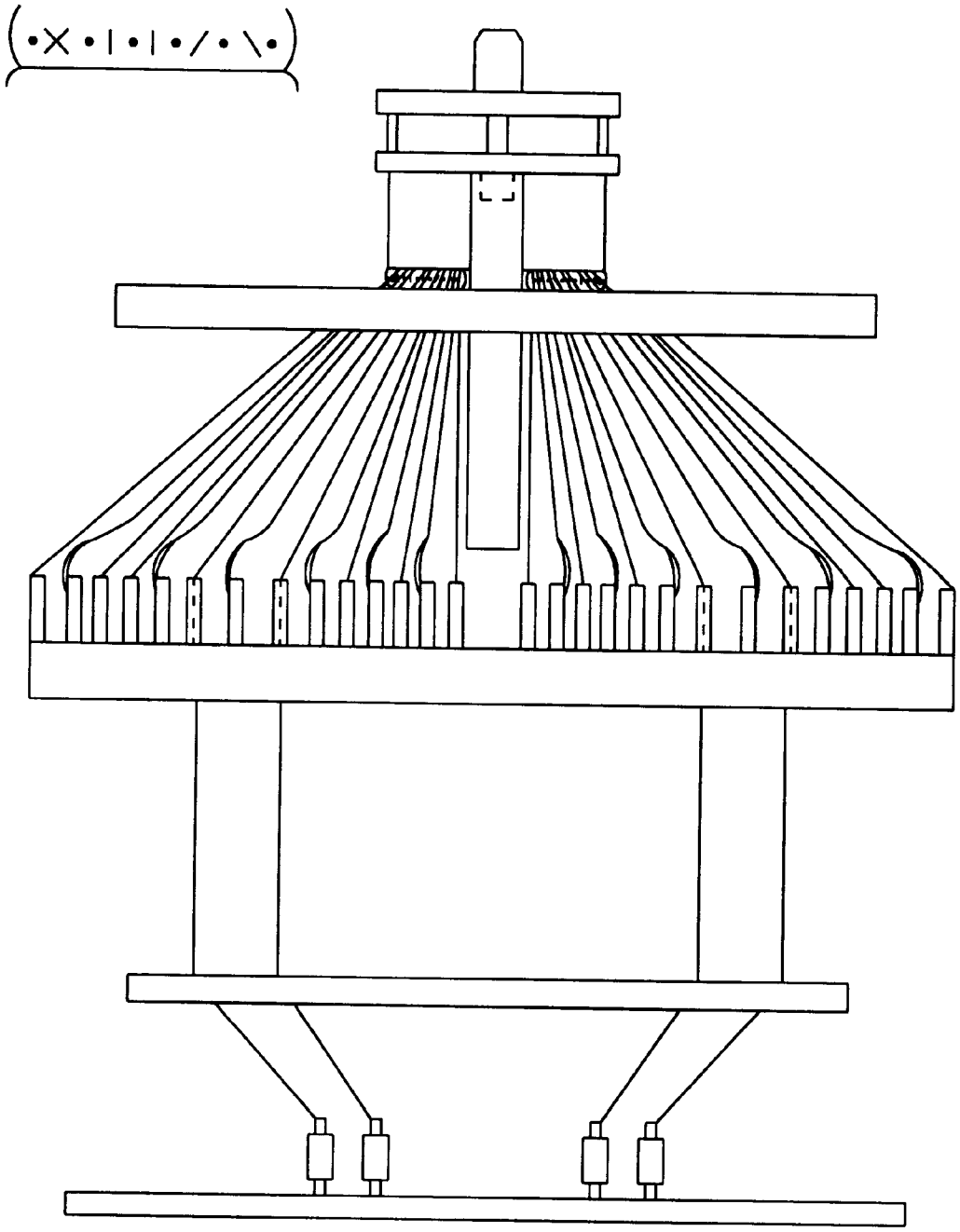
Figures 2, 14D:
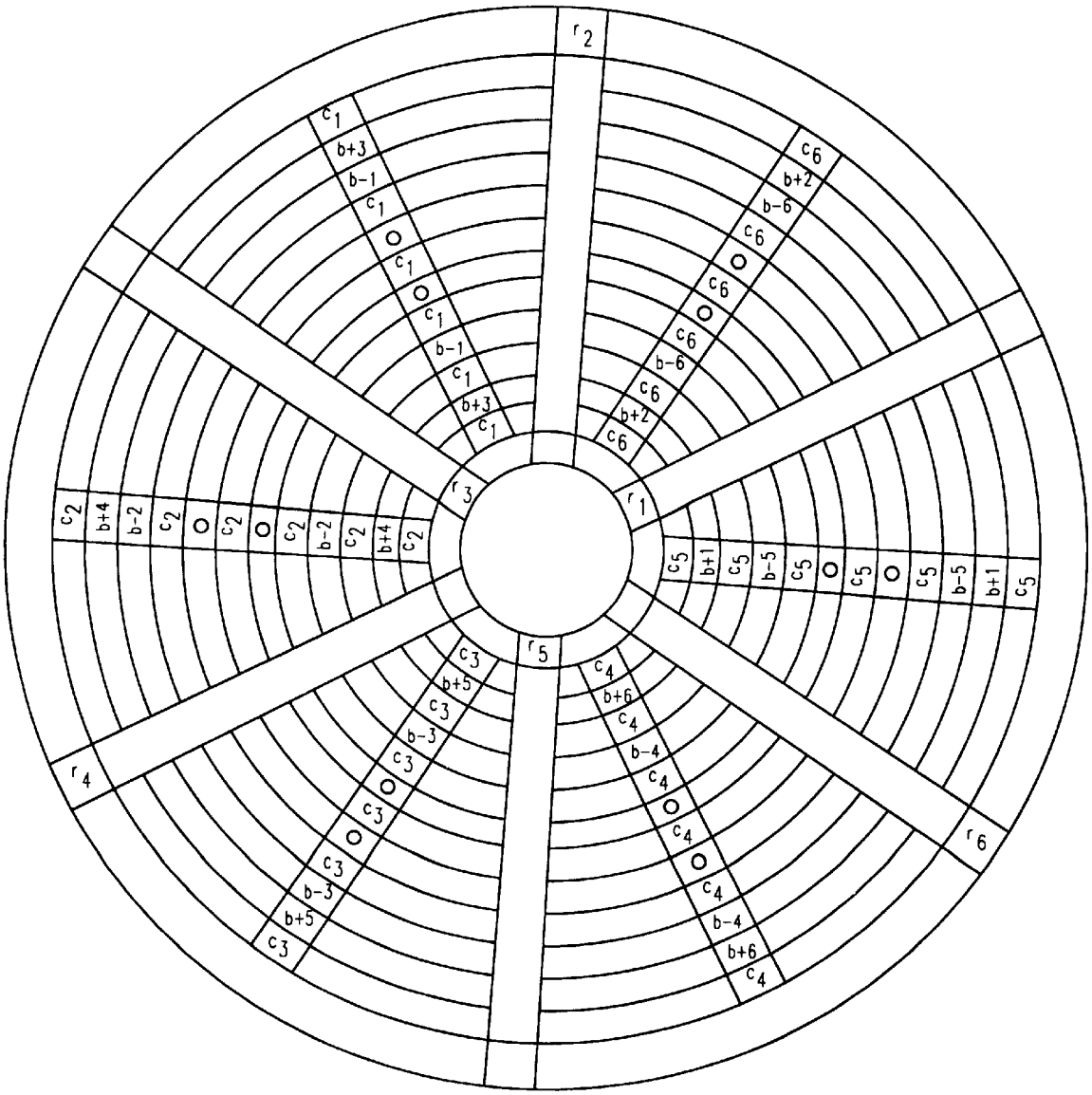
Figures 1, 14E:
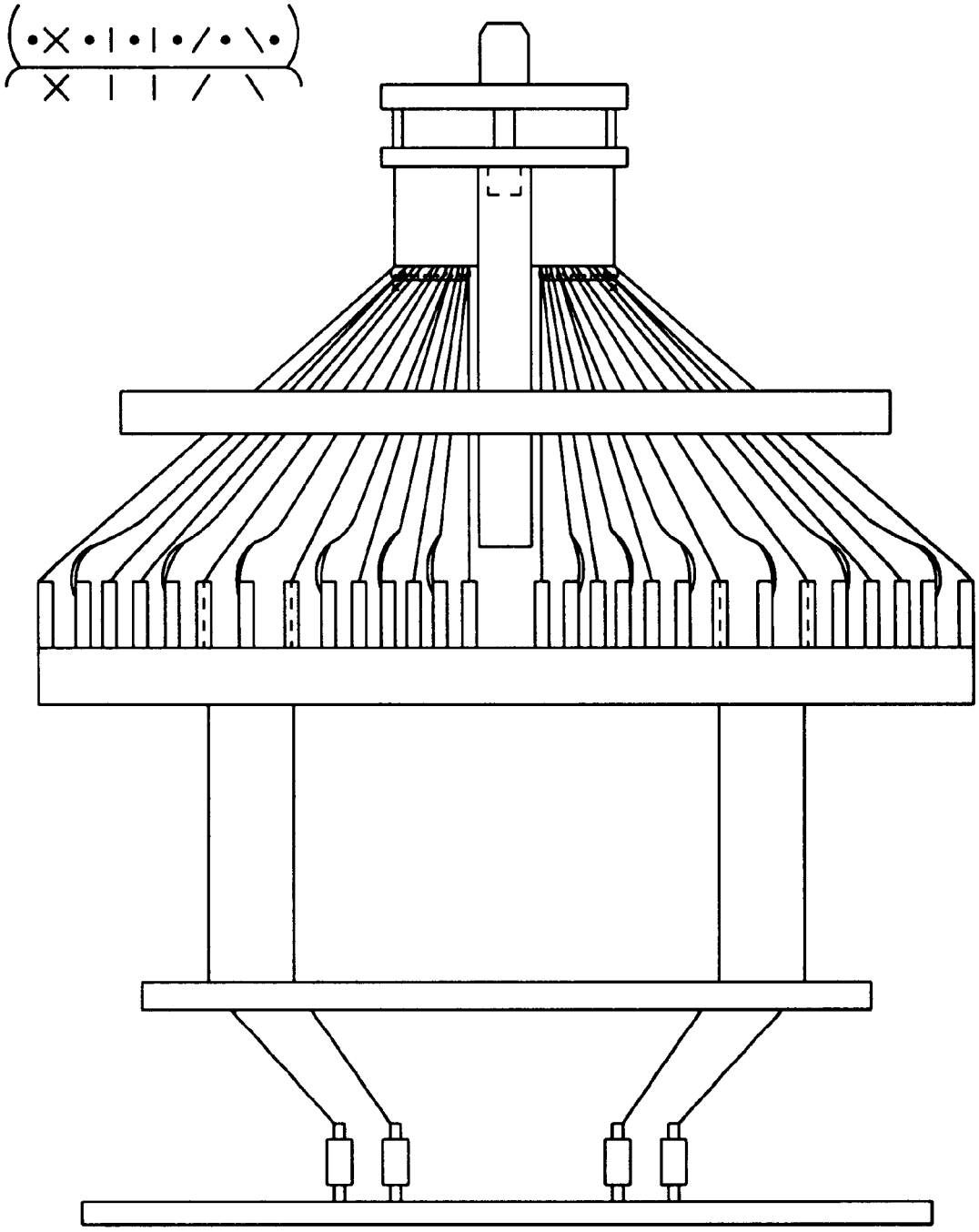
Figures 2, 14E:
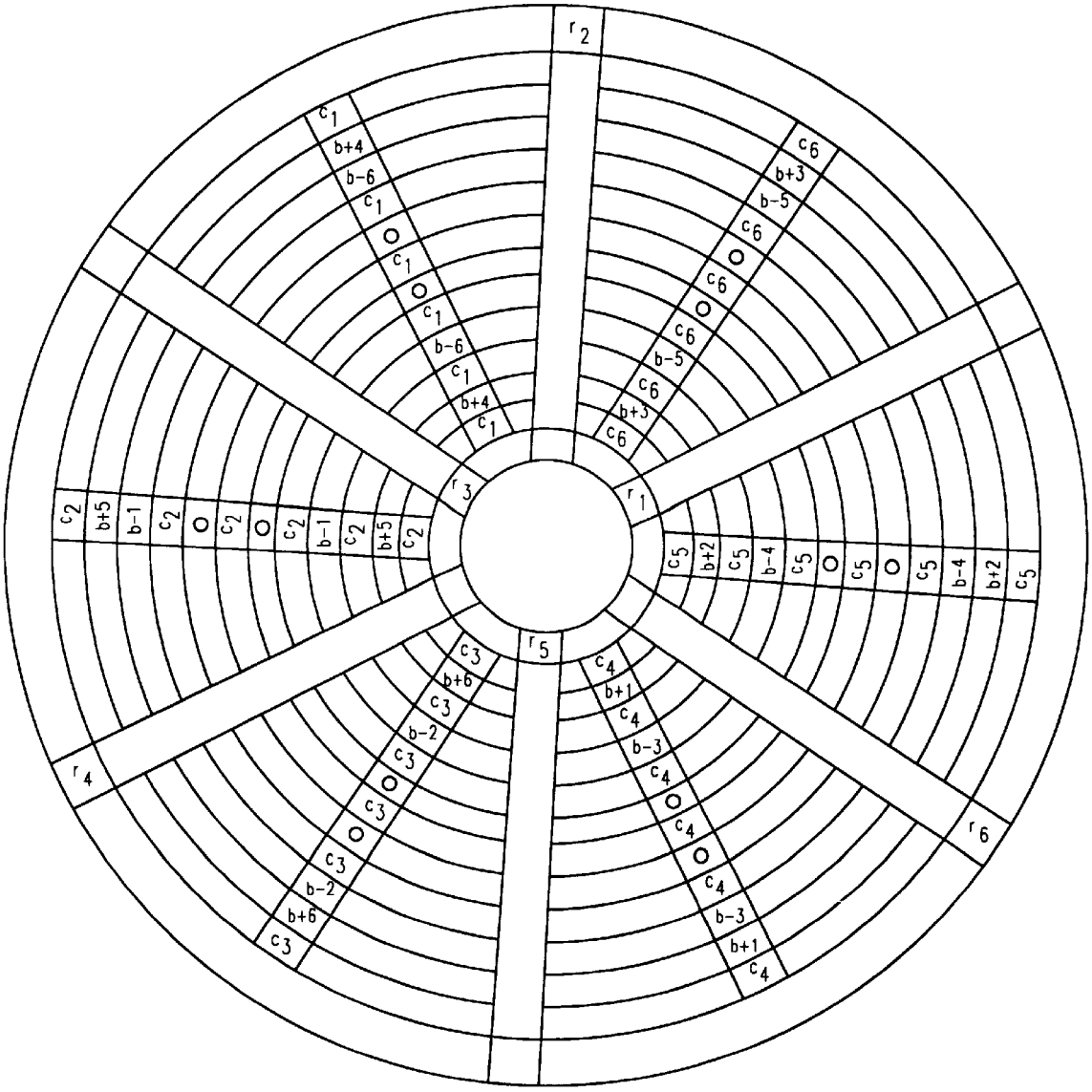
Figures 1, 14F:
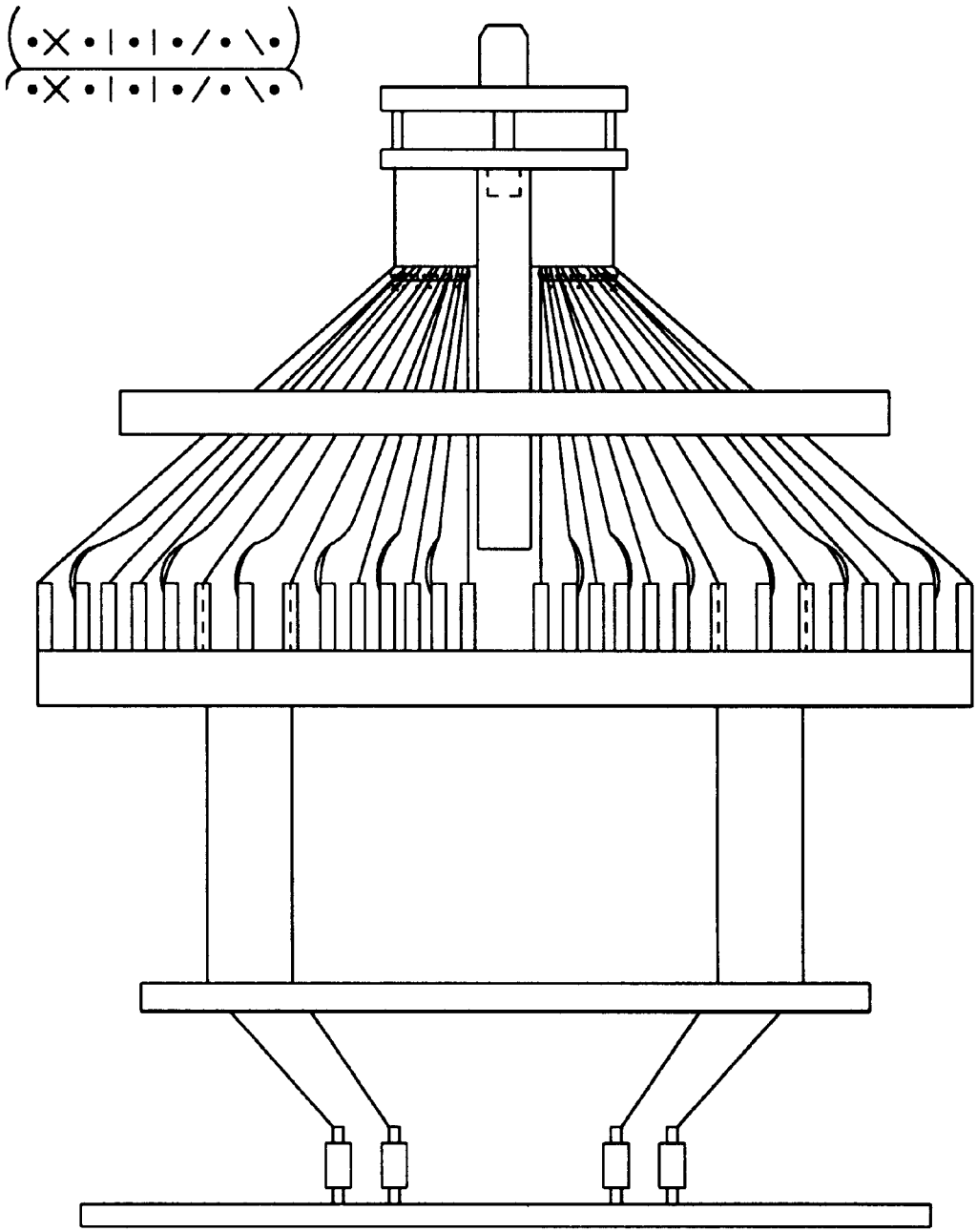
Figures 2, 14F:
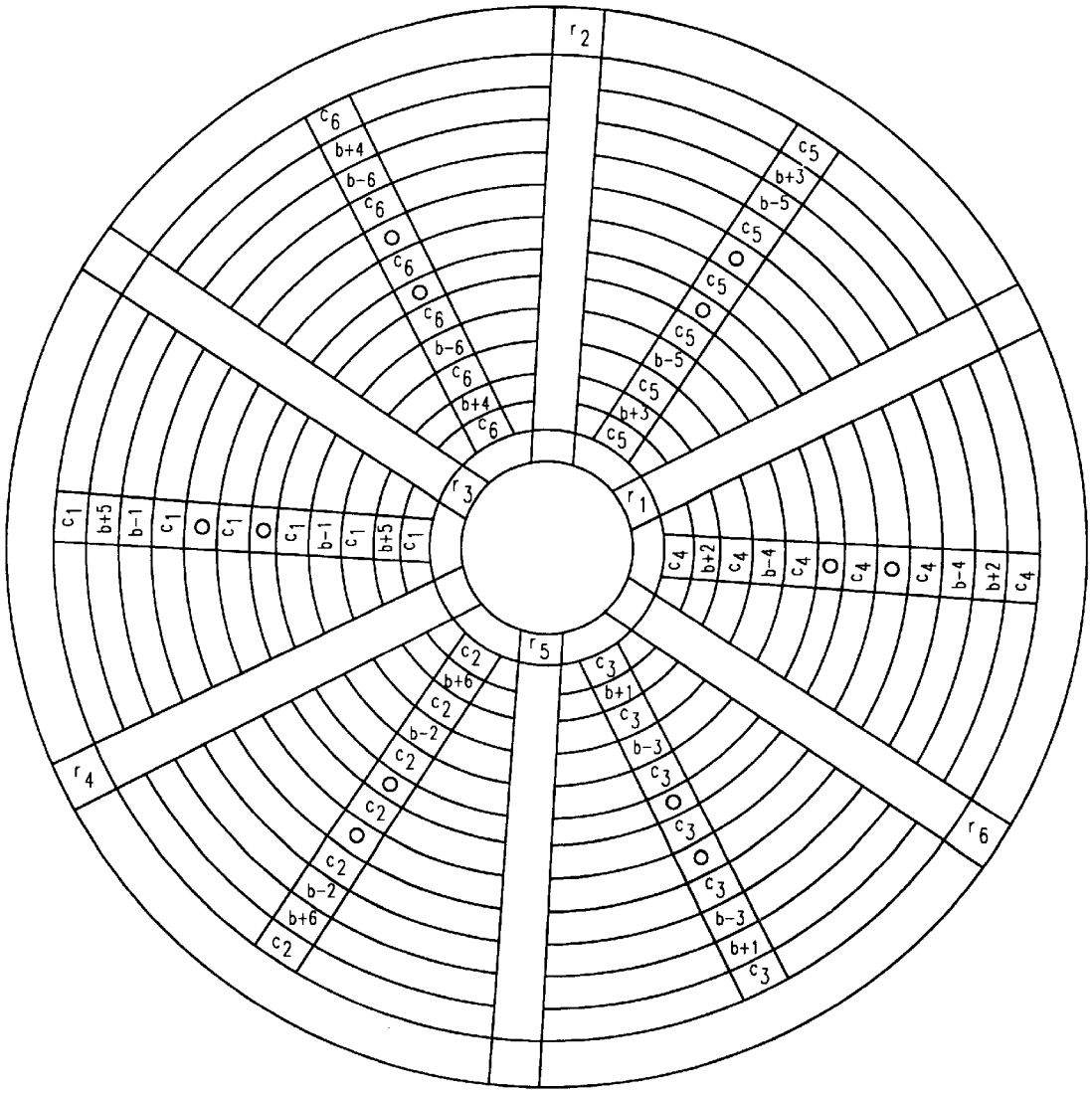
Figures 1, 14G:
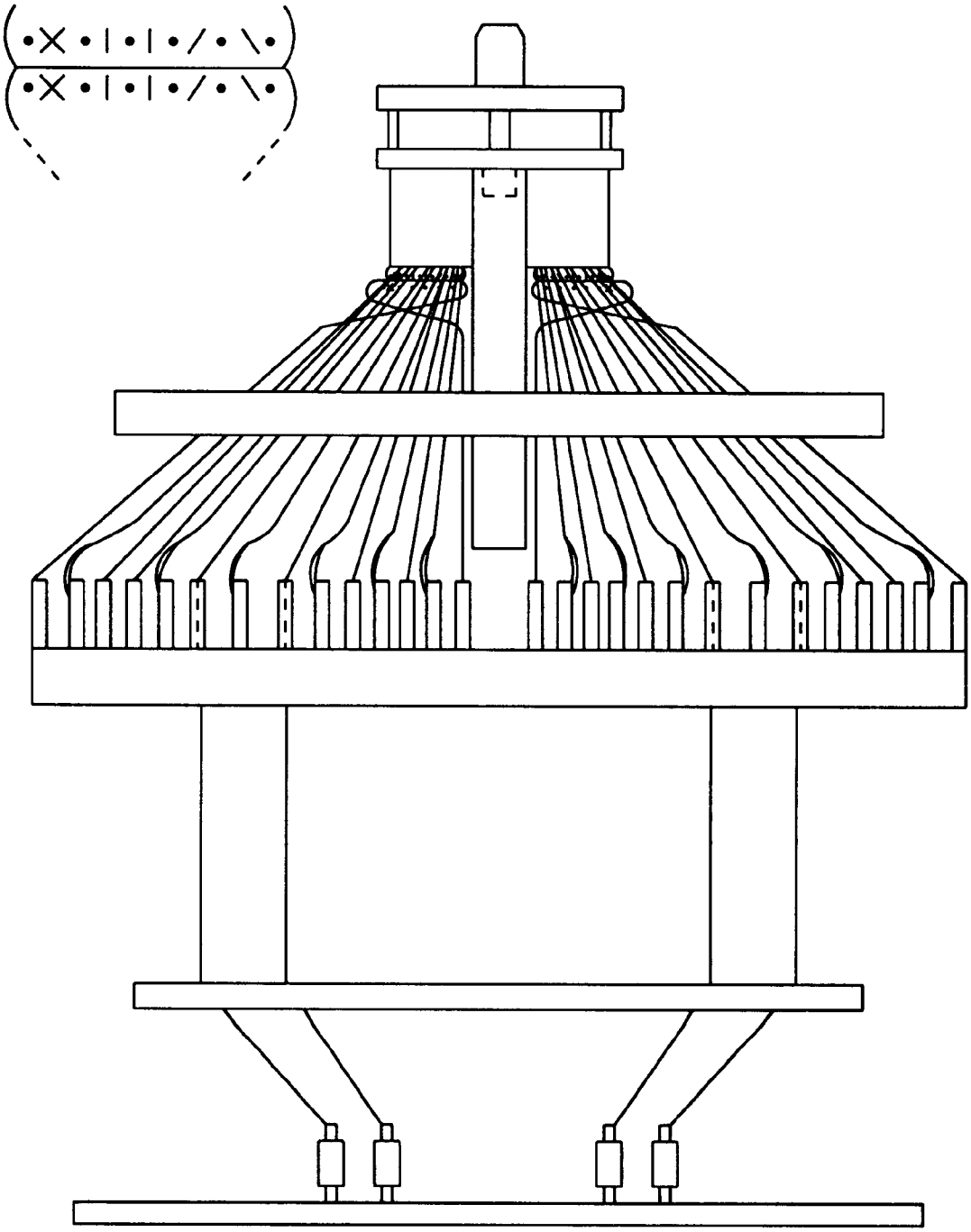
Figures 2, 14G:
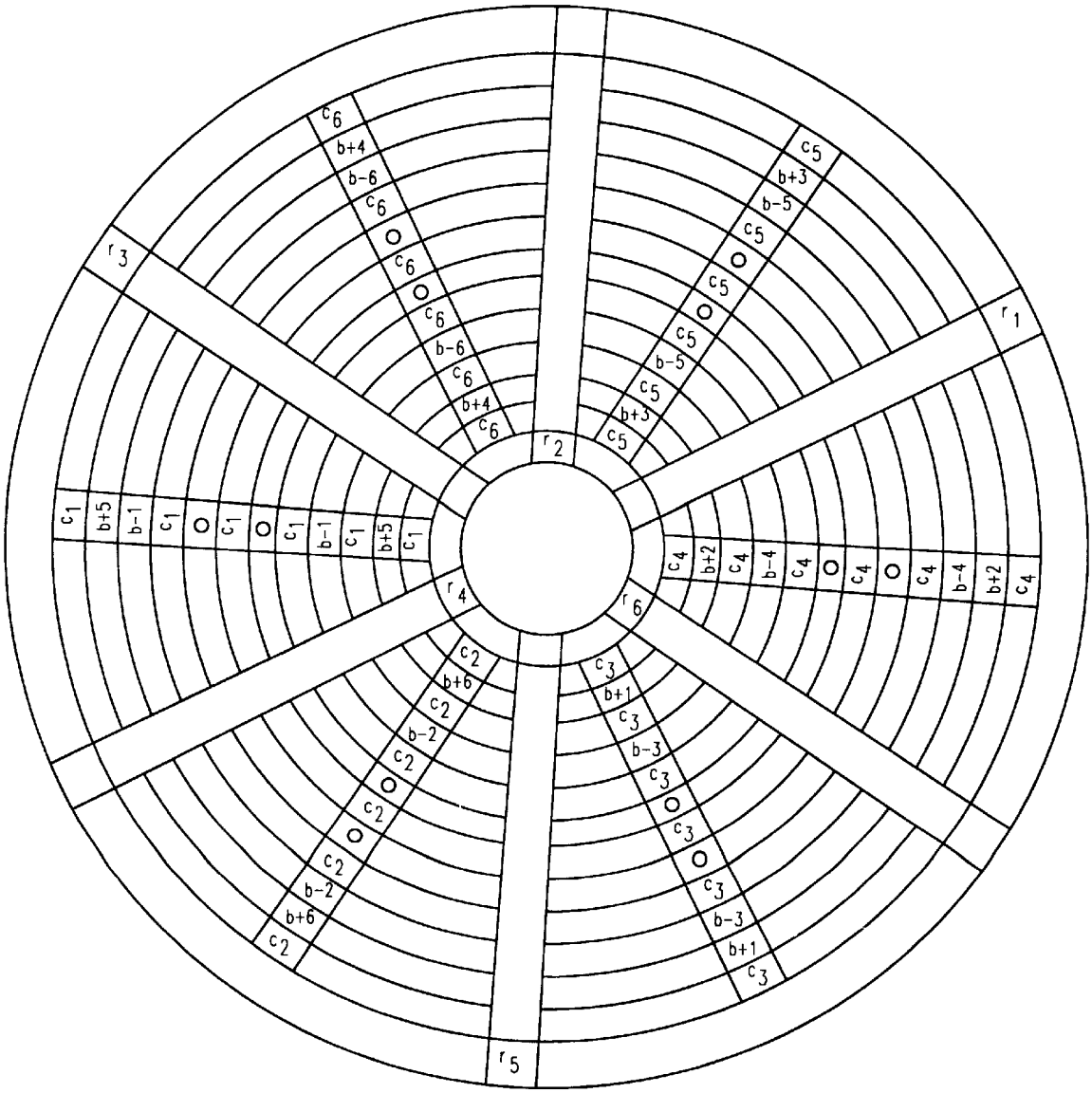
Figures 1, 14H:
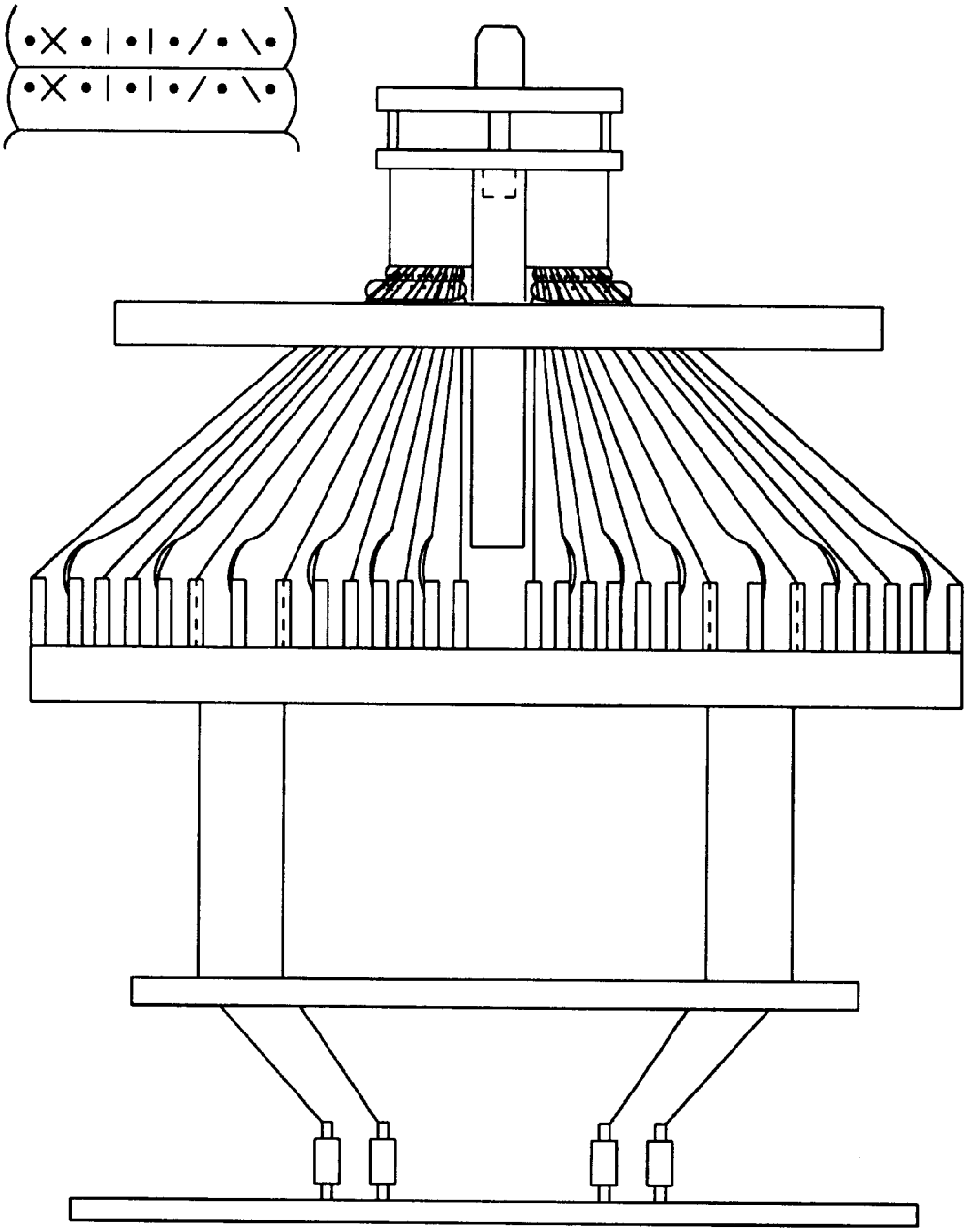
Figures 2, 14H:
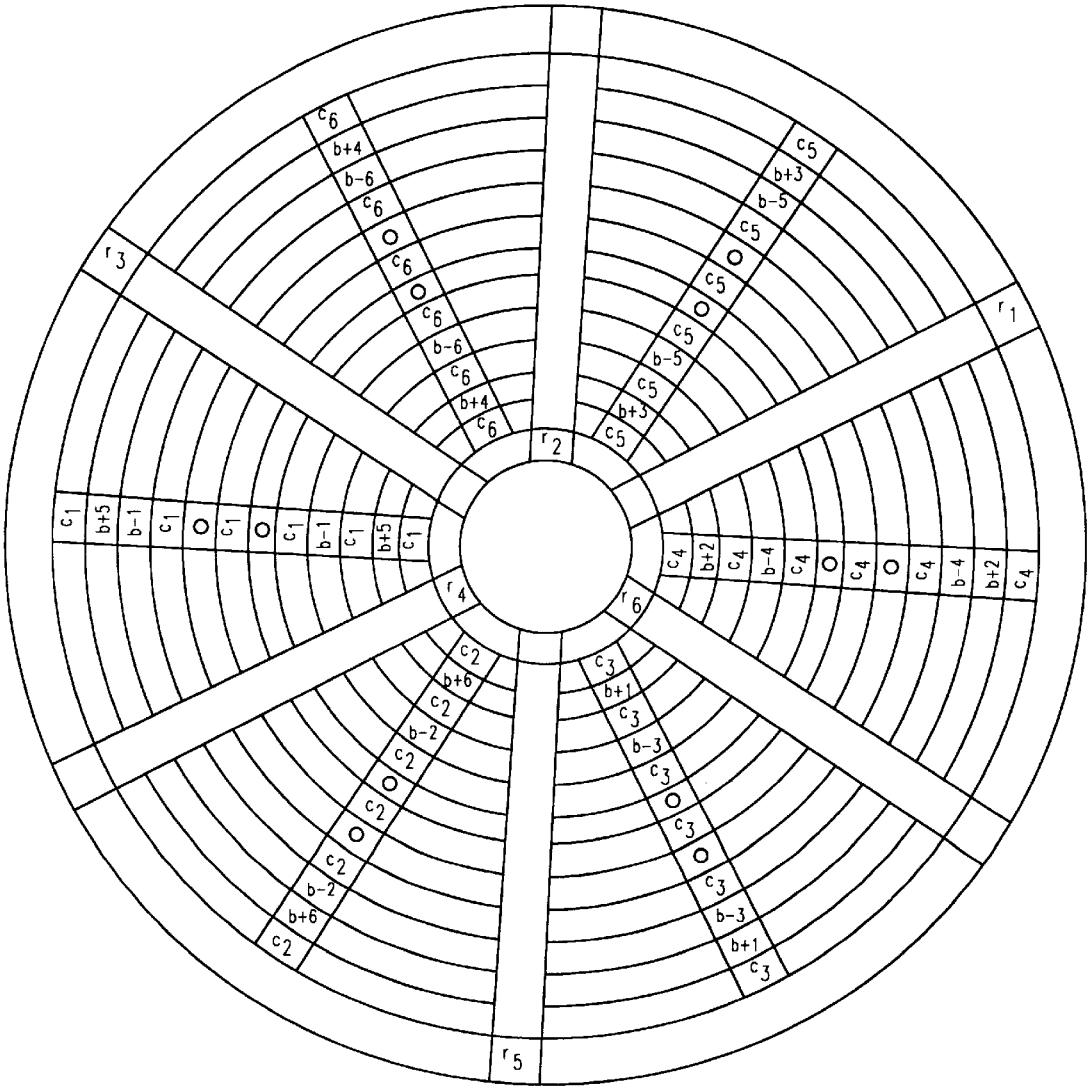
Figures 1, 15:
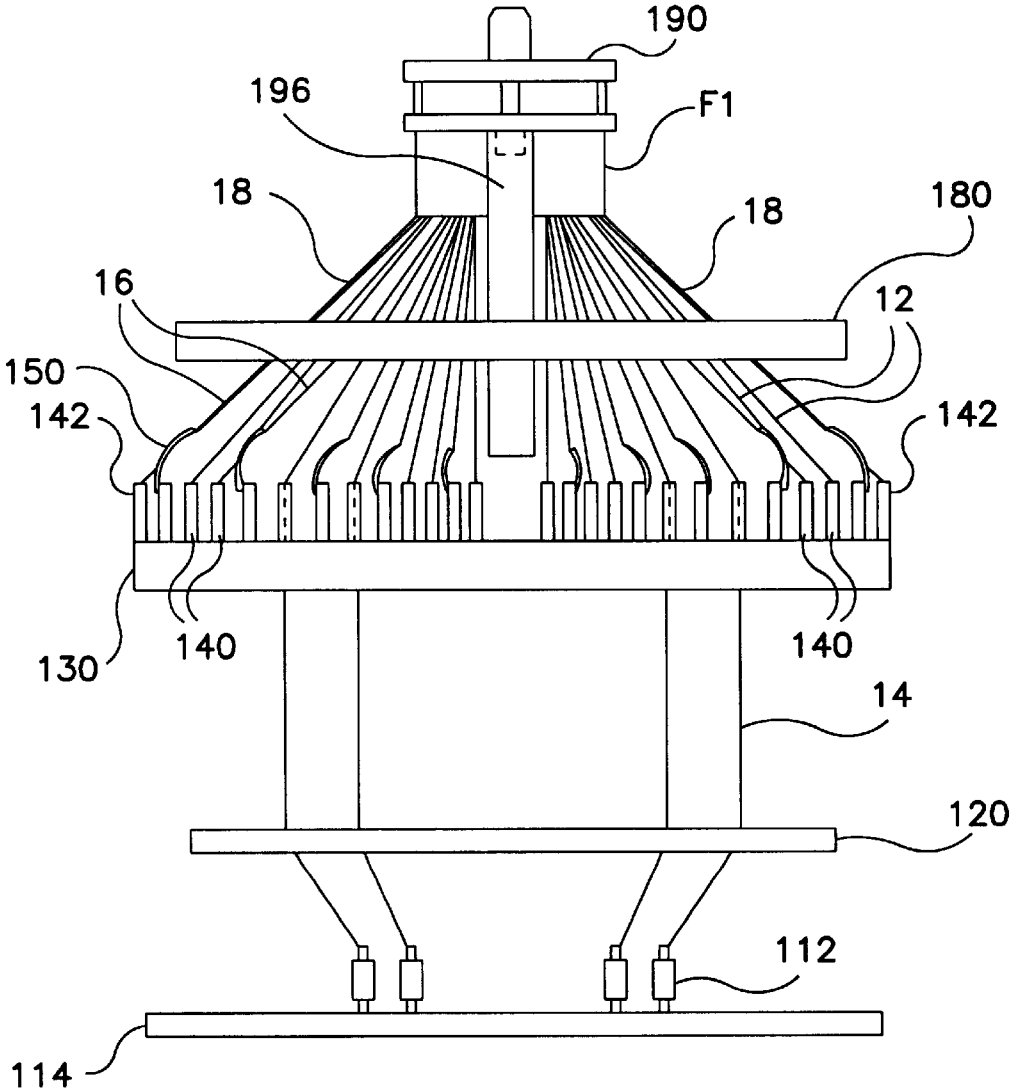
Figures 2, 15:
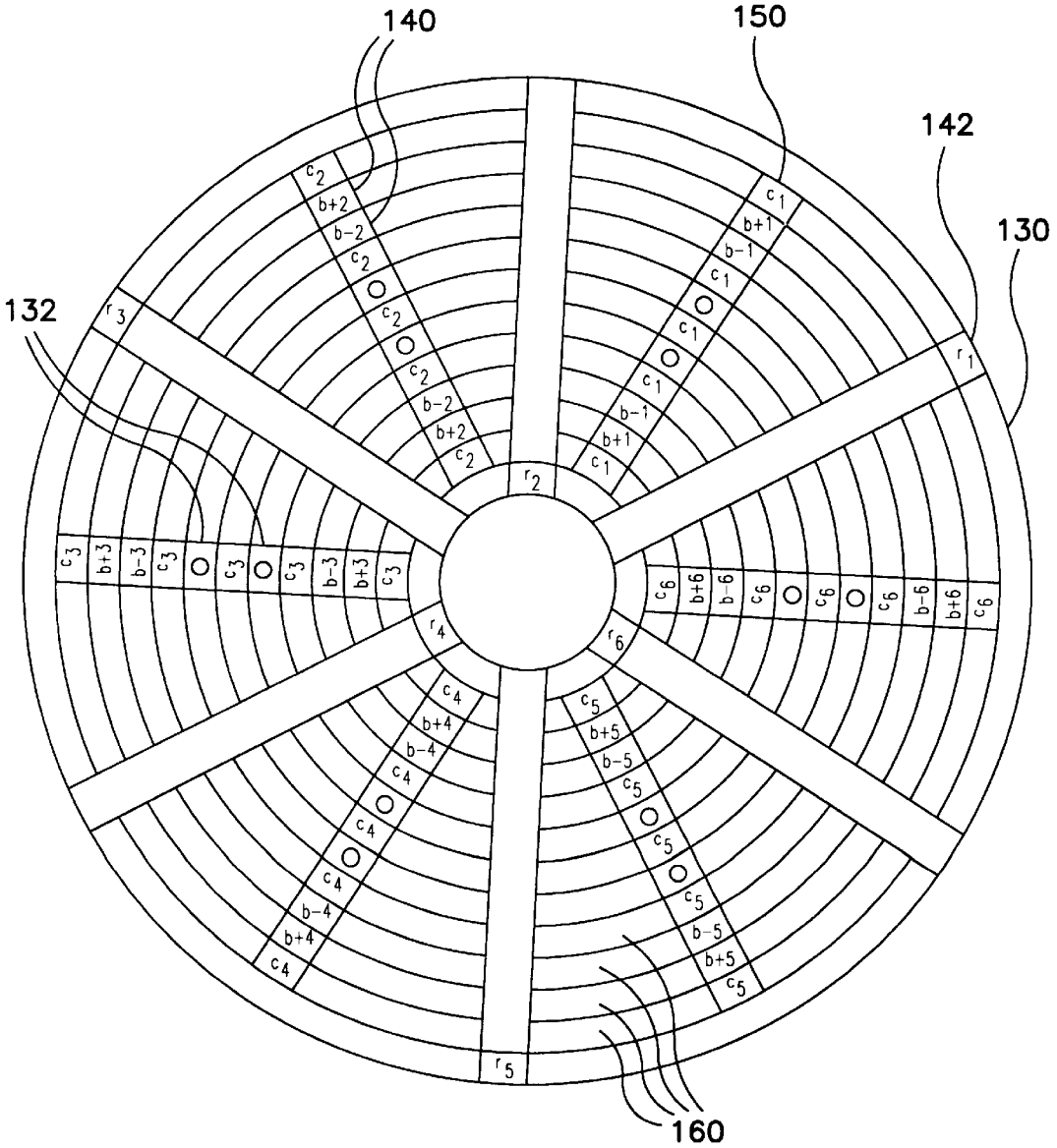
Figures 1, 15A:
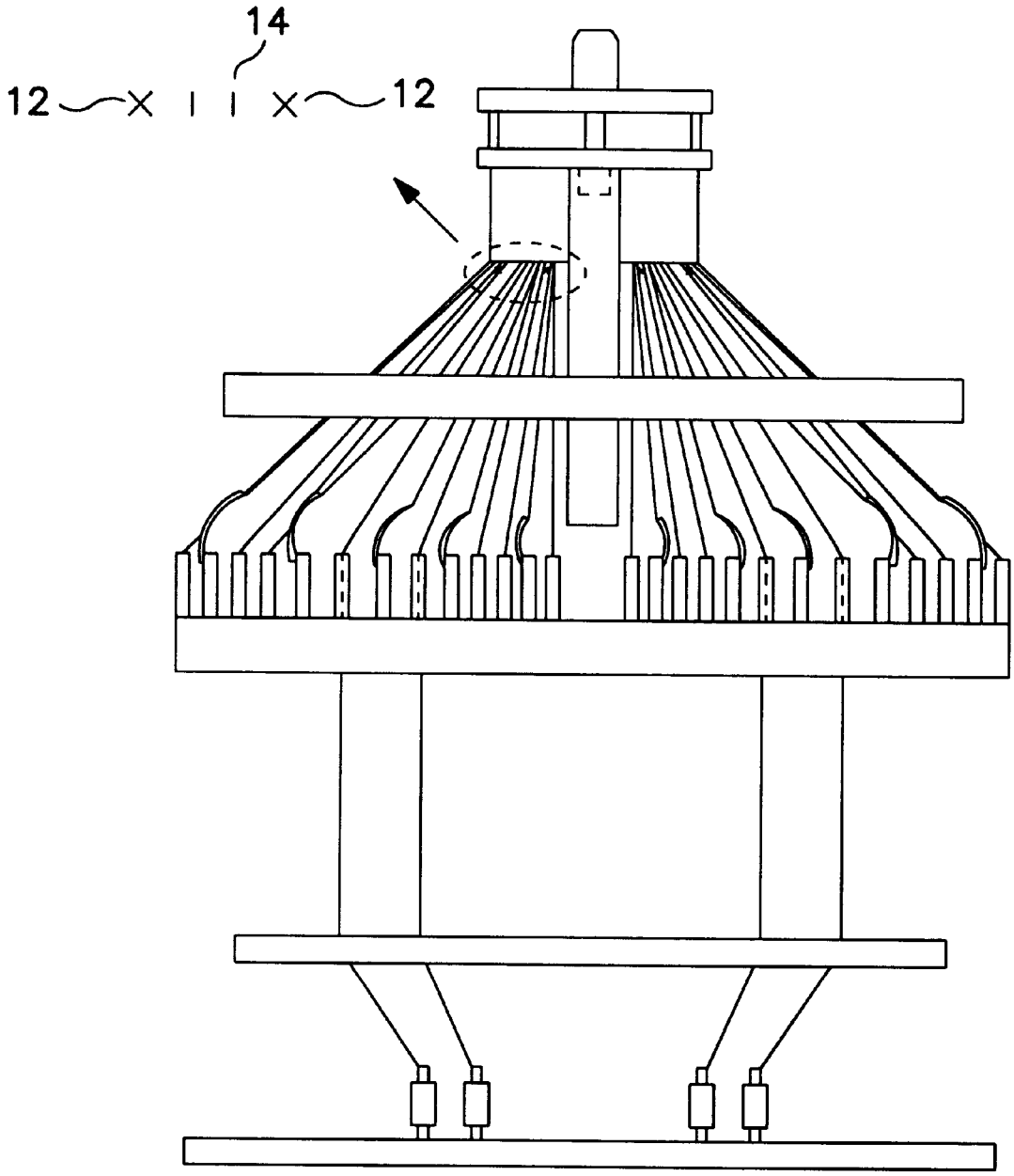
Figures 2, 15A:
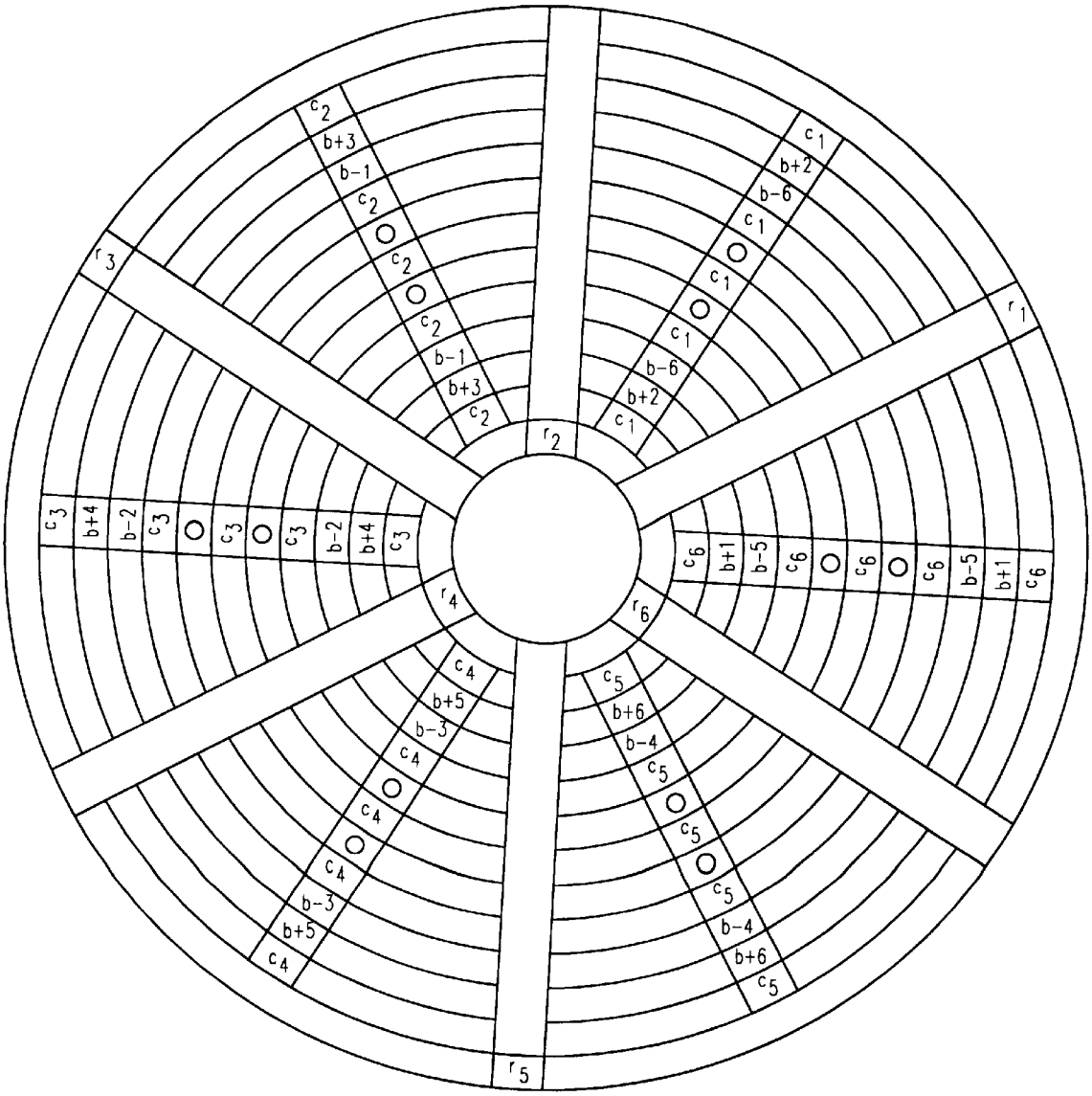
Figures 1, 15B:
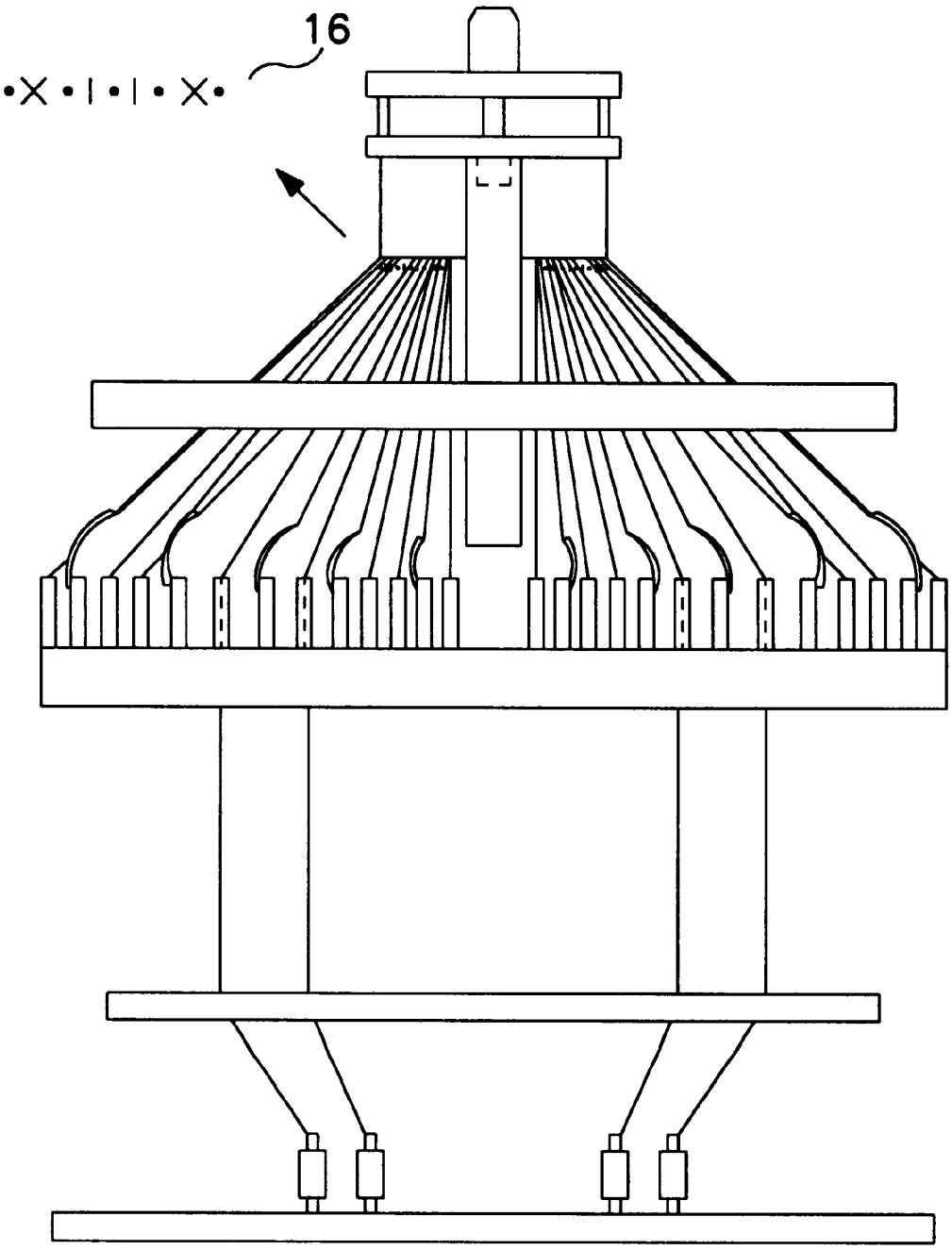
Figures 2, 15B:
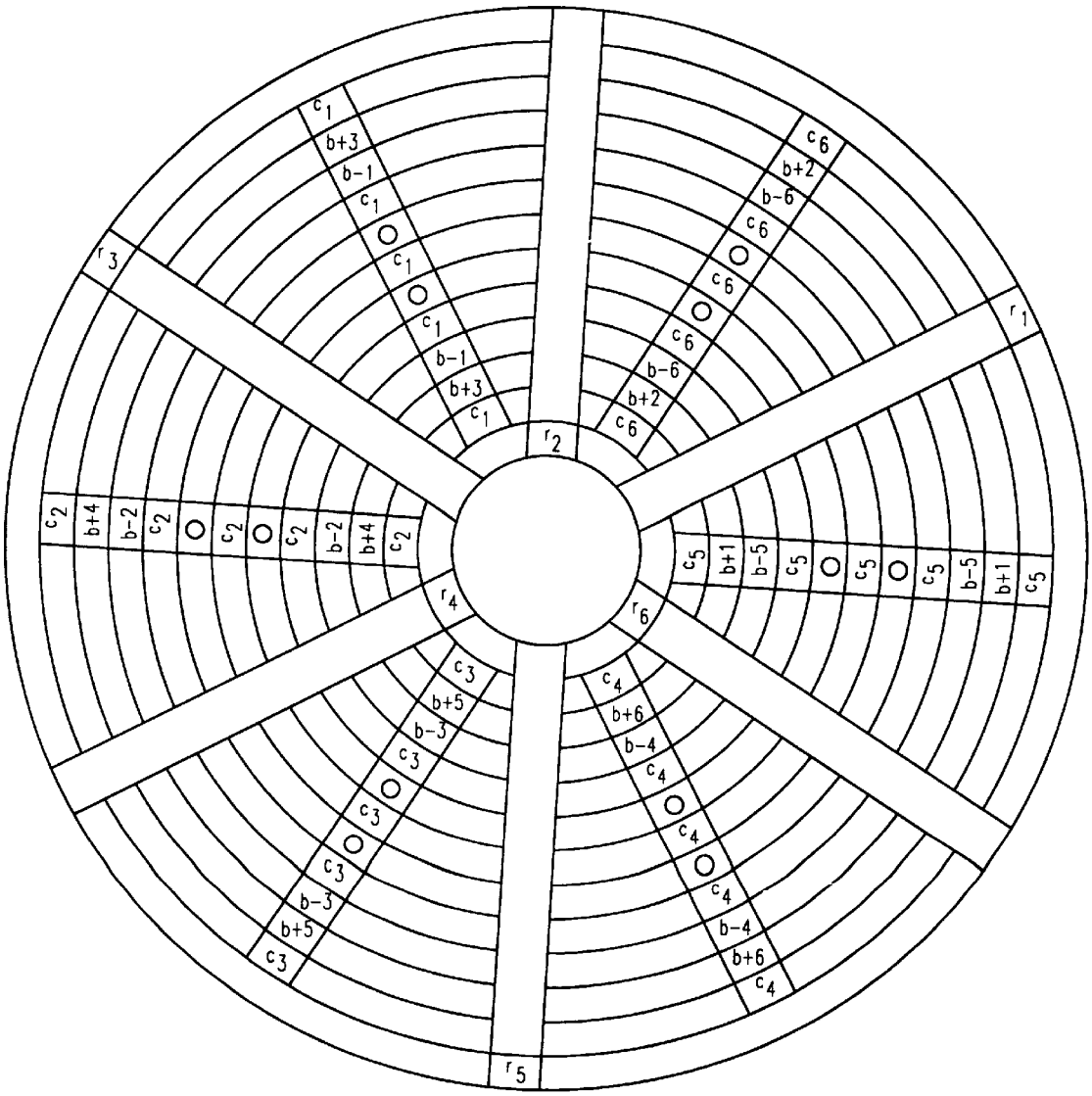
Figures 1, 15C:
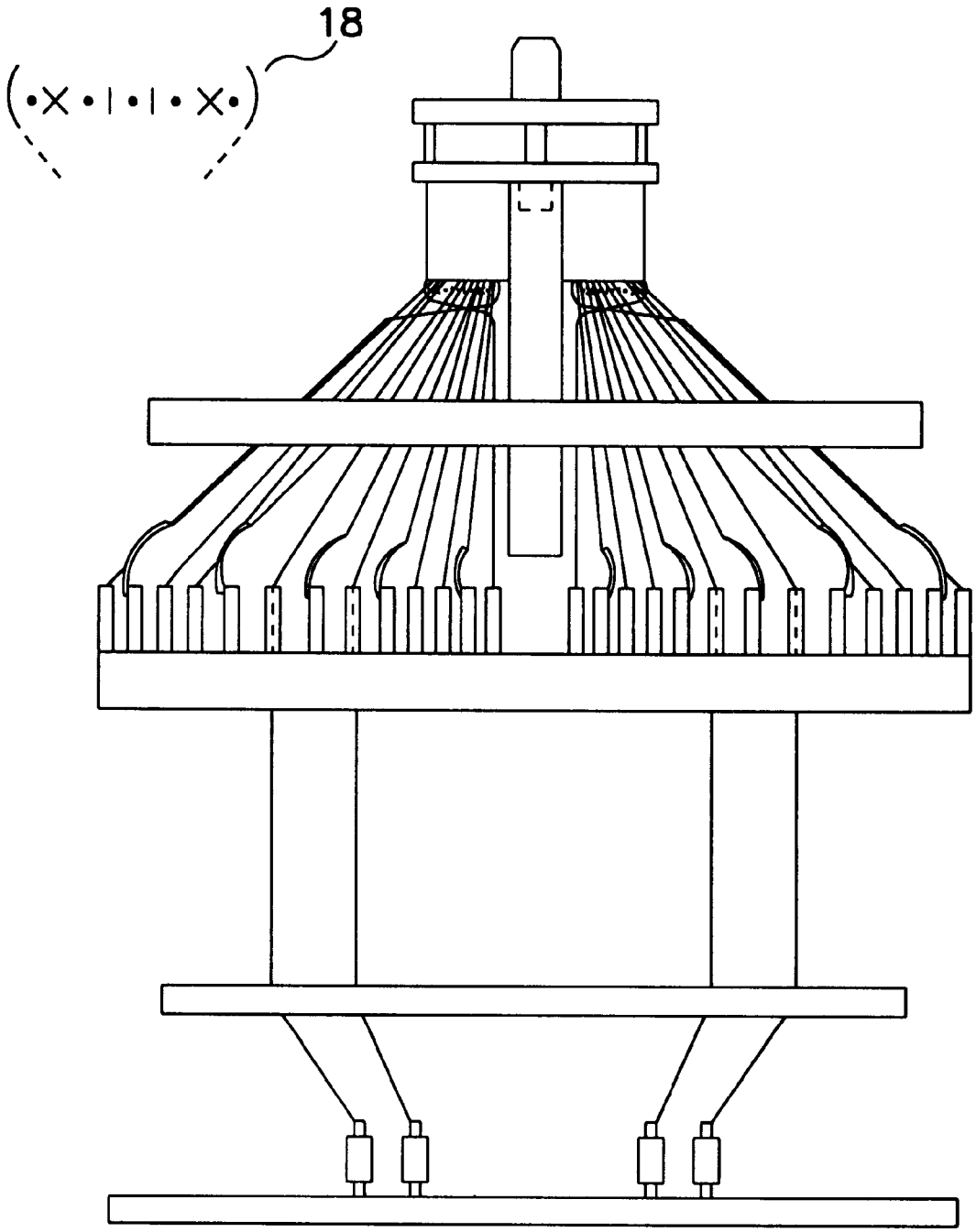
Figures 2, 15C:
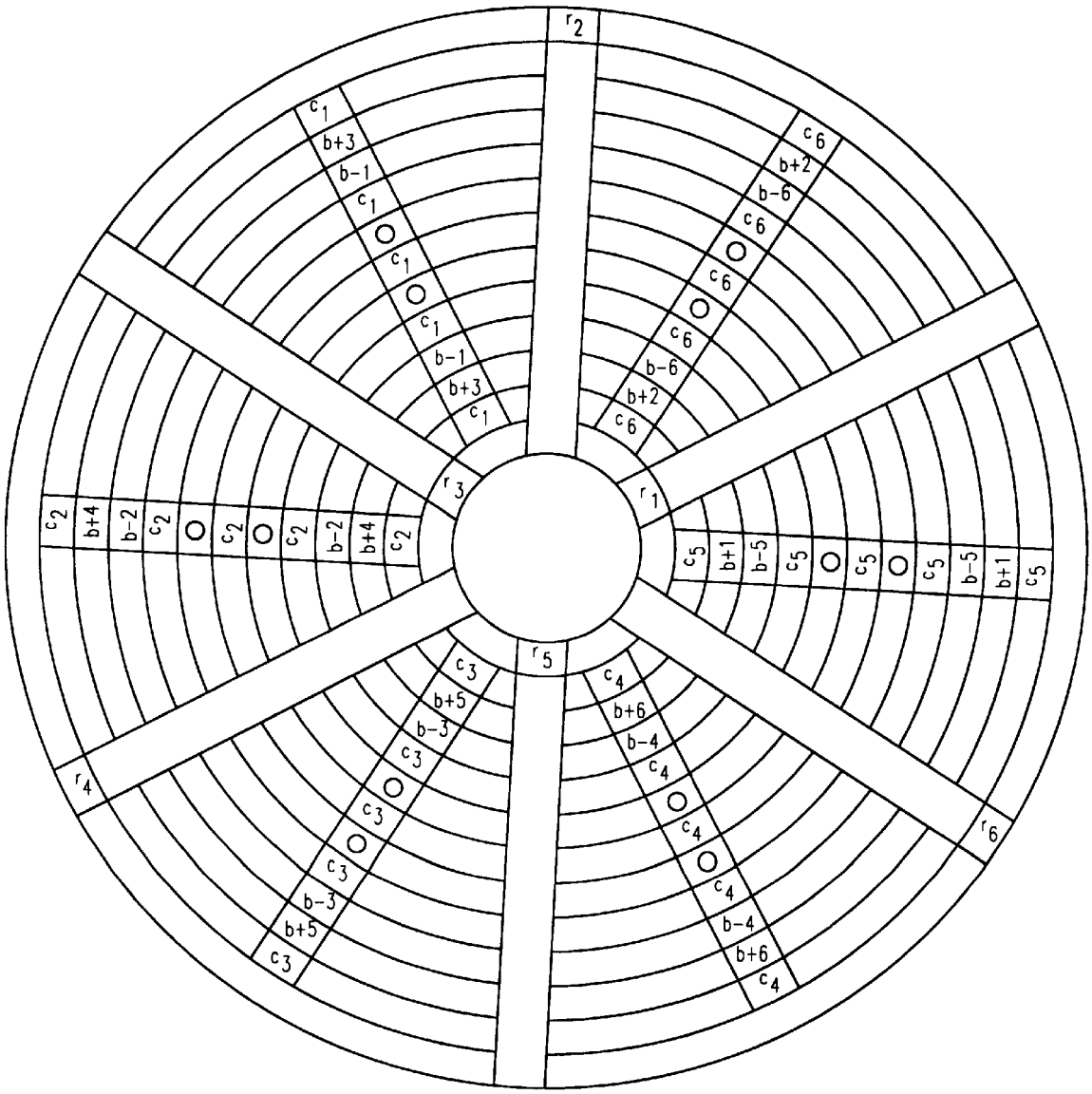
Figures 1, 15D:
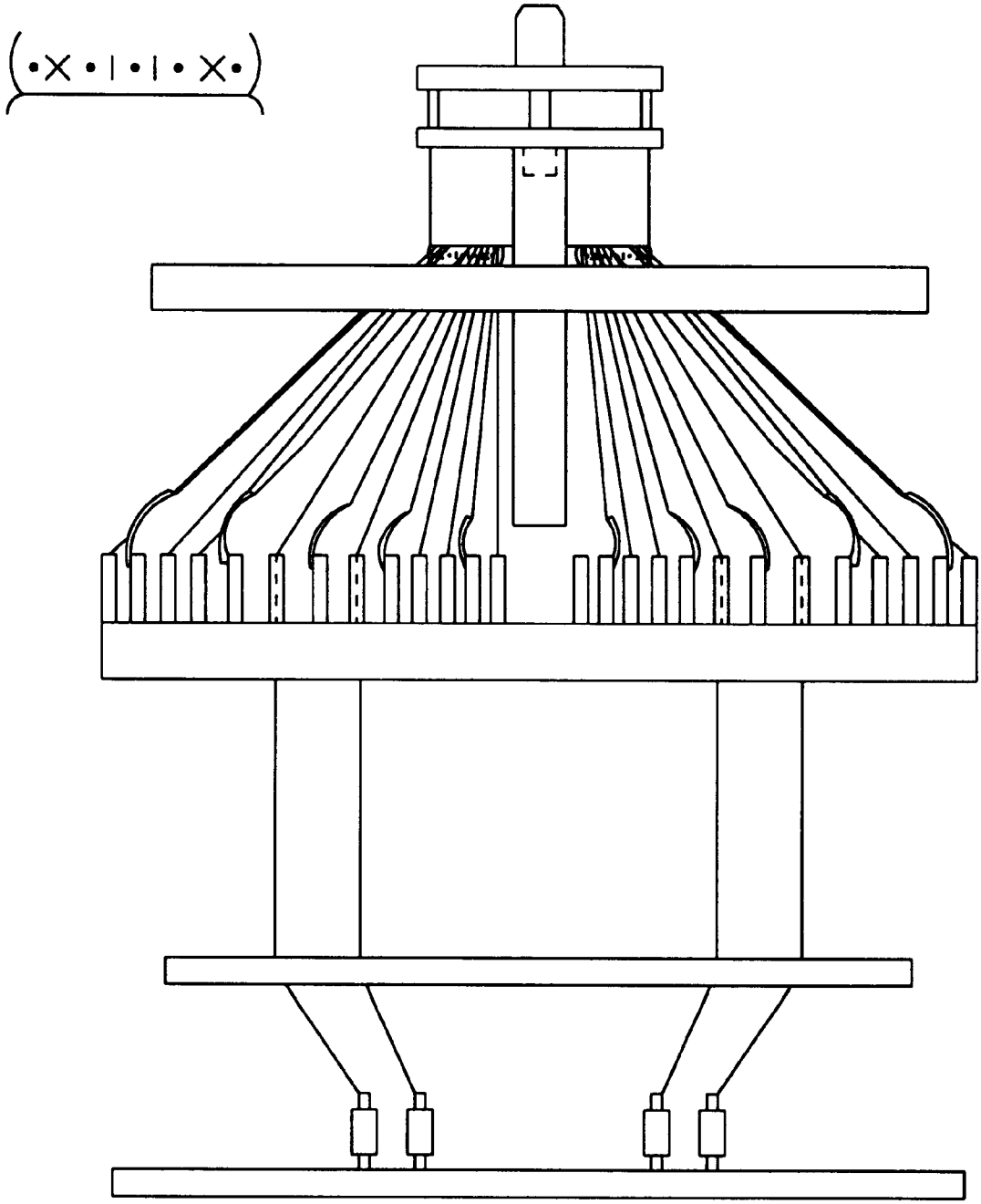
Figures 2, 15D:
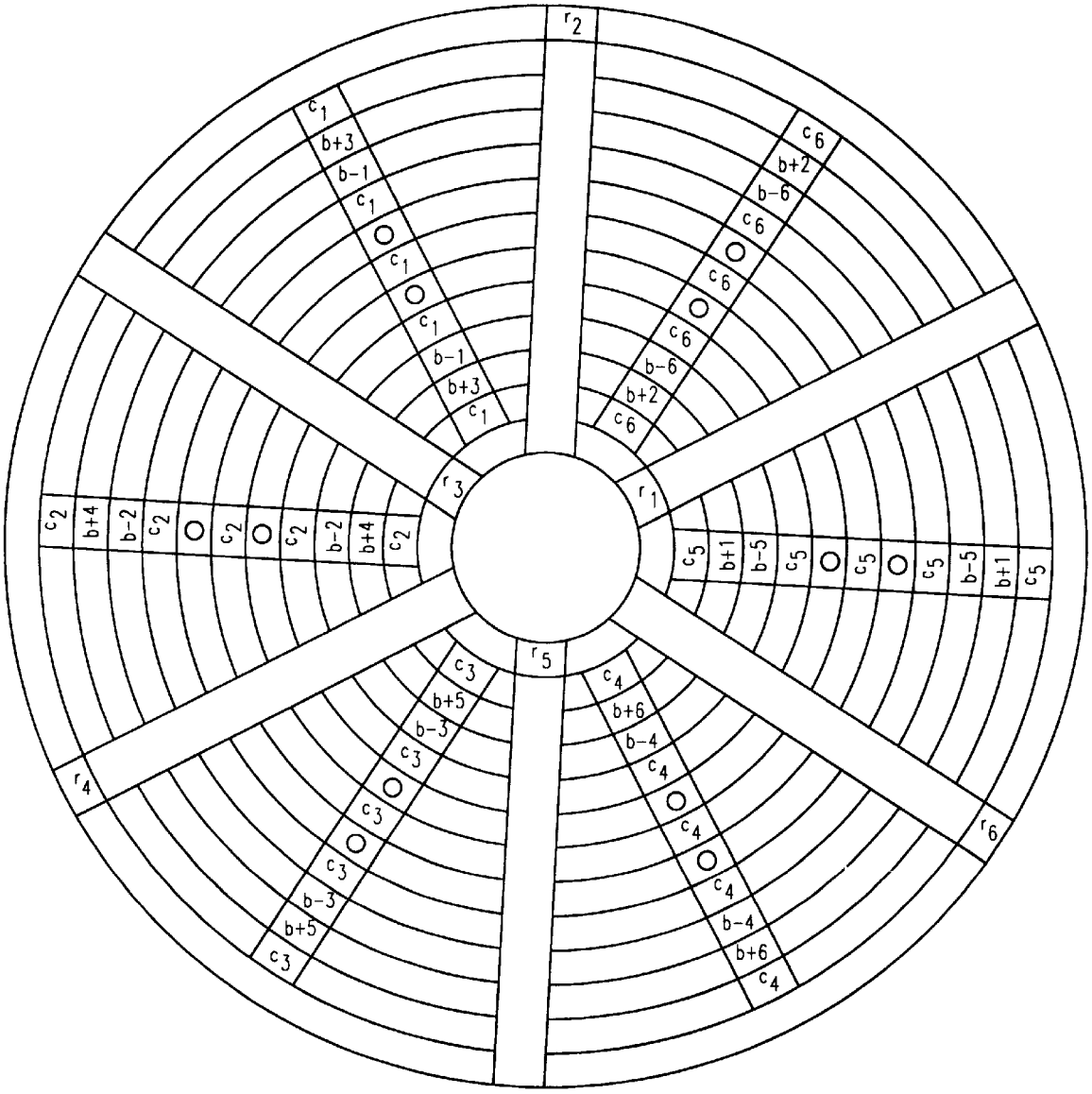
Figures 1, 15E:
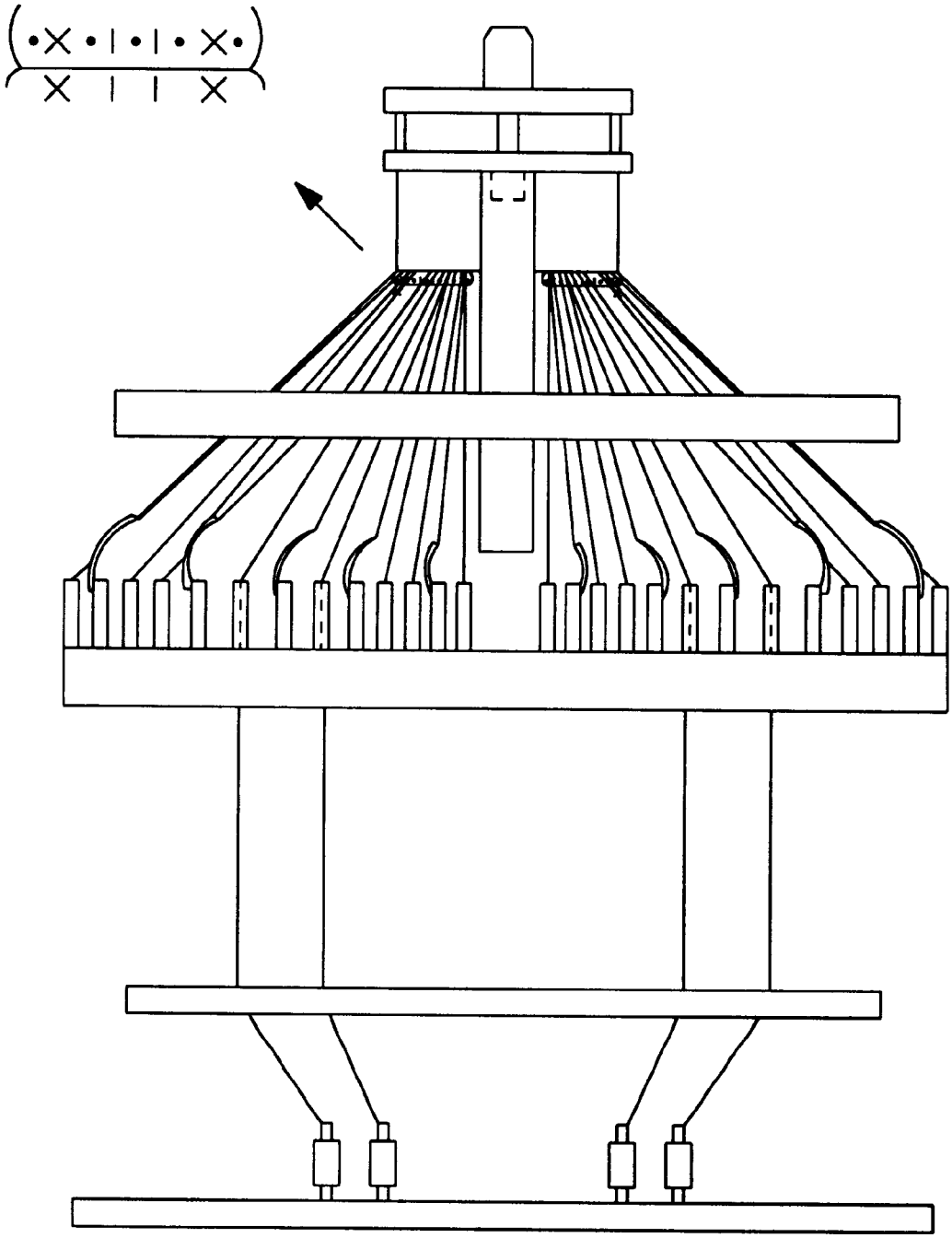
Figures 2, 15E:
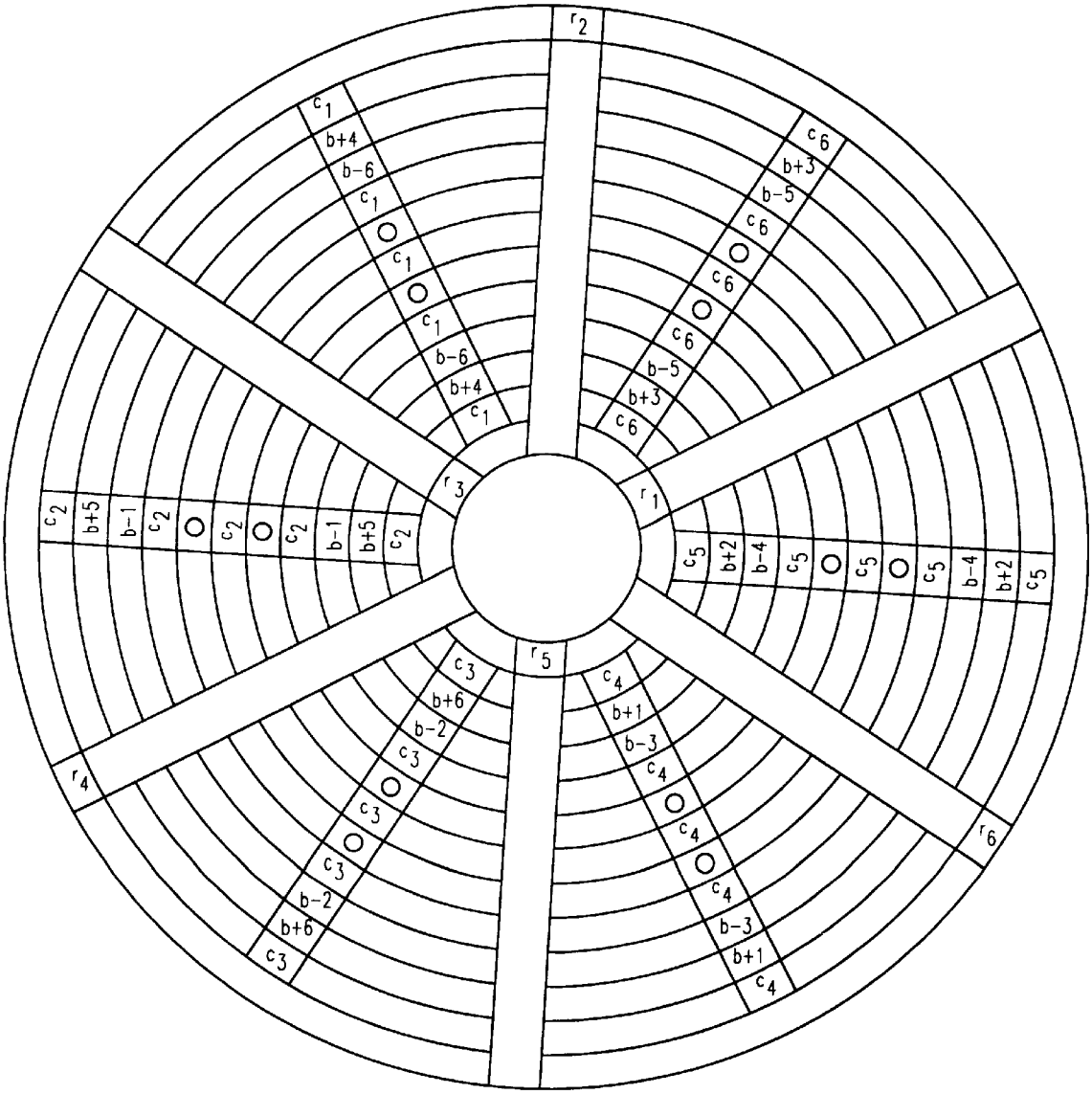
Figures 1, 15F:
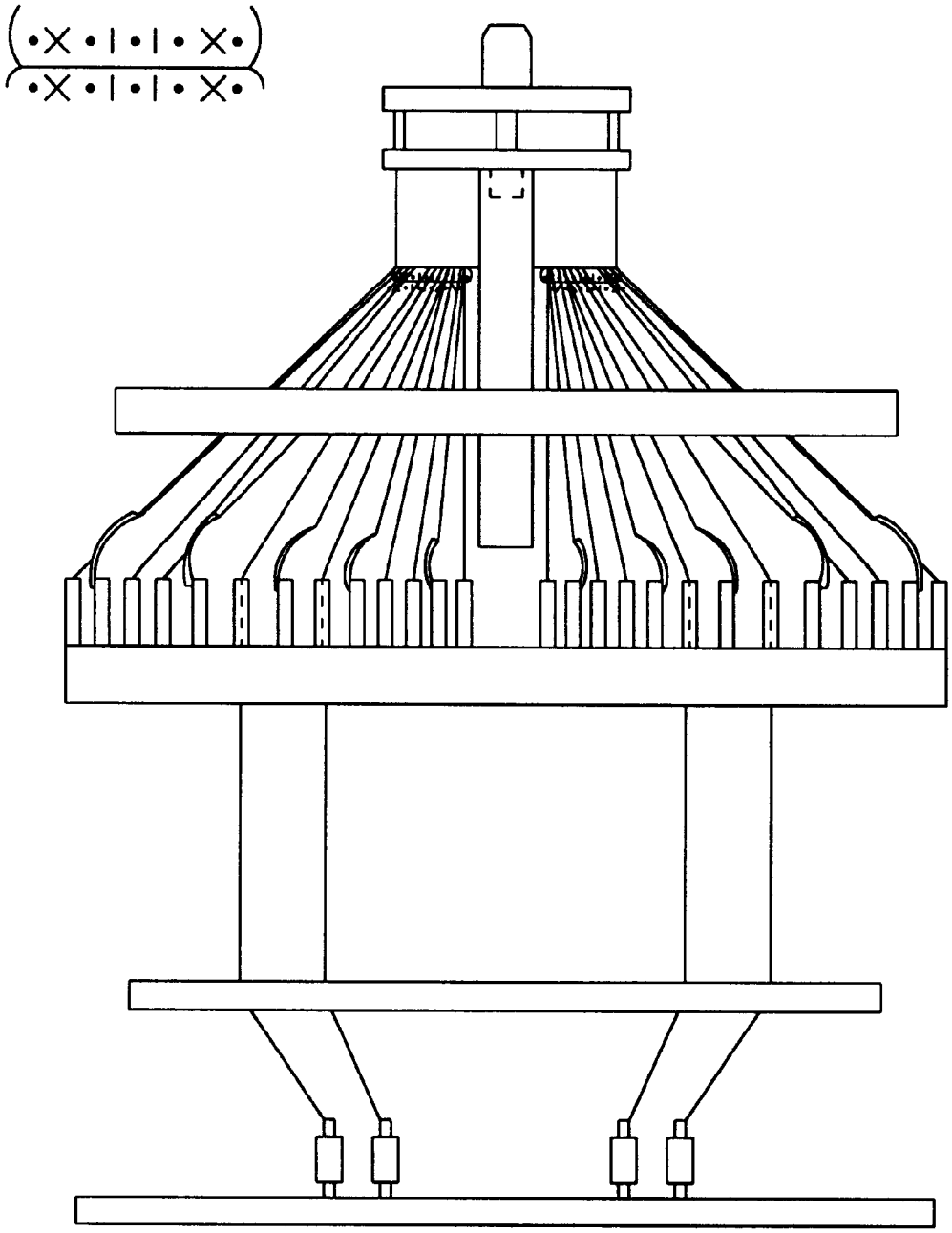
Figures 2, 15F:
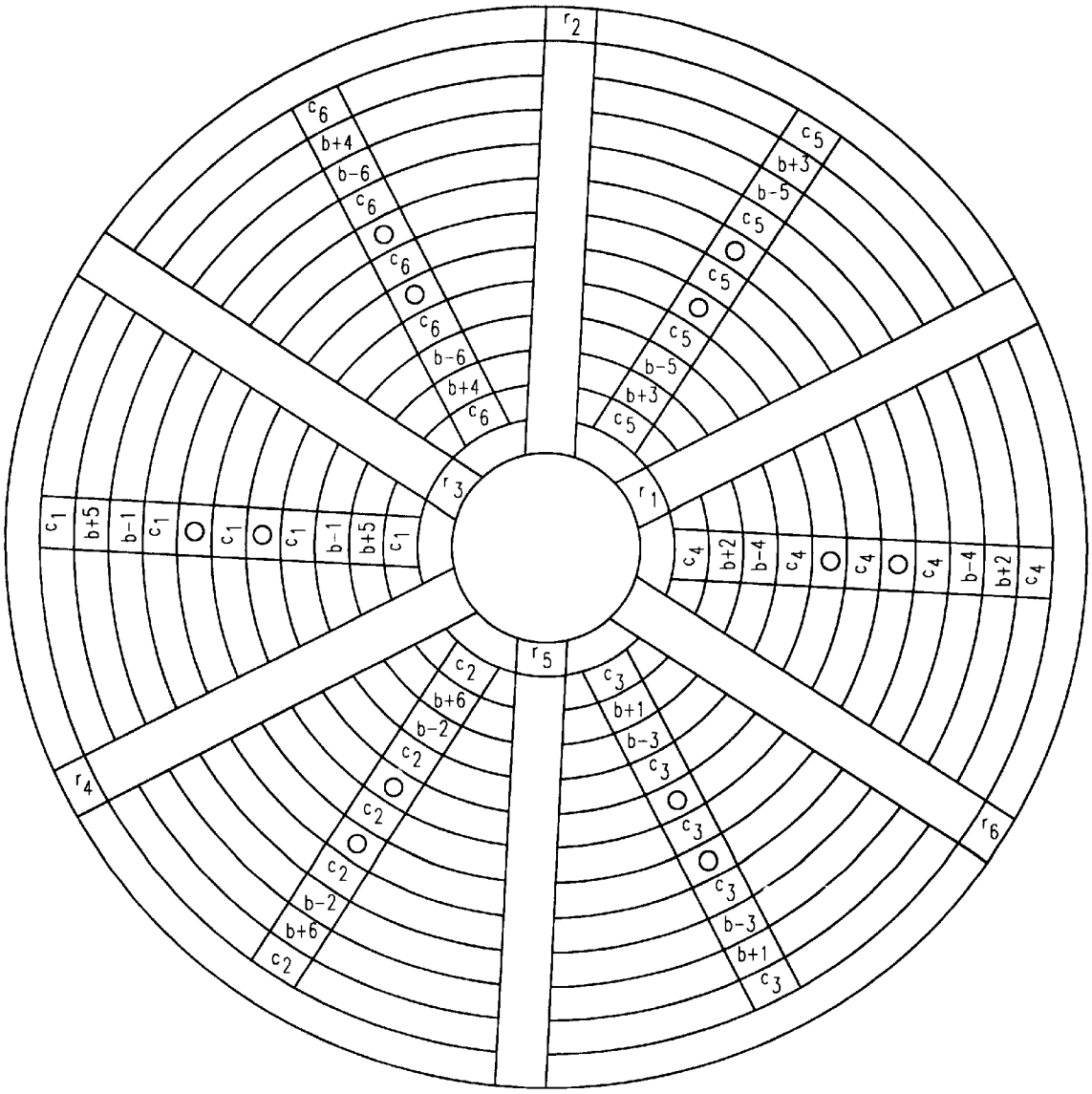
Figures 1, 15G:
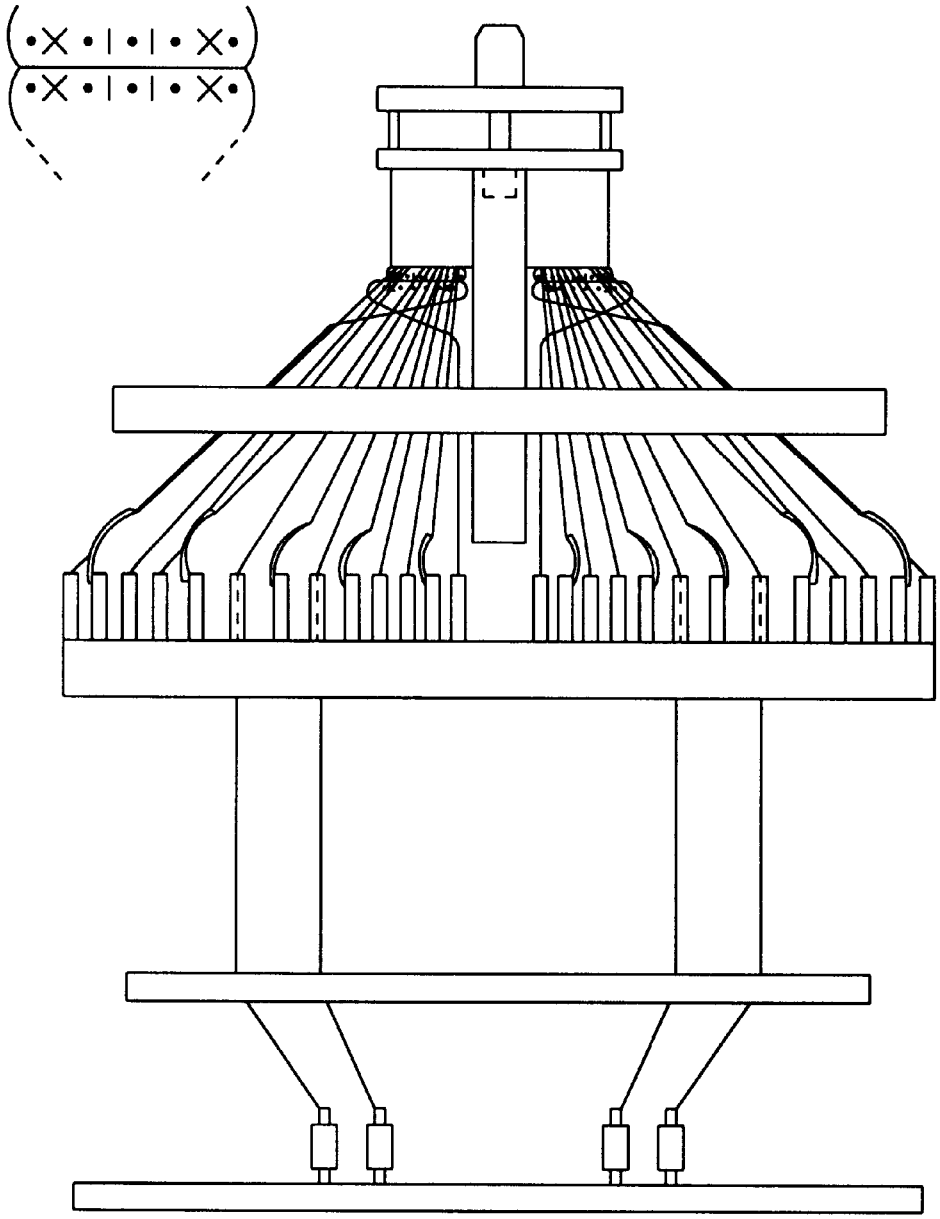
Figures 2, 15G:
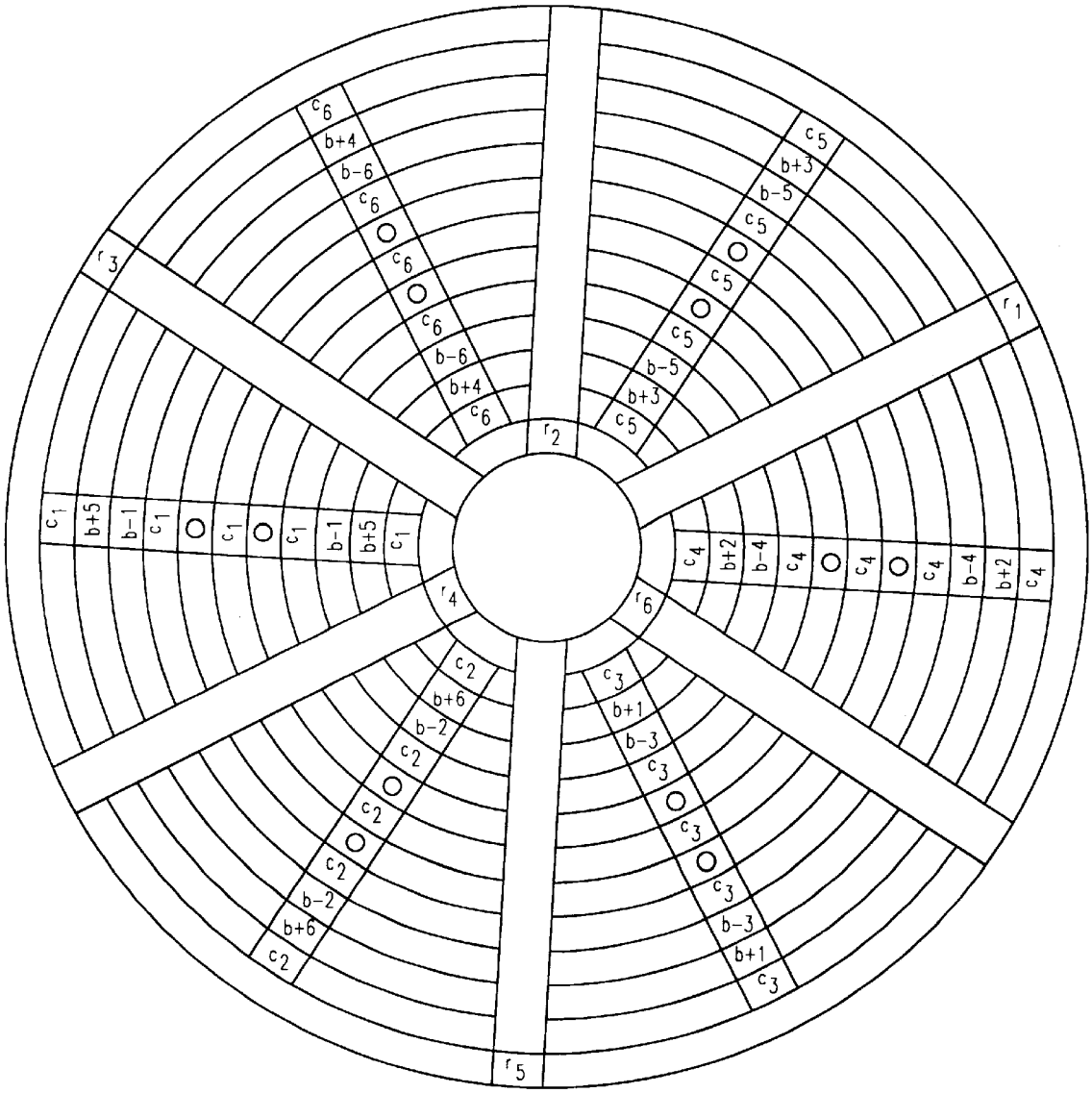
Figures 1, 15H:
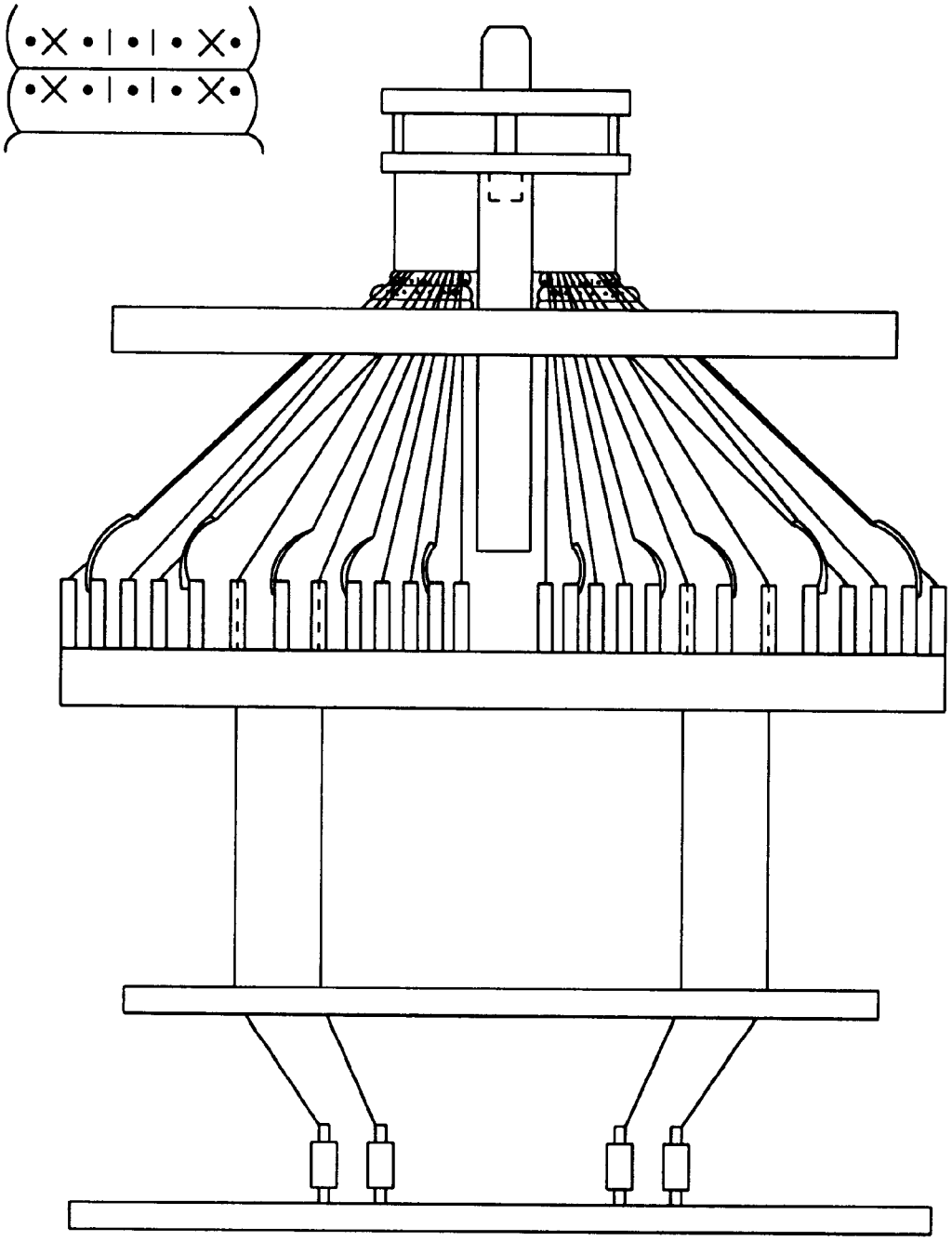
Figures 2, 15H:
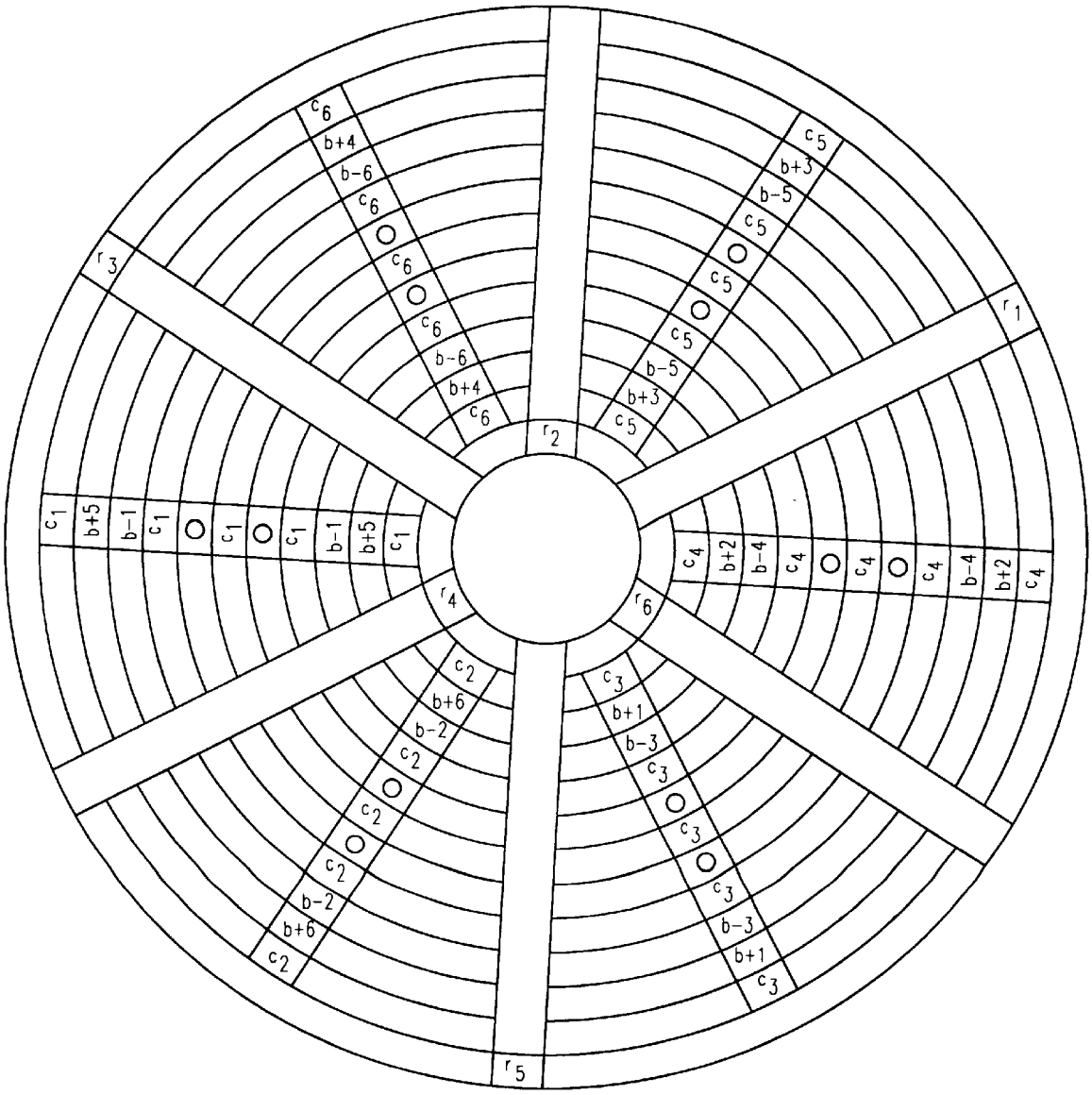
Figures 1, 16:
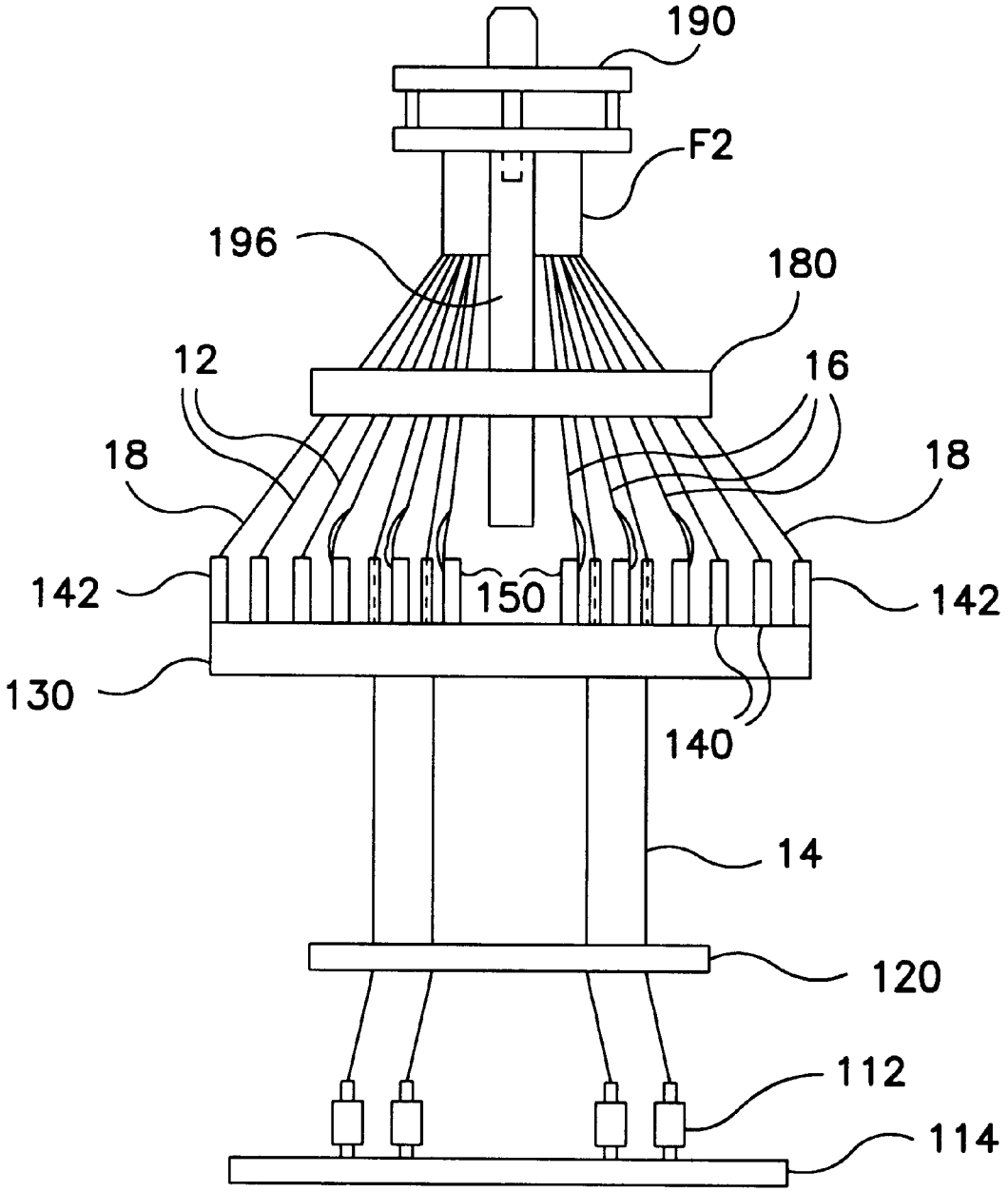
Figures 2, 16:
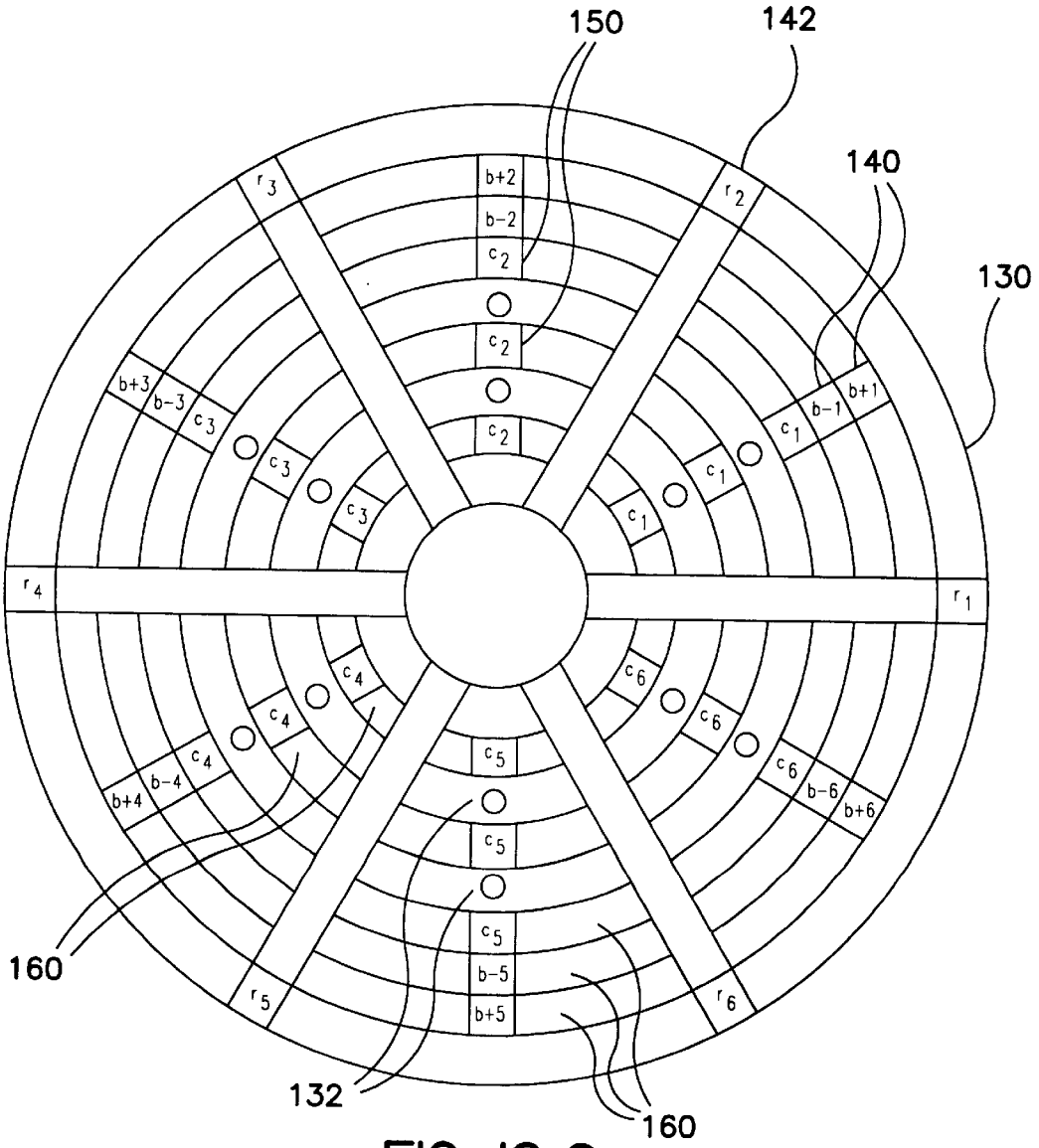
Figures 1, 16A:
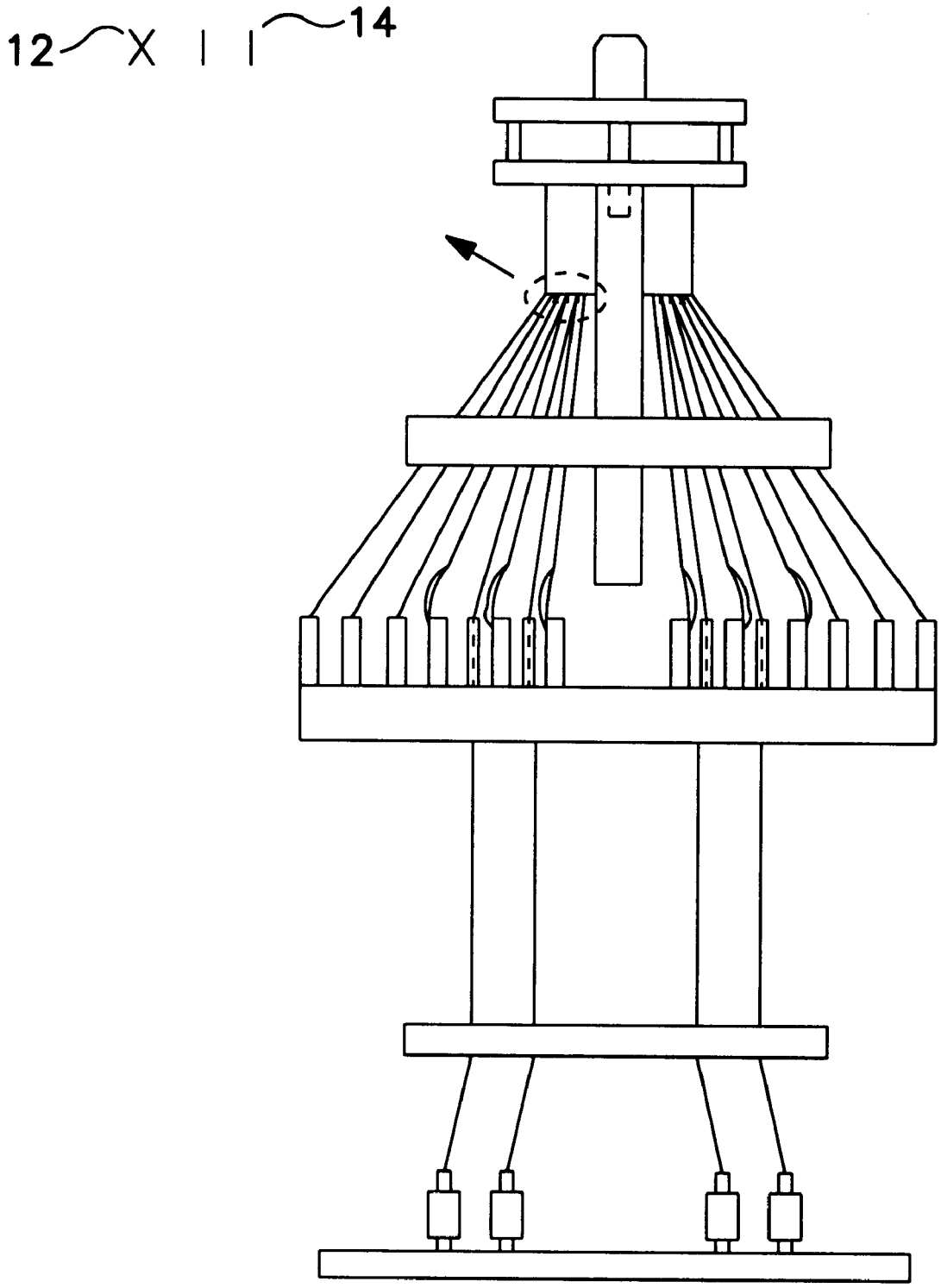
Figures 2, 16A:
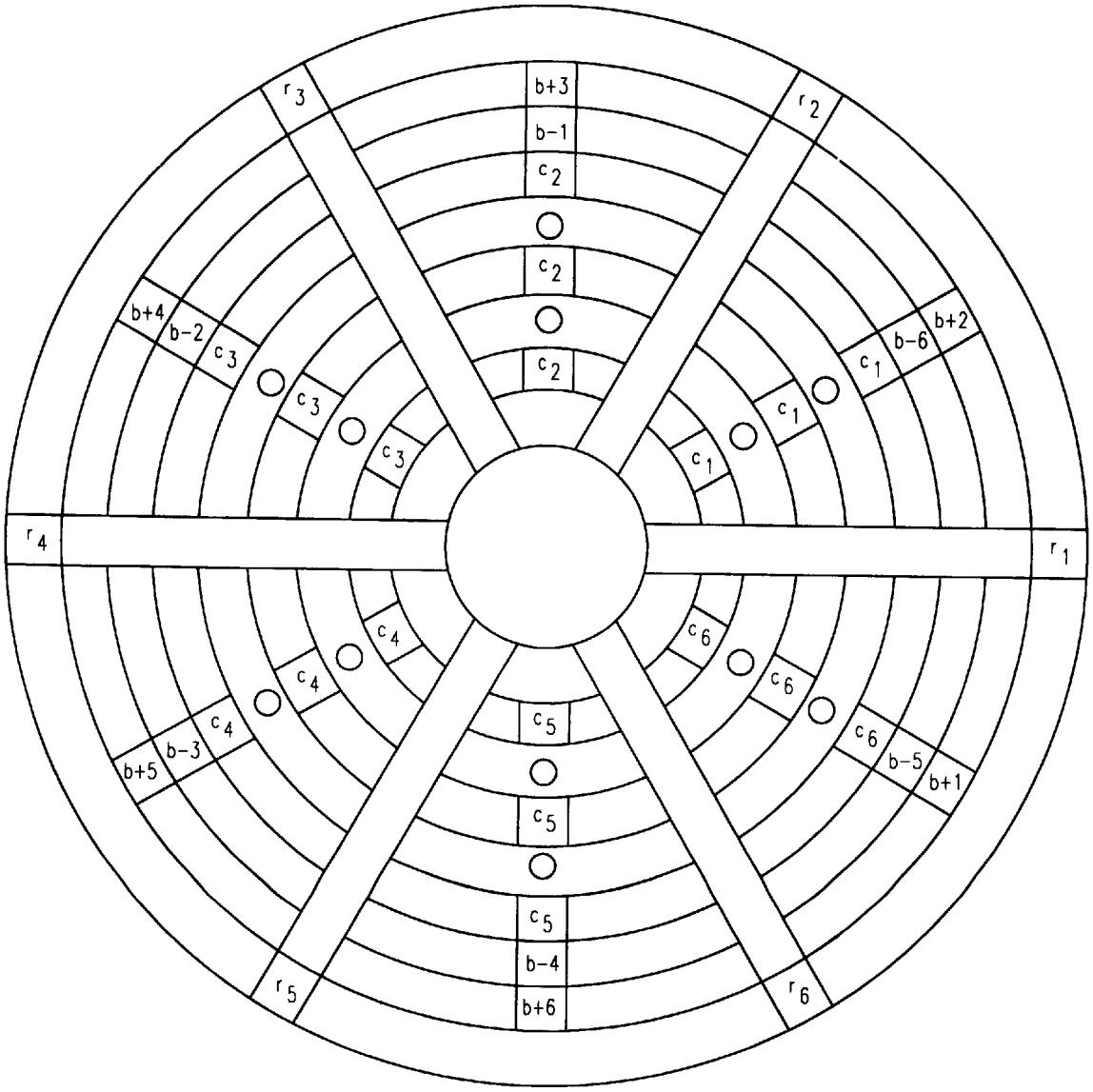
Figures 1, 16B:
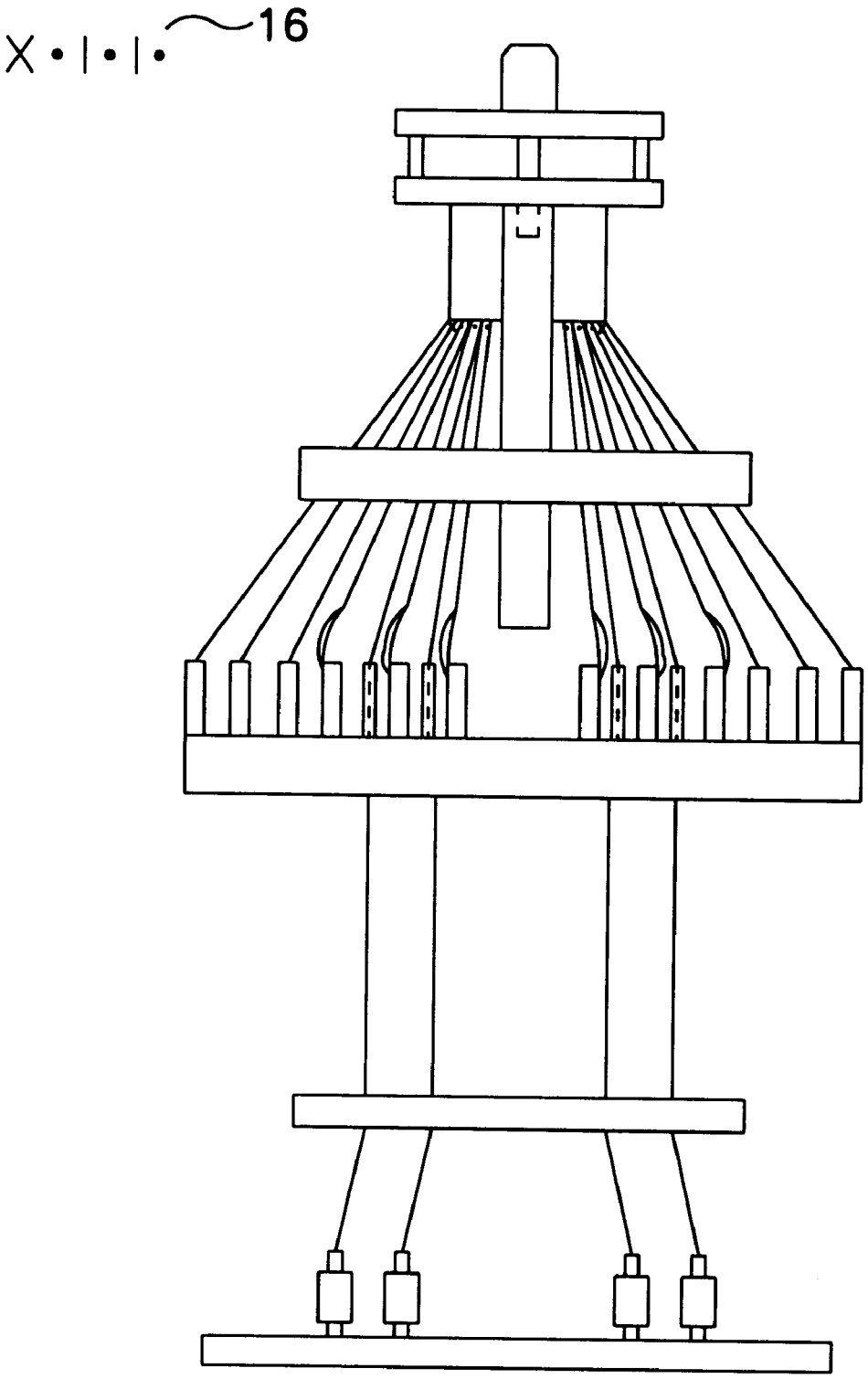
Figures 2, 16B:
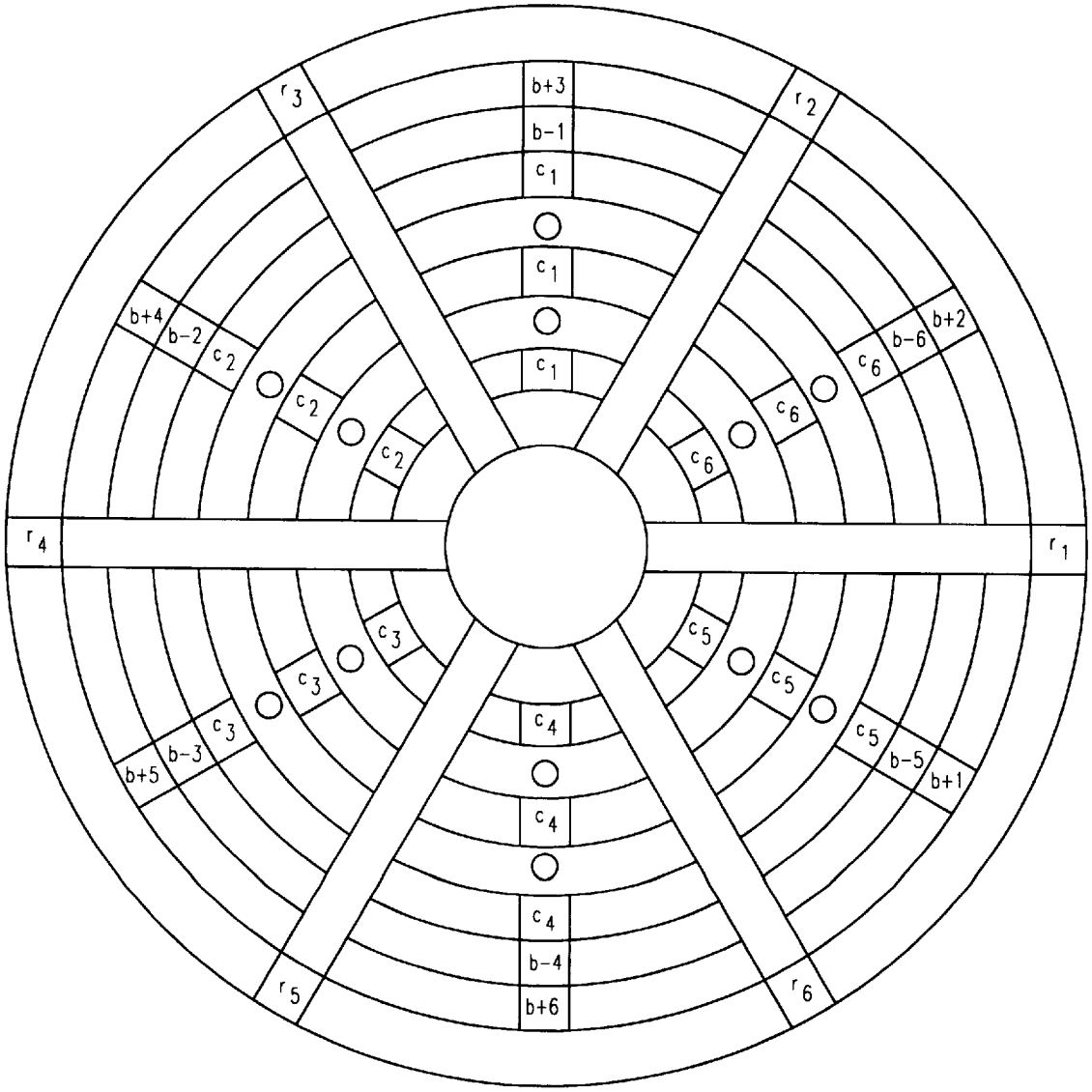
Figures 1, 16C:
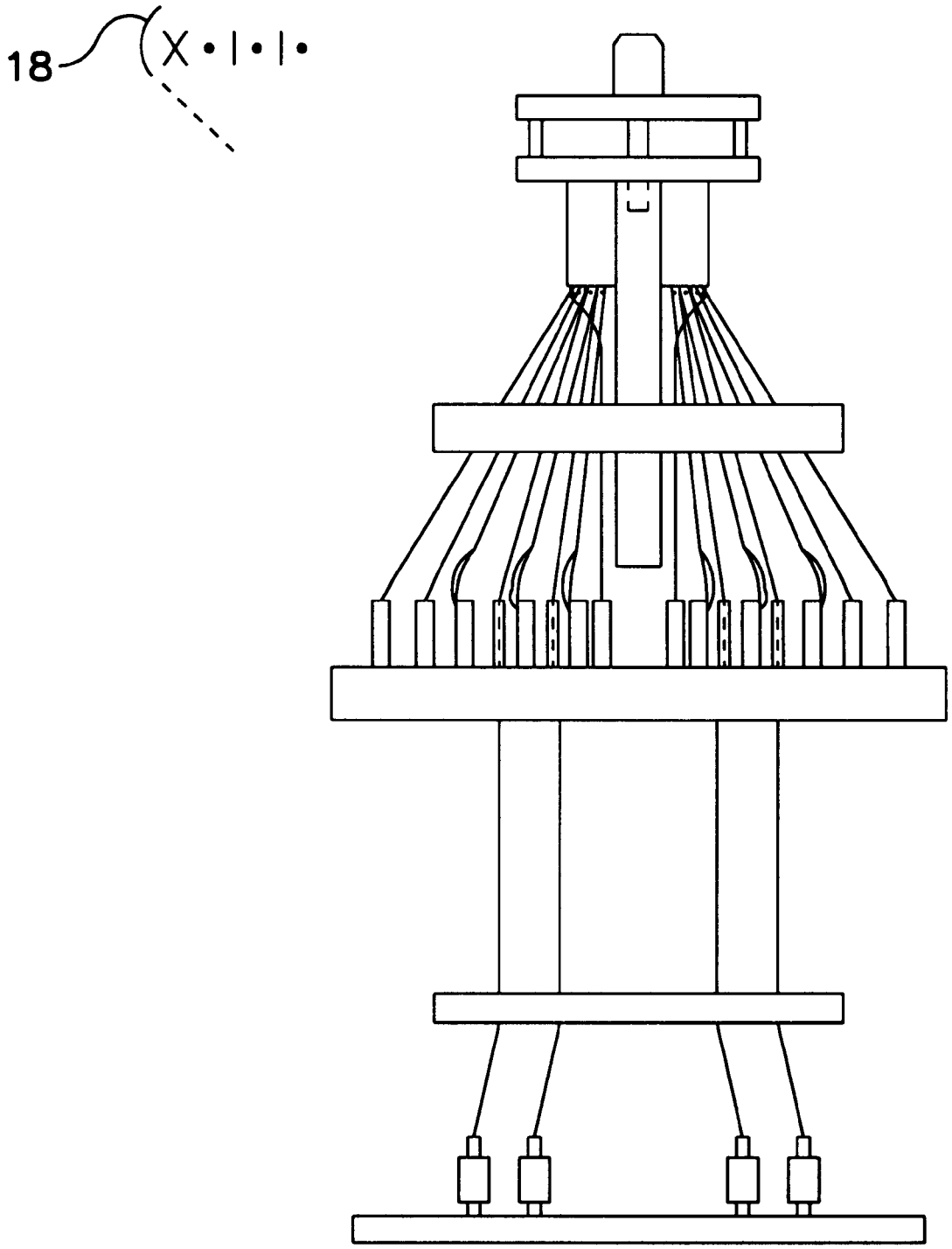
Figures 2, 16C:
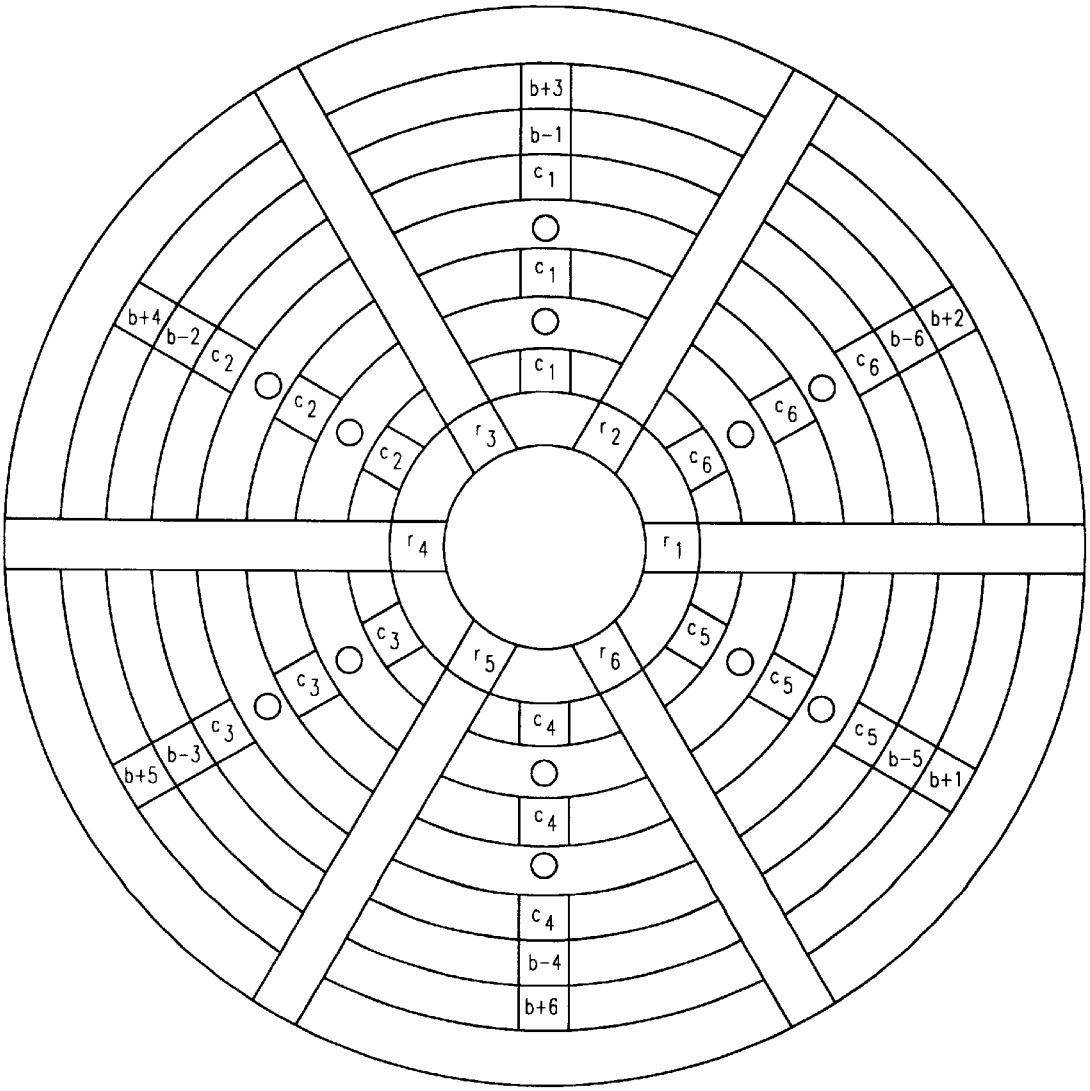
Figures 1, 16D:
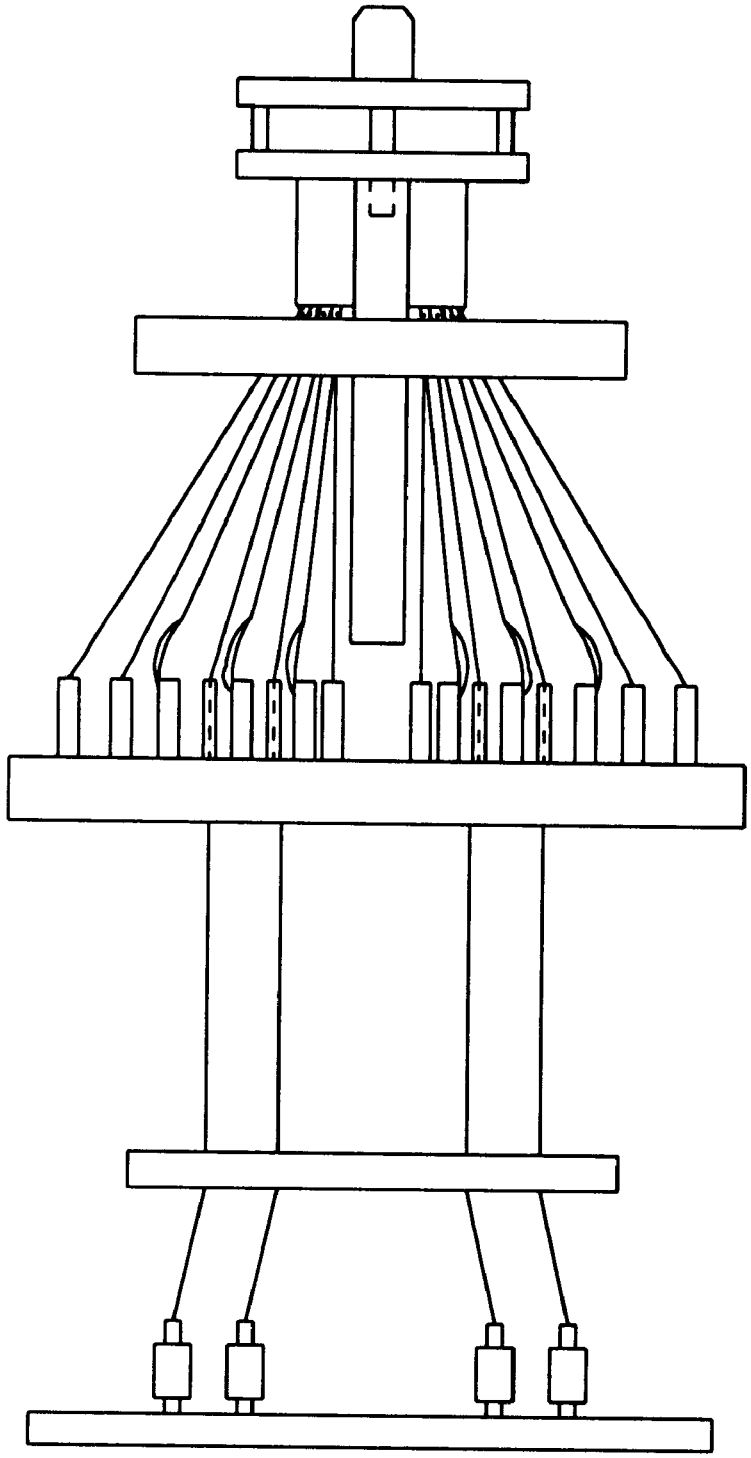
Figures 2, 16D:
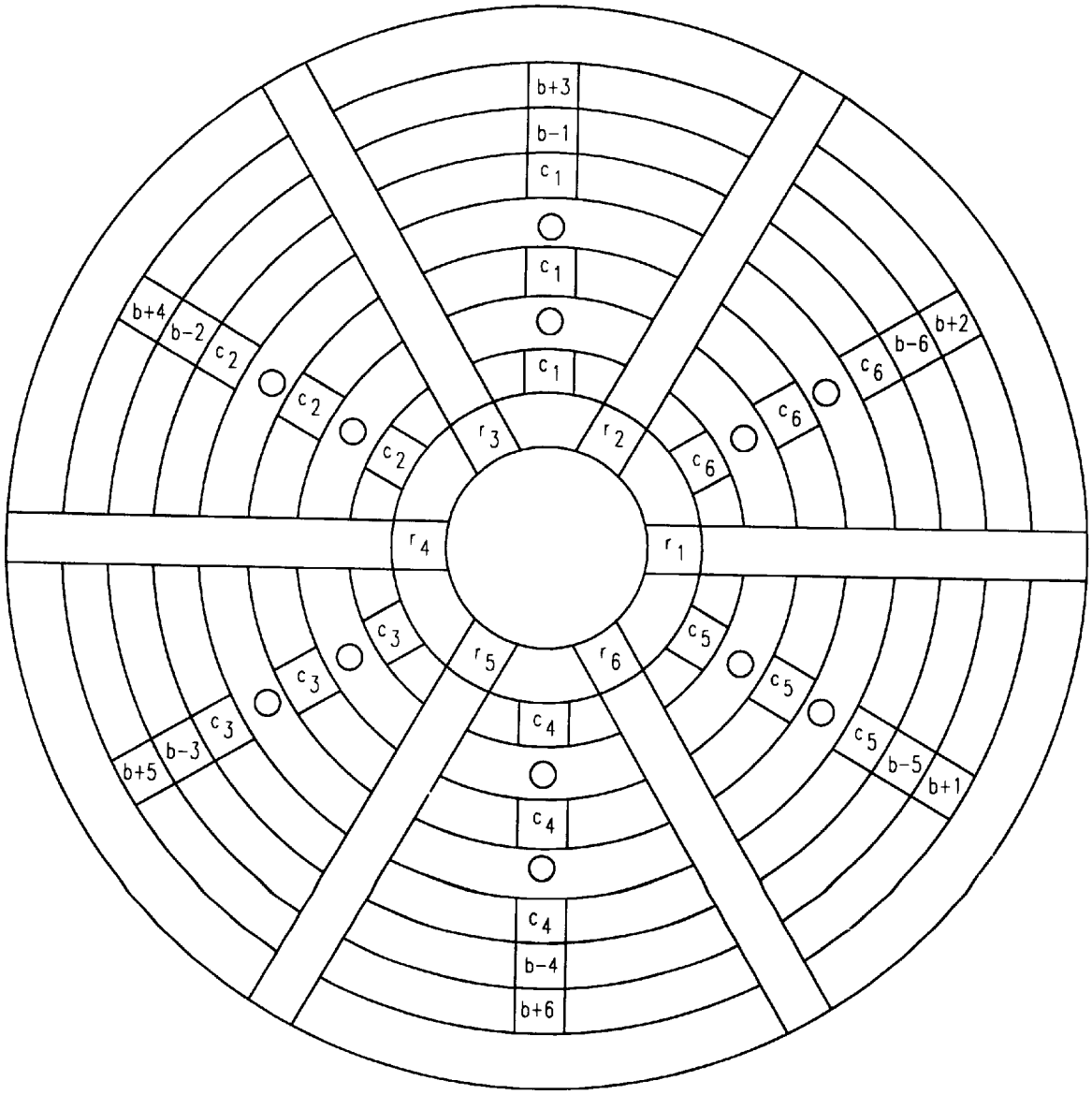
Figures 1, 16E:
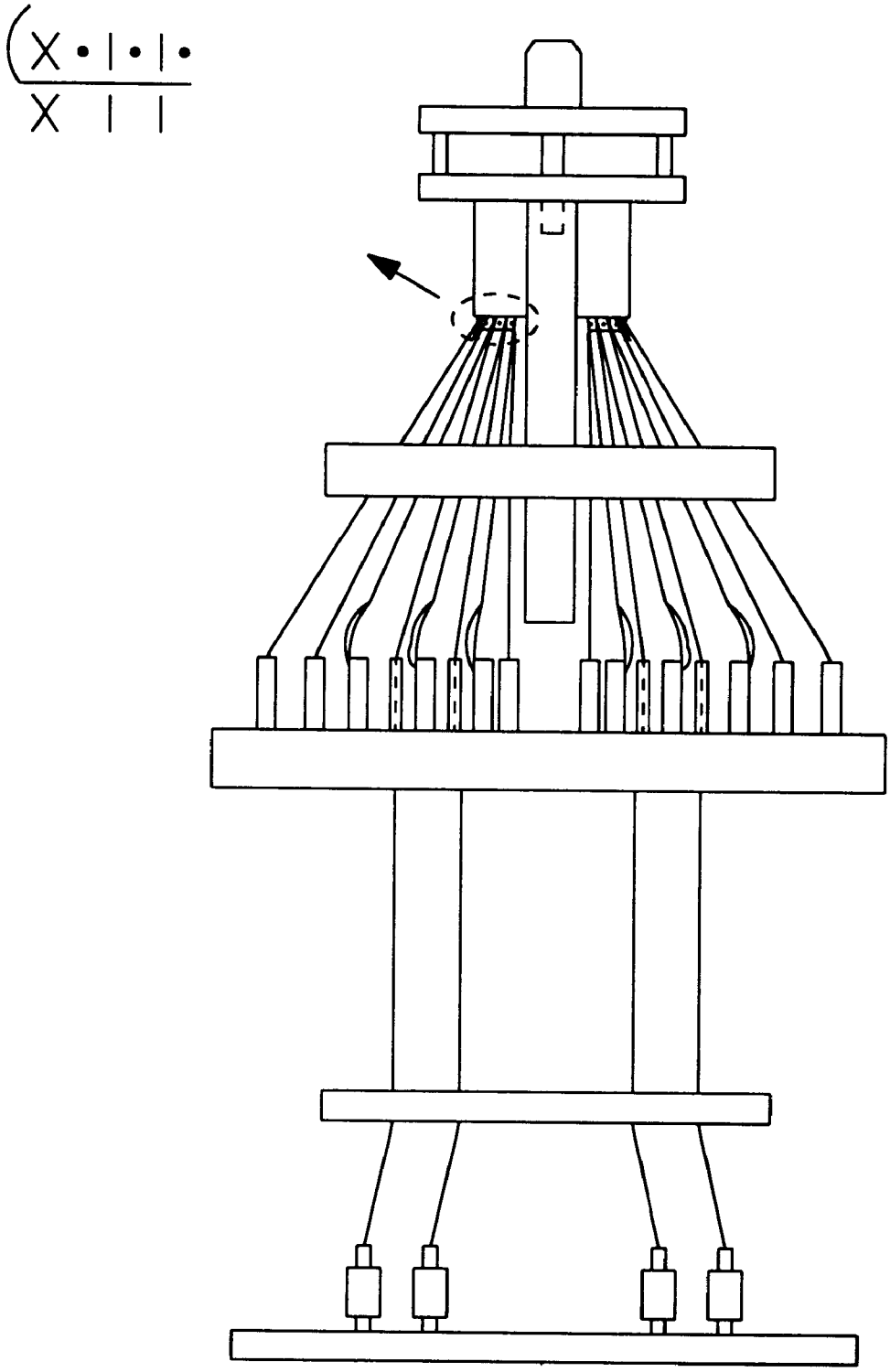
Figures 2, 16E:
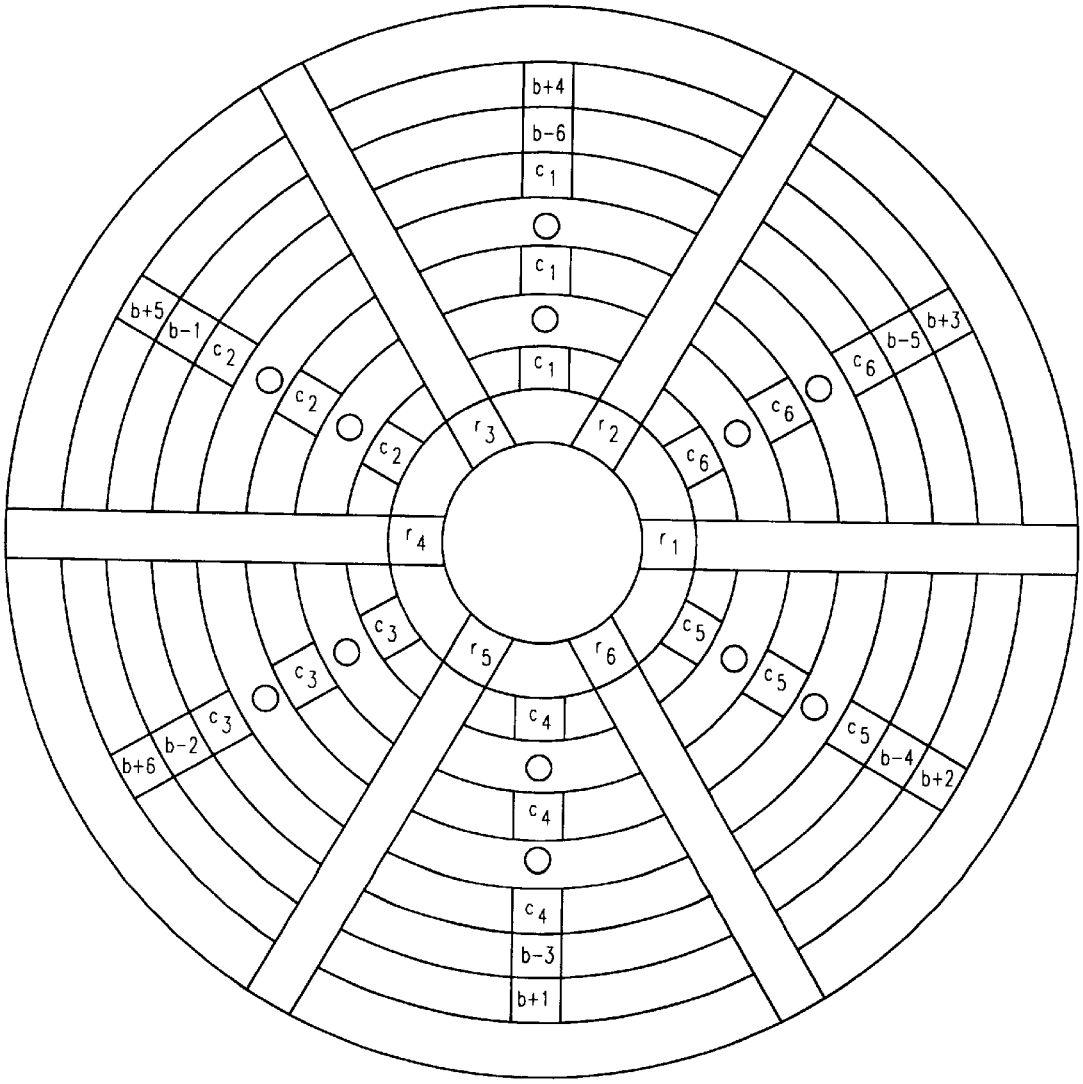
Figures 1, 16F:
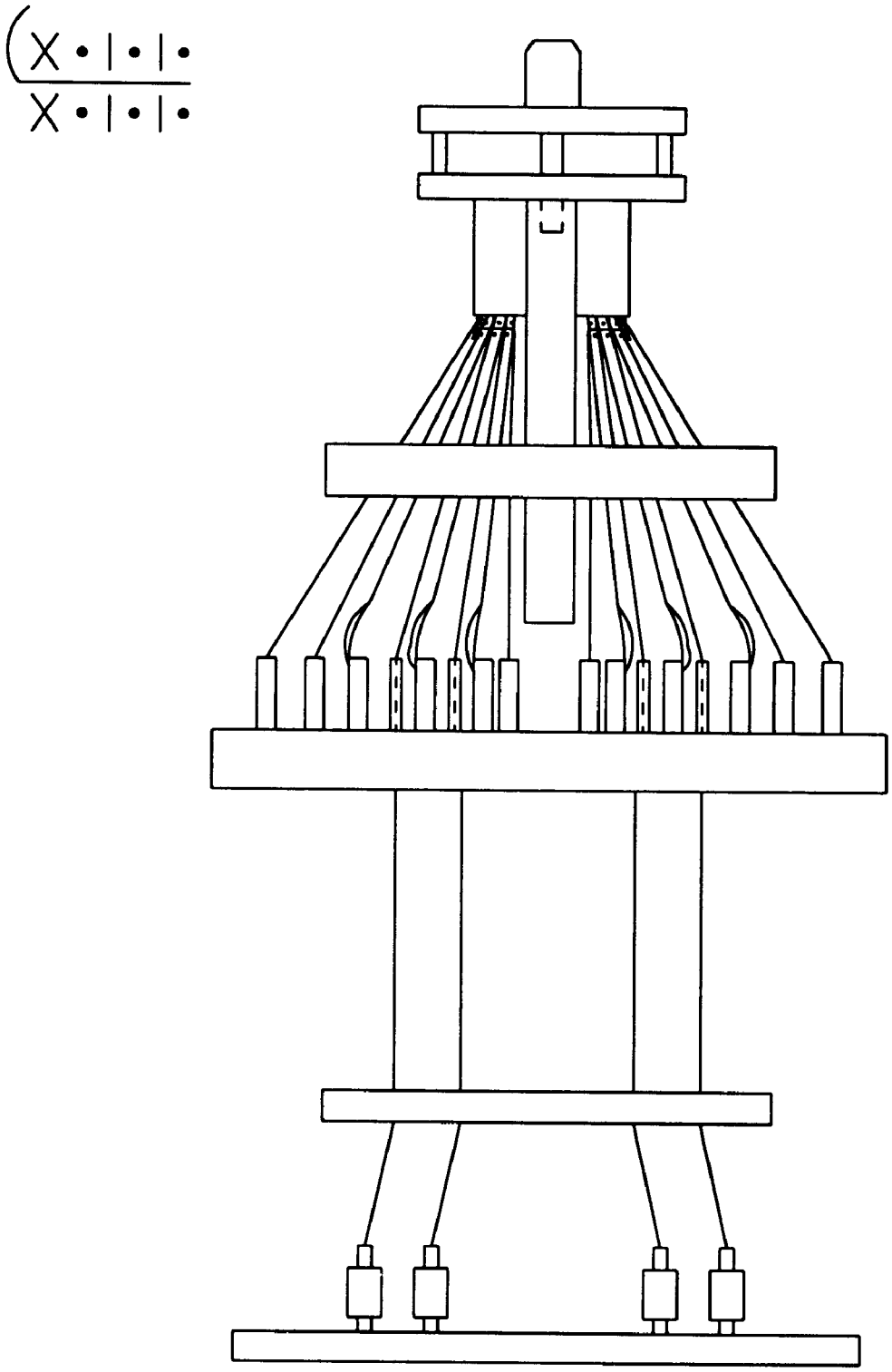
Figures 2, 16F:
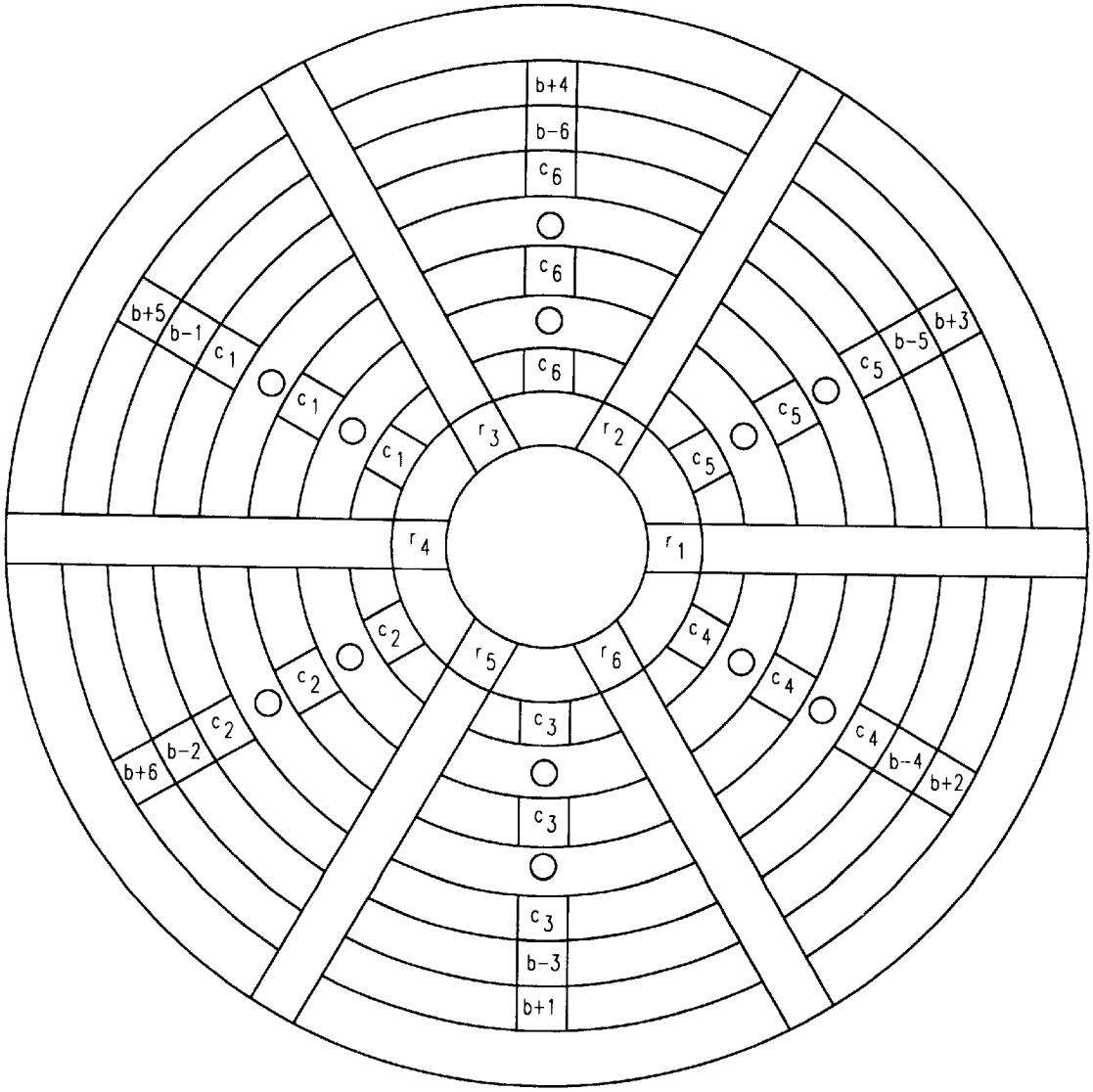
Figures 1, 16G:
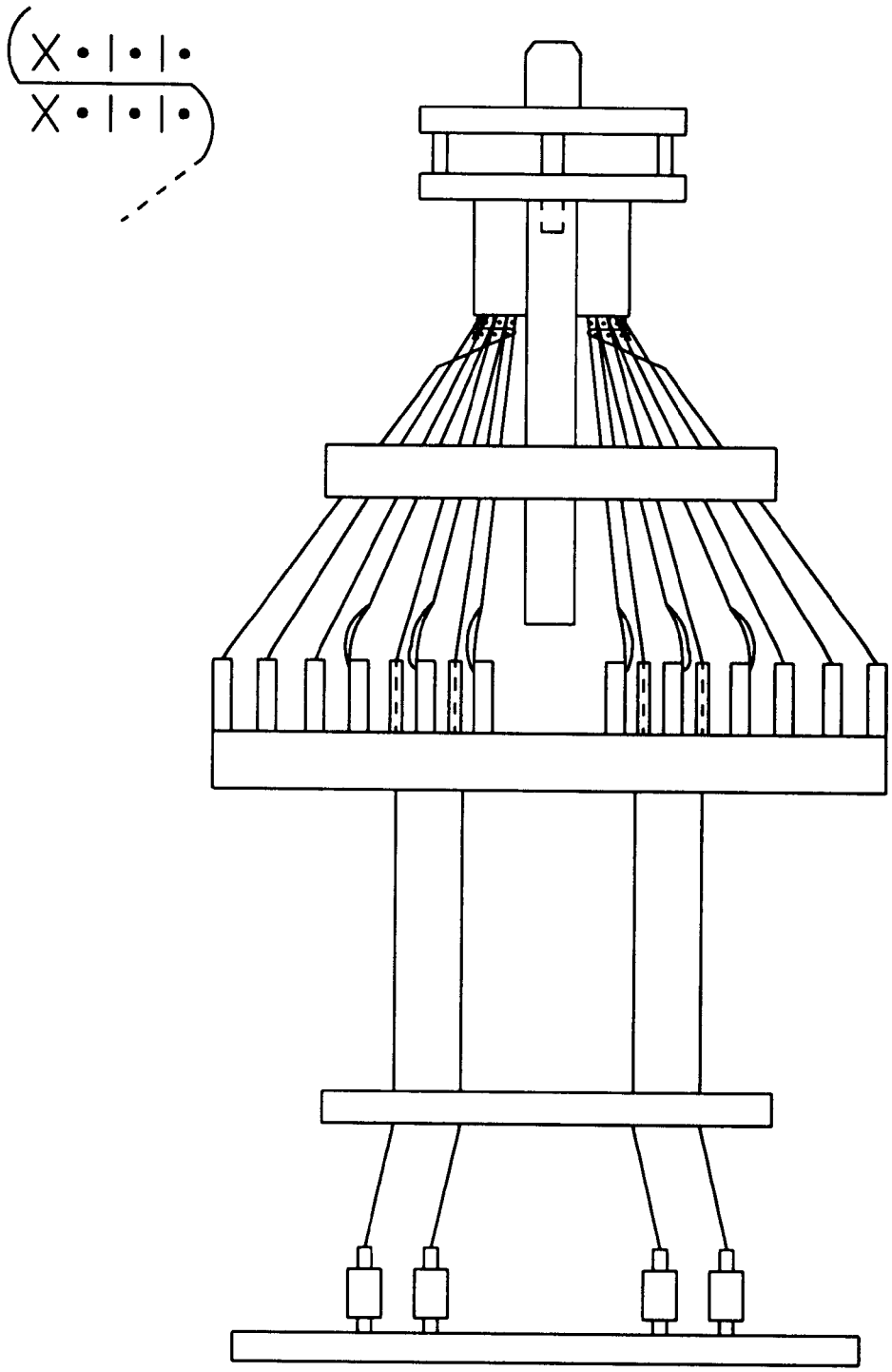
Figures 2, 16G:
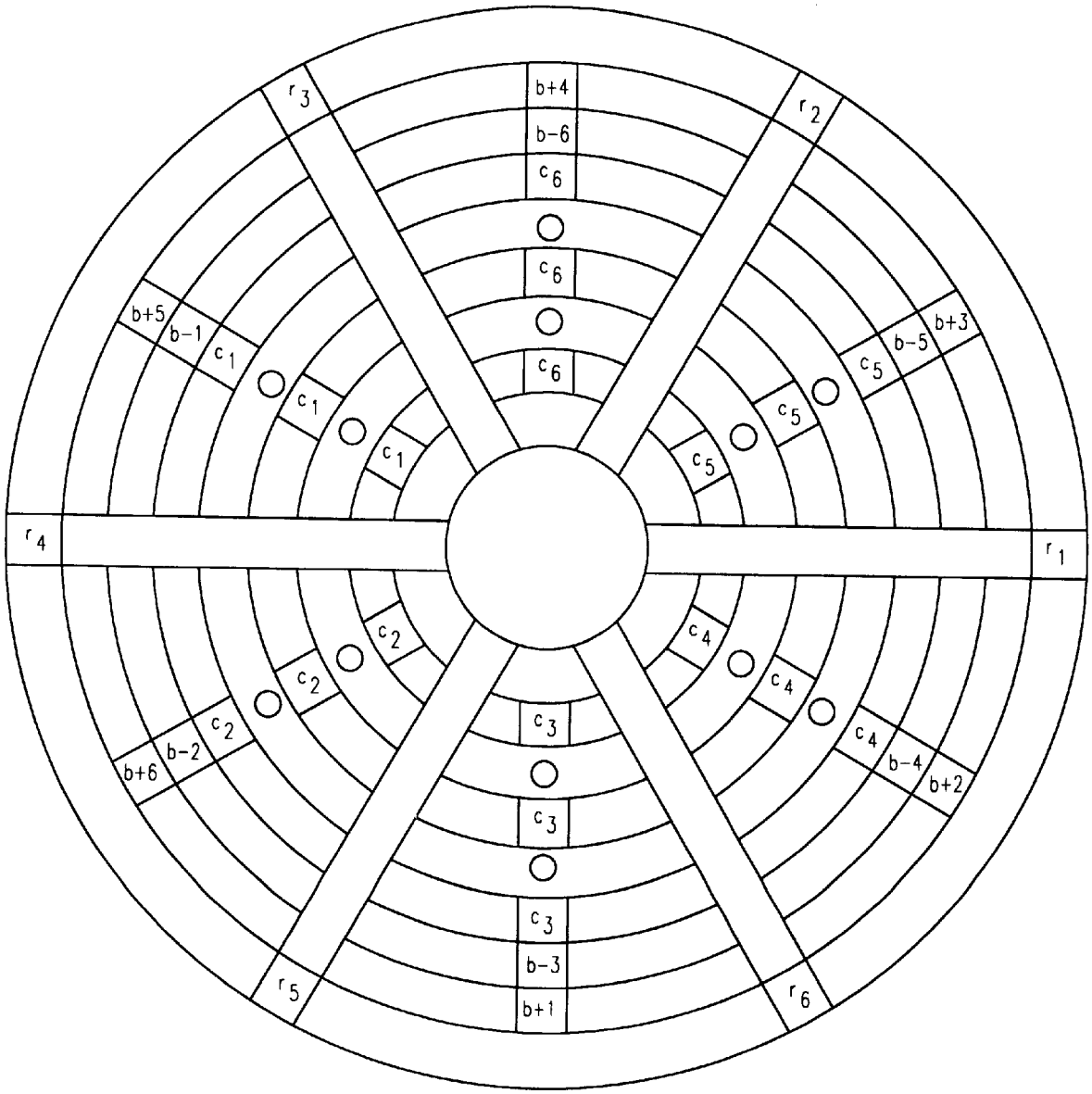
Figures 1, 16H:
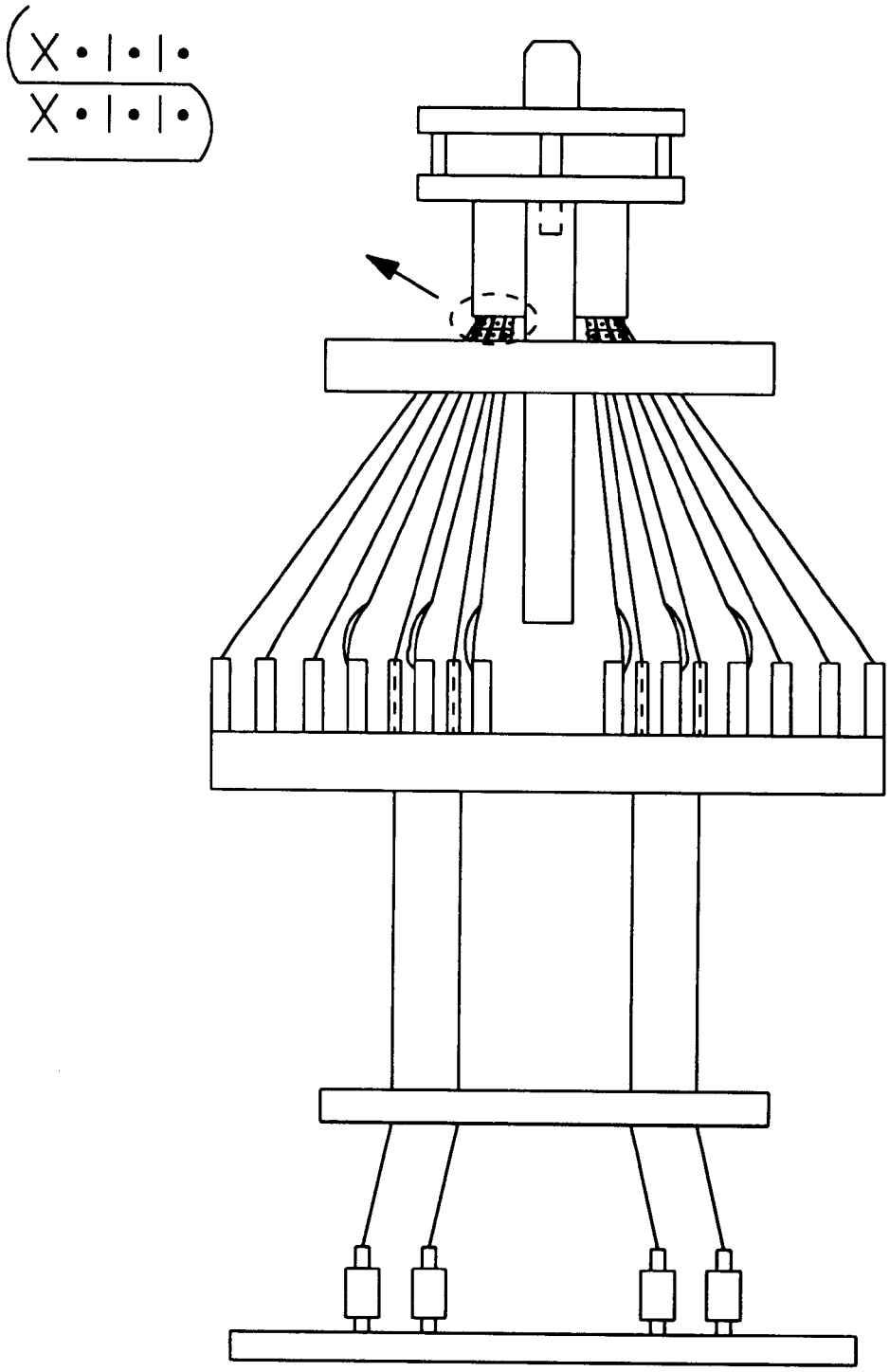
Figures 2, 16H:
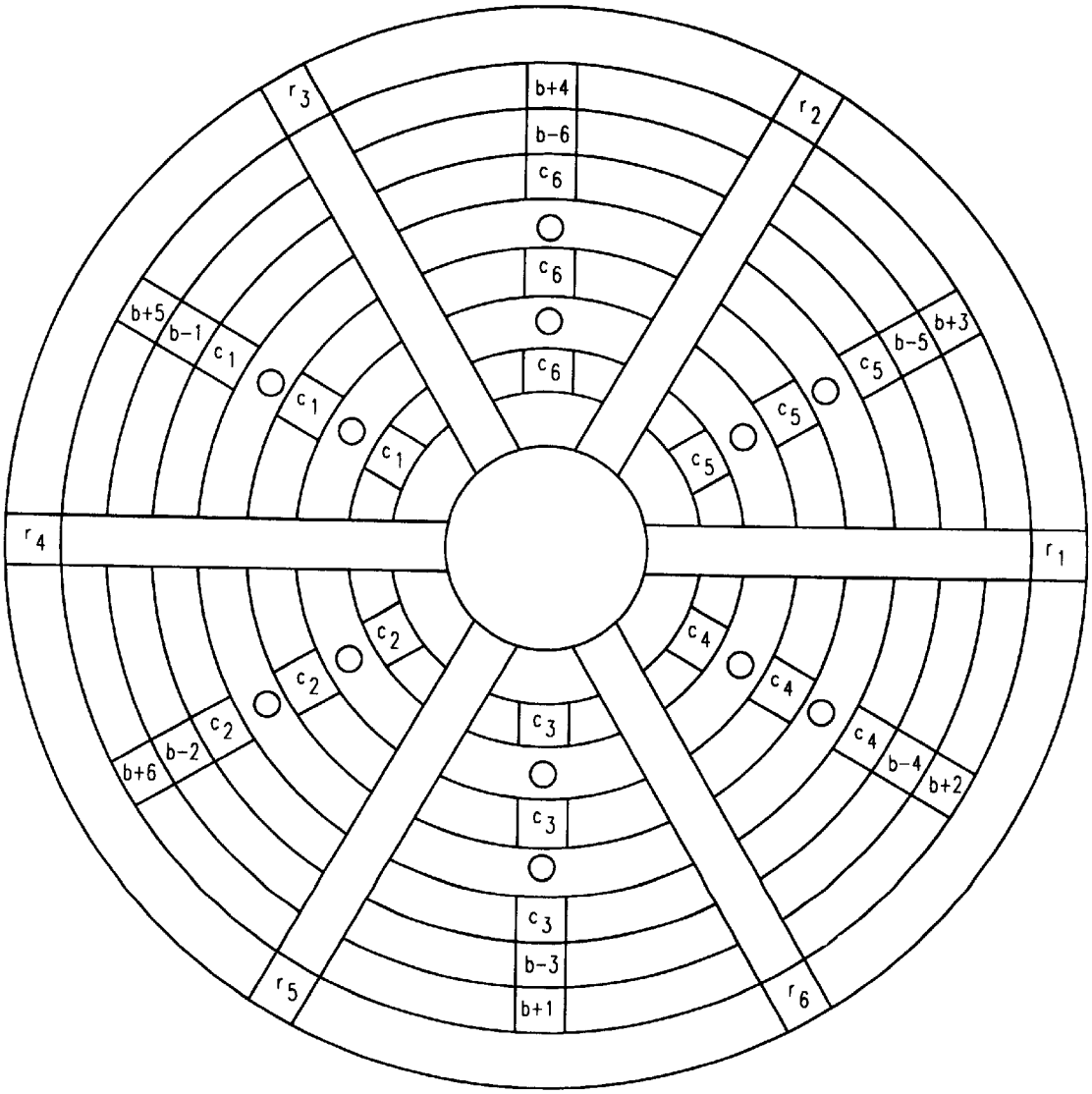
Figures 1, 17:
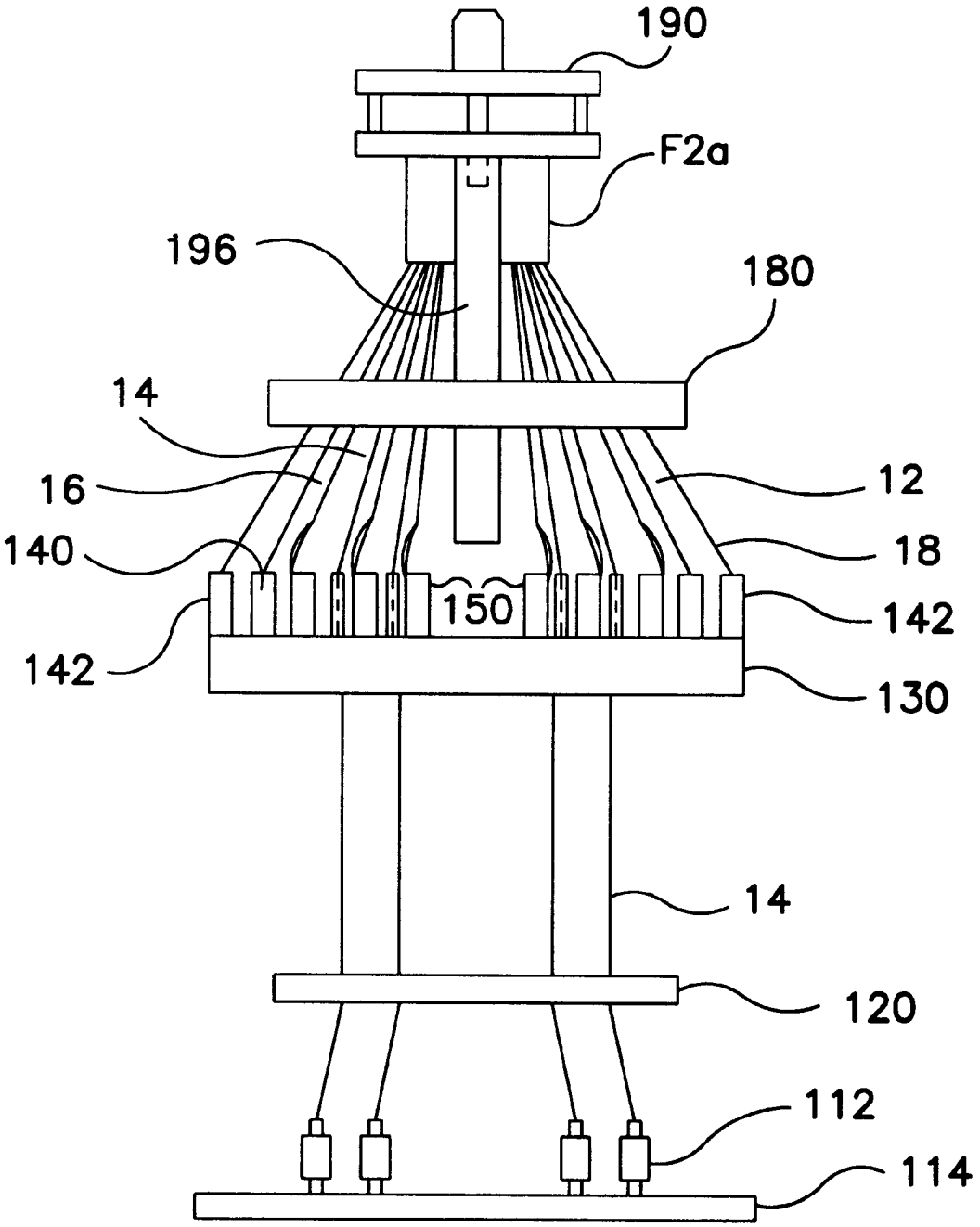
Figures 2, 17:
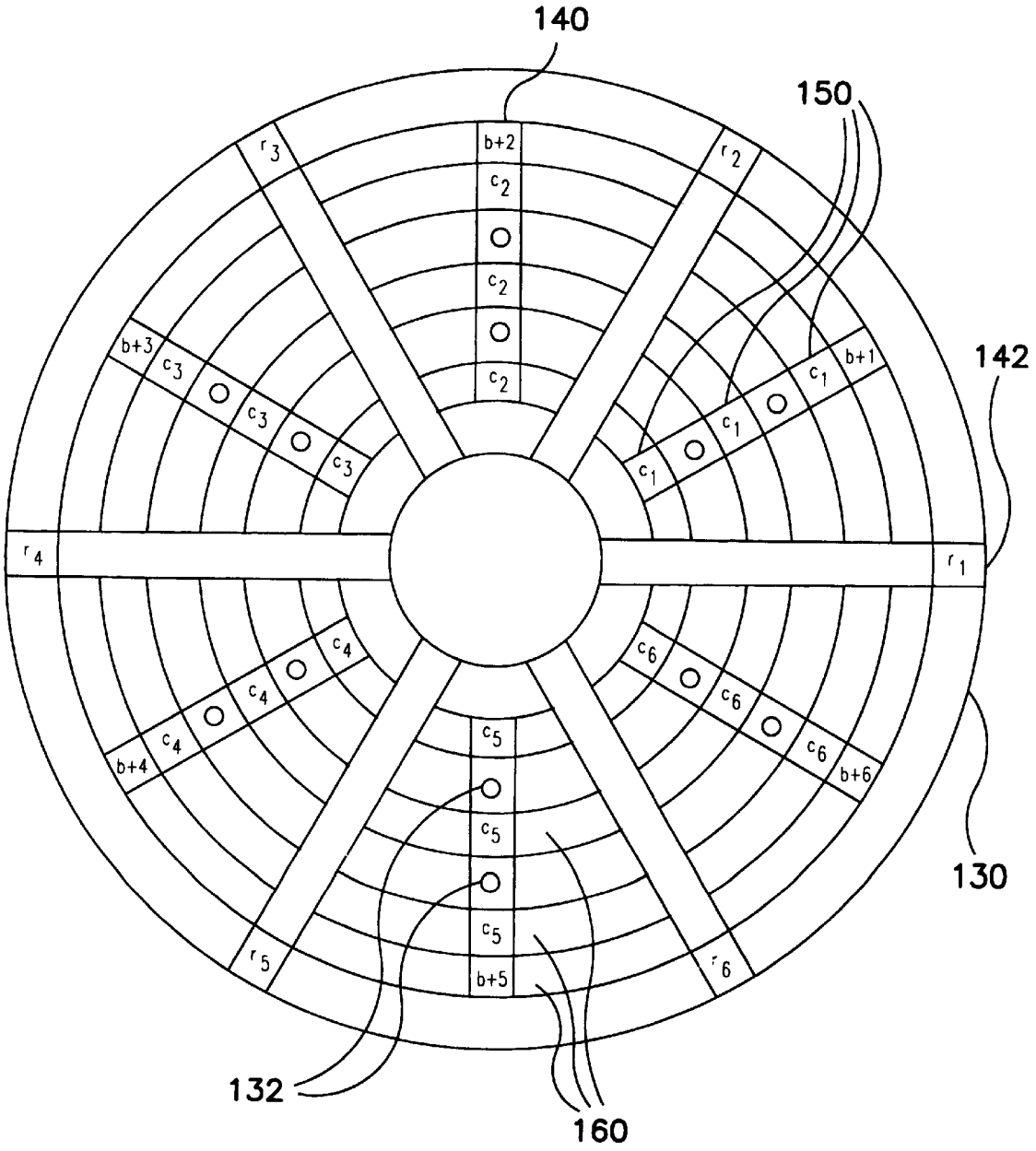
Figures 1, 17A:
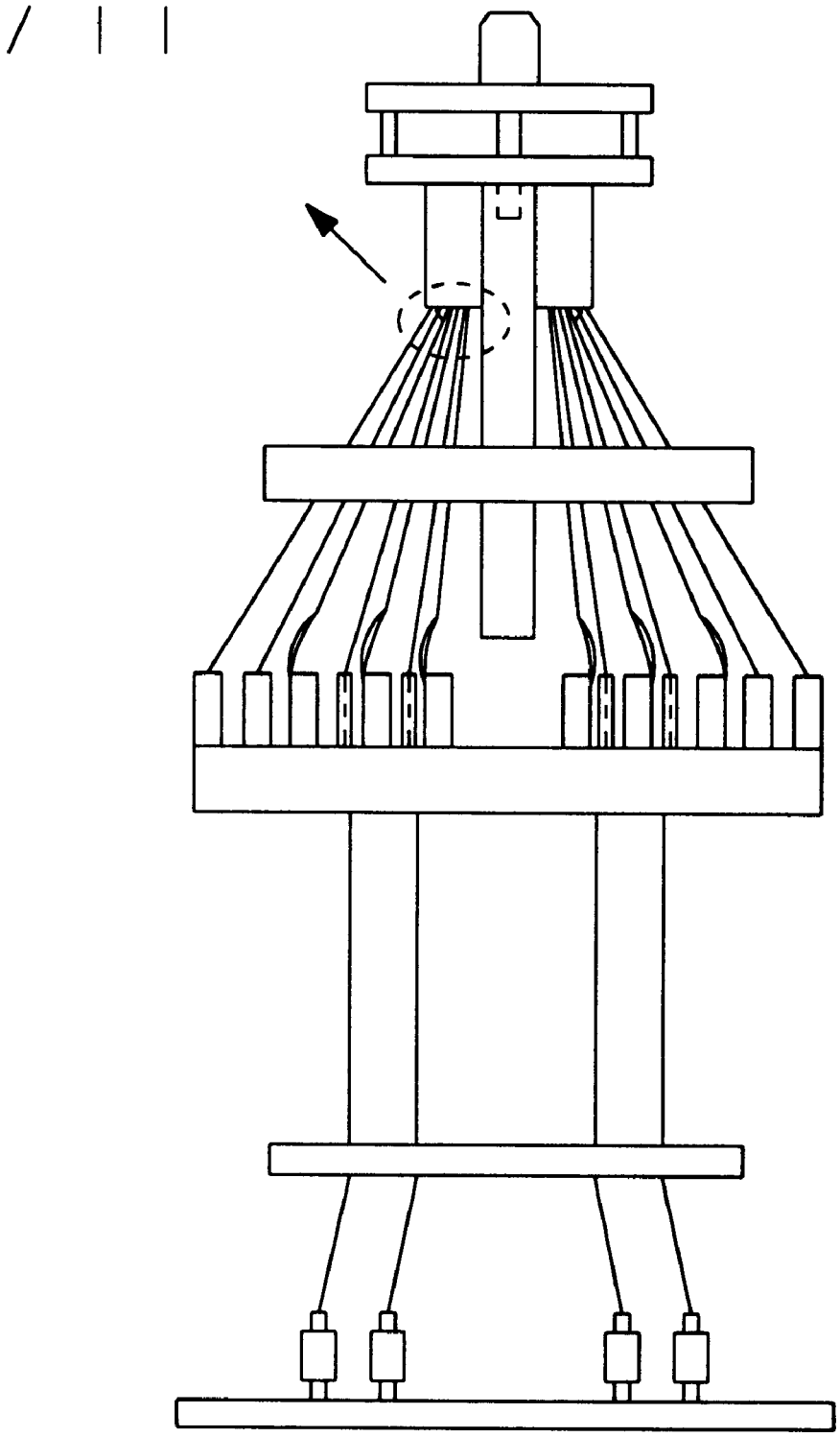
Figures 2, 17A:
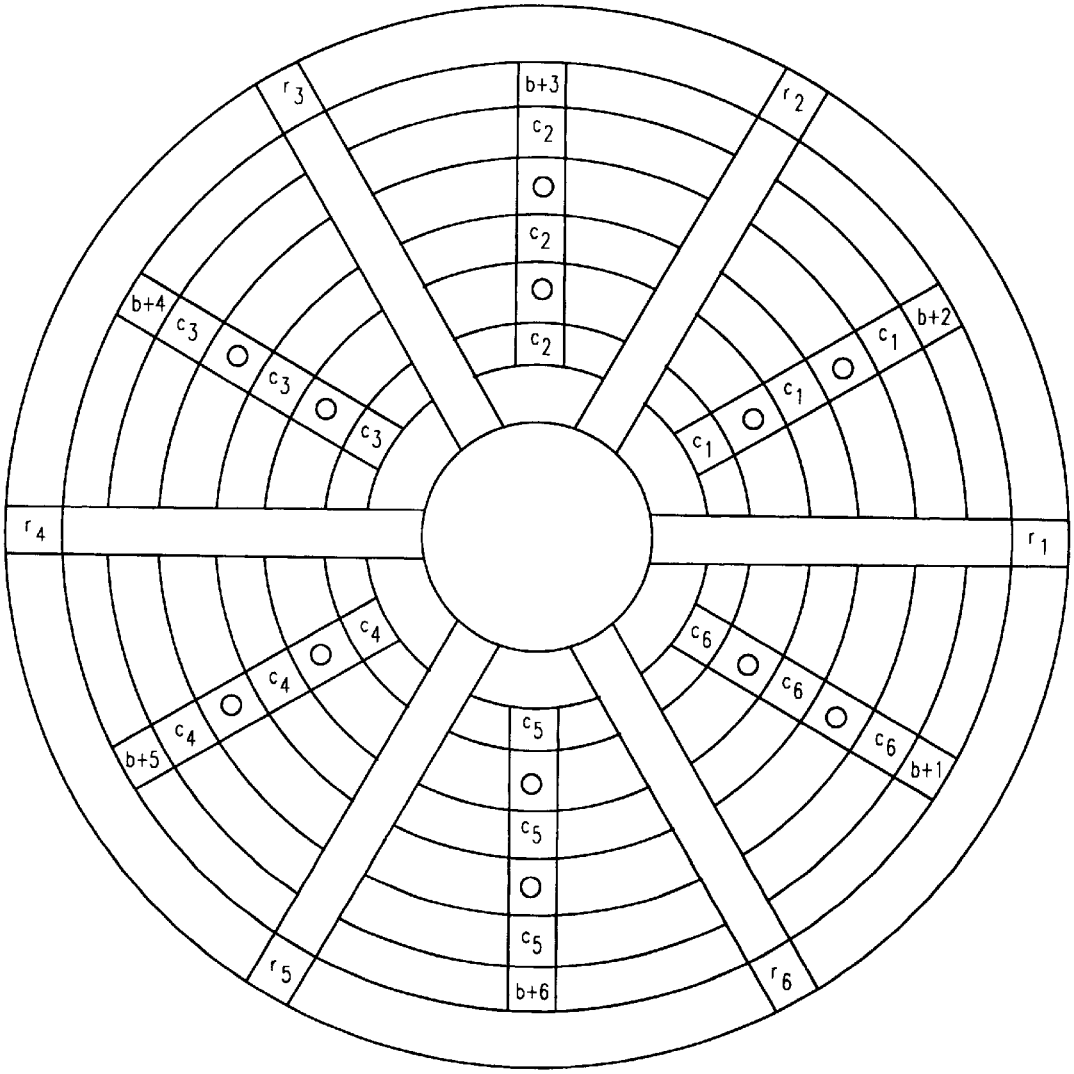
Figures 1, 17B:
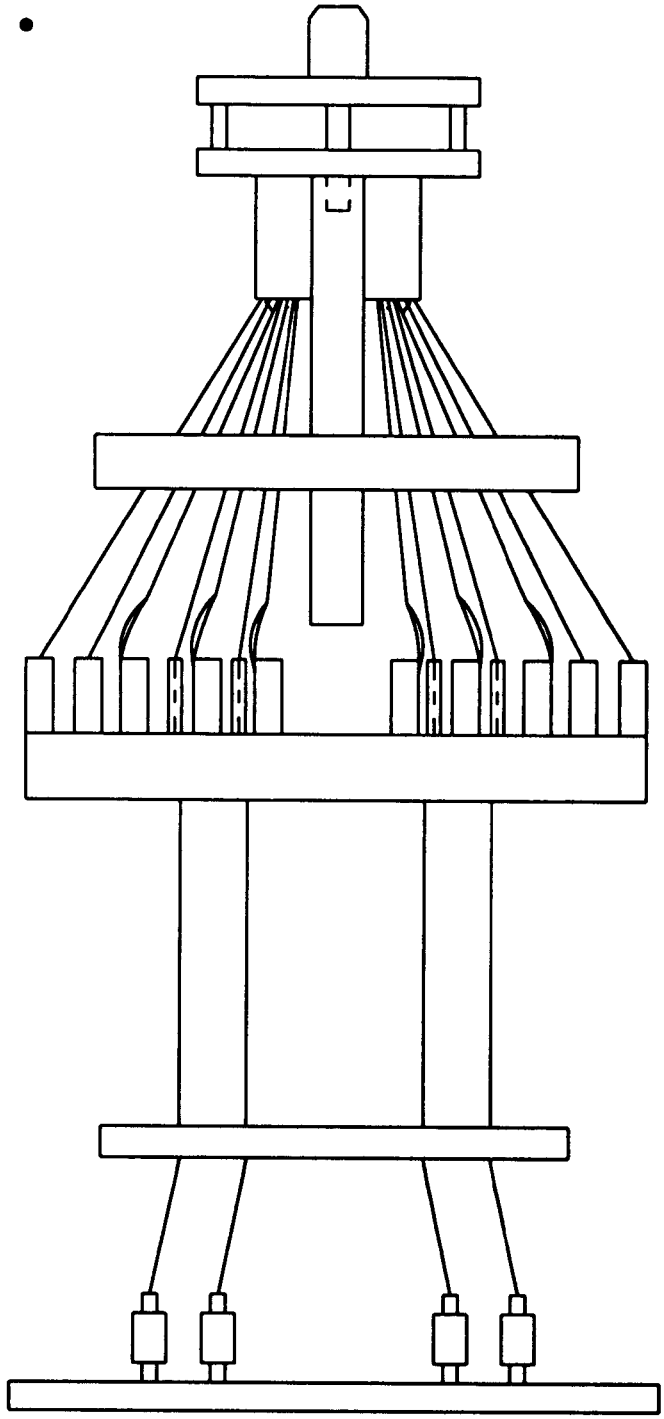
Figures 2, 17B:
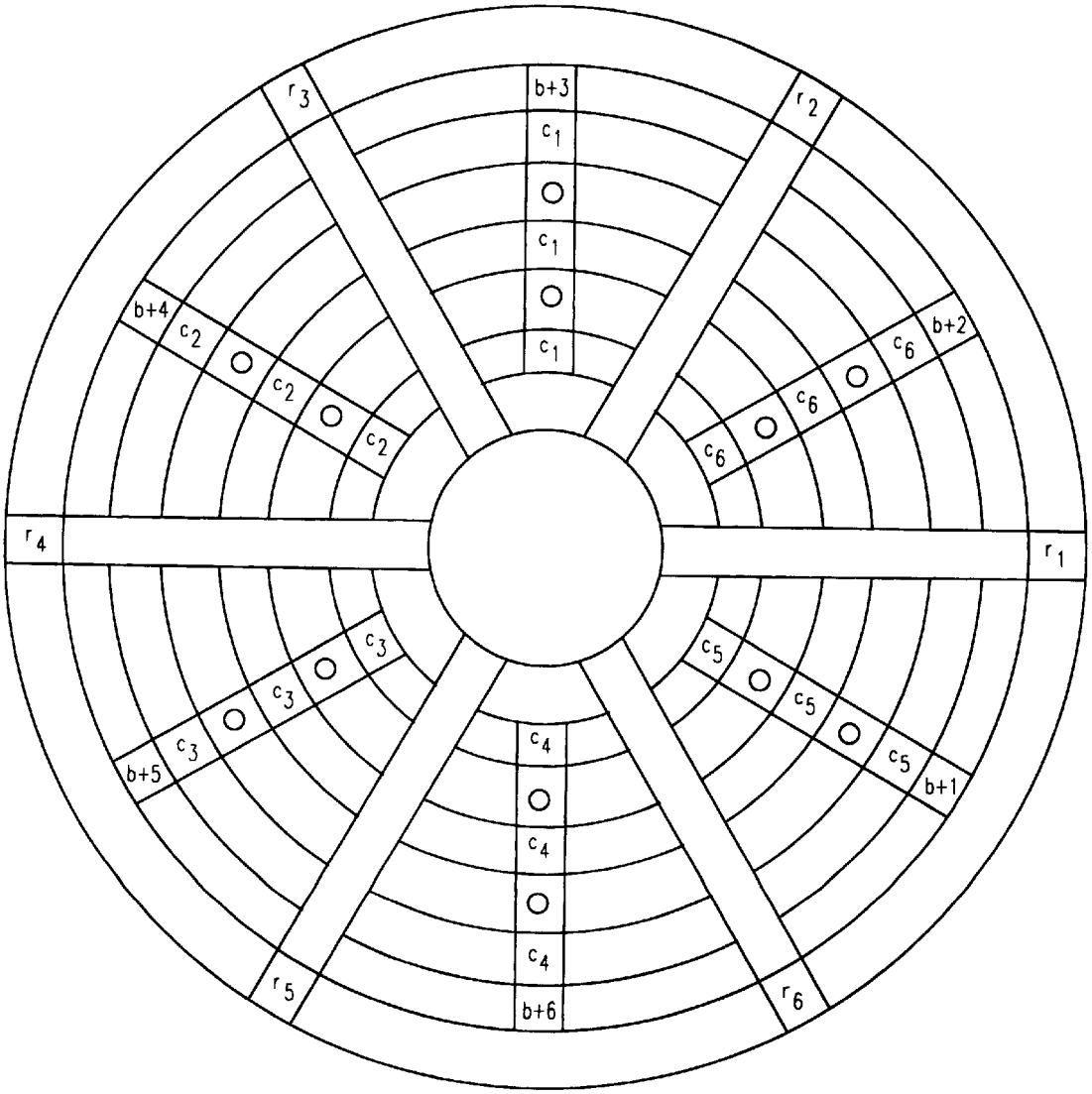
Figures 1, 17C:
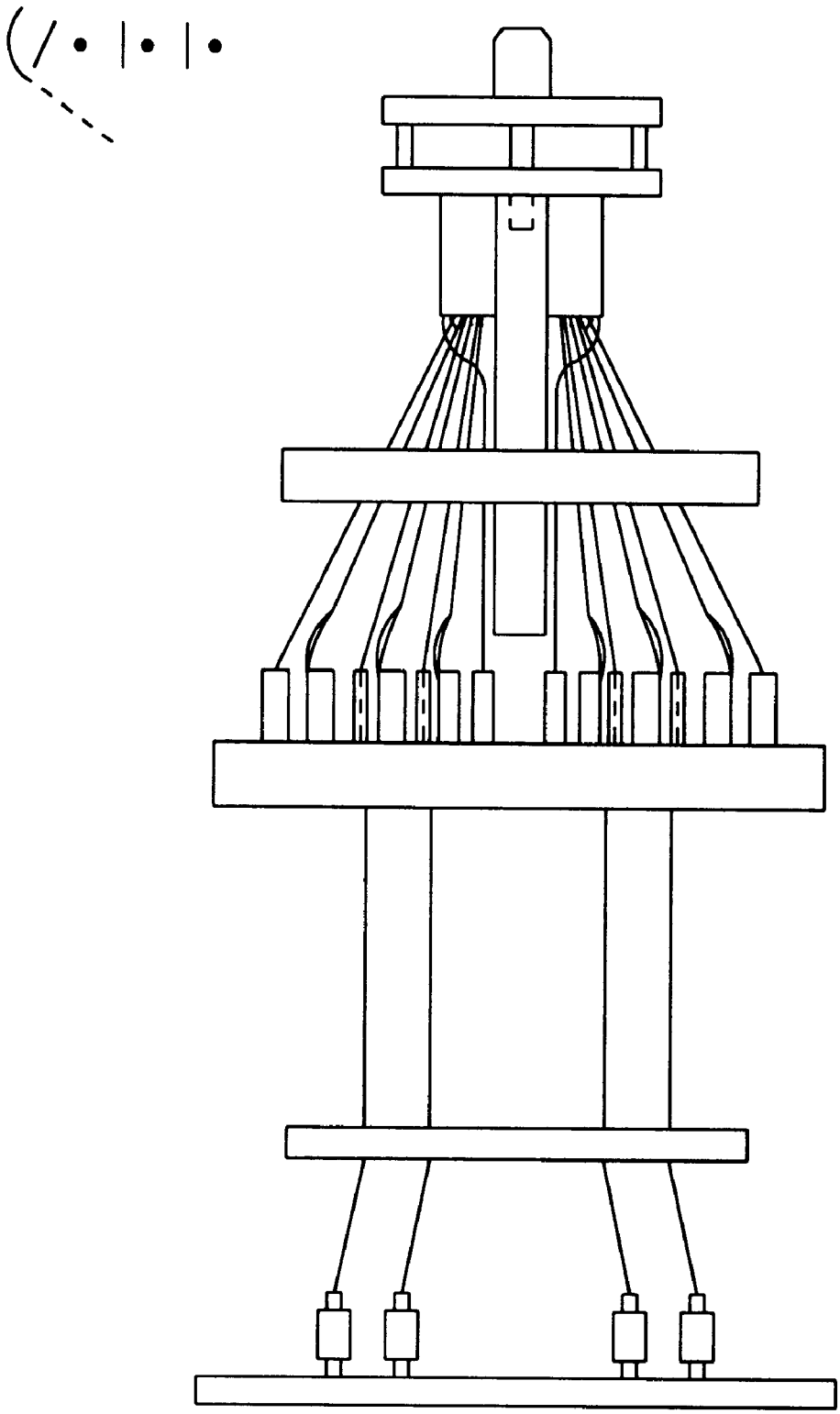
Figures 2, 17C:
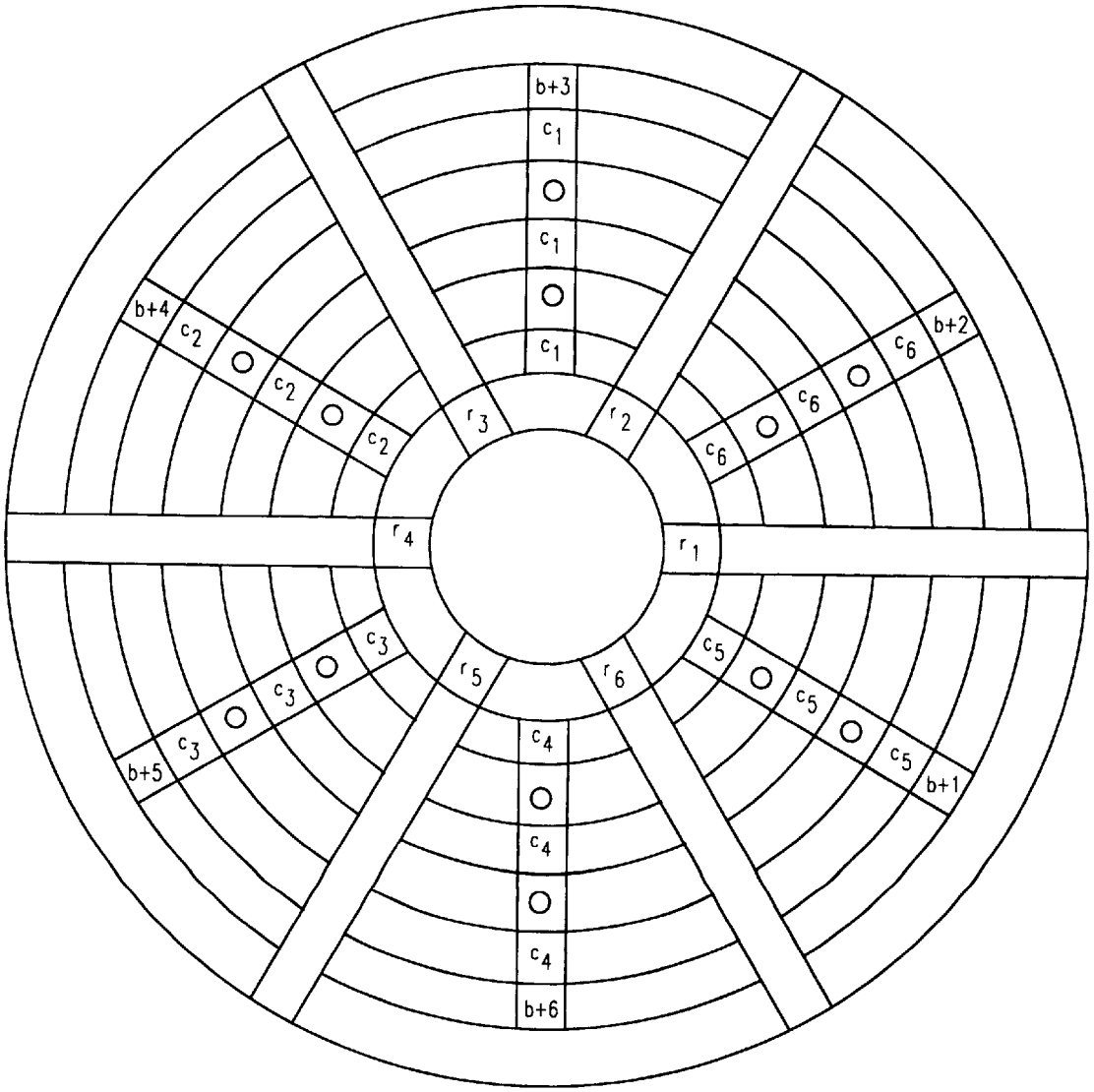
Figures 1, 17D:
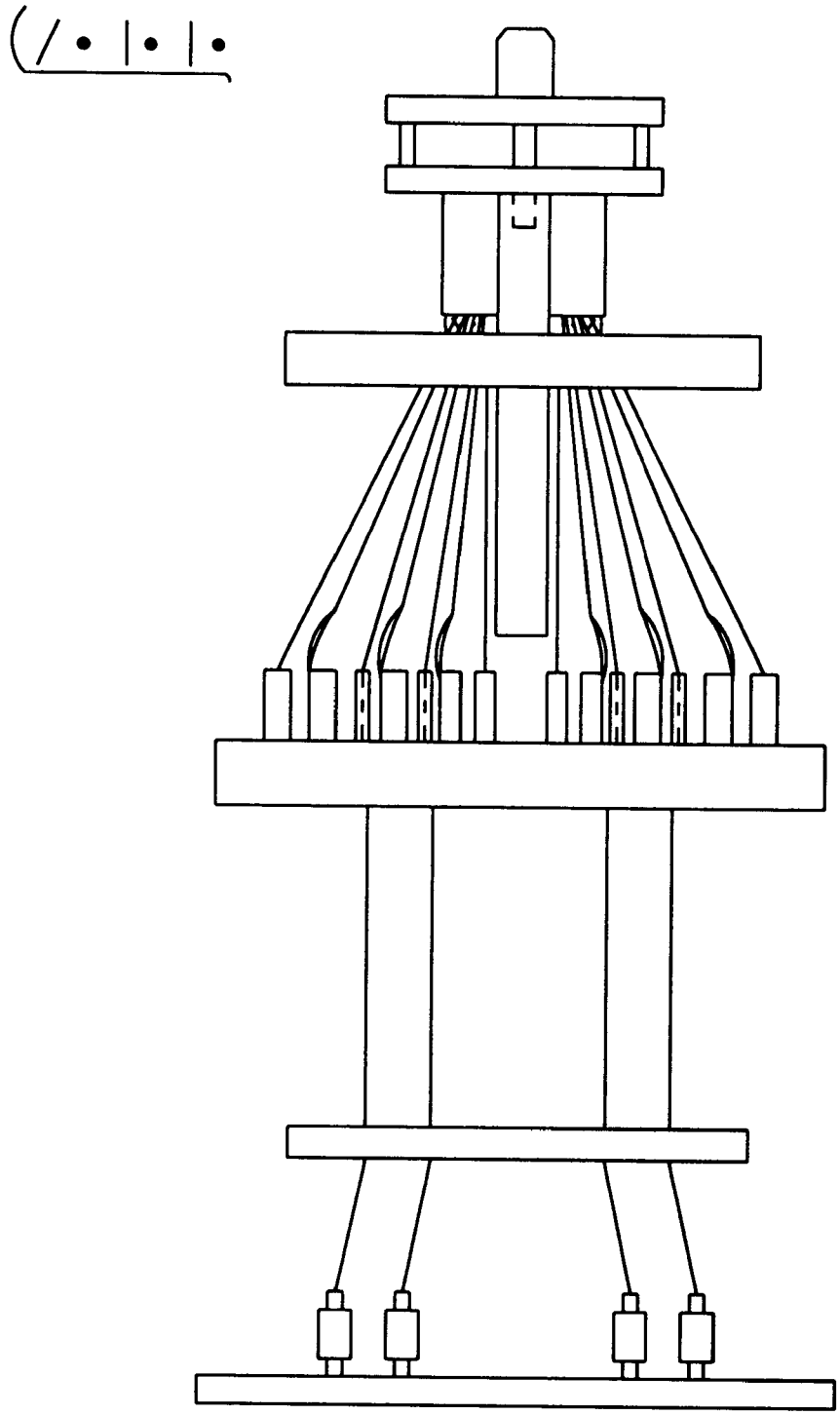
Figures 2, 17D:
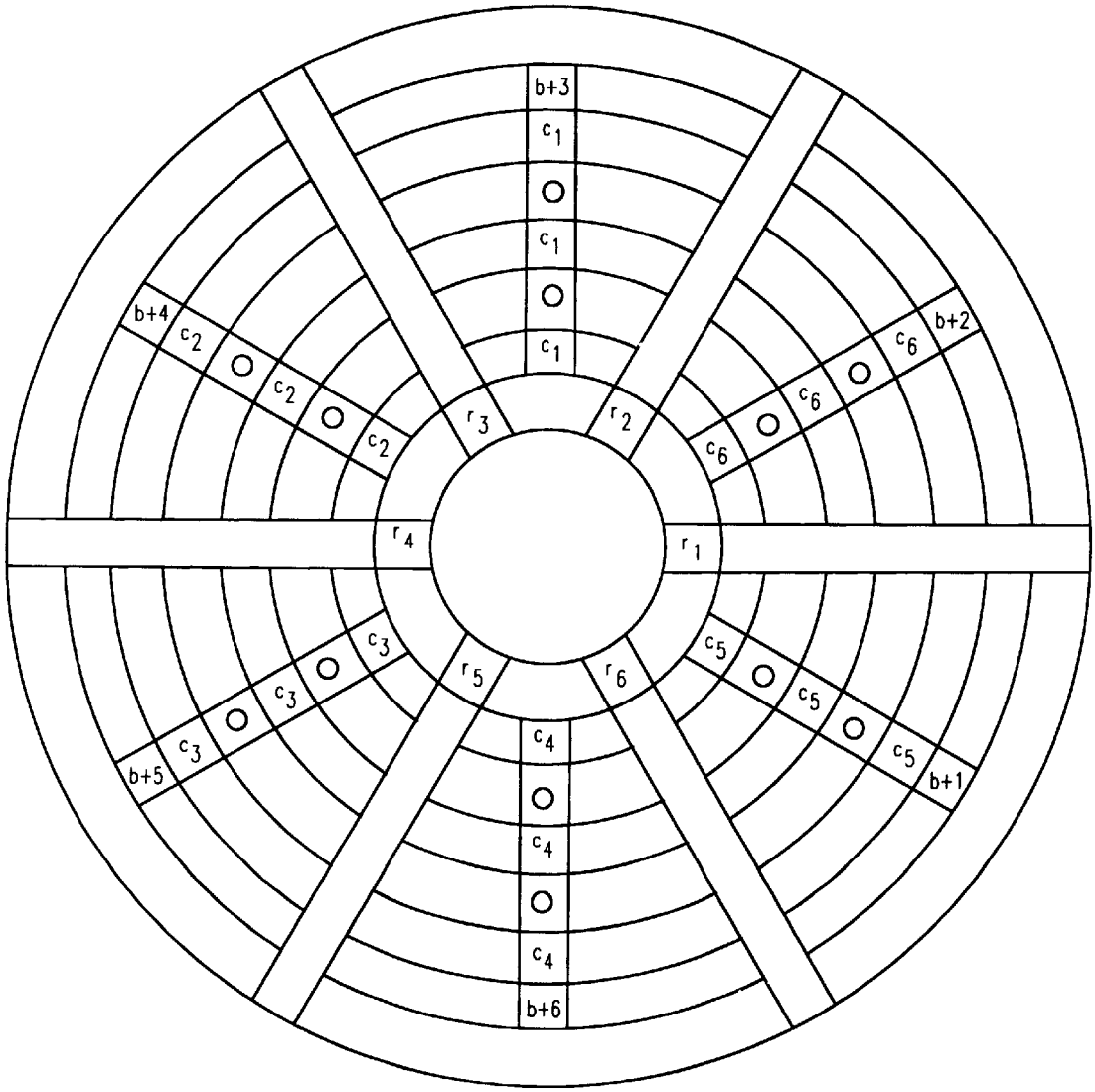
Figures 1, 17E:
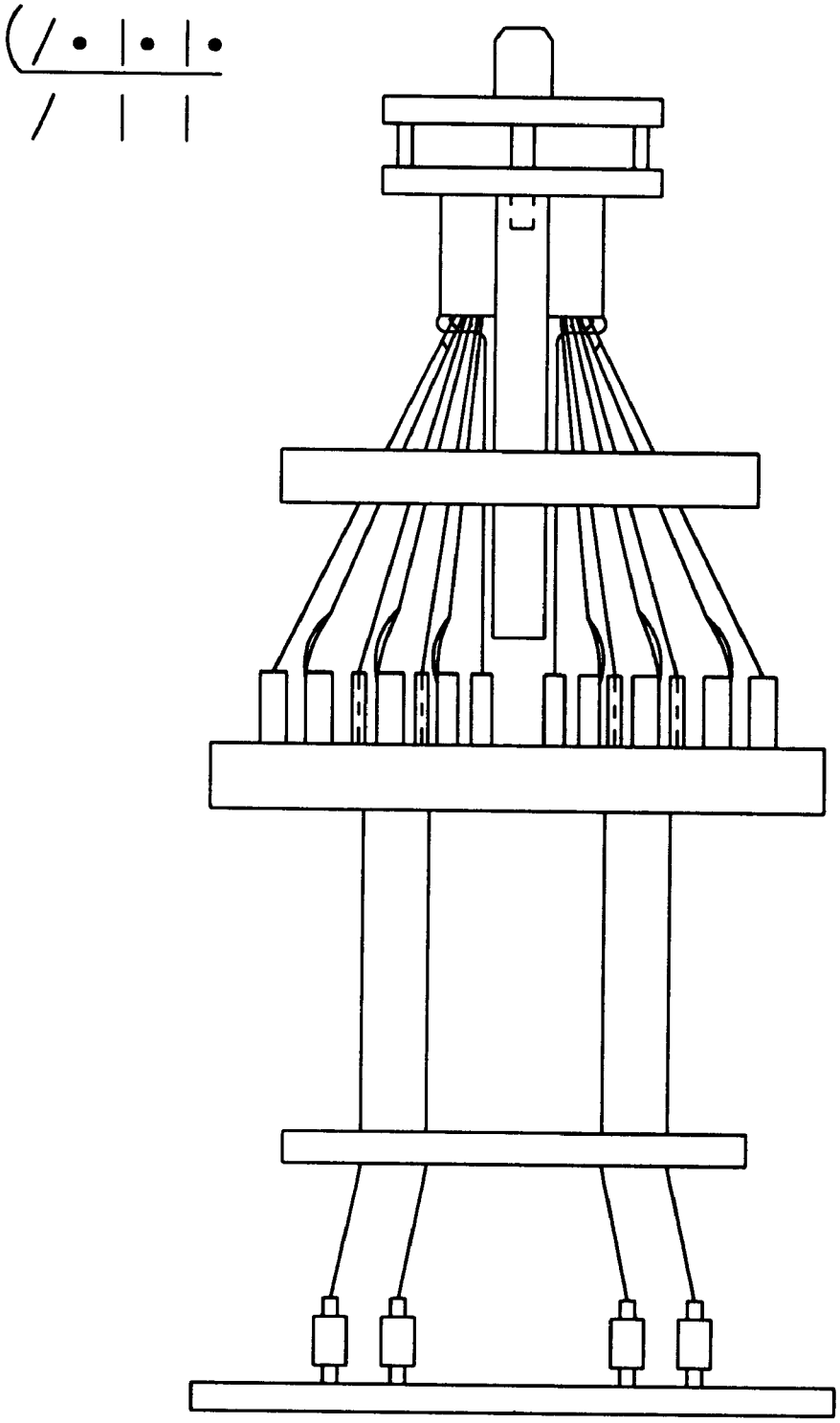
Figures 2, 17E:
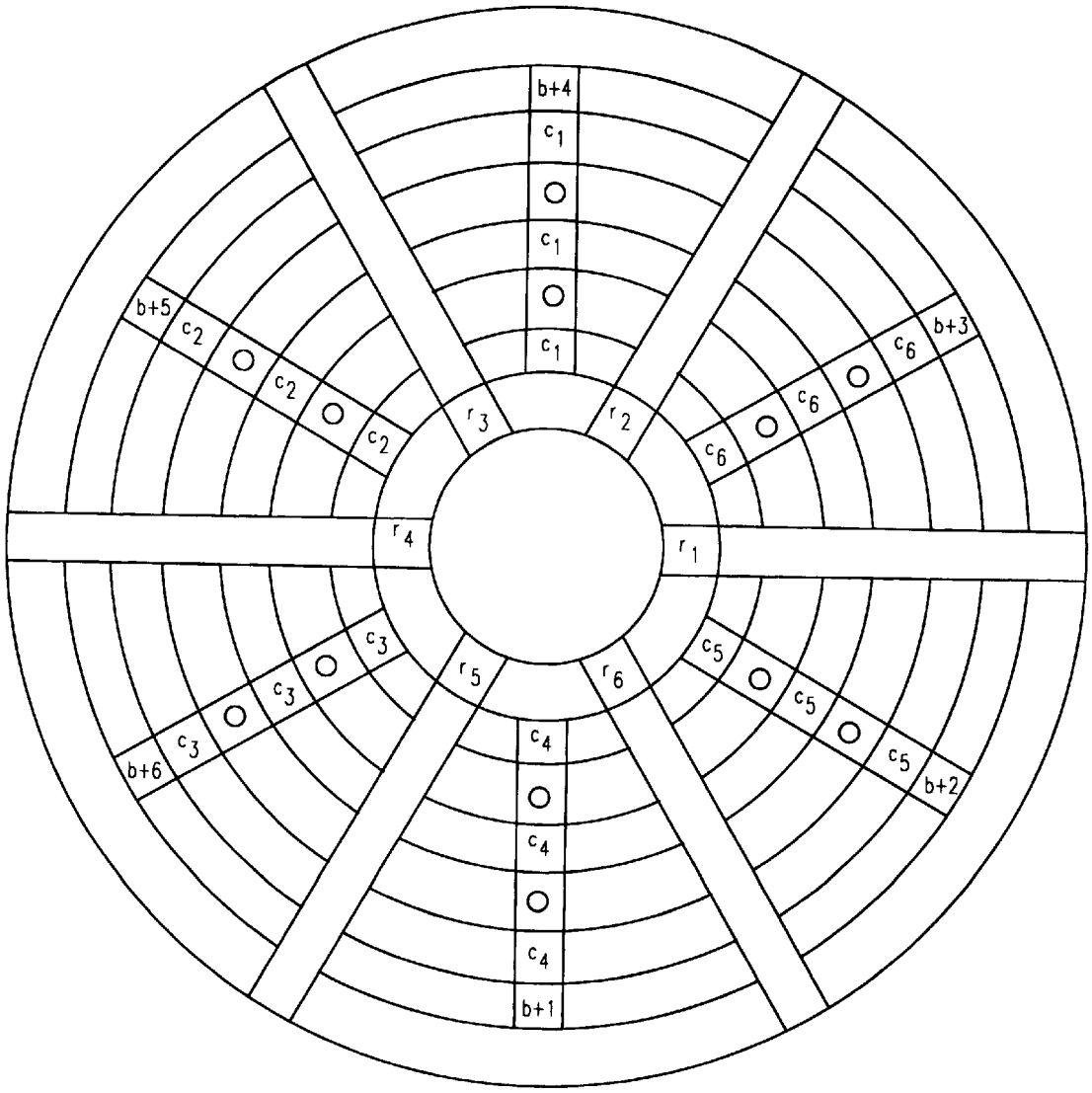
Figures 1, 17F:
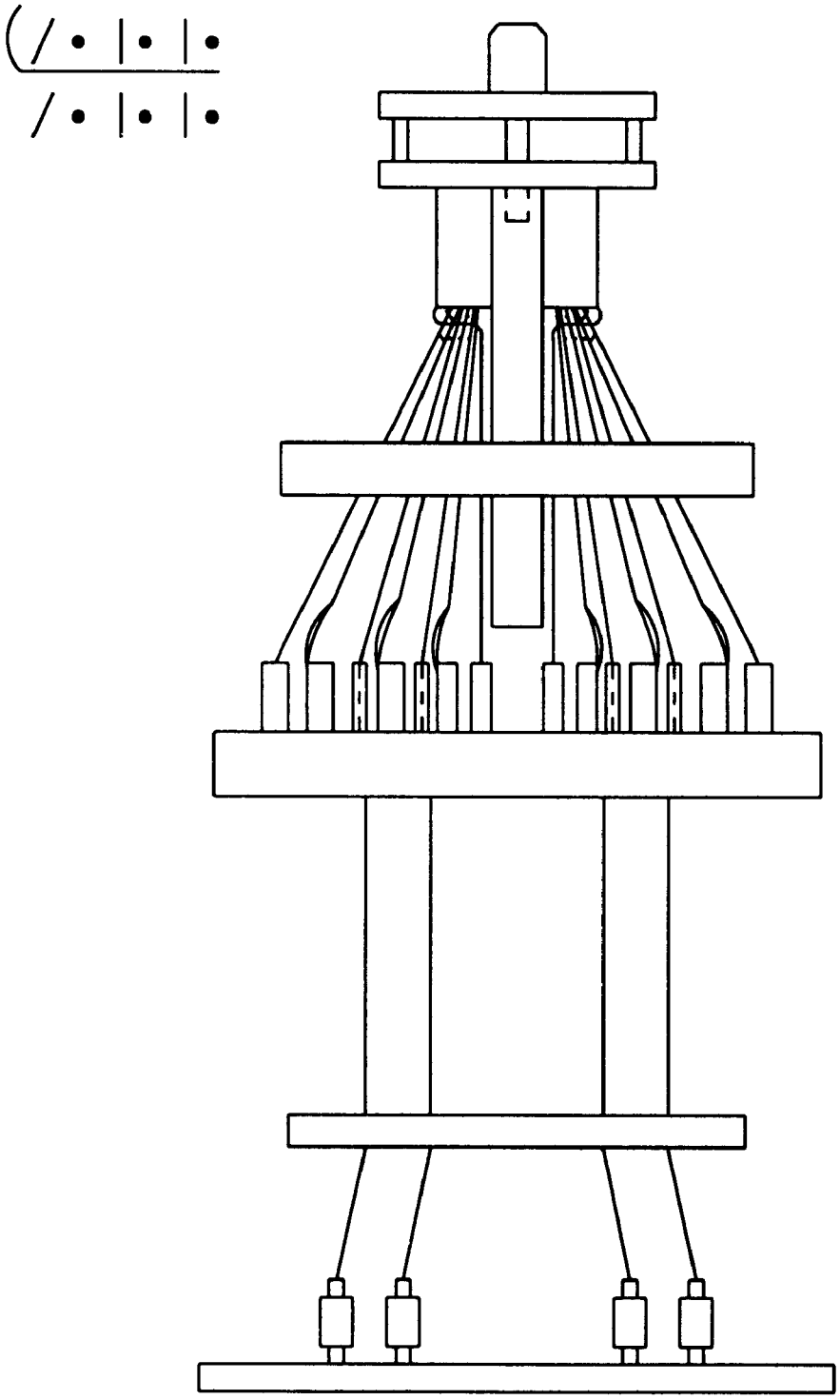
Figures 2, 17F:
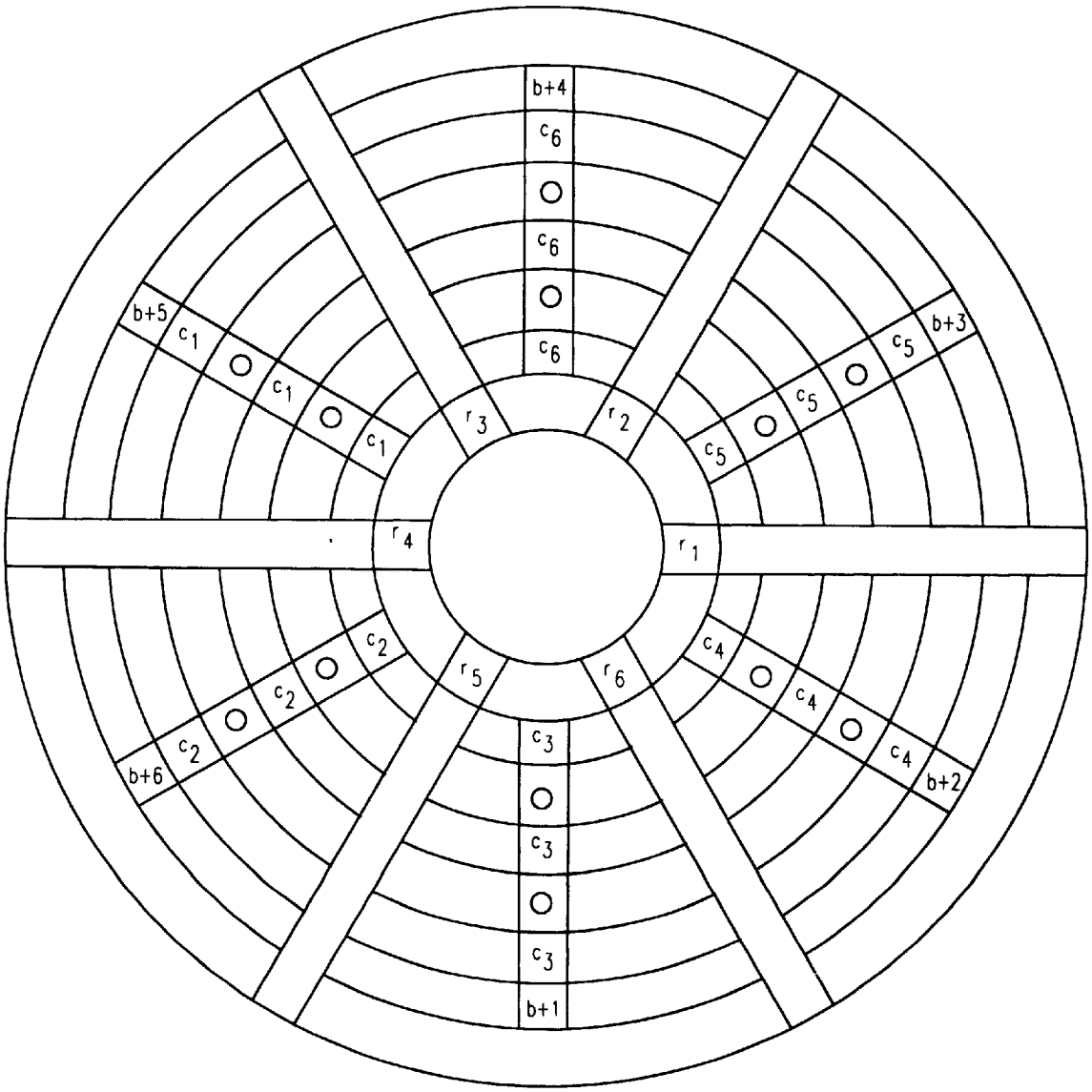
Figures 1, 17G:
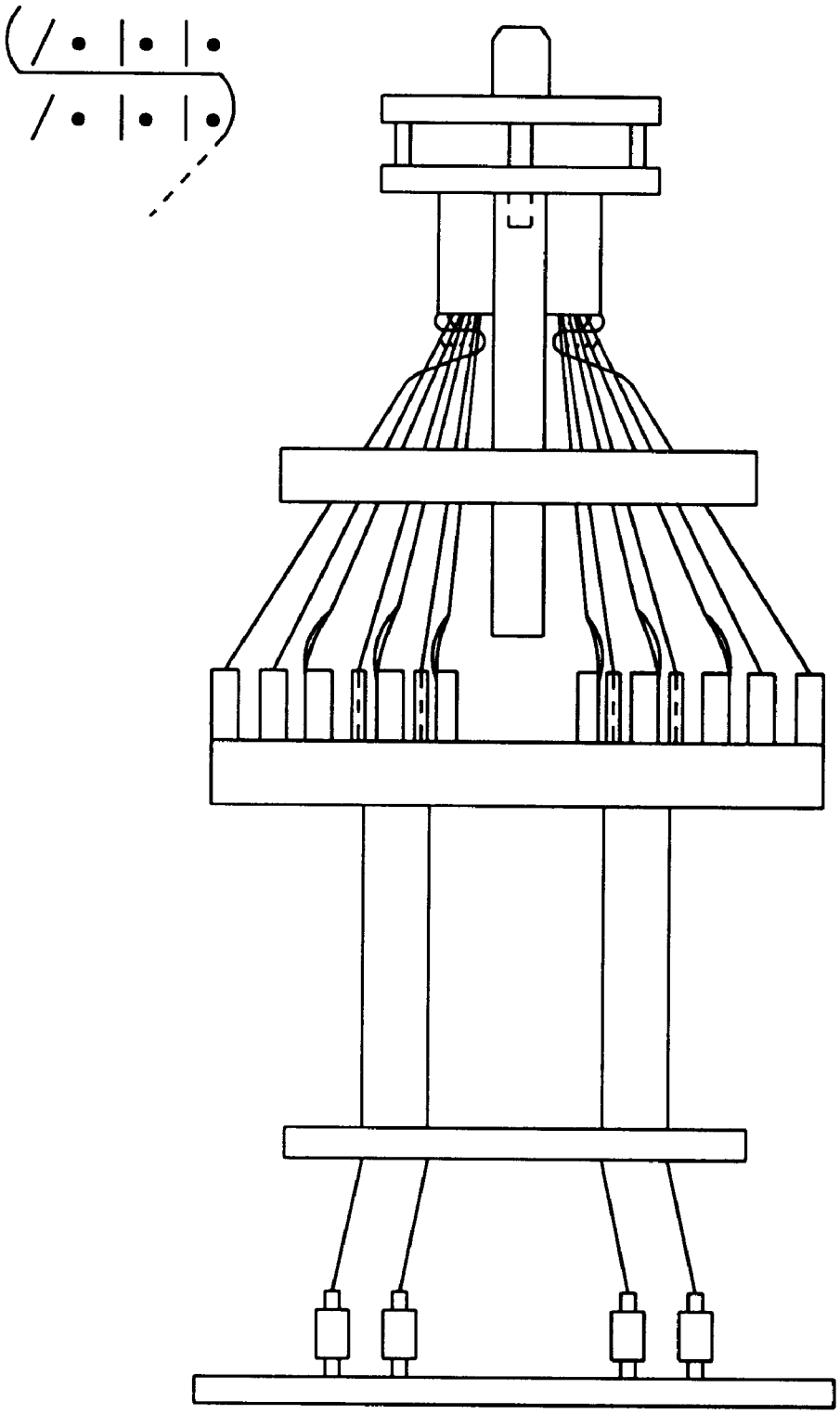
Figures 2, 17G:
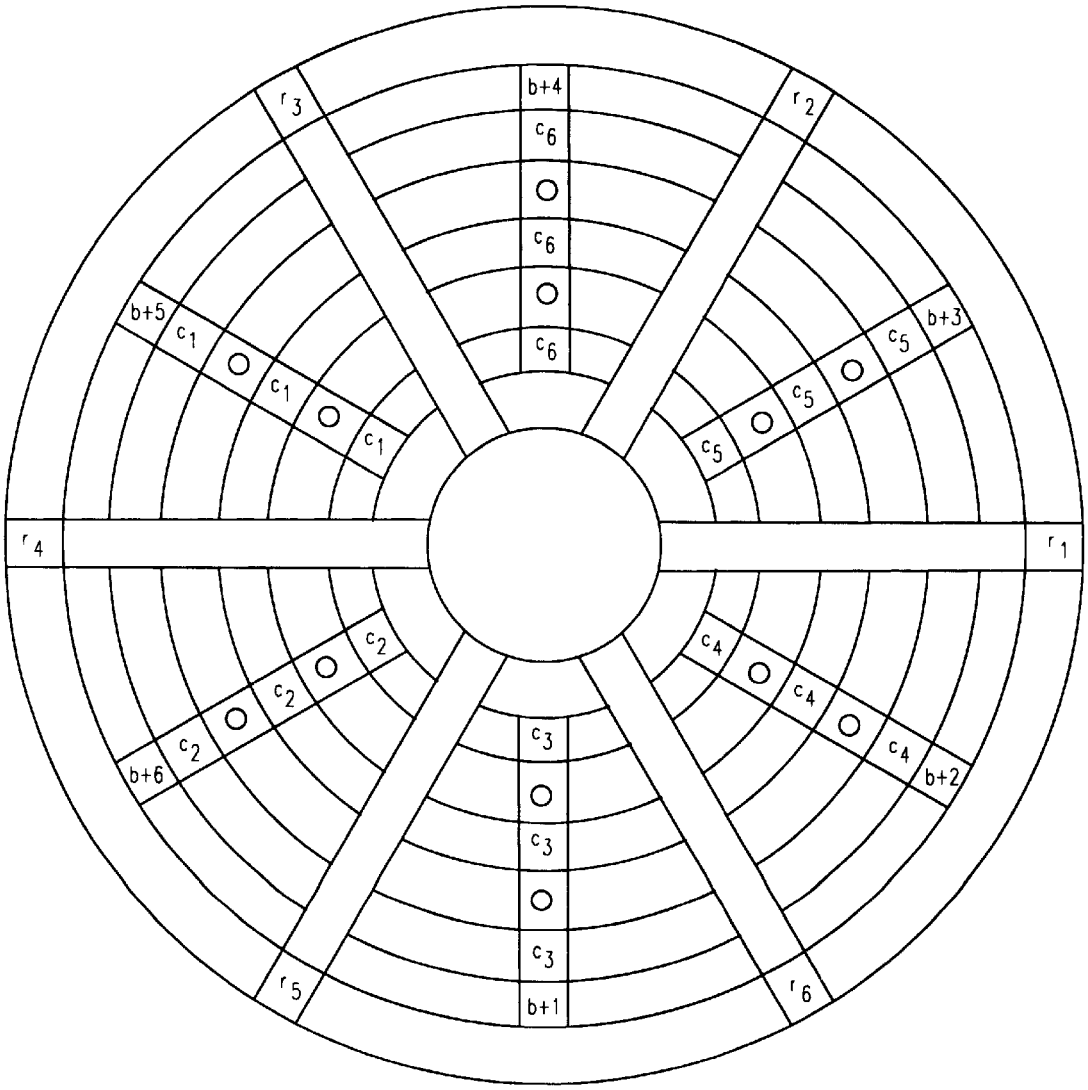
Figures 1, 17H:
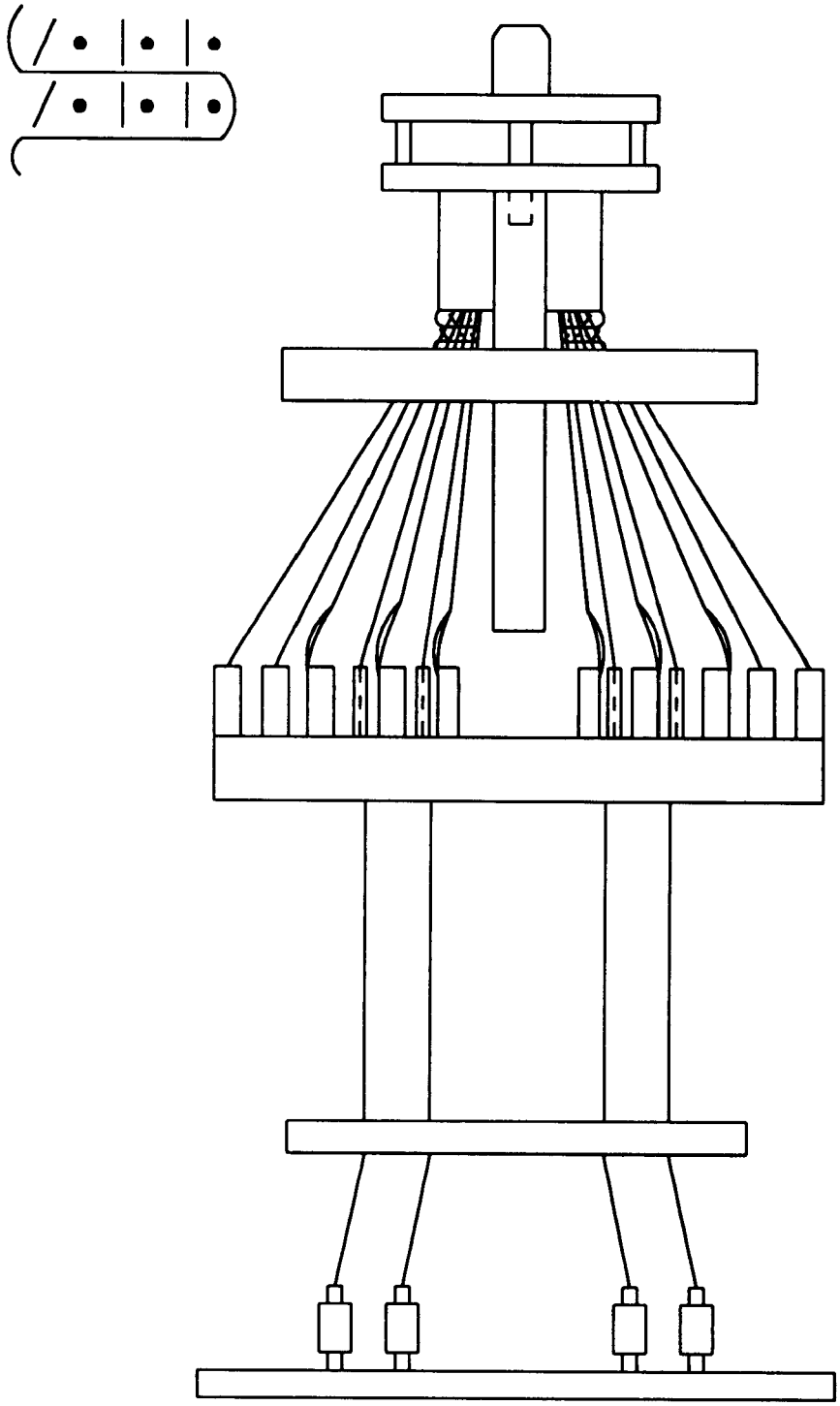
Figures 2, 17H:
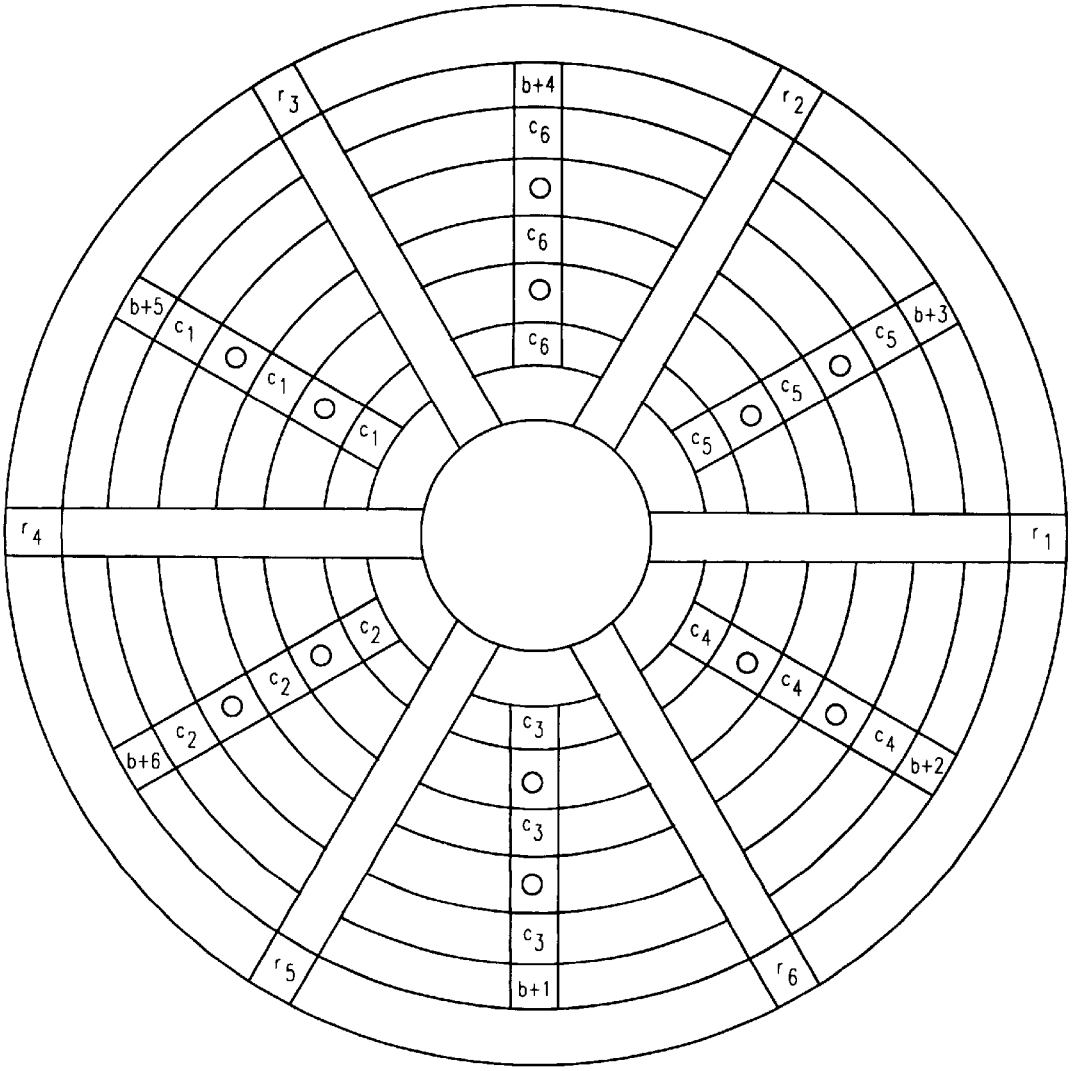
Figures 1, 18:
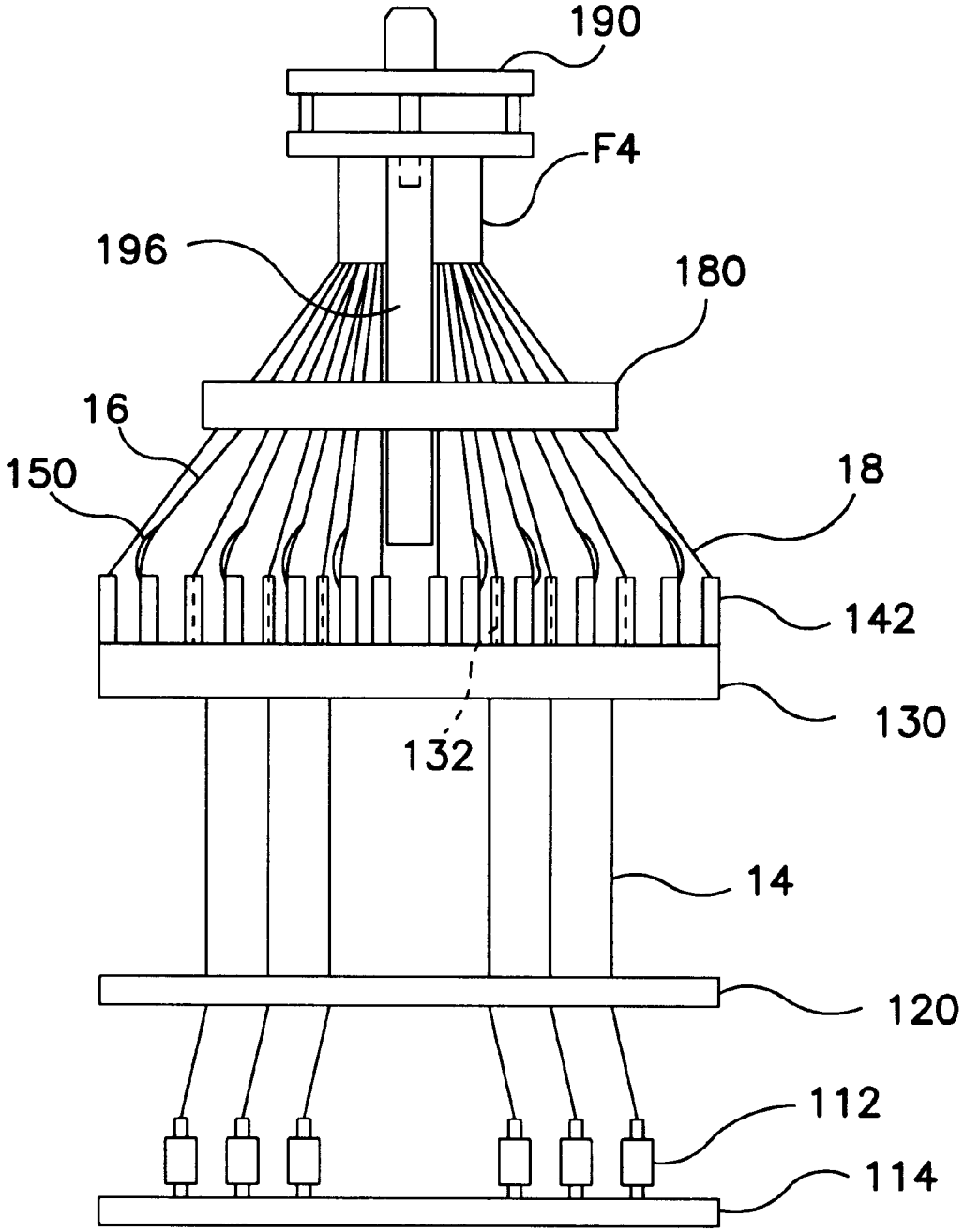
Figures 2, 18:
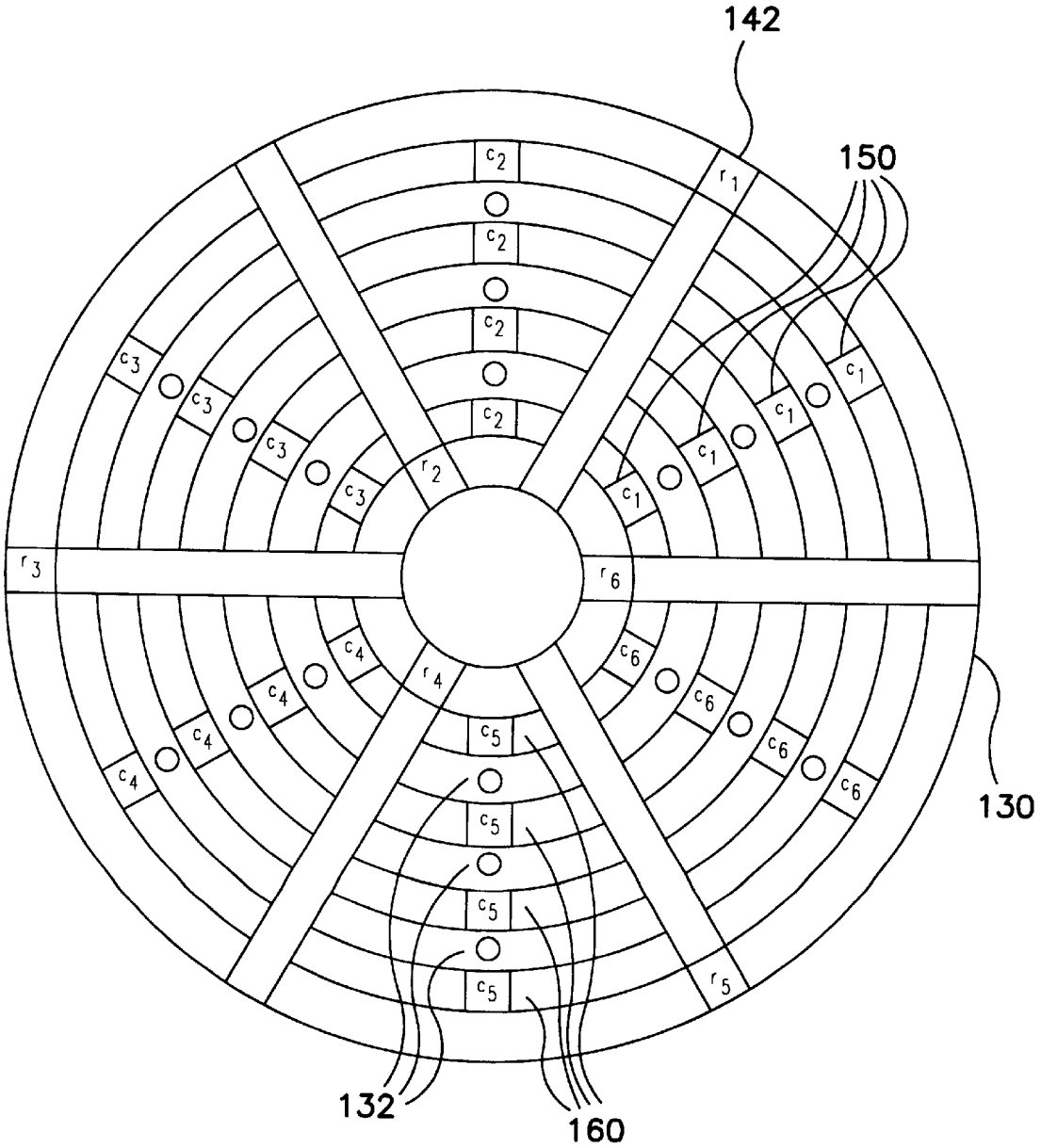
Figures 1, 18A:
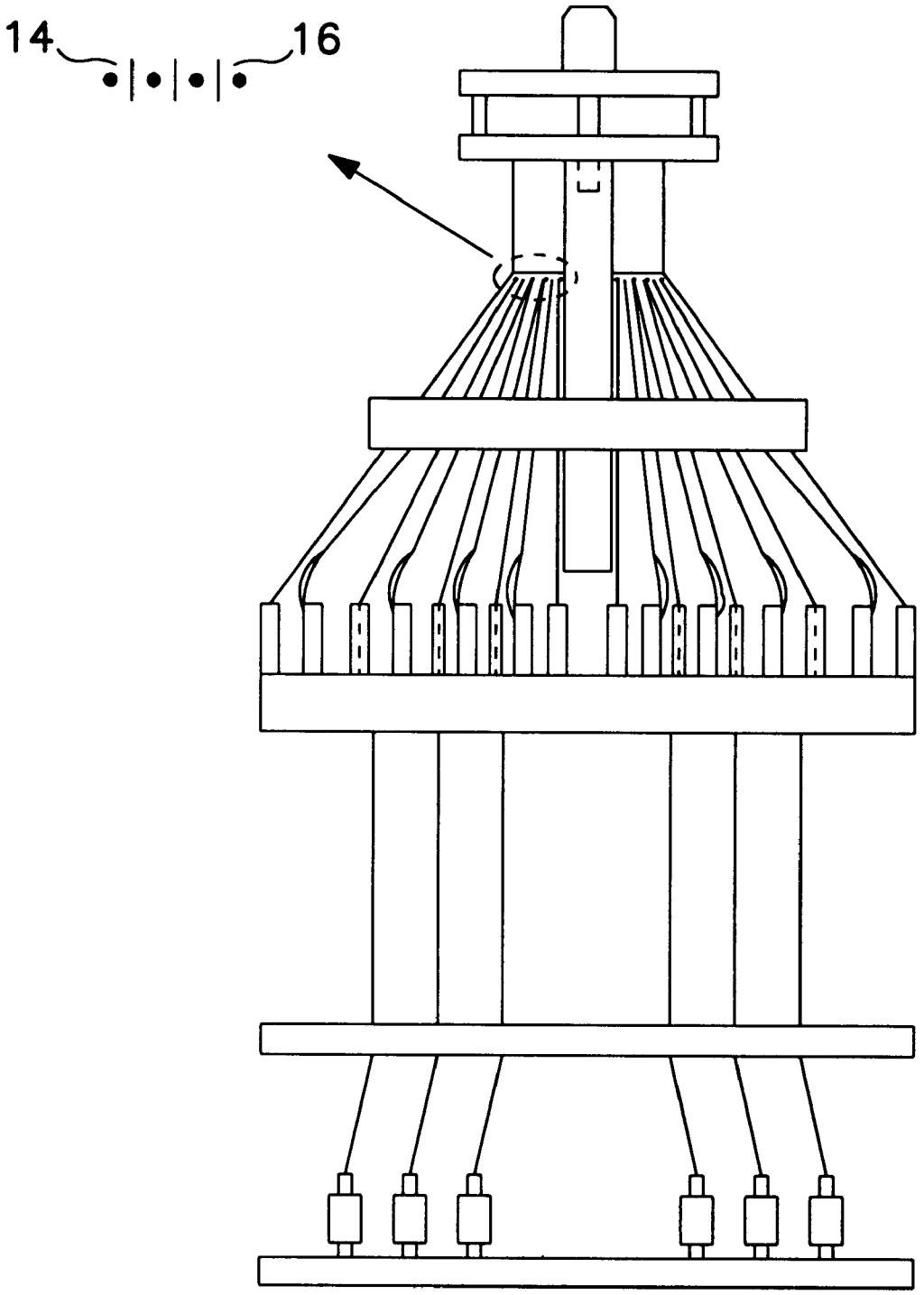
Figures 2, 18A:
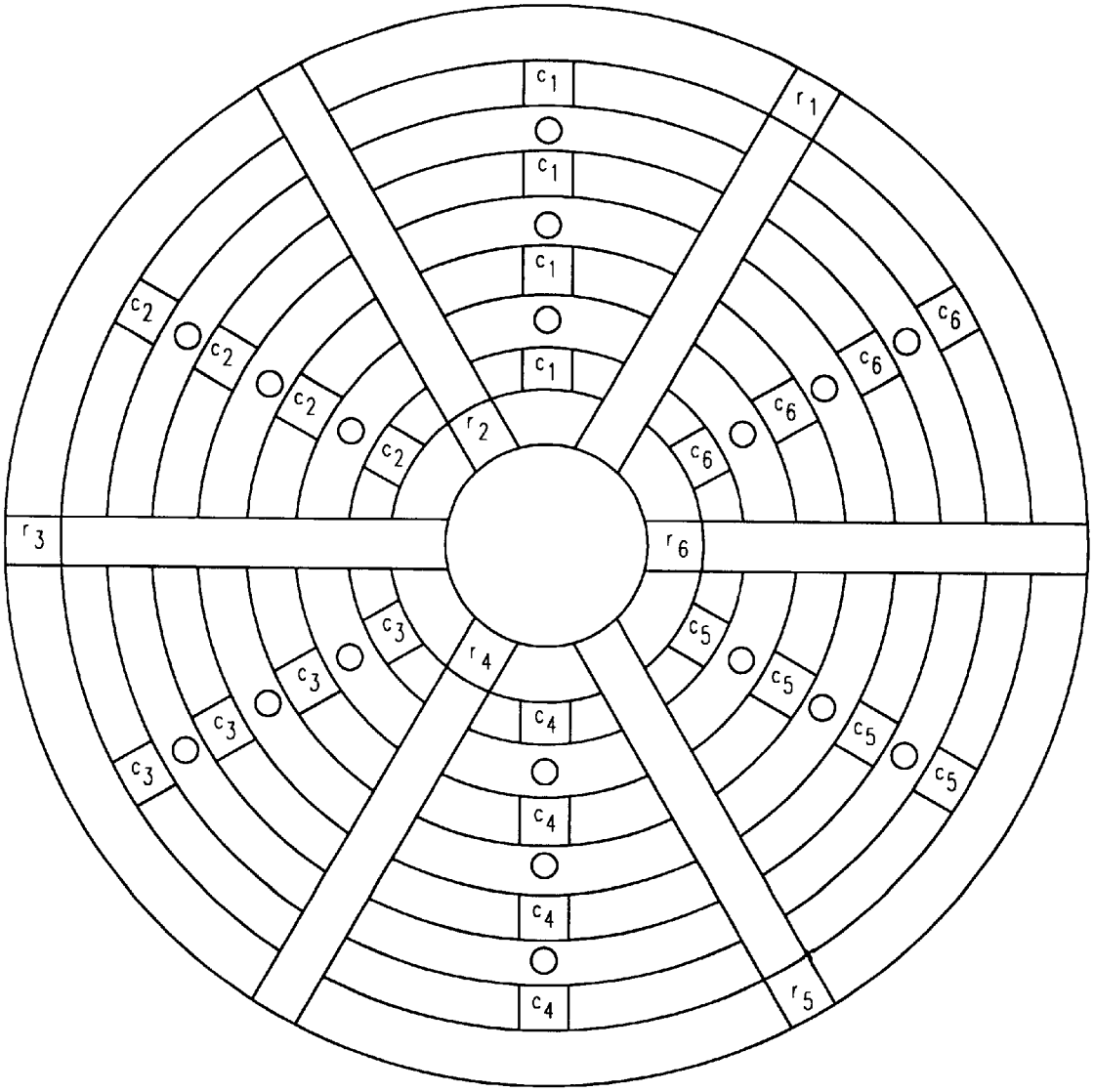
Figures 1, 18B:
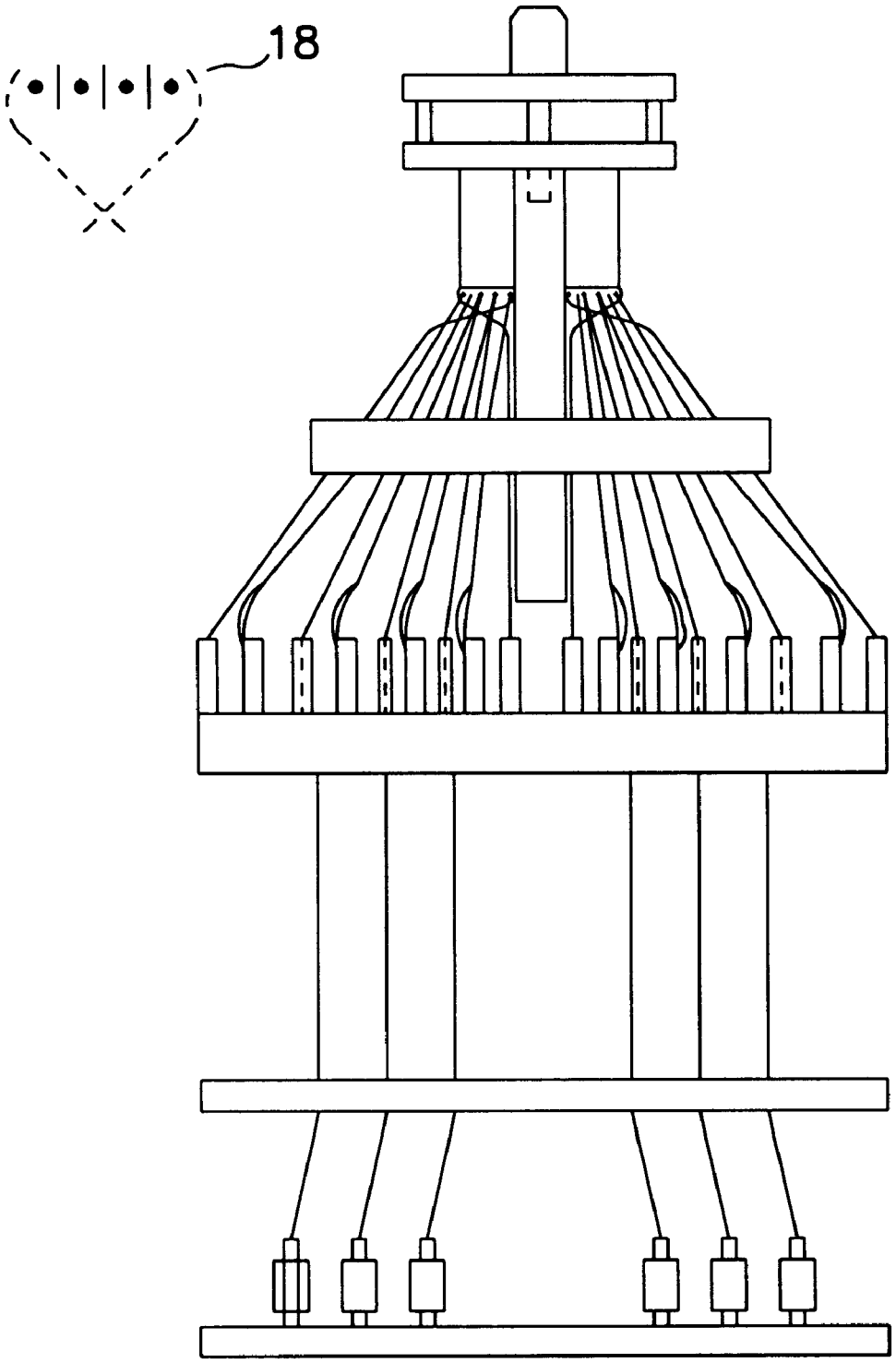
Figures 2, 18B:
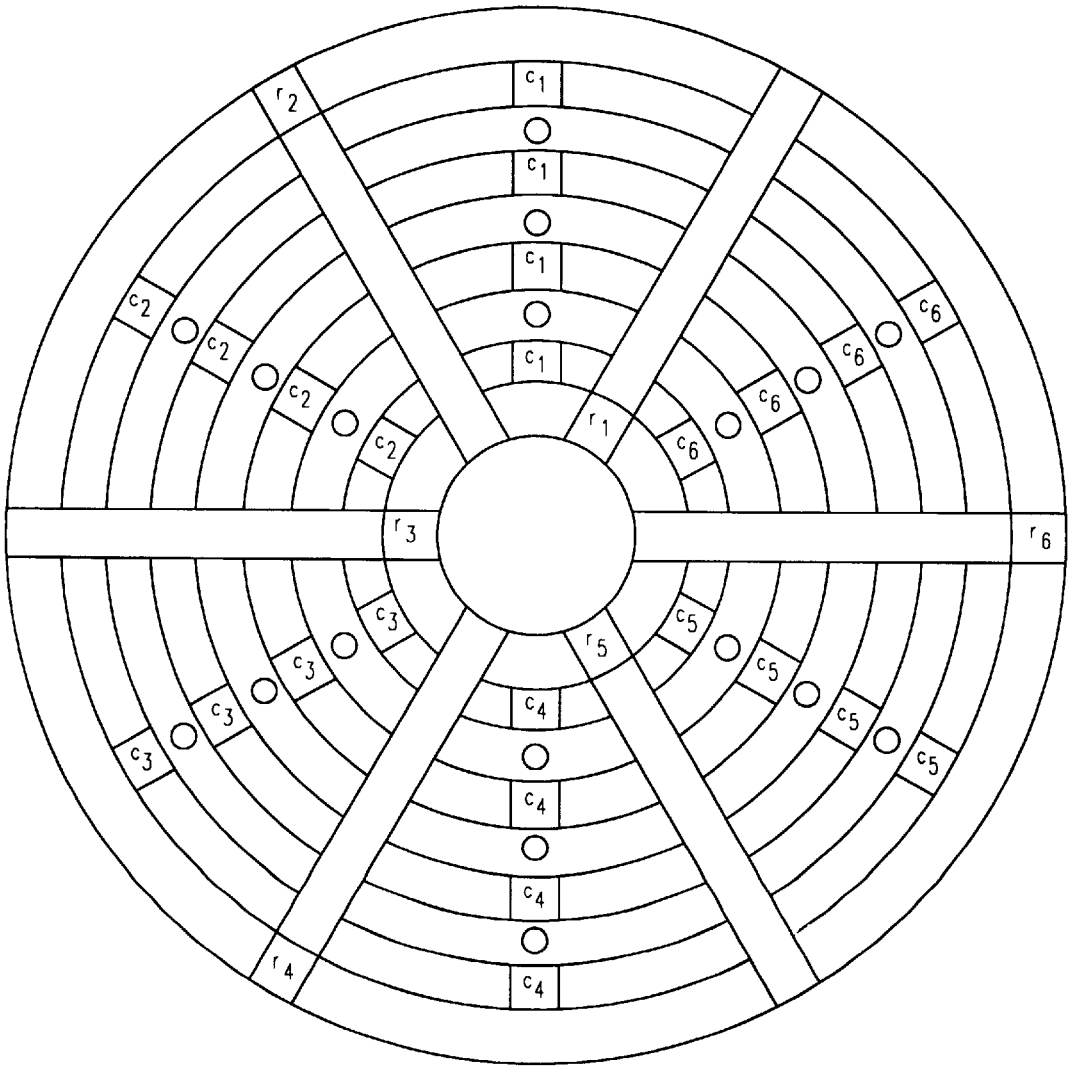
Figures 1, 18C:
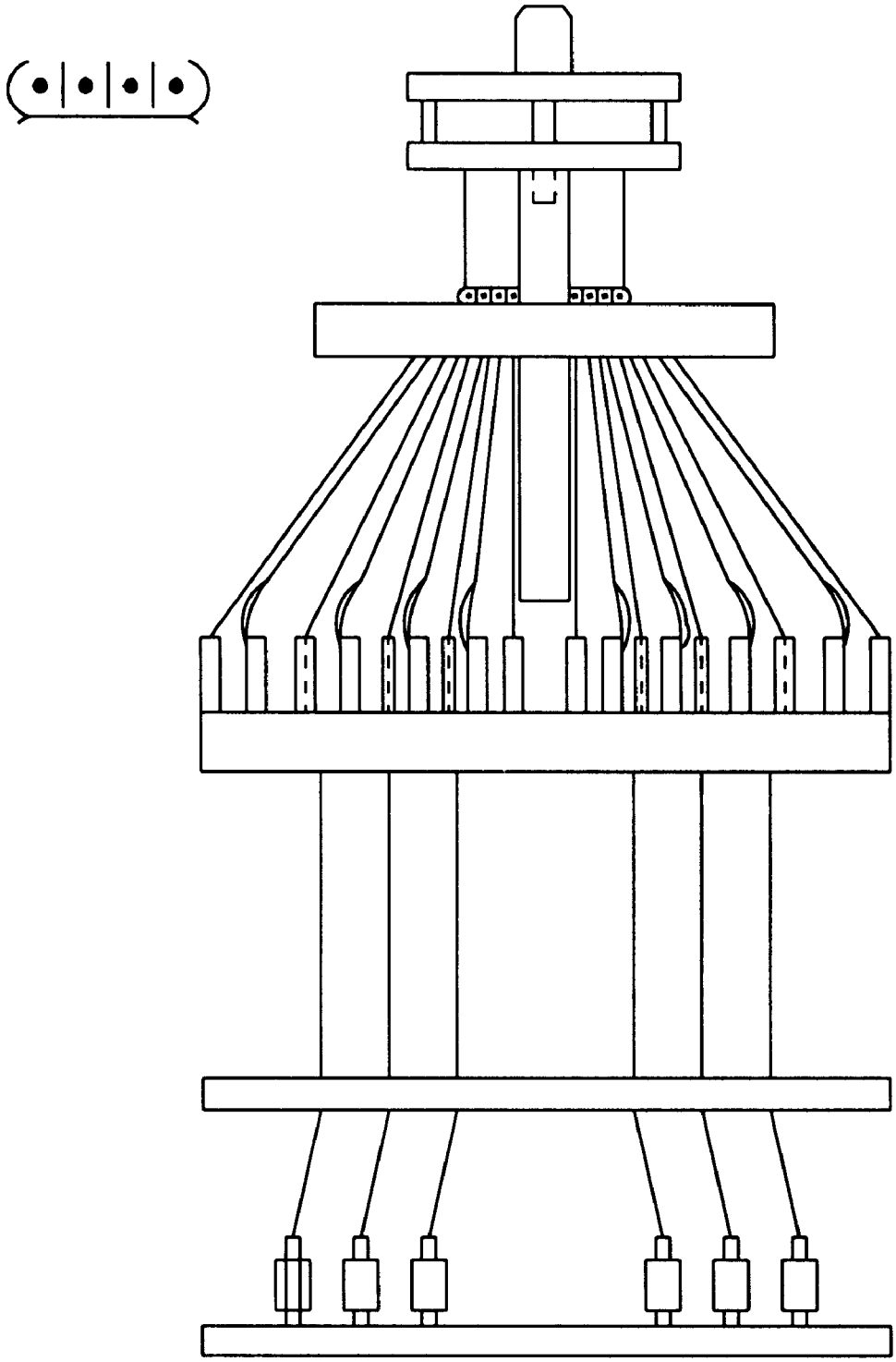
Figures 2, 18C:
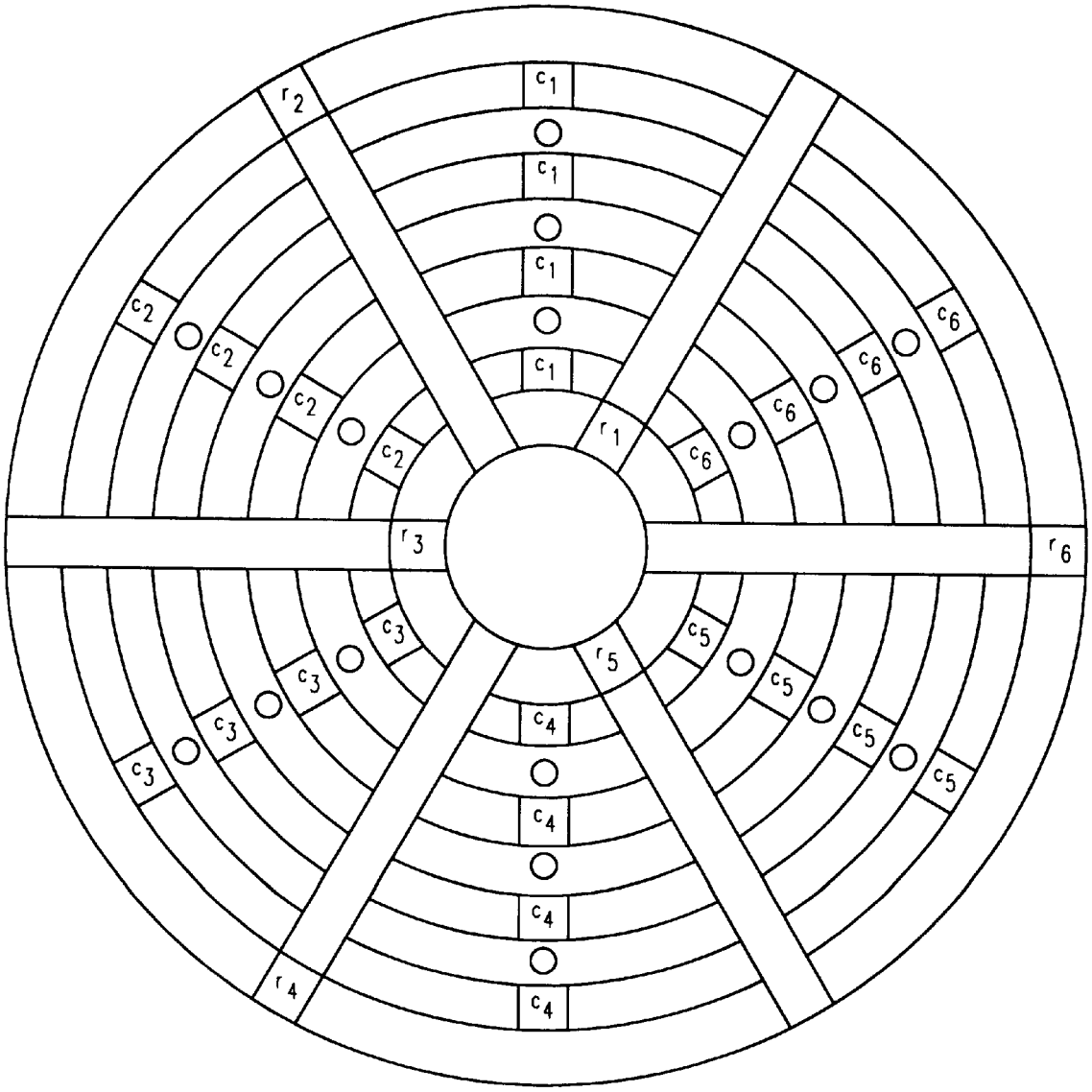
Figures 1, 18D:
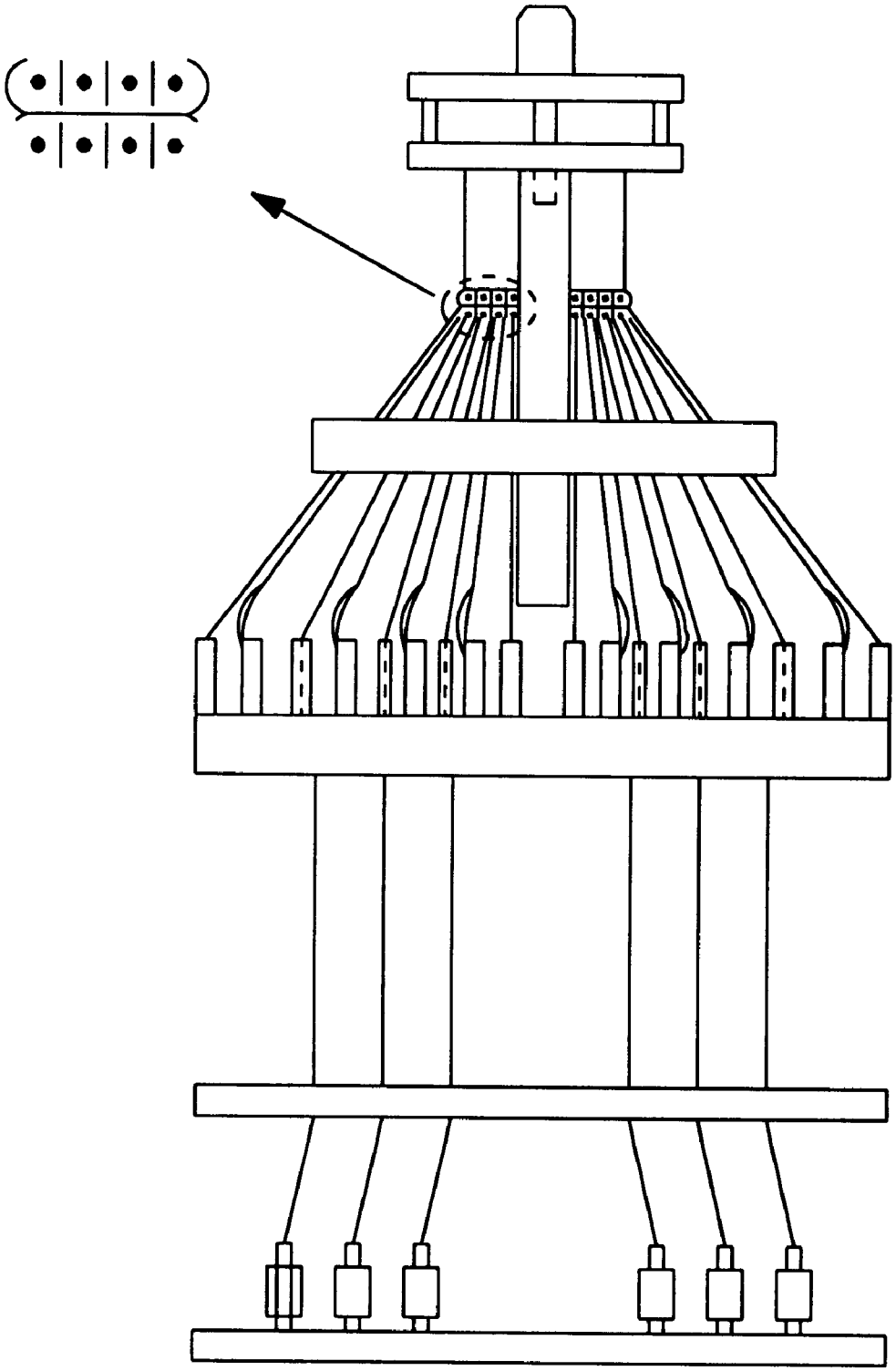
Figures 2, 18D:
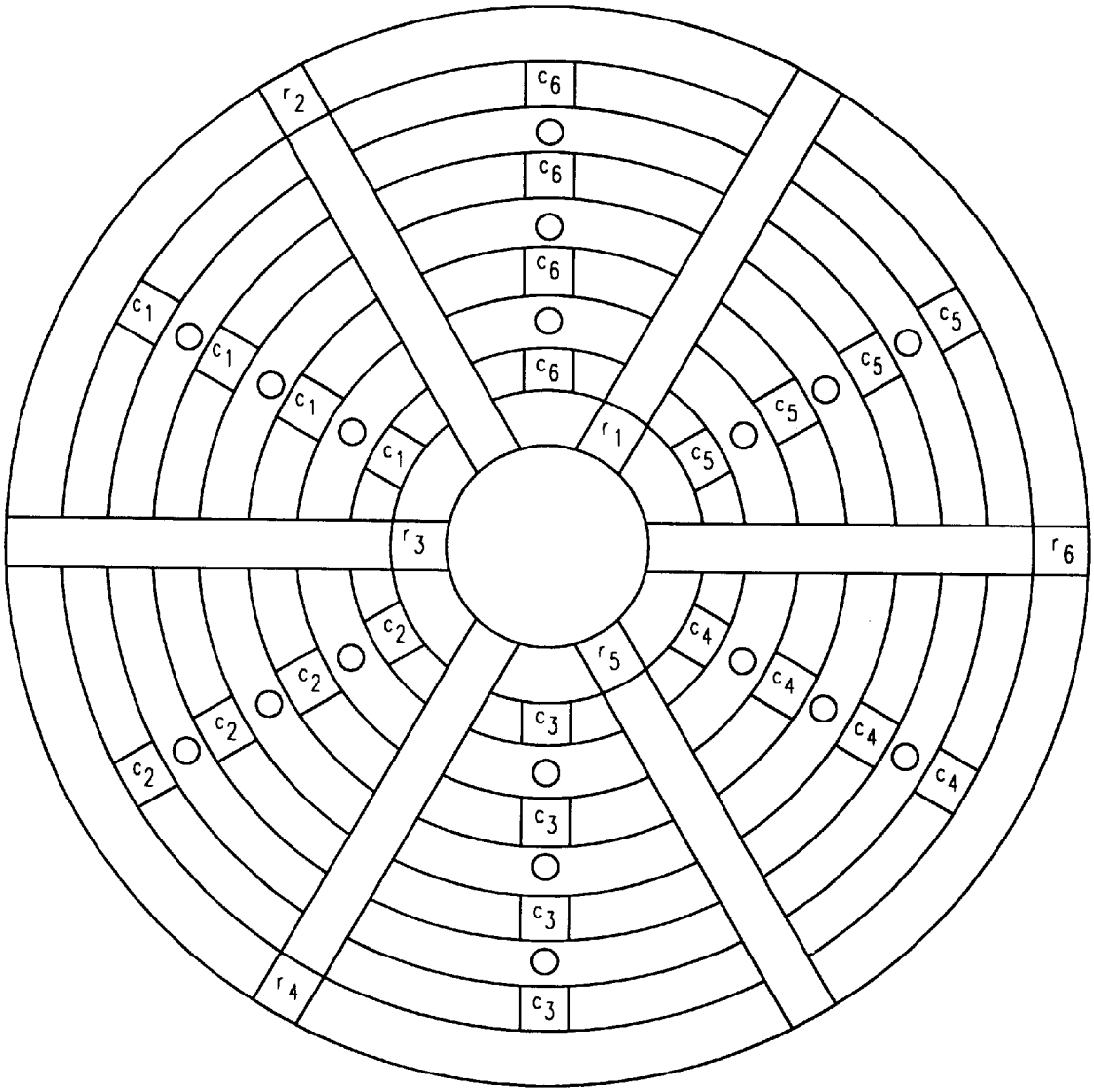
Figures 1, 18E:
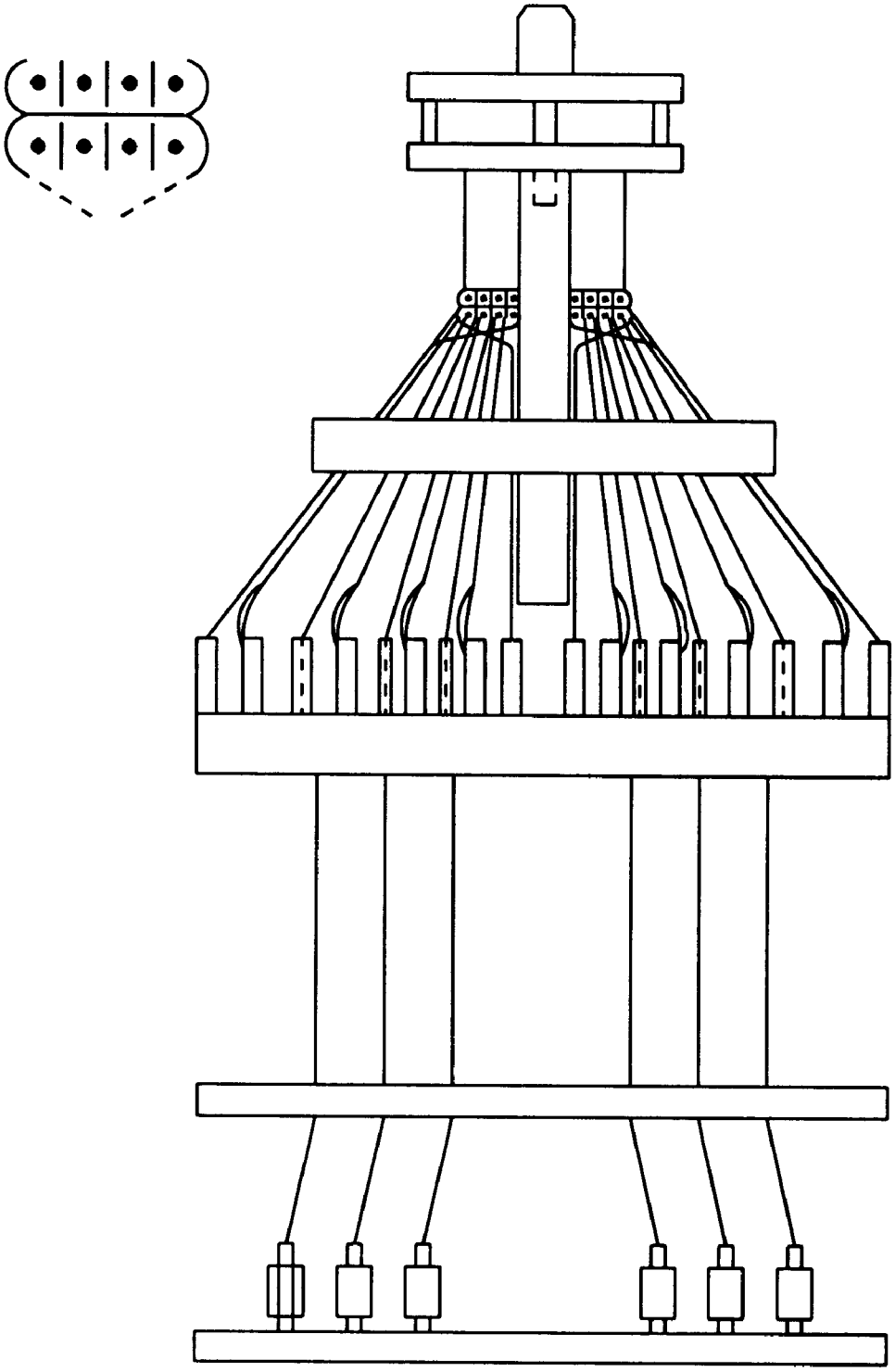
Figures 2, 18E:
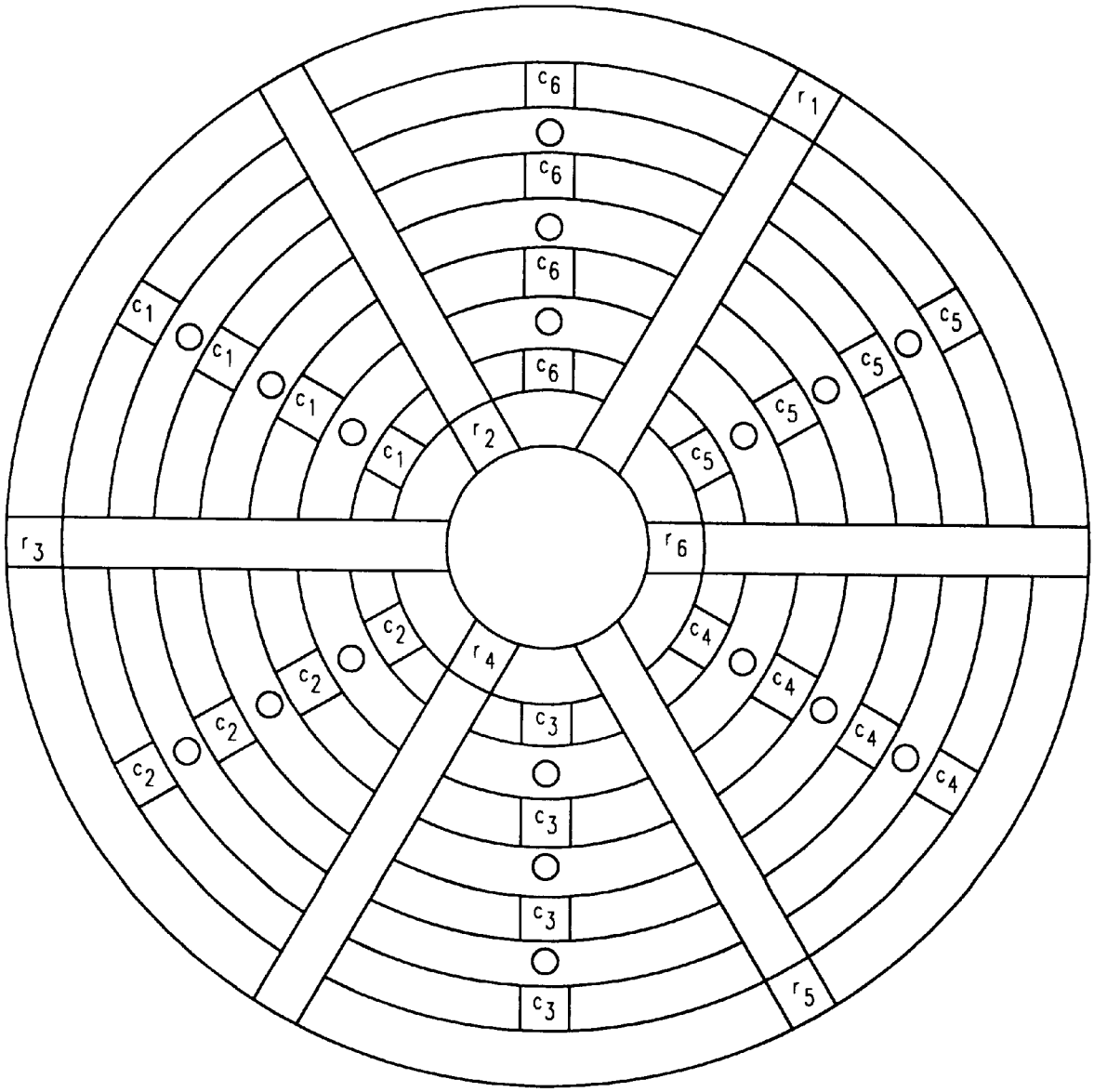
Figures 1, 18F:
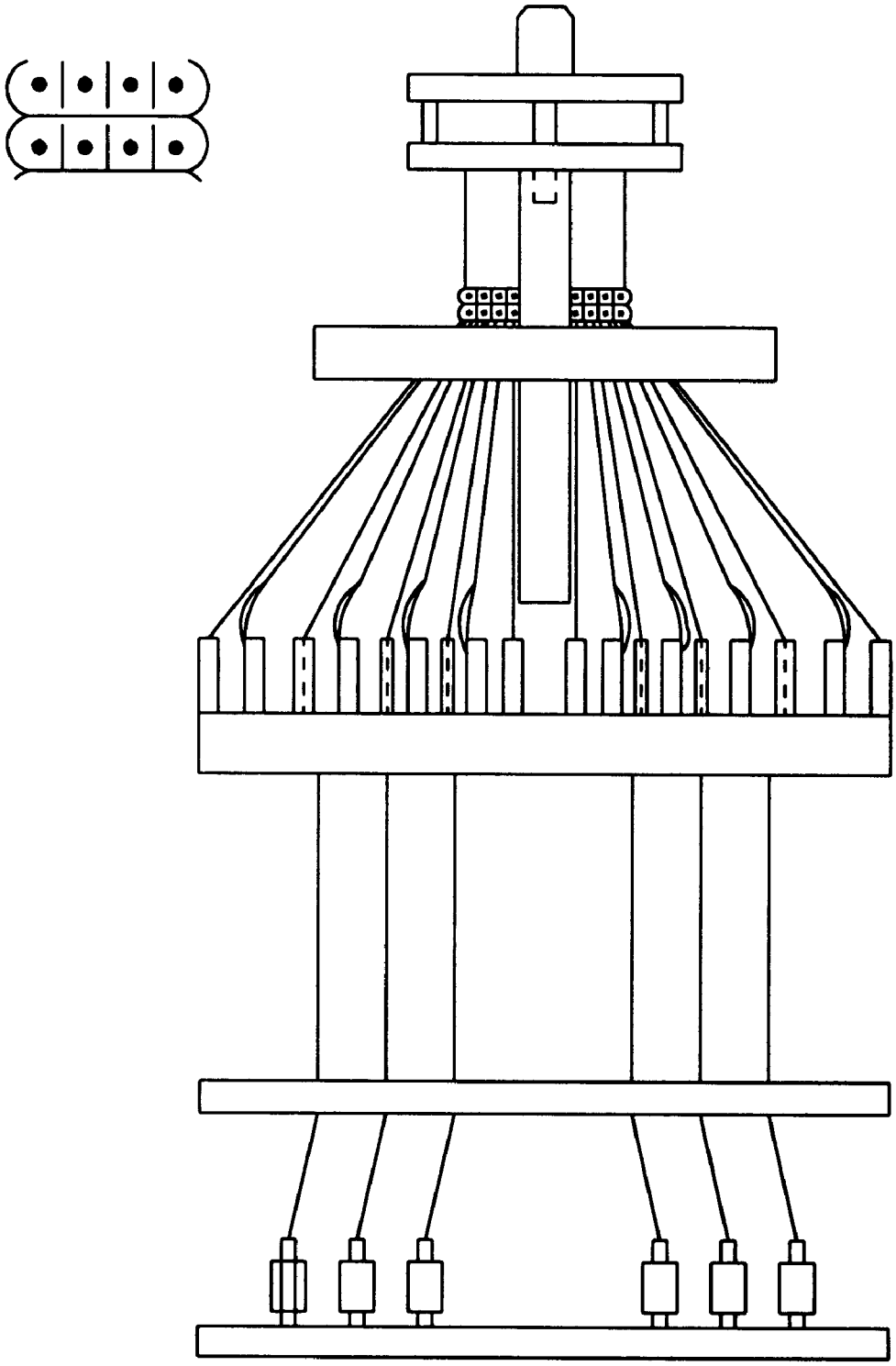
Figures 2, 18F:
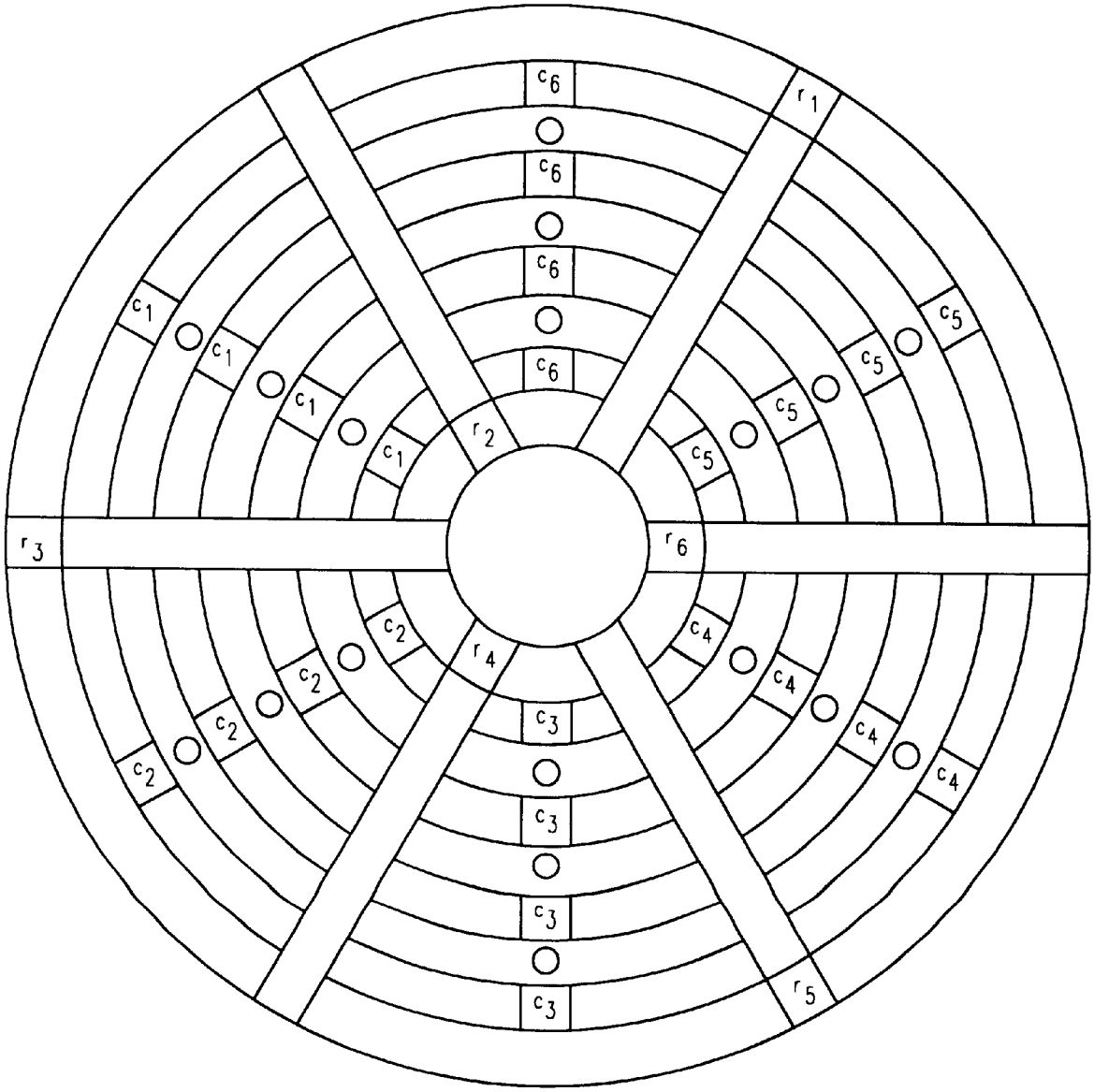
Figure 19:
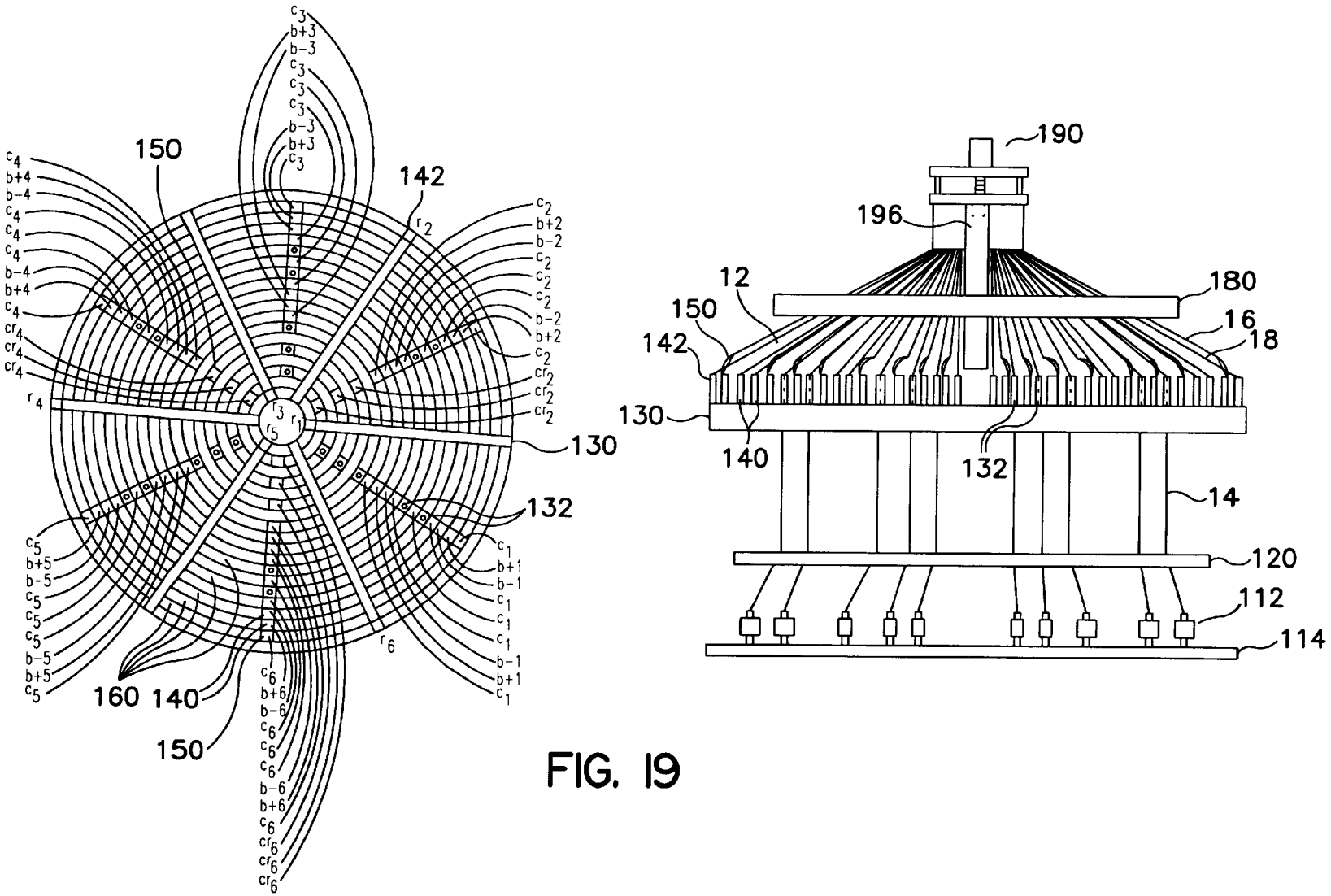
Figure 19A:
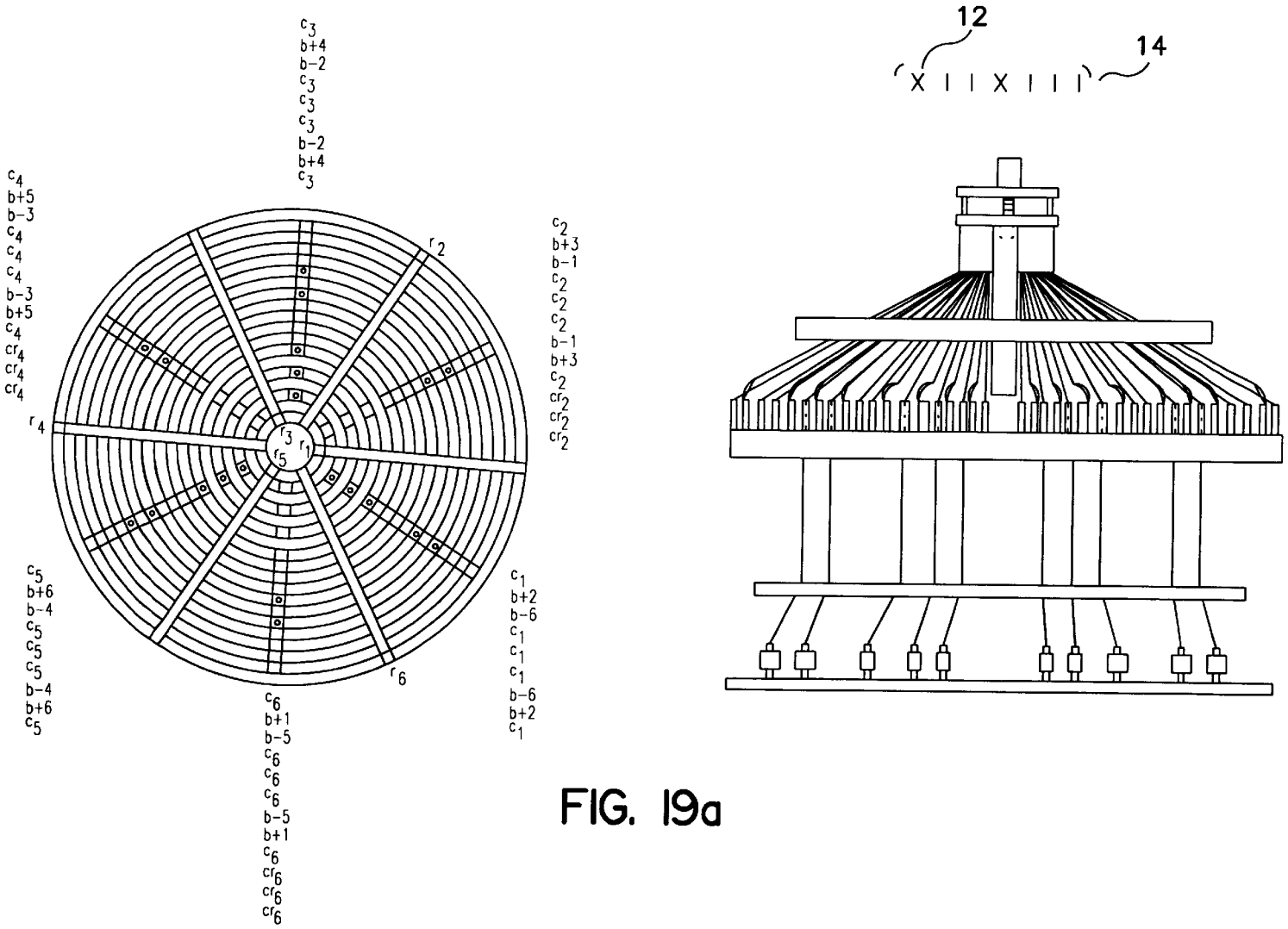
Figure 19B:
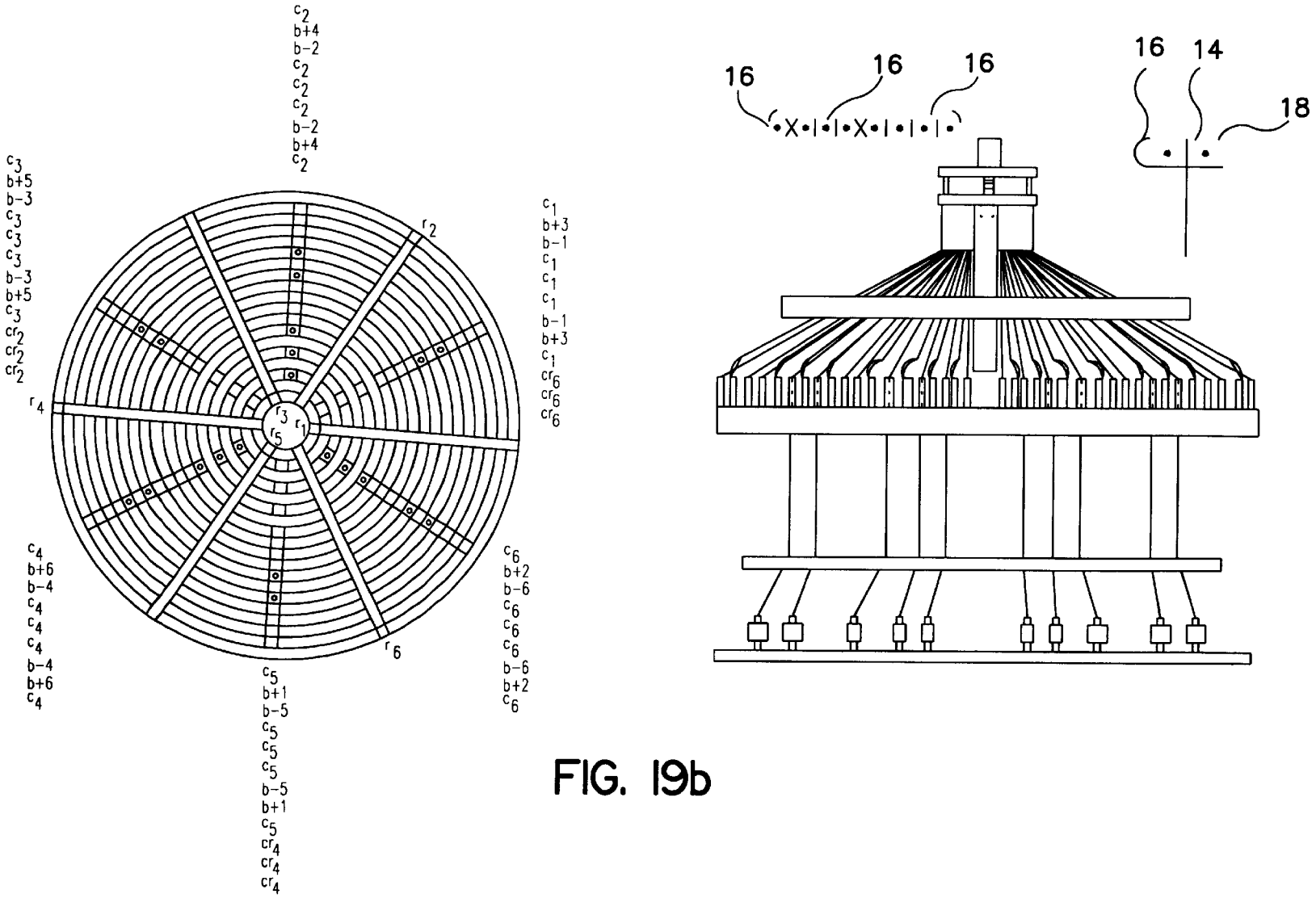
Figure 19C:
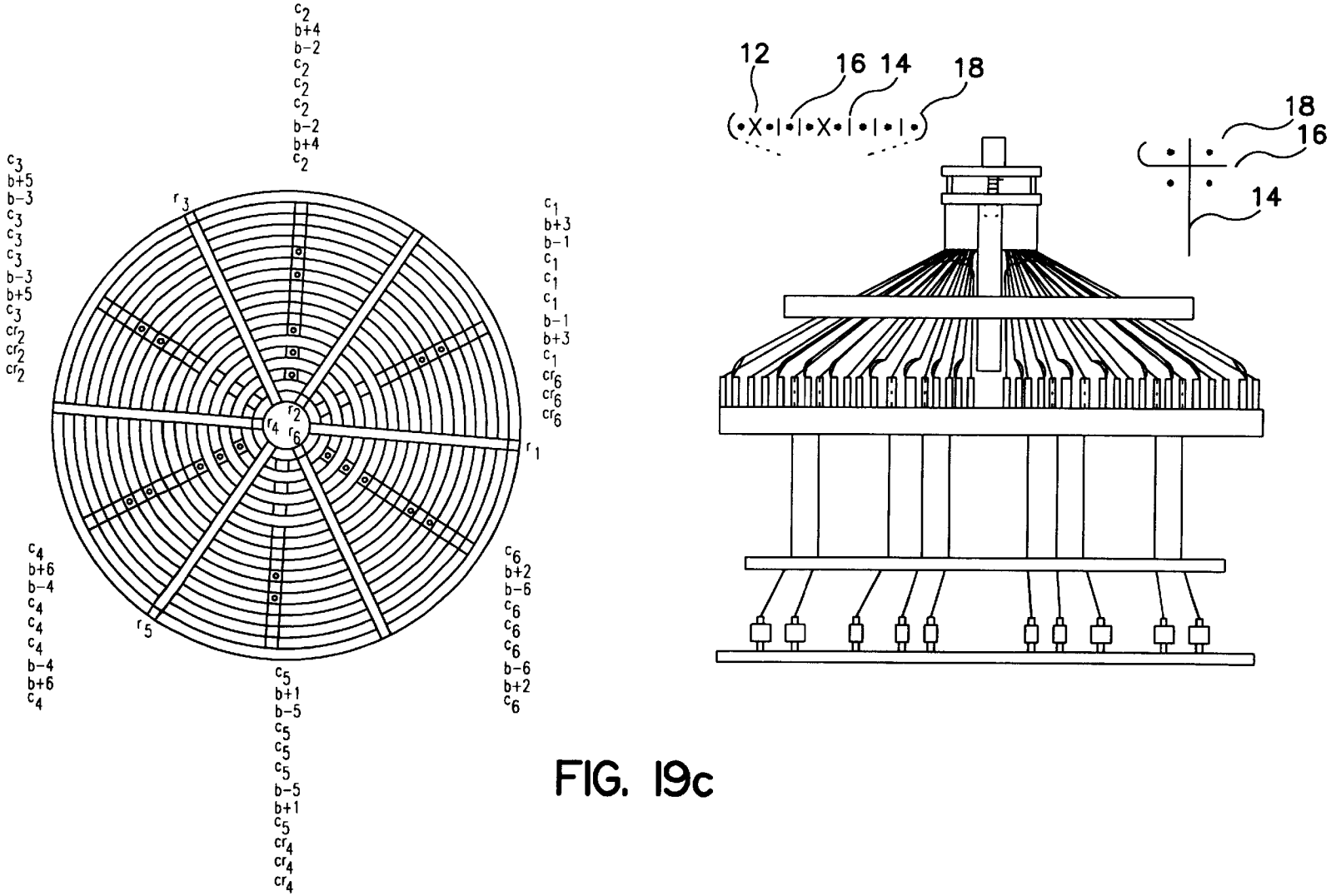
Figure 19D:
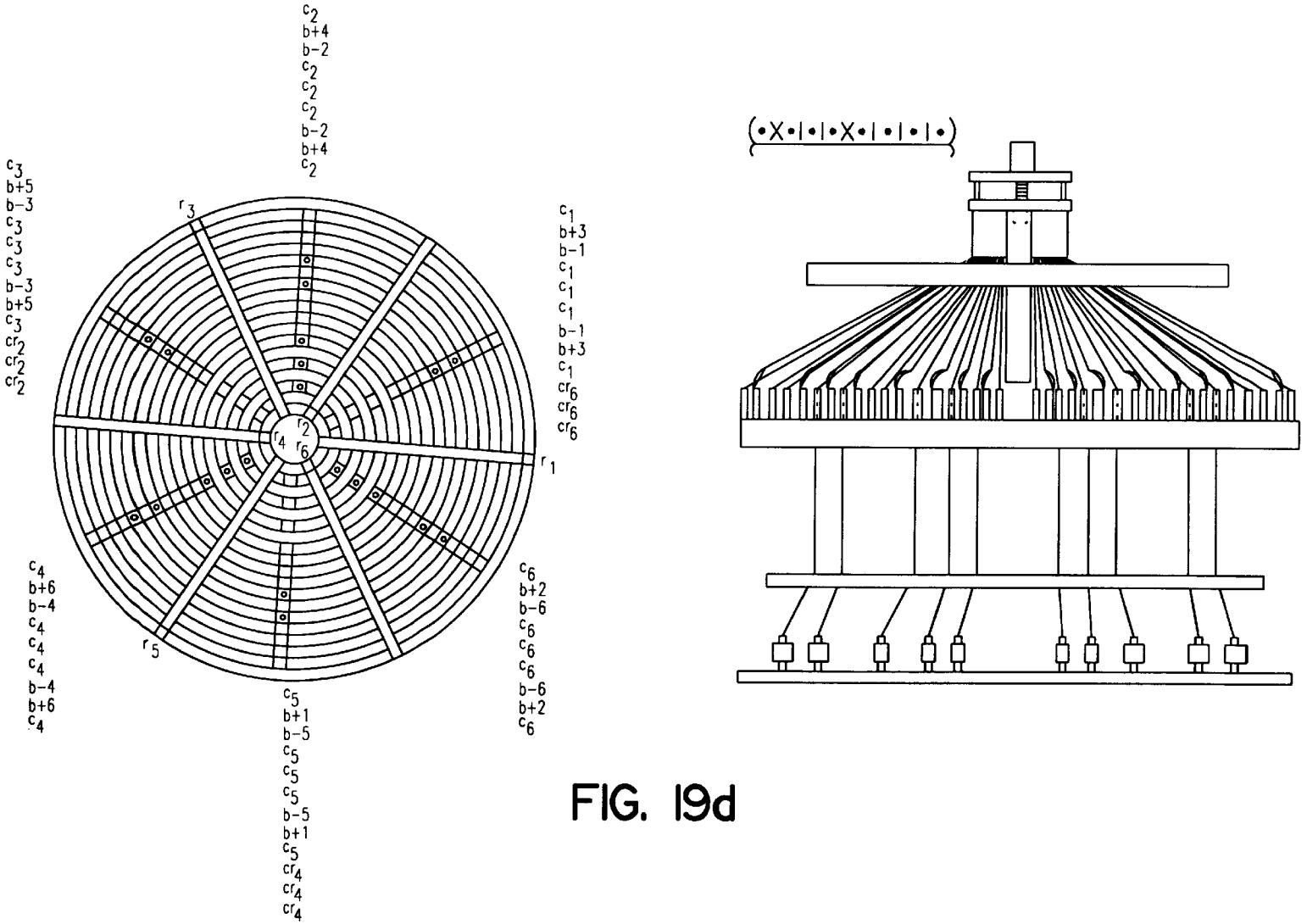
Figure 19E:
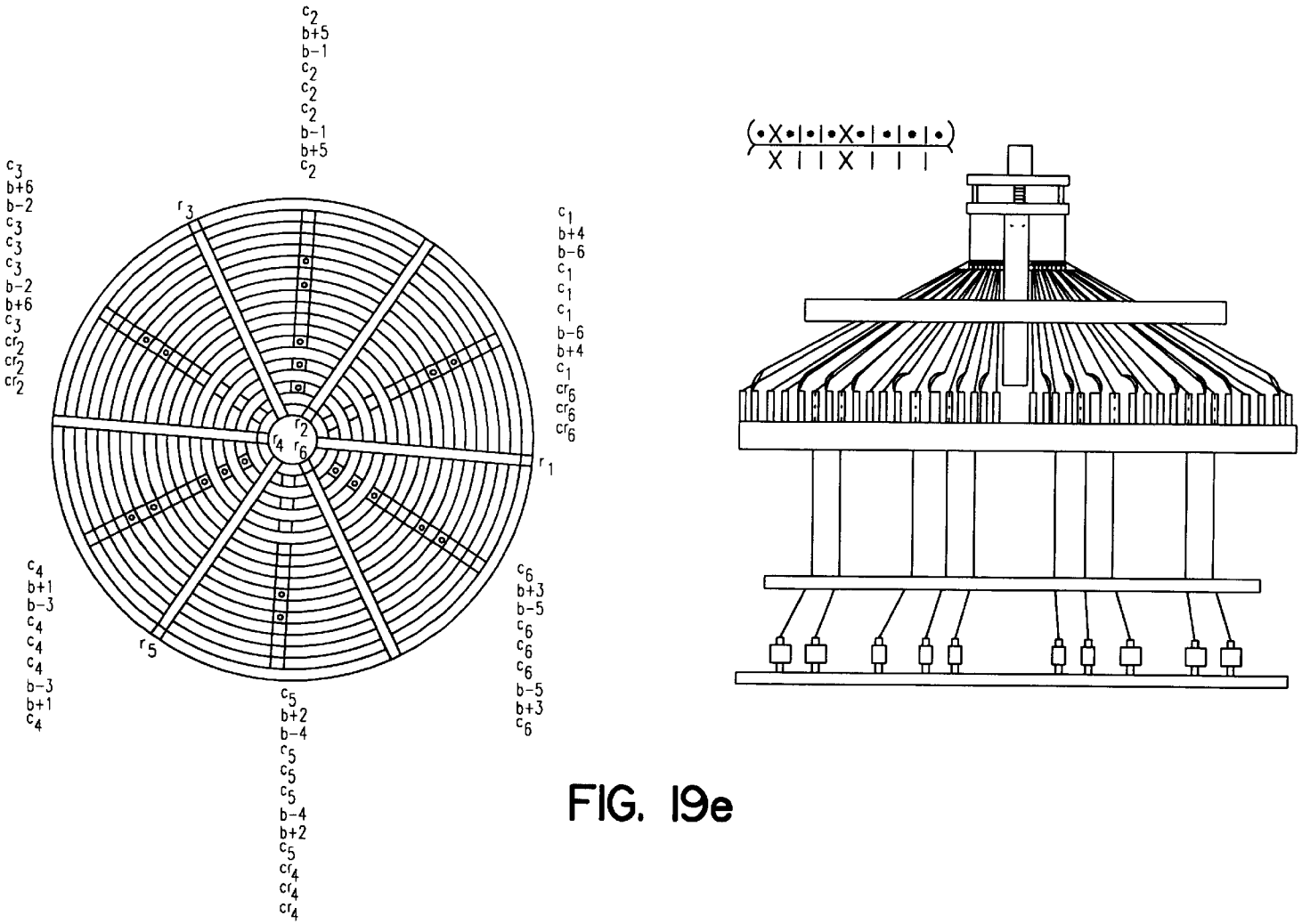
Figure 19F:
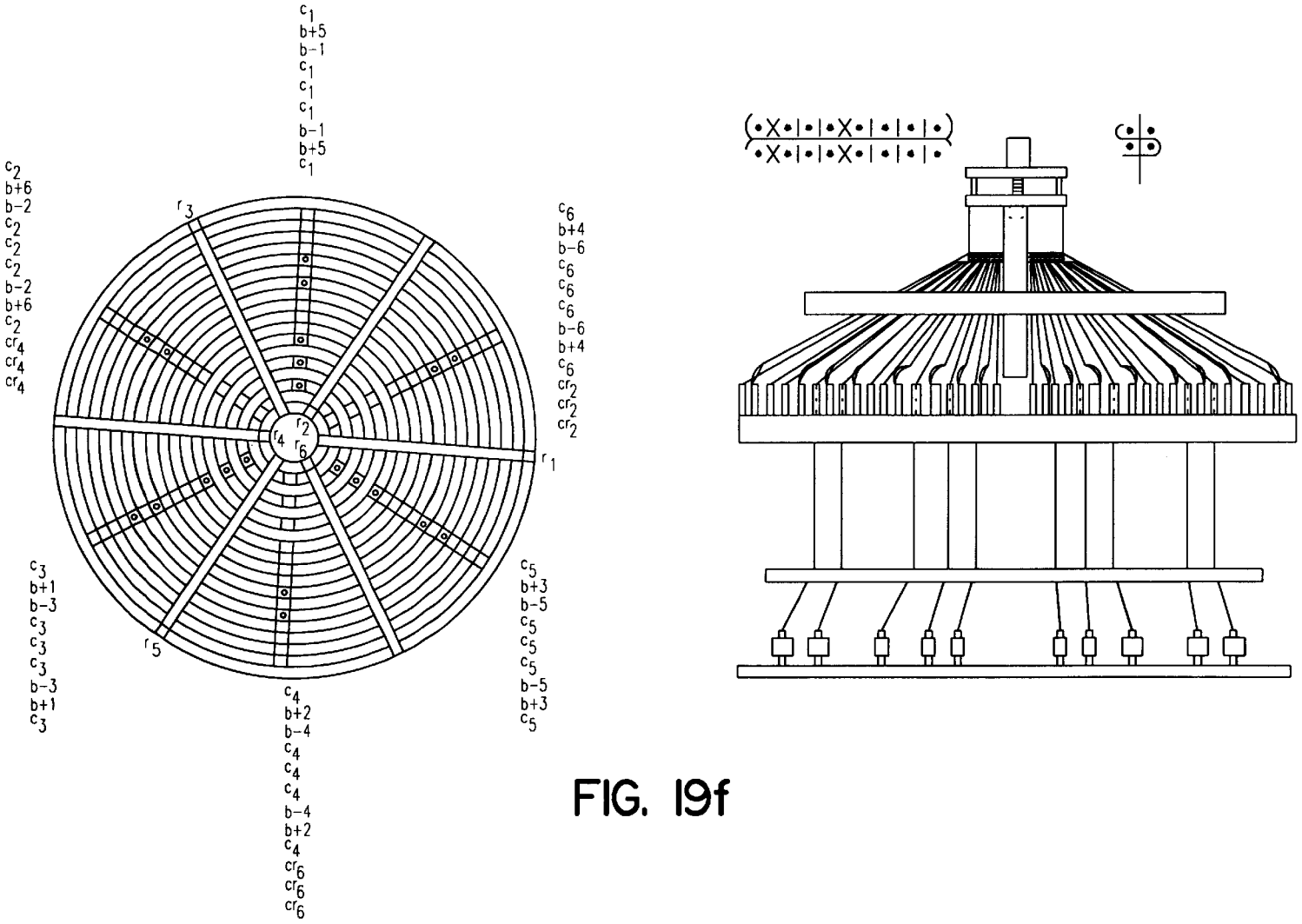
Figure 19G:
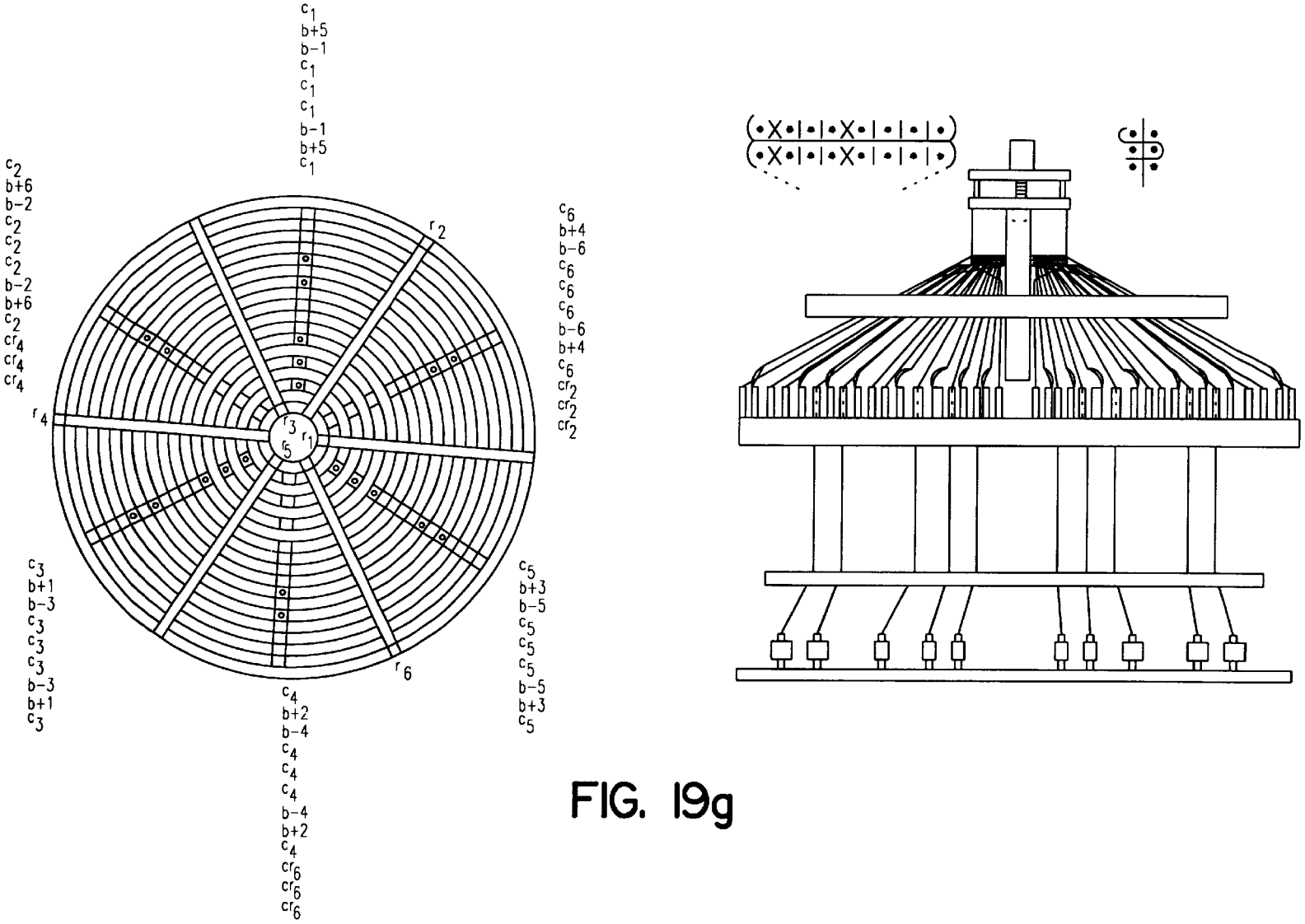
Figure 19H:
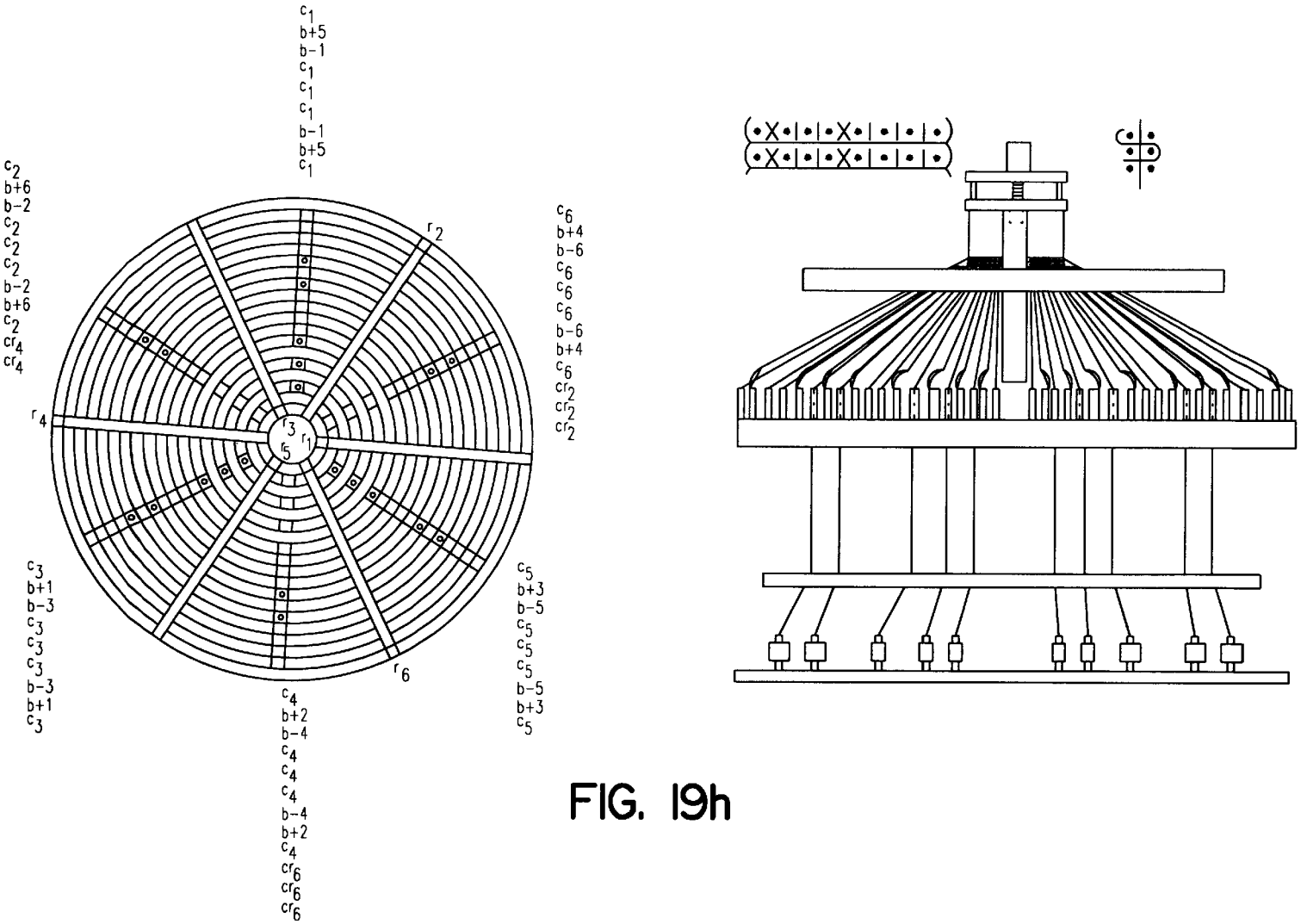

FIG. 14(*a*) illustrates the movement of the +/−bias yarn carrier;

FIG. 14(*b*) illustrates the rotation of the circular yarn carrier;

FIG. 14(*c*) illustrates the movement of the radial yarn carrier;

FIG. 14(*d*) illustrates the beat-up operation of the weaving apparatus;

FIG. 14(*e*) illustrates the movement of the +/−bias yarn carrier;

FIG. 14(*f*) illustrates the rotation of the circular yarn carrier;

FIG. 14(*g*) illustrates the movement of the radial yarn carrier;

FIG. 14(*h*) illustrates the beat-up operation of the weaving apparatus;

FIG. 15 is a schematic view of the starting position of the weaving apparatus of FIG. 9 for producing the preform F1;

FIG. 15(*a*) illustrates the movement of the +/−bias yarn carrier;

FIG. 15(*b*) illustrates the rotation of the circular yarn carrier;

FIG. 15(*c*) illustrates the movement of the radial yarn carrier;

FIG. 15(*d*) illustrates the beat-operation of the weaving apparatus;

FIG. 15(*e*) illustrates the movement of the +/−bias yarn carrier;

FIG. 15(*f*) illustrates the rotation of the circular yarn carrier;

FIG. 15(*g*) illustrates the movement of the radial yarn carrier;

FIG. 15(*h*) illustrates the beat-up operation of the weaving apparatus;

FIG. 16 is a schematic view of the starting position of the weaving apparatus of FIG. 9 for producing the preform F2;

FIG. 16(*a*) illustrates the movement of the +/−bias yarn carrier;

FIG. 16(*b*) illustrates the rotation of the circular yarn carrier;

FIG. 16(*c*) illustrates the movement of the radial yarn carrier;

FIG. 16(*d*) illustrates the beat-up operation of the weaving apparatus;

FIG. 16(*e*) illustrates the movement of the +/−bias yarn carrier;

FIG. 16(*f*) illustrates the rotation of the circular yarn carrier;

FIG. 16(*g*) illustrates the movement of the radial yarn carrier;

FIG. 16(*h*) illustrates the beat-up operation of the weaving apparatus;

FIG. 17 is a schematic view of the starting position of the weaving apparatus of FIG. 9 for producing the preform F2*a*;

FIG. 17(*a*) illustrates the movement of the +bias yarn carrier;

FIG. 17(*b*) illustrates the rotation of the circular yarn carrier;

FIG. 17(*c*) illustrates the movement of the radial yarn carrier;

FIG. 17(*d*) illustrates the beat-up operation of the weaving apparatus;

FIG. 17(*e*) illustrates the movement of the +bias yarn carrier;

FIG. 17(*f*) illustrates the rotation of the circular yarn carrier;

FIG. 17(*g*) illustrates the movement of the radial yarn carrier;

FIG. 17(*h*) illustrates the beat-up operation of the weaving apparatus;

FIG. 18 is a schematic view of the starting position of the weaving apparatus of FIG. 9 for producing the preform F4;

FIG. 18(*a*) illustrates the rotation of the circular yarn carrier;

FIG. 18(*b*) illustrates the movement of the radial yarn carrier;

FIG. 18(*c*) illustrates the beat-up operation of the weaving apparatus;

FIG. 18(*d*) illustrates the rotation of the circular yarn carrier;

FIG. 18(*e*) illustrates the movement of the radial yarn carrier;

FIG. 18(*f*) illustrates the beat-up operation of-the weaving apparatus;

FIG. 19 is a schematic view of the starting position of the weaving apparatus for producing the preform F5 wherein o means axial yarn;

r means radial yarn;

c means circumferential yarn for circular basement;

cr means circumferential yarn for curved section; and b+/−means +/−bias yarns.

Figure 20:
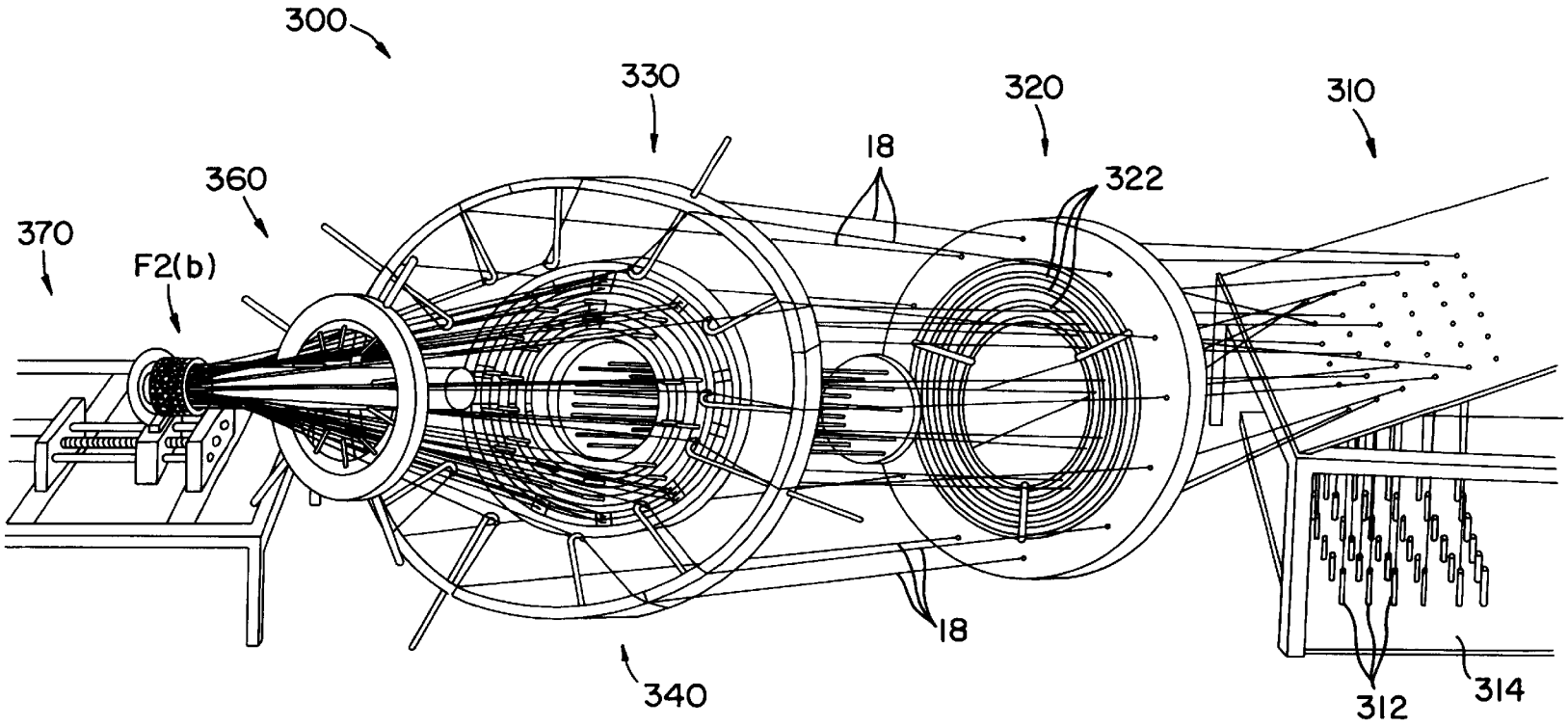
Figure 21:
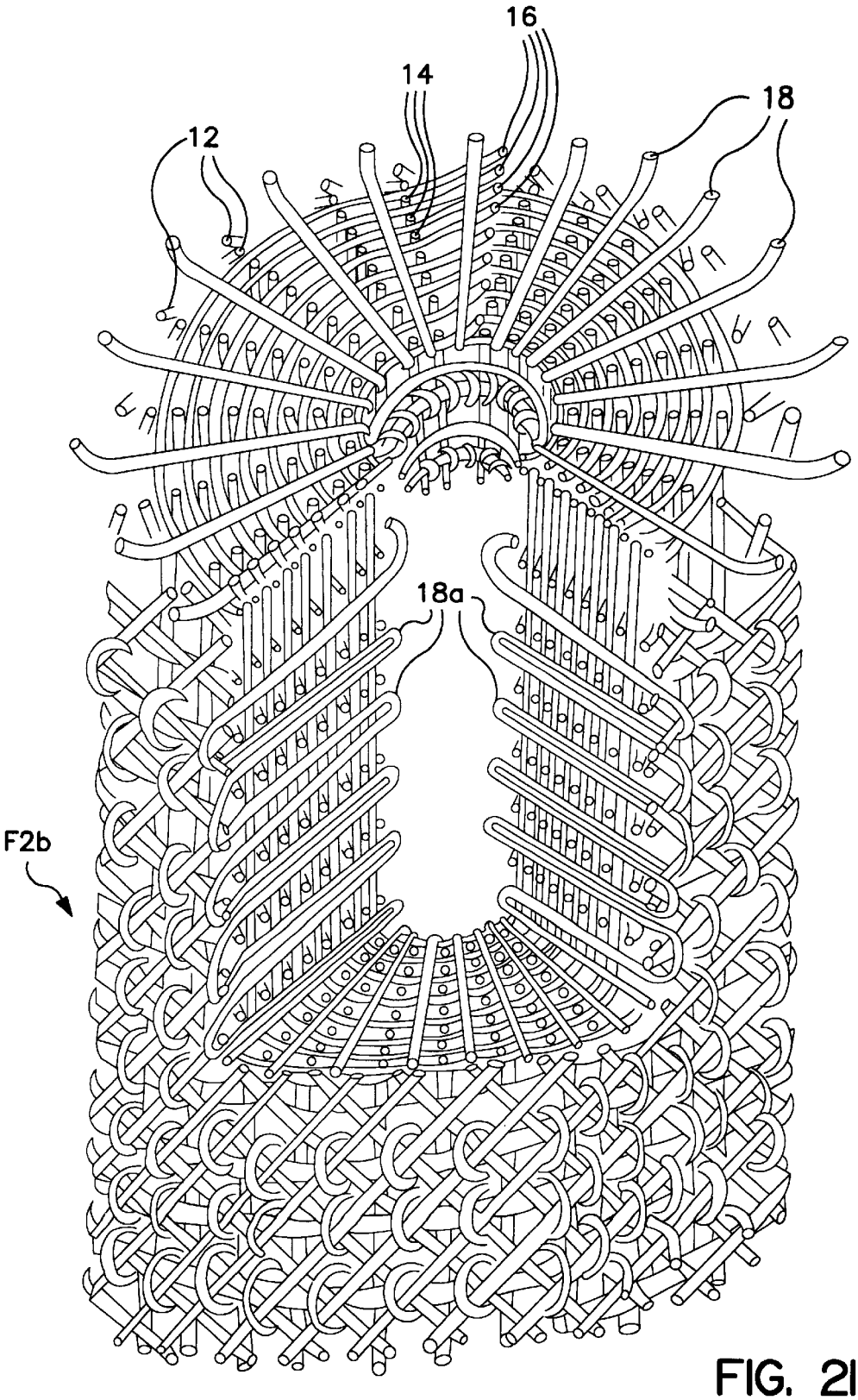
Figure 22:
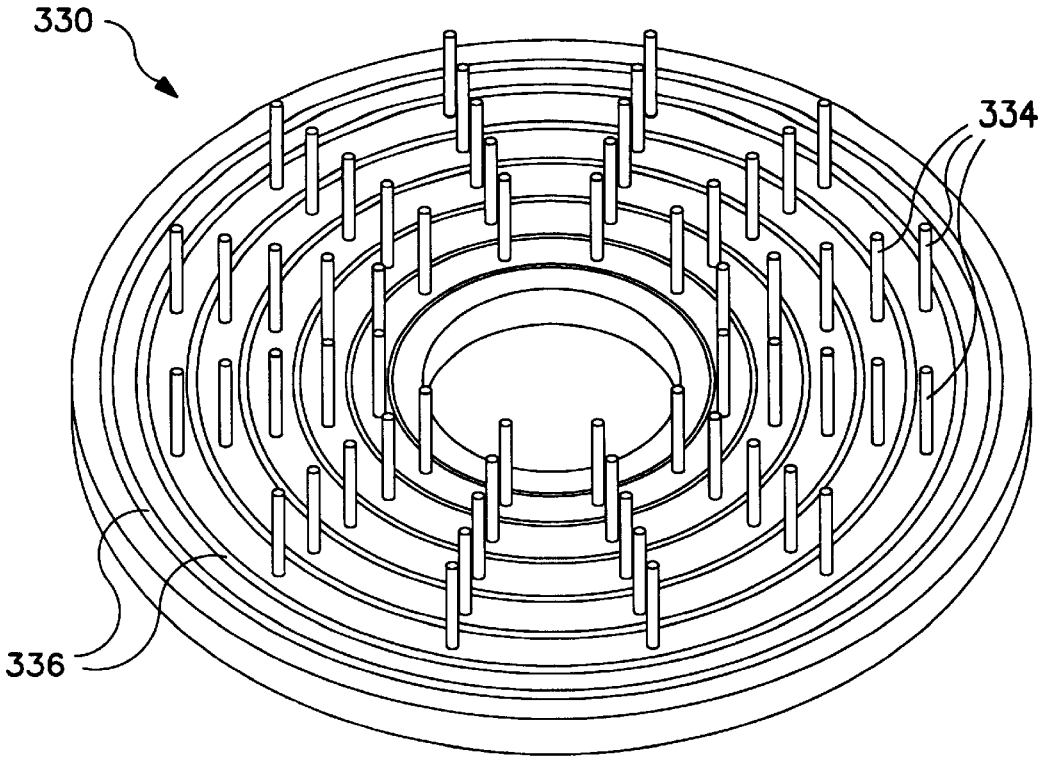
Figure 23:
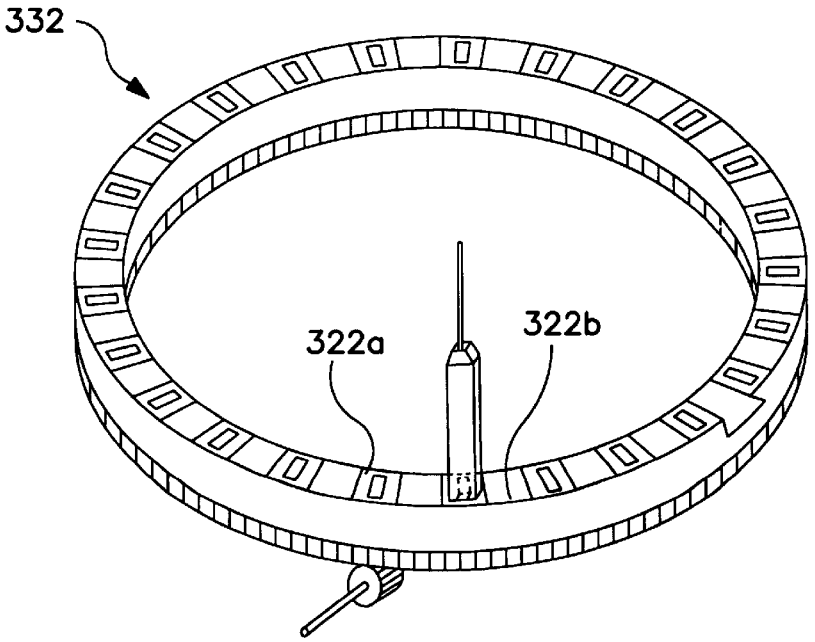
Figure 24:
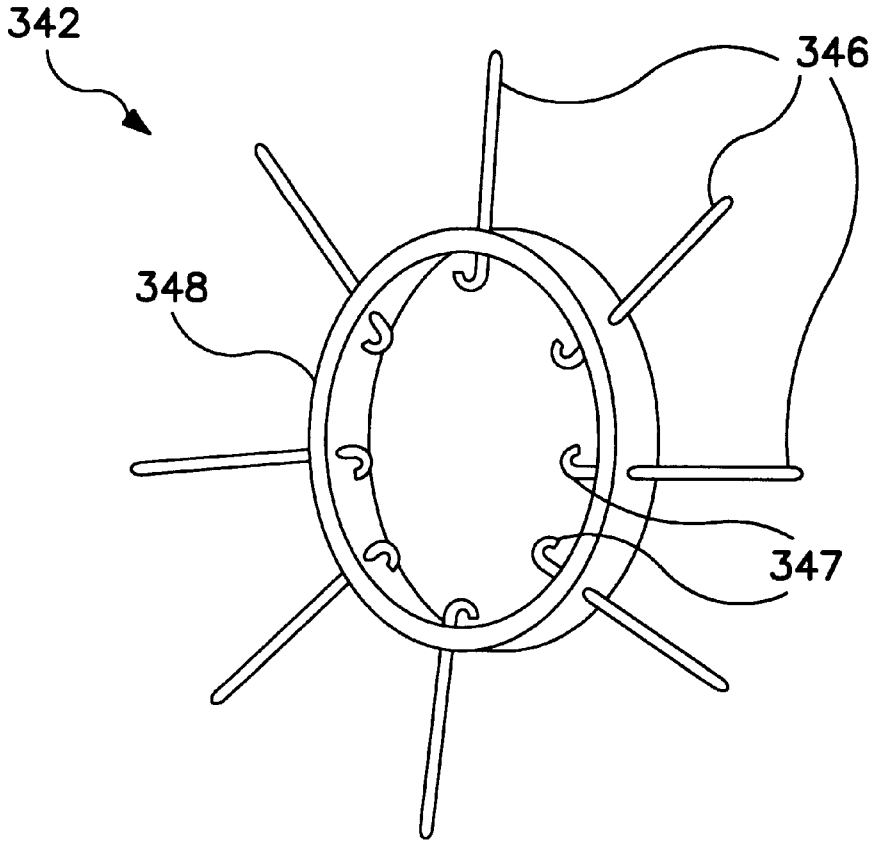
Figure 24A:
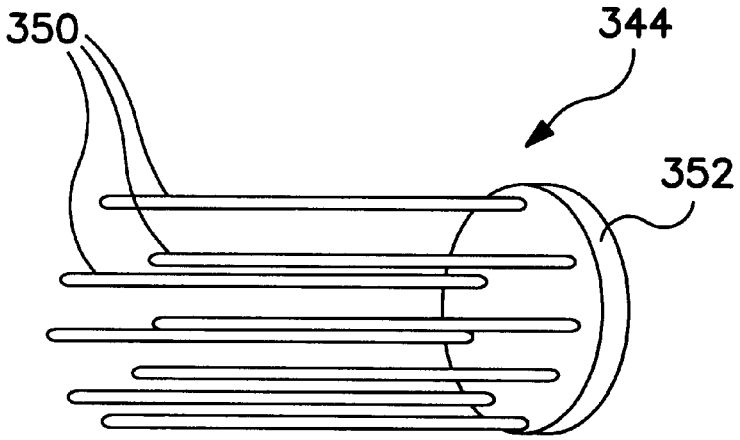
Figure 25:
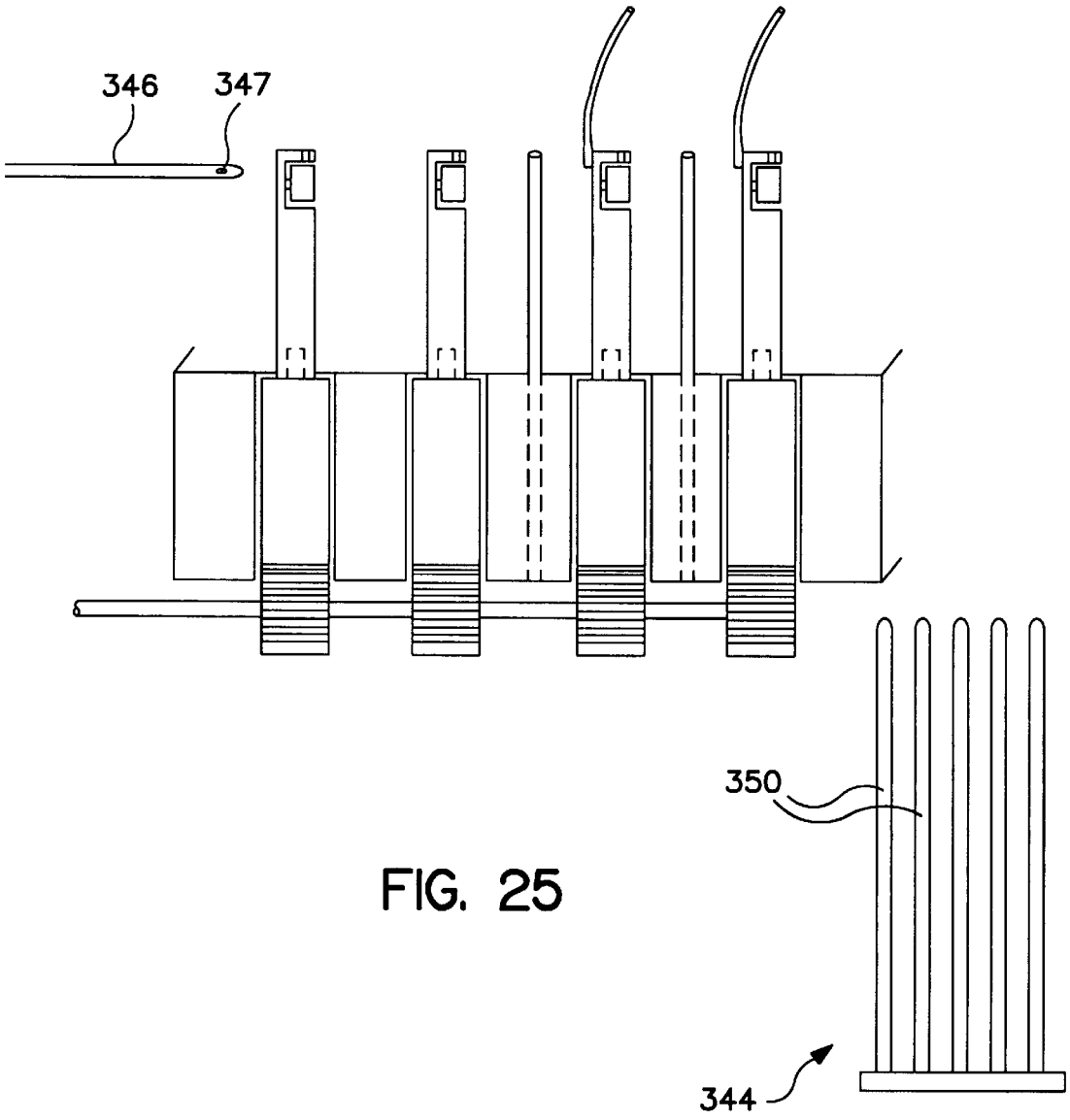
Figure 26:
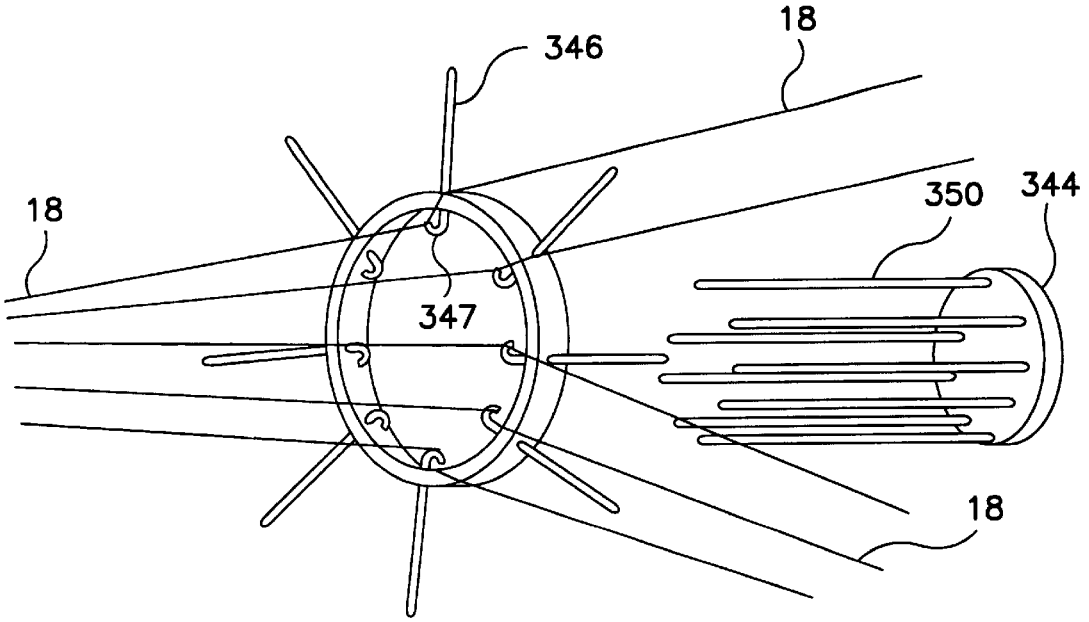
Figure 26A:
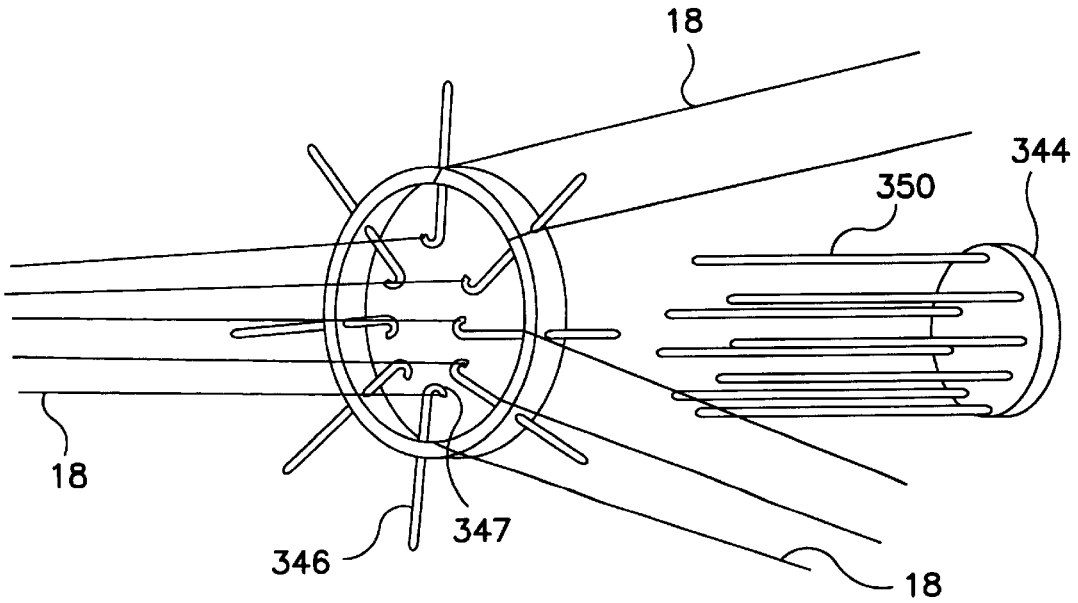
Figure 26B:
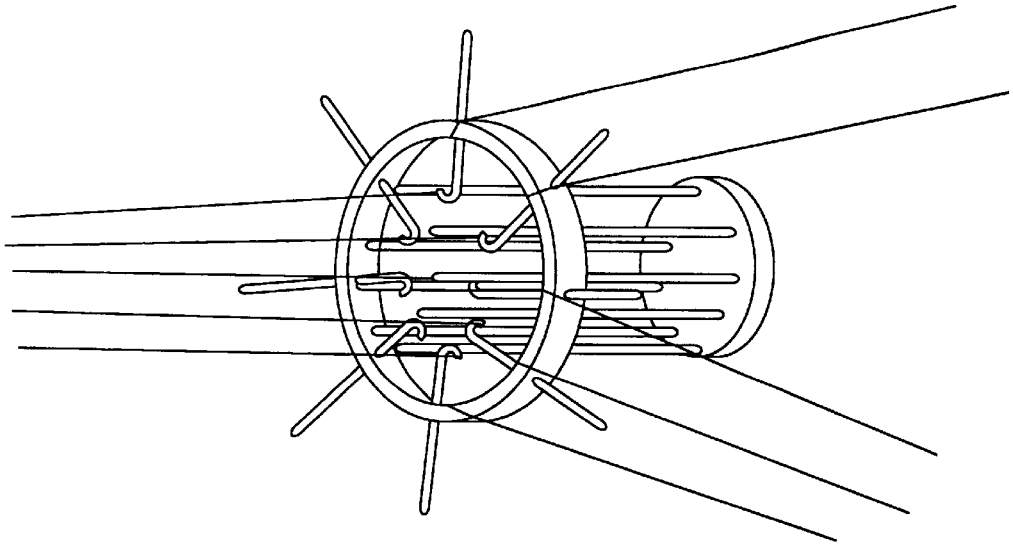
Figure 26C:
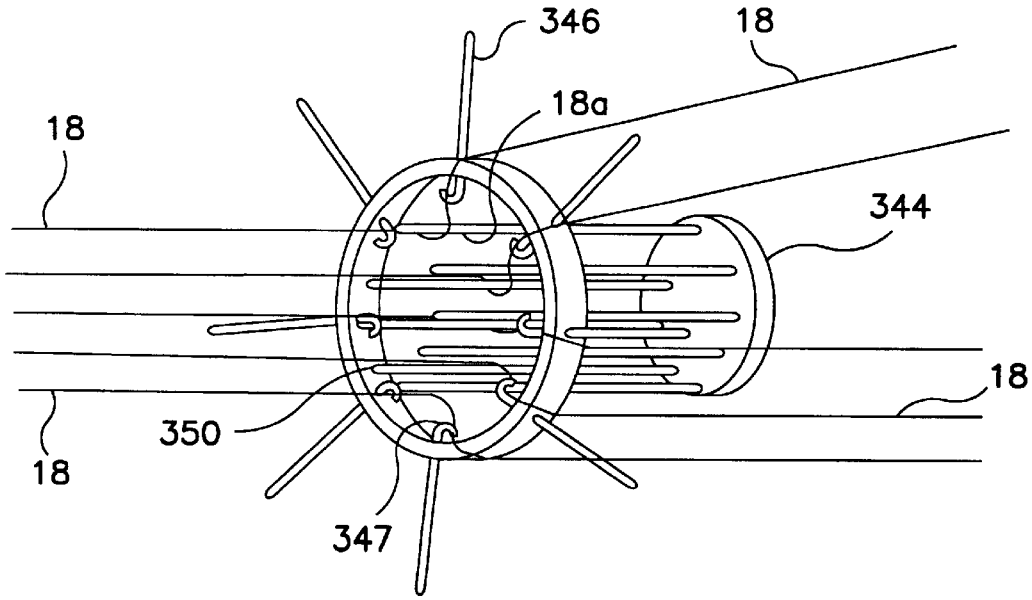

FIG. 19(*a*) illustrates the movement of the +/−bias yarn carrier;

FIG. 19(*b*) illustrates the rotation of the circular yarn carrier for both the basement and curved section;

FIG. 19(*c*) illustrates the movement of the radial yarn carrier;

FIG. 19(*d*) illustrates the beat-up operation of the weaving apparatus;

FIG. 19(*e*) illustrates the movement of the +/−bias yarn carrier;

FIG. 19(*f*) illustrates the rotation of the circumferential yarn carrier for the circular basement toward the counter-clockwise direction and rotation of circumferential yarn carrier for curved section side toward the clockwise direction;

FIG. 19(*g*) illustrates the movement of the radial yarn carrier;

FIG. 19(*h*) illustrates the beat-up operation of the weaving apparatus;

FIG. 20 is a schematic perspective view of a second embodiment of the three-dimensional multiaxial circular weaving apparatus of the invention;

FIG. 21 is a perspective partial view of the three-dimensional multiaxial woven fabric constructed as a preform (F2*b*) produced by the second embodiment of the weaving apparatus;

FIG. 22 is a schematic perspective view of the machine bed according to the second embodiment of the weaving apparatus;

FIG. 23 is a schematic perspective view of the circular ring for the +/−bias yarn carriers and the circumferential yarn carriers of the second embodiment of the weaving apparatus;

FIG. 24 is a schematic perspective view of the needle assembly of the weaving apparatus;

FIG. 24(*a*) is a schematic perspective view of the rod assembly of the weaving apparatus;

FIG. 25 is a schematic cross-sectional view of the machine bed with the needle-rod assembly of the weaving apparatus;

FIG. 26 is a schematic view of the starting position of the needle-rod assembly according to the second embodiment of the weaving apparatus;

FIG. 26(*a*) is a schematic view of the inwardly radial movement of the needles according to the second embodiment of the weaving apparatus;

FIG. 26(*b*) is a schematic view of the forward movement of the rod assembly throughout the needle assembly according to the second embodiment of the weaving apparatus; and FIG. 26(*c*) is a schematic view of the outwardly radial movement of the needles according to the second embodiment of the weaving apparatus of the present invention.

BEST MODE FOR CARRYING OUT THE INVENTION

Referring now to FIGS. 1–26 of the drawings, preform F comprises five sets of yarns including +/−bias 12, axial 14, circumferential 16, and radial yarns 18. Axial yarns 14 are arranged in a circular matrix of circumferential row and radial column within the required cross-sectional shape. So, multiple axial yarn layers in the preform F are arrayed to the axial direction. There is a gap between each axial adjacent layer both in the circumferential and radial directions. Positive and negative bias yarn 12 layers are placed on both surfaces of the preform, namely the outside and the inside surface of the preform as seen in FIG. 1.

Circumferential yarn 16 layers are placed between each axial yarn 14 layer in the circumferential direction. At the outside surface of the preform, circumferential yarn 16 layers are placed on the positive bias yarn 12 layer in which there is no circumferential yarn layer between the positive and negative bias yarn 12 layers. However, on the inside surface of the preform F, circumferential yarn 16 layers are placed between negative and positive bias 12 yarn layers as well as on the positive bias yarn layer as seen in FIGS. 1 and 1(*a*). Radial yarn 18 layers are placed between each adjacent axial layer in the radial direction.

Figure 1:
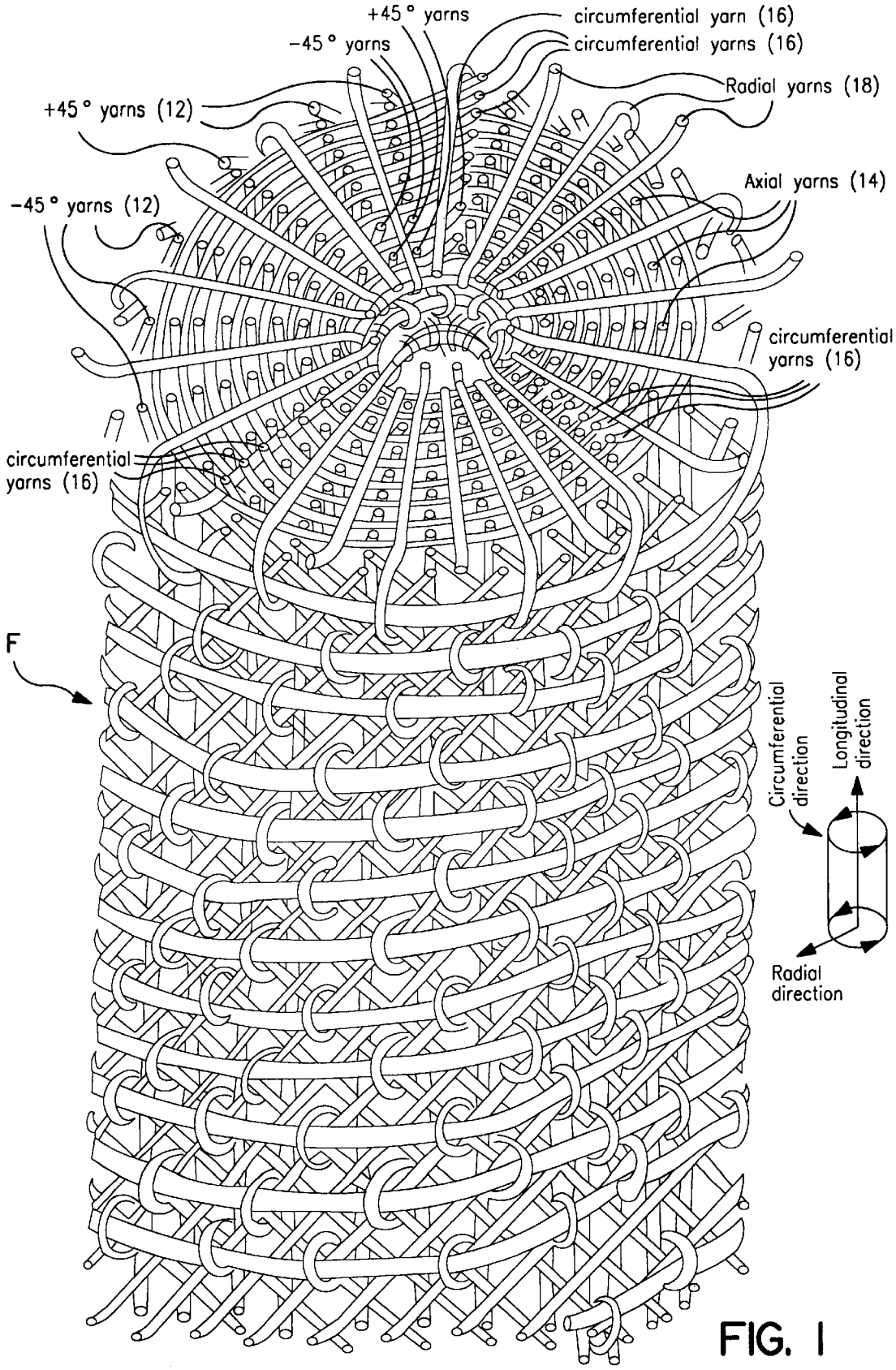
FIG. 1 is a perspective view of the three-dimensional multiaxial circular woven fabric constructed as a preform (F)
Figure 1A:
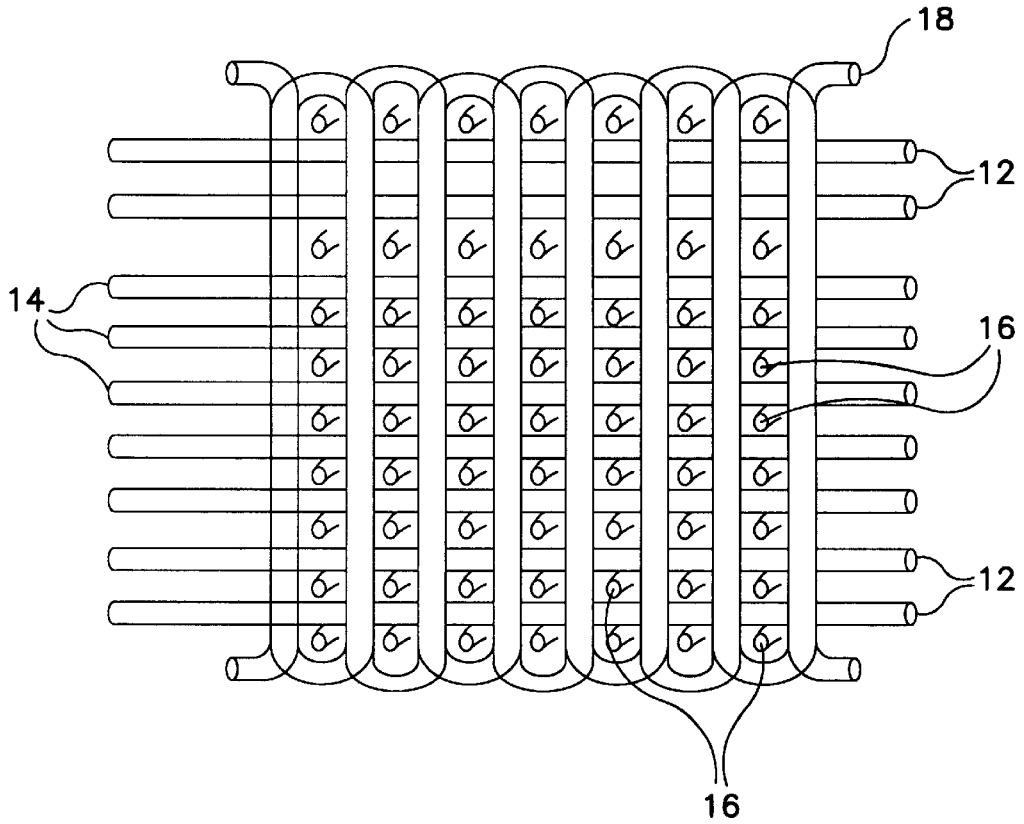
Figure 1B:
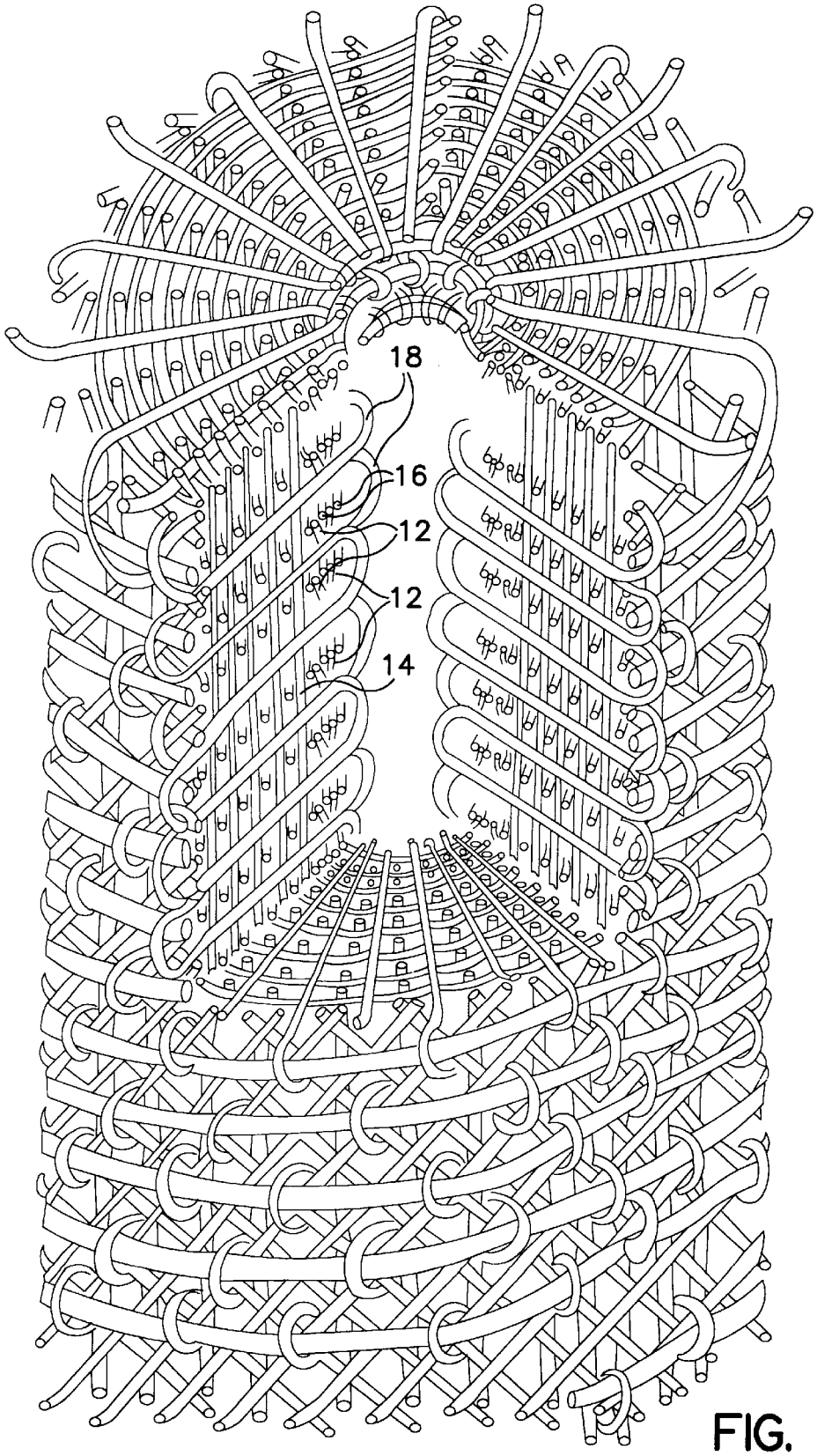

After the +/−bias yarns 12 are oriented at about 45°, circumferential yarns 16 are laid (inserted) between axial yarn 14 layers and on the +bias yarn layer for the outside surface of the preform F and between +/−bias yarn layers and +bias yarn layer for the inside surface of the preform F as seen in FIG. 1. Radial yarns 18 are inserted and passed across each other between each axial yarn 14 layer in the radial direction and across circumferential yarn 16 layers and +/−bias yarn 12 layers. So, +/−bias yarns, circumferential yarns and axial yarns are locked by the radial yarns 18. The circumferential yarns 16 are beaten against the woven line and the take-up system removes the fabric structure from the weaving zone. This represents one cycle of the method to weave 3-D multiaxial woven fabric for preform F shown in FIG. 1 and FIG. 1(*a*) and FIG. 1(*b*).

Figure 2:
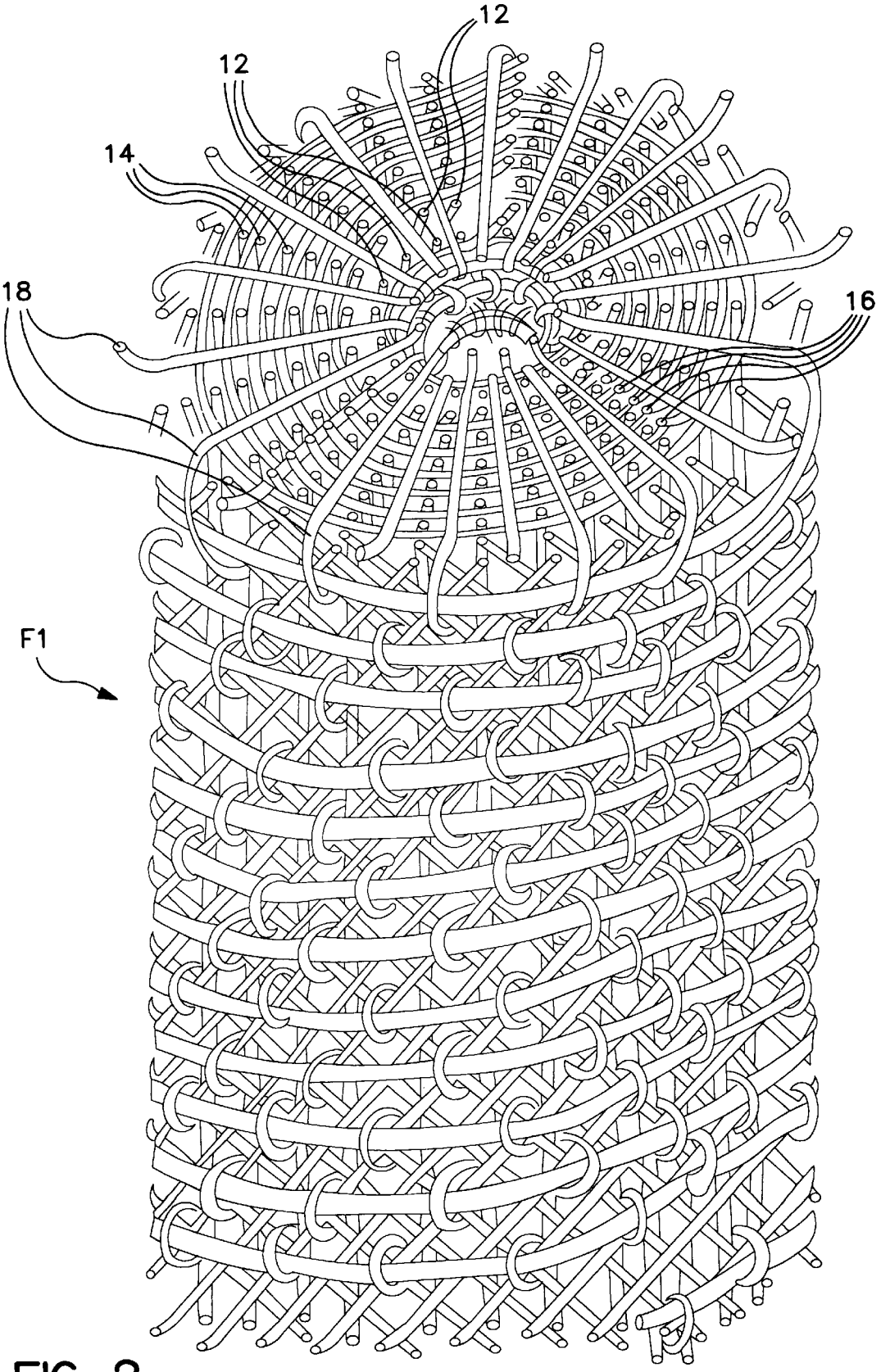
FIG. 2 is a perspective view of another form of the three-dimensional multiaxial circular woven fabric constructed as a preform (F1)
Figure 2A:
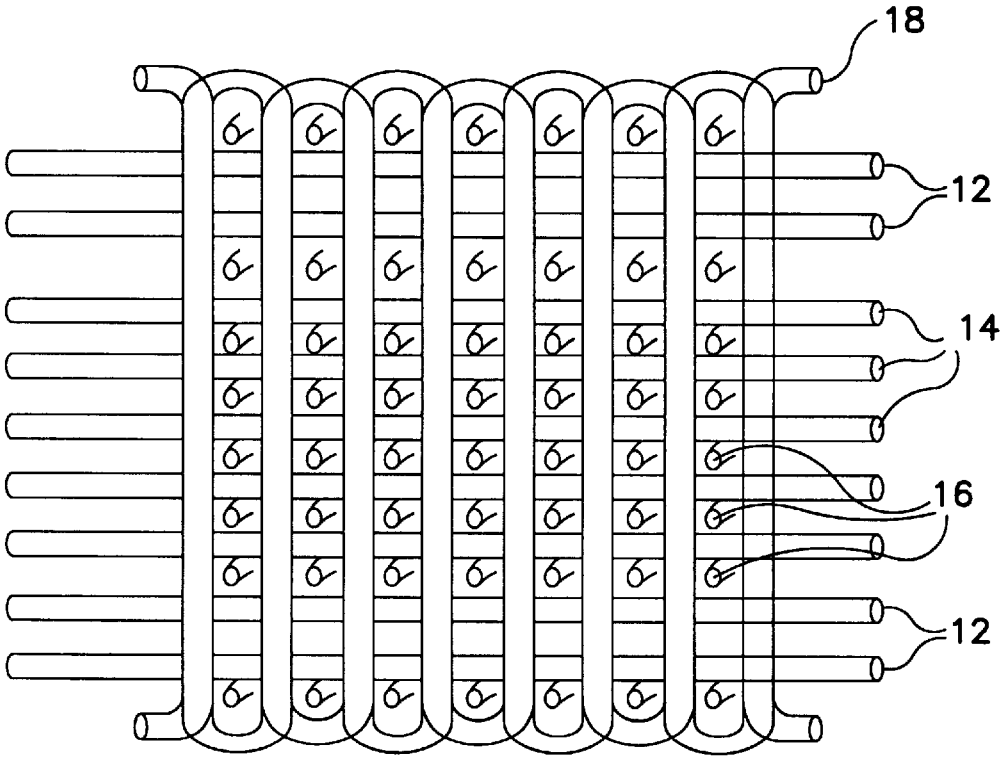

In preform F1 shown in FIG. 2, there are five sets of yarns: +/−bias; axial; circumferential; and radial yarn. The differences of this preform to the first preform shown in FIG. 1 is that there are not any circumferential yams used between positive and negative bias yarn sets which are placed at the inner surface of the preform. This is schematically seen in FIG. 2 and it is shown very well in FIG. 2(*a*).

Figure 3:
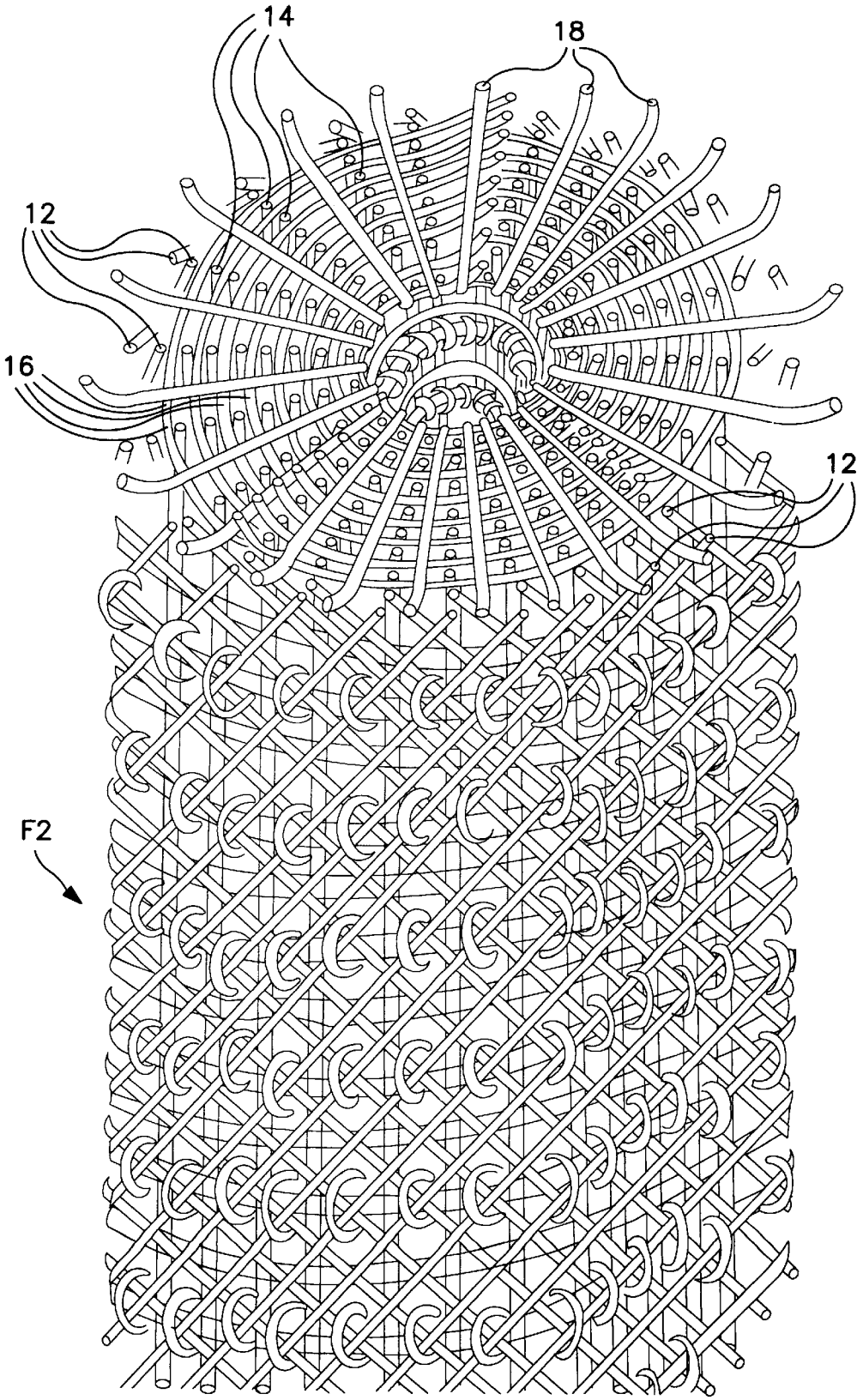
FIG. 3 is a perspective view of another form of the three-dimensional multiaxial circular woven fabric constructed as a preform F2.
Figure 3A:
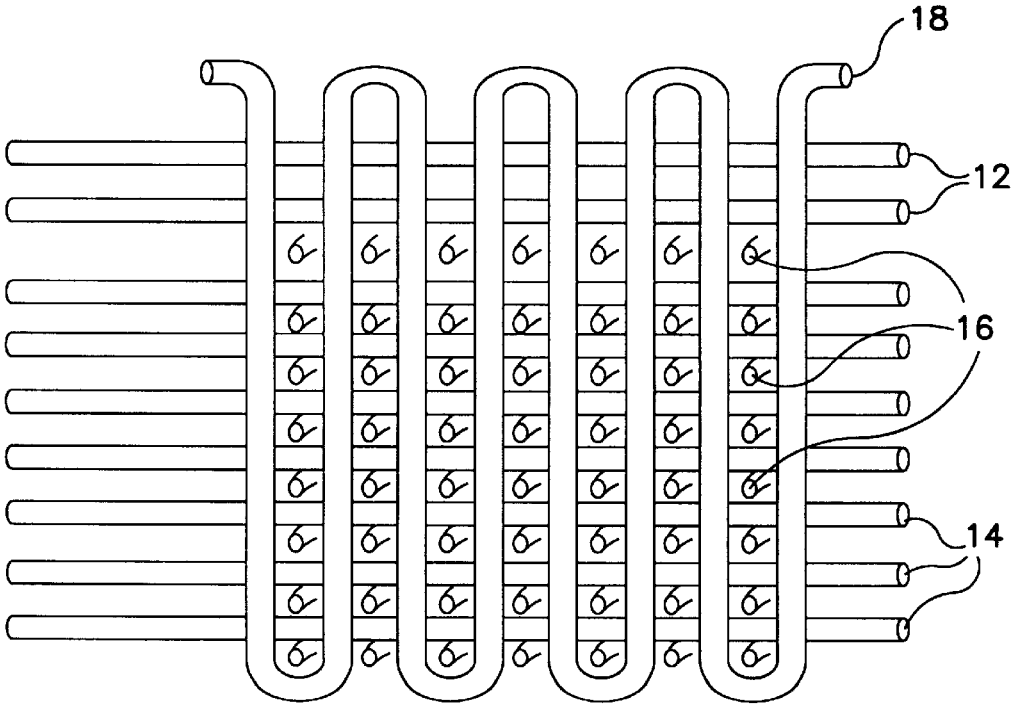
Figure 3B:
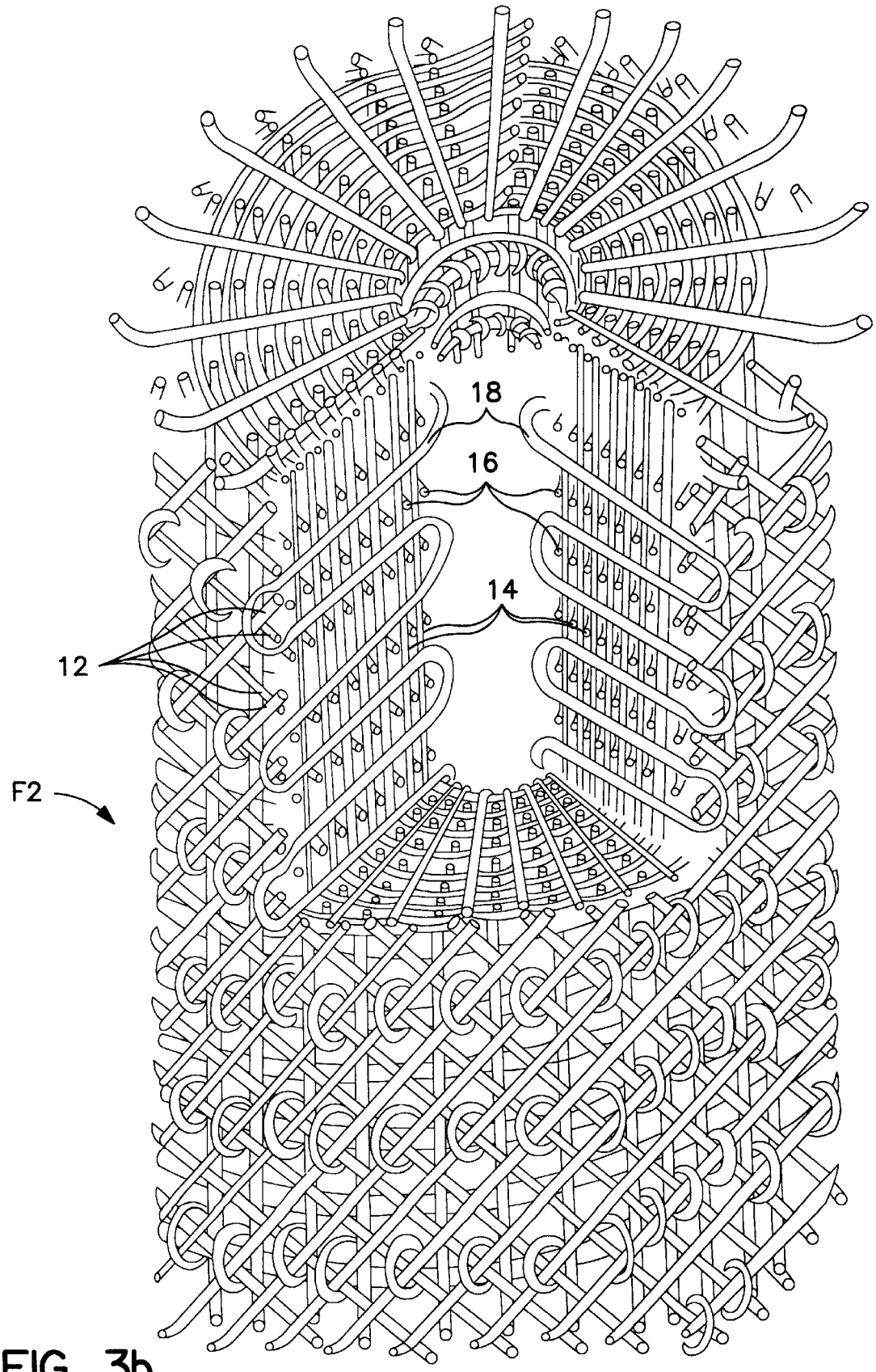
Figure 3C:
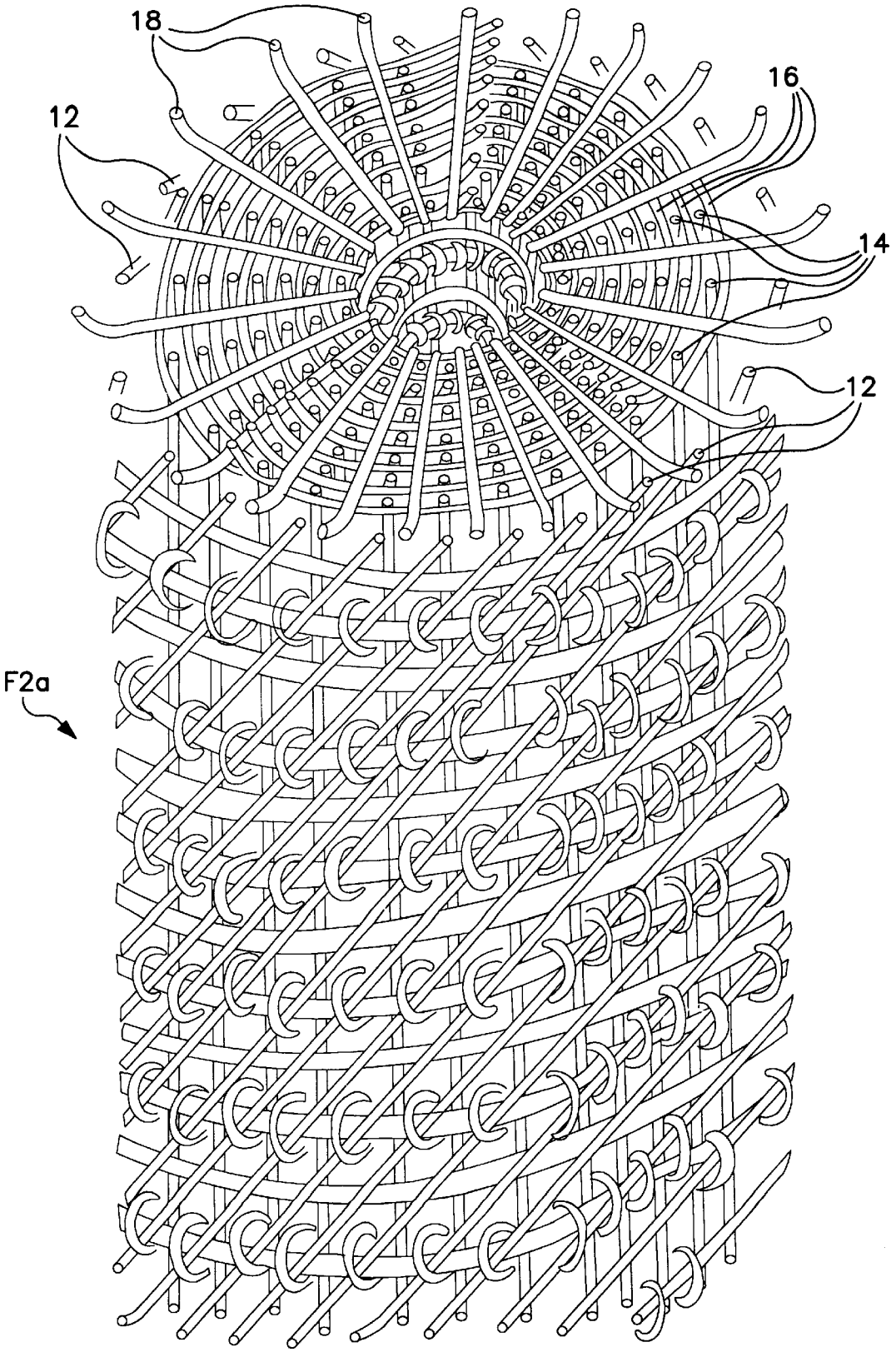
Figure 3D:
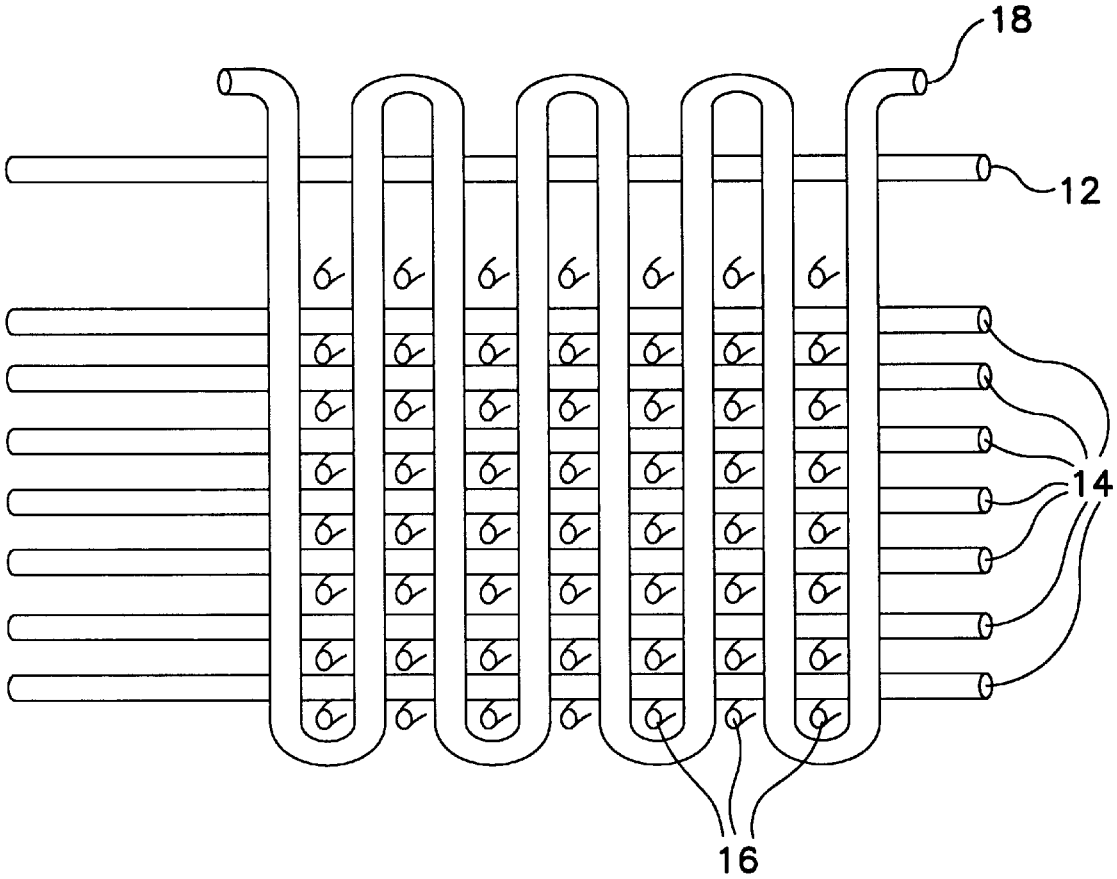

Referring to FIG. 3, in preform F2, five sets of yarns are used: +/−bias; axial; circumferential; and radial yarn. Axial yarns 14 are arranged in a circular matrix of circumferential row and radial column within the required cross-sectional shape. Between each of the axial layers, there is a gap in the circumferential and radial directions. Circumferential yarns 16 are placed between each of the axial layers towards the circumferential direction and there are two sets of +/−bias yarn 12 placed on just one side of the preform which is the outside surface as is seen in FIG. 3. Radial yarns 18 are placed between each adjacent axial layer to the radial direction of the preform.

After the +/−bias yarns 12 are oriented at 45° on the one side of the preform F2, multiple circumferential yarns 16 are laid between axial layers in the circumferential direction. All radial yarns 18 are inserted from the outside surface of the preform towards the innerside surface of the preform to cross the circumferential yarns 16 and lock the +/−bias yarns 12, circumferential yarns 16, axial yarns 14 in their place. The inserted yarns are beaten against the woven line and take-up removes the woven preform F2 from the weaving zone.

Again, +/−bias yarns 12 are oriented at 45° on the outside surface of the preform F2. After that, circumferential yarn sets are laid between the axial layers in the circumferential direction. All radial yarns are inserted from the innerside surface of the preform to the outside surface of the preform to cross the circumferential yarns 16 and lock the +/−bias yarns 12, circumferential yarns 16 and axial yarns 14 in their place. The inserted yarns are again beaten against the woven line and take-up removes the woven preform F2 from the weaving zone. This is one cycle of the method to fabricate this type of woven preform F2. FIG. 3(*a*) also shows preform cross-section view in the longitudinal direction. FIG. 3(*b*) shows a partial view of the preform F2.

In preform F2*a* of FIG. 3(*c*), four sets of yarns are used: +bias yarns 12; axial yarns 14; circumferential 16; and radial yarns 18. Axial yarns 14 are arranged in a circular matrix of circumferential row and radial column within the required cross-sectional shape. Between each of the axial layers, there is a gap in the circumferential and radial directions. Circumferential yarns 16 are placed between each of the axial layers towards the circumferential direction and there is one set of +bias yarn 12 placed on just one side of the preform which is the outside surface as seen in FIG. 3(*c*). Radial yarns 18 are placed between each of the adjacent axial layers in the radial direction of the preform F2*a*.

After +bias yarns 12 are oriented at 450 on the one side of the preform, multiple circumferential yarns 16 are inserted (laid) between axial layers to circumferential direction. All radial yarns 18 are inserted from outside surface of the preform to the innerside surface of the preform to cross the circumferential yarns 16 and lock the +bias yarns 12, circumferential yarns 16 and axial yarns 14 in their place. The inserted yarns are beaten against the woven line and take-up removes the woven preform F2*a* from the weaving zone. Again, +bias yarns 12 are oriented at 45° on the outside surface of the preform F2*a*. After that, circumferential yarn sets are laid between the axial layers in the circumferential direction. All radial yarns 18 are inserted from the innerside surface of the preform to the outside surface of the preform to cross the circumferential yarns 16 and lock the +bias yarns 12, circumferential yarns 16, axial yarns 14 in their place. The inserted yarns are again beaten against the woven line and take-up removes the woven preform from the weaving zone. This is one cycle of the method to fabricate the preform F2*a*. Also, FIG. 3(*d*) shows a cross section of preform F2*a* along the longitudinal direction.

Figure 4:
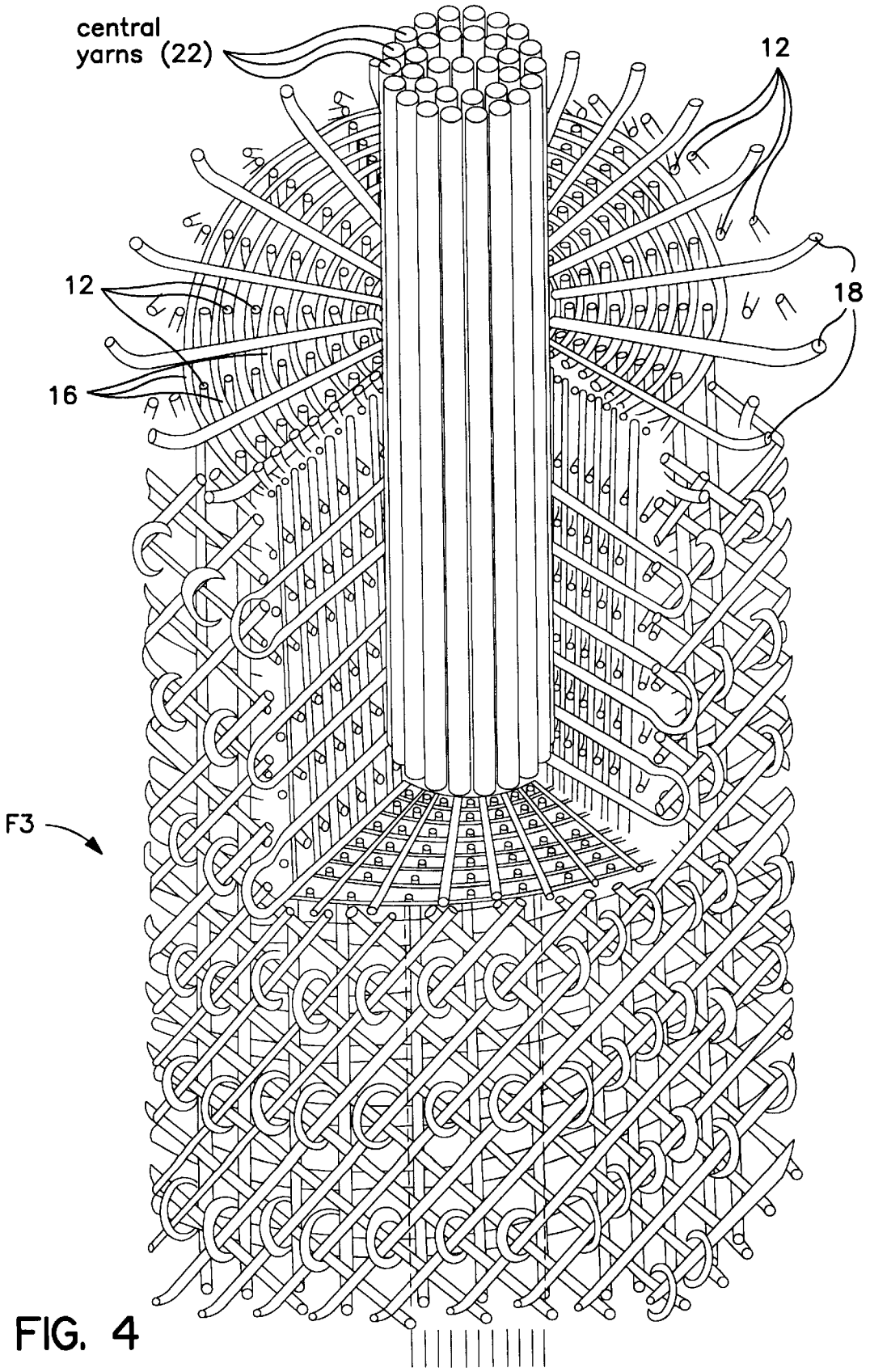
FIG. 4 is a perspective view of the three-dimensional multiaxial circular woven fabric constructed as a rod preform (F3)

In preform F3 shown in FIG. 4, central yarns 22 are introduced to the preform F3 to make rod sectional preform F3. The central yarns are multiple yarn ends and can be arranged according to the inner diameter of the preform F3. The preform F3 has six sets of yarns: +/−bias yarns 12; axial yarns 14; central yarns 22; circumferential yarns 16; and radial yarns 18. As described above, in the preform F2 as shown in FIG. 3 all interlacement between +/−bias, axial, circumferential and radial yarns are the same as in preform F3 except the central yarns 22 which fill the hollow section of the preform F2. There is not any interlacement between central yarns 22 to other yarn sets as seen in FIG. 4.

Figure 5:
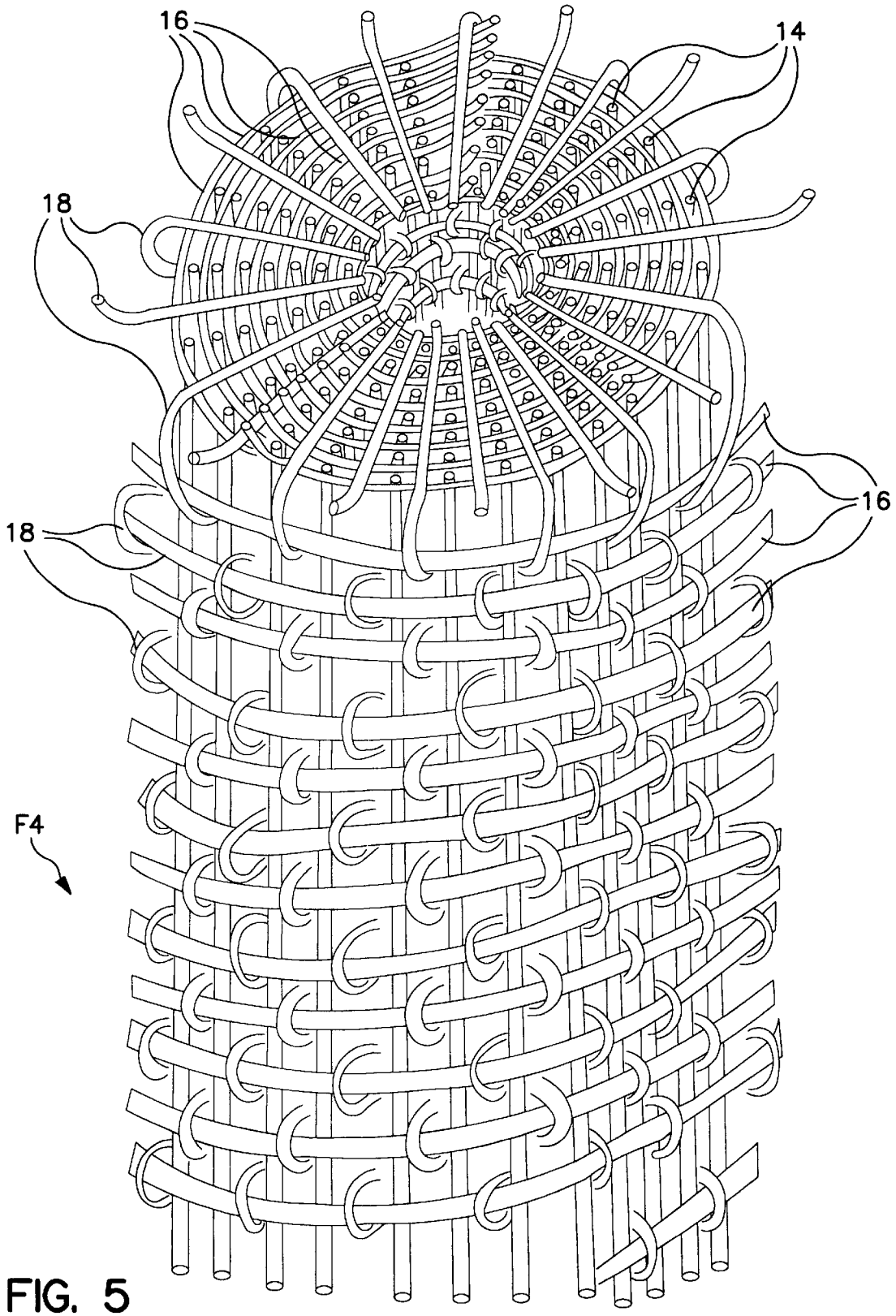
FIG. 5 is a perspective view of a three-dimensional multiaxial circular woven fabric constructed as an orthogonal circular preform (F4)
Figure 5A:
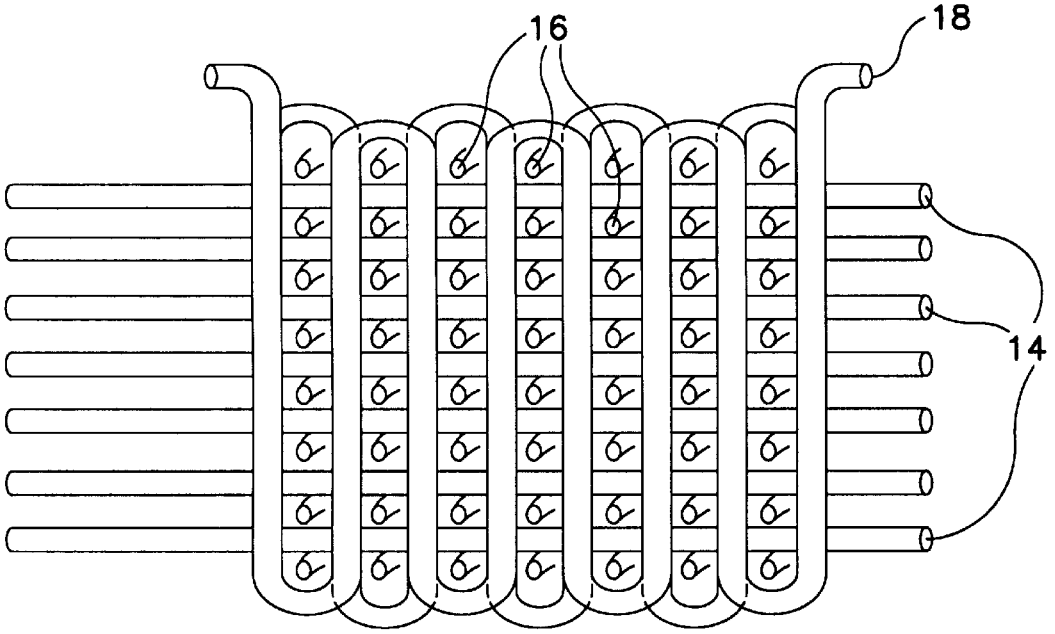

In preform F4 shown in FIG. 5, three sets of yarns are used: axial yarns 14; circumferential yarns 16; and radial yarns 18. Axial yarns 14 are arranged in a circular matrix of circumferential rows and radial columns within the required cross-sectional shape. Multiple axial yarn layers in the preform F4 are arrayed in the axial direction. There is a gap between each axial adjacent layer both in the circumferential and radial directions. Multiple circumferential yarns 16 are laid (or inserted) in each circumferential row or axial layer in the circumferential direction. Multiple radial yarns 18 are also inserted in each radial column of the axial layer in the radial direction.

After the circumferential yarns 16 are inserted (laid) around the axial layers, radial yarns 18 are inserted and passed across each other between each axial yarn 14 layers in the radial direction and across circumferential yarns 16 and the axial yarns 14. So, the axial yarns 14 and circumferential yarns 16 are locked by the radial yarns 18. The inserted yams are beaten against the woven line and take-up removes the preform form the weaving zone. This is one cycle of the 3-D orthogonal weaving and the cycle can be repeated according to the required preform length. The preform F4 is seen in FIG. 5. Also, the cross-sectional view of the preform F4 is seen in FIG. 5(*a*).

Another form of preform F5 is also possible to produce according to present invention. In this preform F5, five sets of yarns are used: axial yarns 14; +/−bias yarns 12; circumferential yarns for base 16 and curved section 16*a*; and radial yarns 18 shown in FIG. 6.

Figure 6:
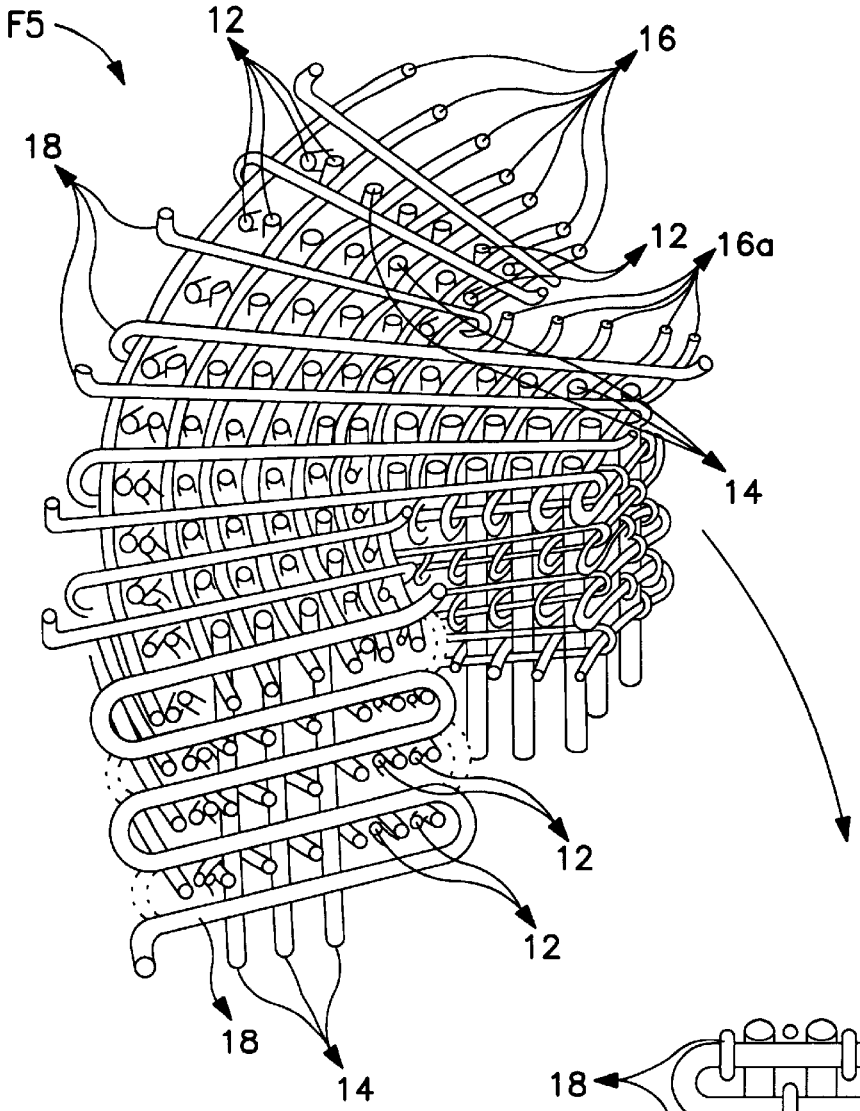
FIG. 6 is a schematic perspective partial view of a three-dimensional multiaxial circular woven fabric constructed as a preform (F5)
Figure 6A:
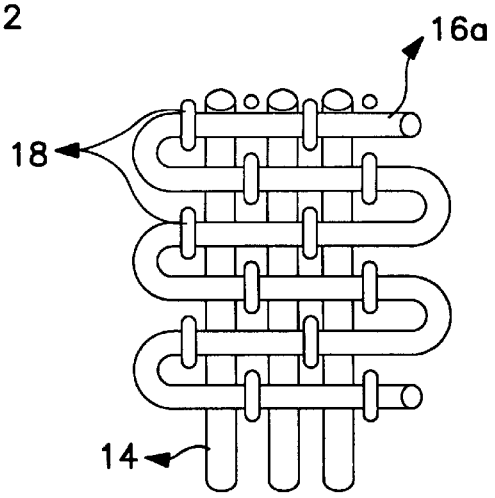
Figure 6B:
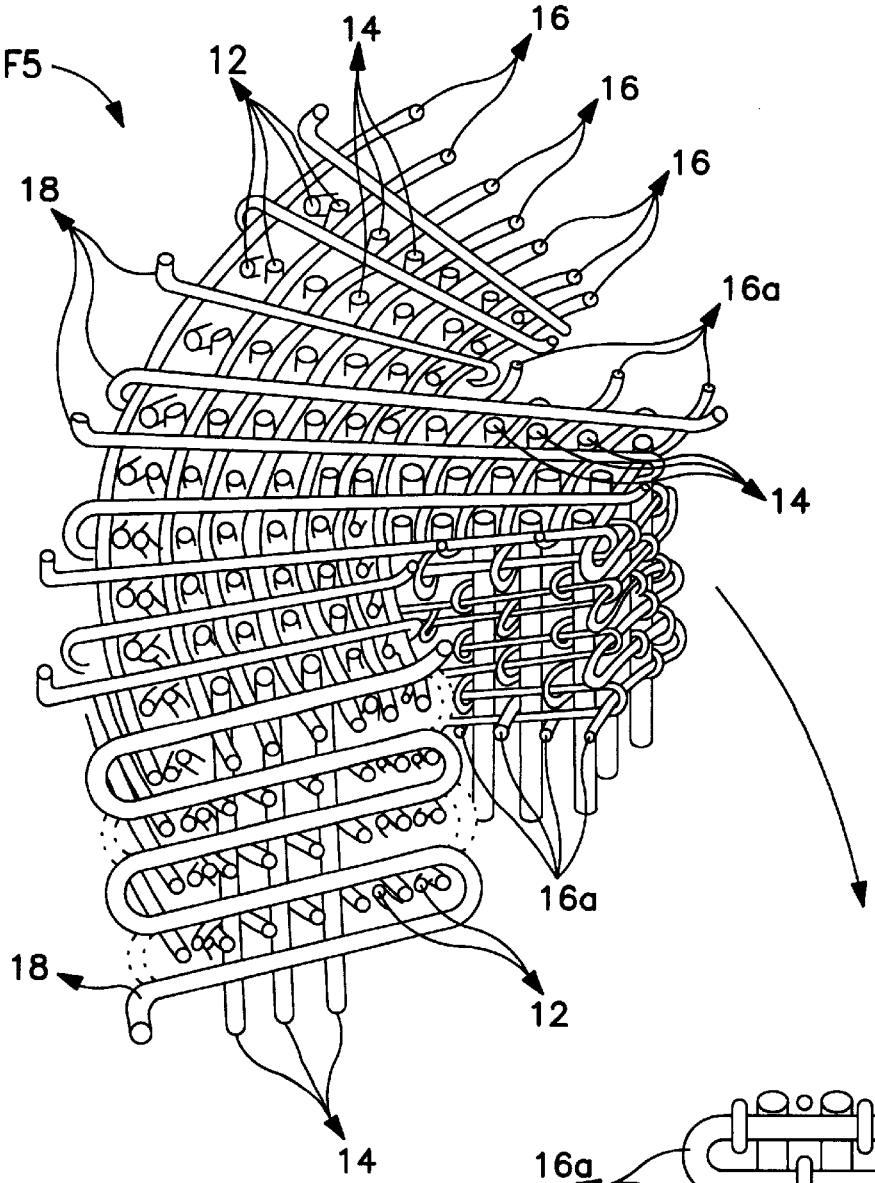
Figure 6C:
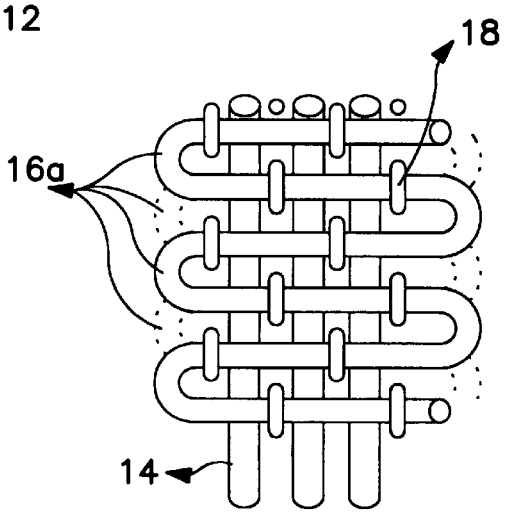
Figure 7A:
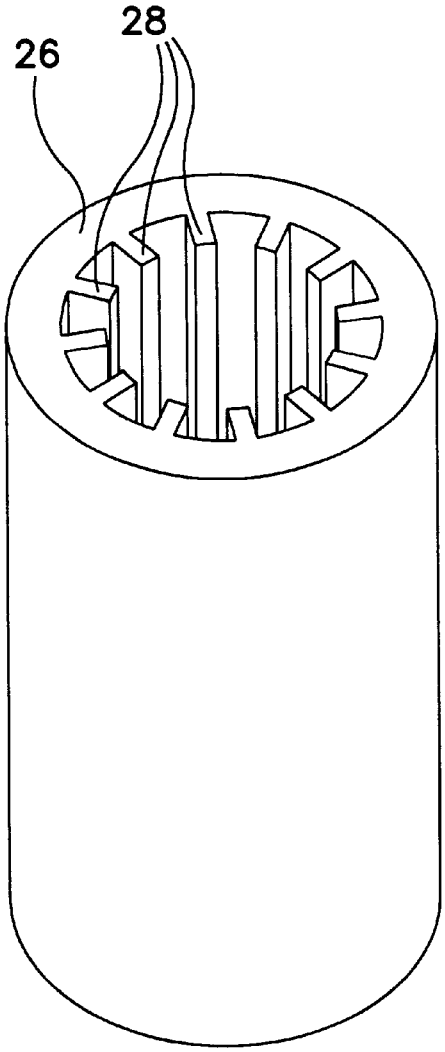
FIG. 7 is a side elevation view of the shaped structure F5.
Figure 7:
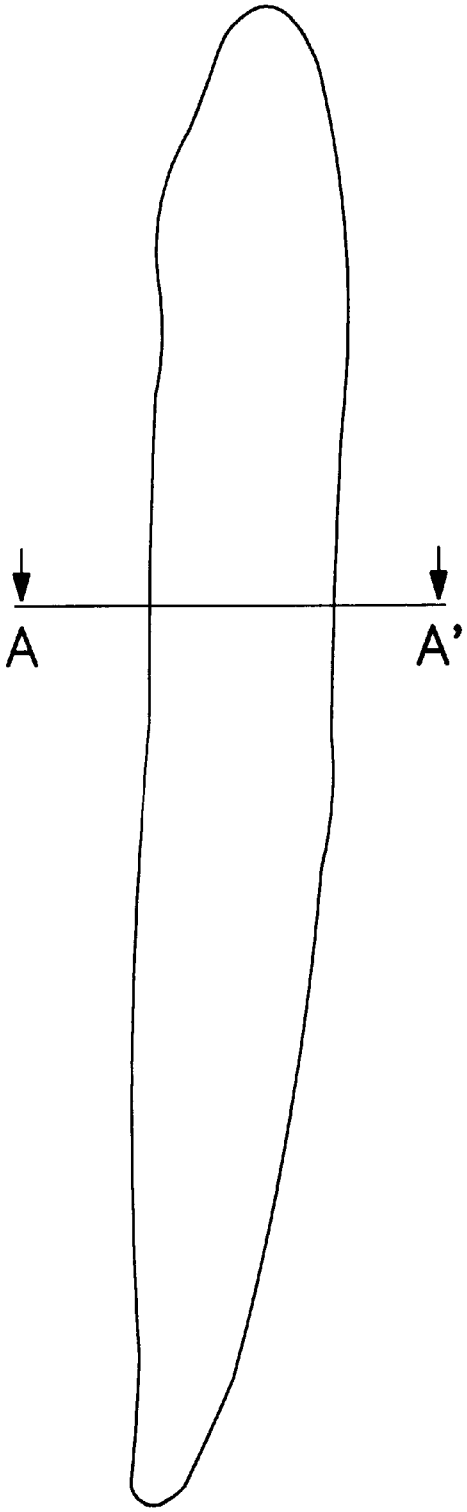

Axial yarn layers are arranged according to cross-sectional shape of the structure in shown FIG. 7(*a*). The structure may be considered as two parts comprising the circular basement and (26) the curved end section 28. The circular basement 26 has +/−bias yarns 12, axial yarns 14, circumferential yarns 16, and radial yarns 18. The yarn placement and interlacement of each of the yarn sets are the same as explained in preform F in shown FIG. 1. However, the curved end section 28 has three sets of yarns comprising axial yarns 12, circumferential yarns 16*a* and radial yarns 18. The yarn placement and yarn interlacement in this section are similar as explained in preform F4 except the movement of the circumferential yarns 16*a*. The circumferential yarns for curved section 16*a* are moved until leftside surface of the curved section. After the radial yarn insertion is completed, the circumferential yarns 16*a* for the curved section are moved until right side surface of the curved section. The cycle is repeated according to this fashion. The surface of the curved section of the preform F5 is seen in FIG. 6(*a*). Alternatively, the circumferential yarns 16*a* can be moved successively reverse to each other, namely, first one moves from left to right; second, right to left; the third one is the same as first one; the fourth one is same as the second one, etc. These are shown in FIG. 6(*b*) and FIG. 6(*c*). Thus, circumferential yarns 16*a* serve to lock all radial yarns 18 towards the axial yarns 14.

Figure 8:
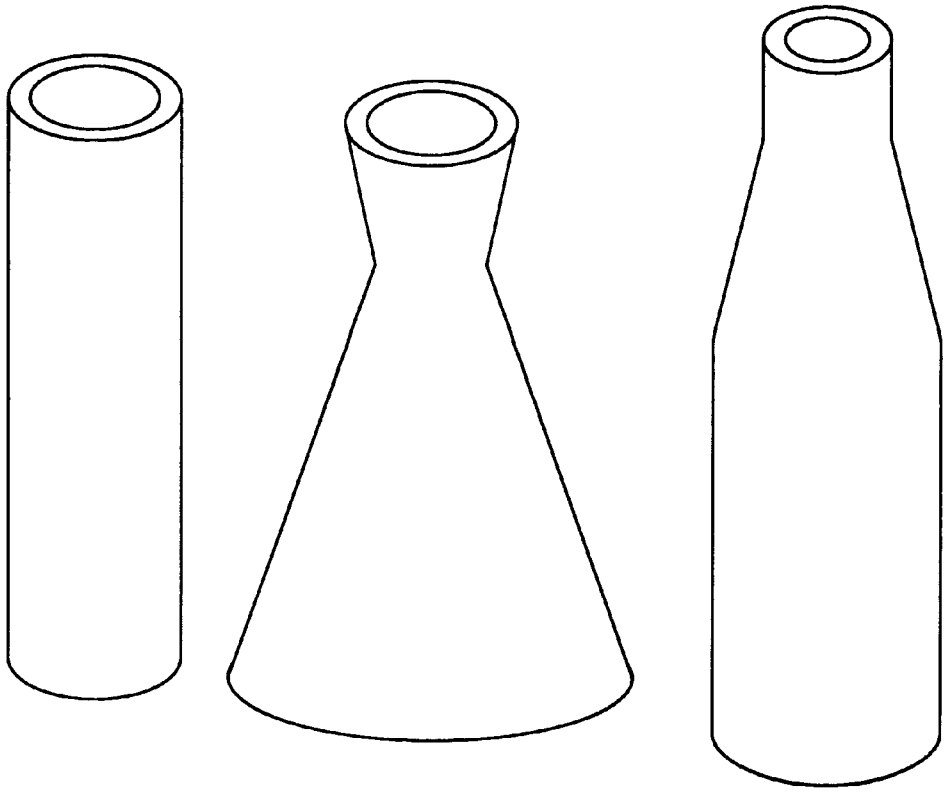
FIG. 8 is a schematic perspective view of a cylinder, cone and cylindro-conical preform shape, respectively.

The preform F5 can be manufactured variably as seen in FIG. 7. The suitable mandrel may be used to provide the exact shape to the preform F5. The previously described preforms F, F1, F2 and F4 are manufactured in a number of representative shapes such as cylinders, cone and cylindro-conical shapes as can be seen in FIG. 8.

According to the present invention, a 3-D multiaxial circular weaving apparatus generally designated 100 for constructing the 3-D multiaxial circular woven fabrics of the invention can be constructed with mainly four units comprising feeding unit 110, machine bed 130, beat-up unit 180 and take-up unit 190. In feeding unit 110, axial yarns are fed to the weaving zone. Feeding unit 110 has a number of axial bobbins 112 and feeding basement plate 114. Guiding disc 120 of apparatus 100 has a number of holes depending upon the number of axial bobbins 122. The disc provides the axial yarns 14 correct space between adjacent axial yarn in both the circumferential row and radial column directions. The main machine bed 130 includes +/−bias yarn carrier 140, radial yarn carrier 142, circumferential yarn carrier 150 and circular rings 160.

The beat-up unit 190 has mandrel holder 192 and stepping motor 194. The mandrel holder 192 is attached to the mandrel 196 and the take-up unit removes the preform F from the weaving zone. This is shown in FIGS. 9, 9(*a*) and 9(*b*).

Figure 10:
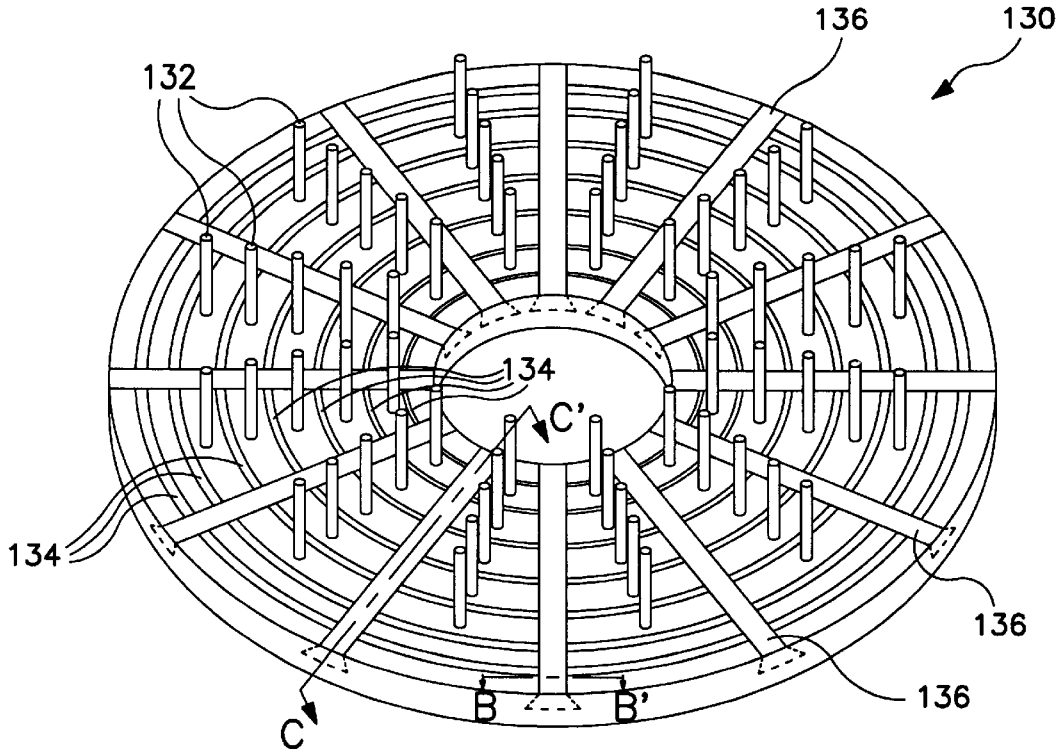
FIG. 10 is a schematic perspective view of the machine bed of the three-dimensional multiaxial circular weaving apparatus shown in FIG. 9.
Figure 10A:
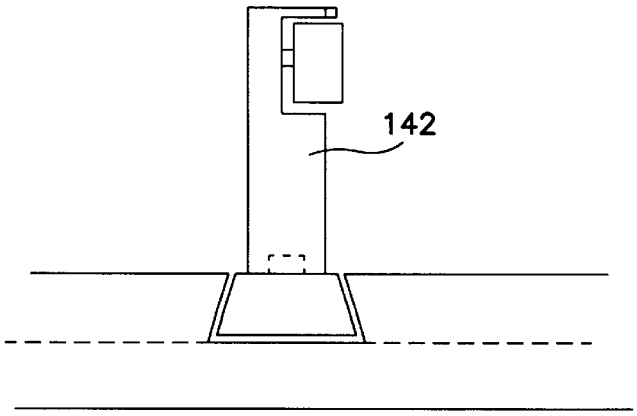
Figure 10B:
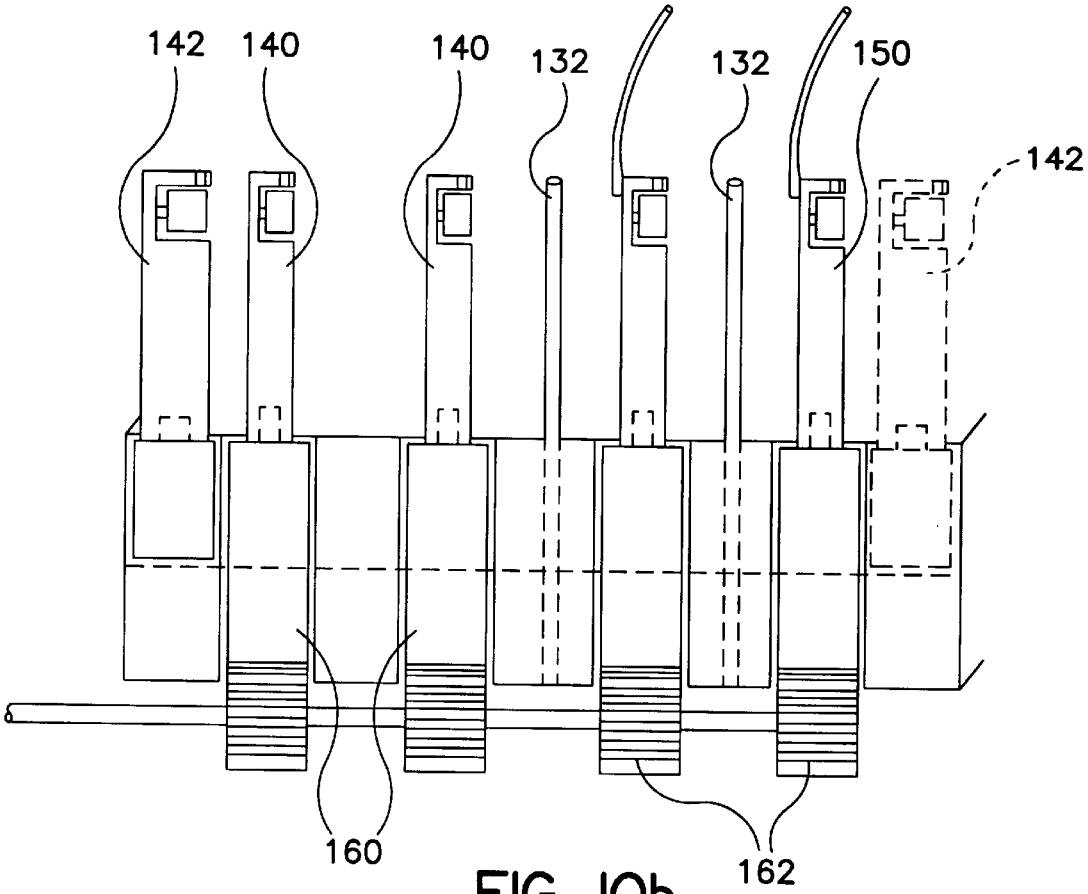
Figure 10C:
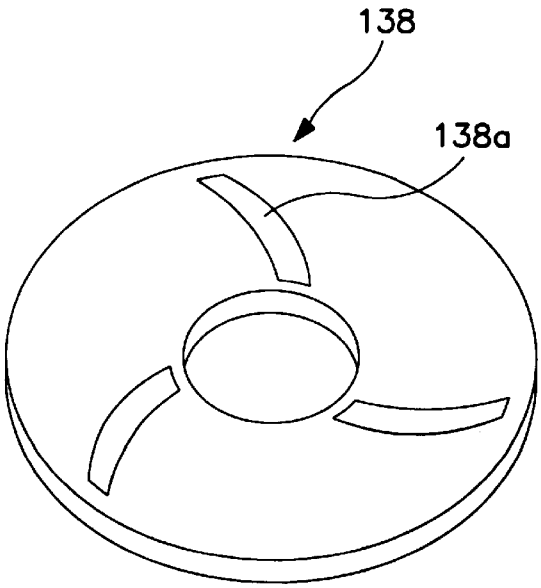

The machine bed 130 has axial tubes 132 and grooves 134 for placement of each of the circular rings. The machine bed has also triangular corridors 136 for radial yarn carrier 142. This is shown in FIG. 10. The best view of the triangular corridor for radial yarn carrier 142 is seen in FIG. 10(*a*).

As it is seen clearly from the sectional view of the machine bed to radial direction shown in FIG. 10(*b*), radial yarn carriers 142 are placed on both edges of the machine bed. Axial tubes 132 are also mounted on the machine bed.

The +/−bias yarn carriers 140 and circumferential yarn carriers 150 are mounted on the circular rings 160. The grooves 134 for each circular ring are deeper than that of triangular corridors 136 for radial yarns carriers 142.

Figure 11:
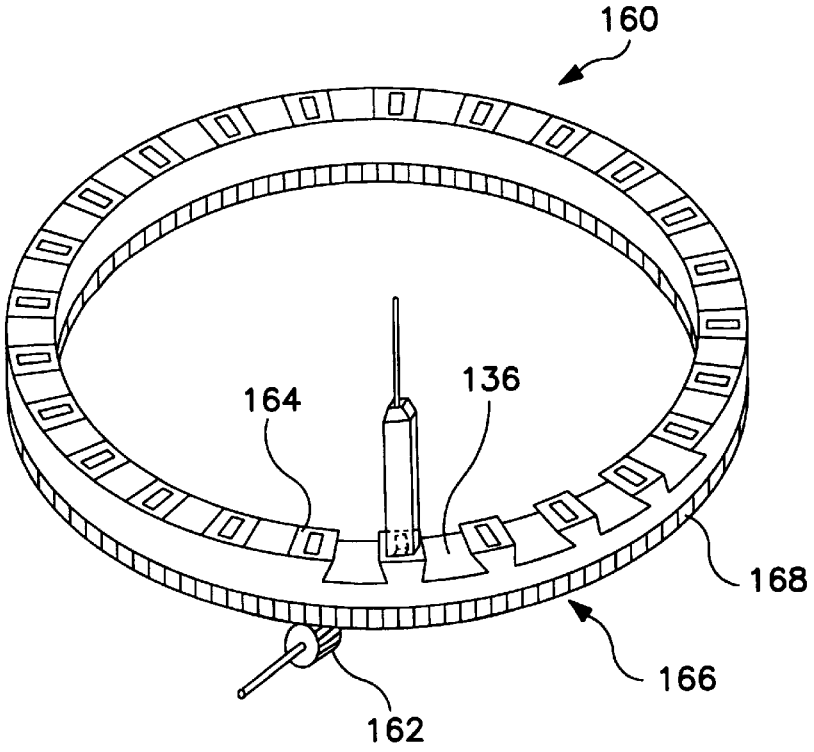
FIG. 11 is a schematic perspective view of the circular ring for +/−bias yarn carriers and circumferential yarn carriers of the weaving apparatus shown in FIG. 9.
Figure 11A:
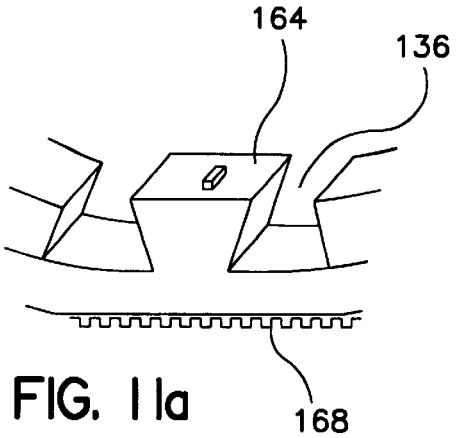
Figure 11B:
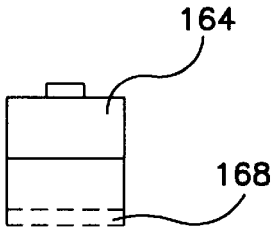
Figure 11C:
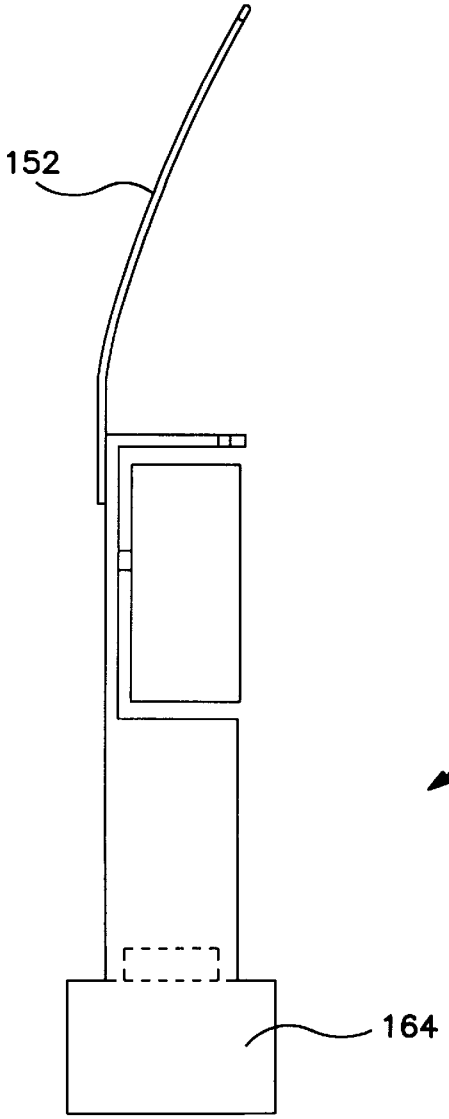
Figure 13:
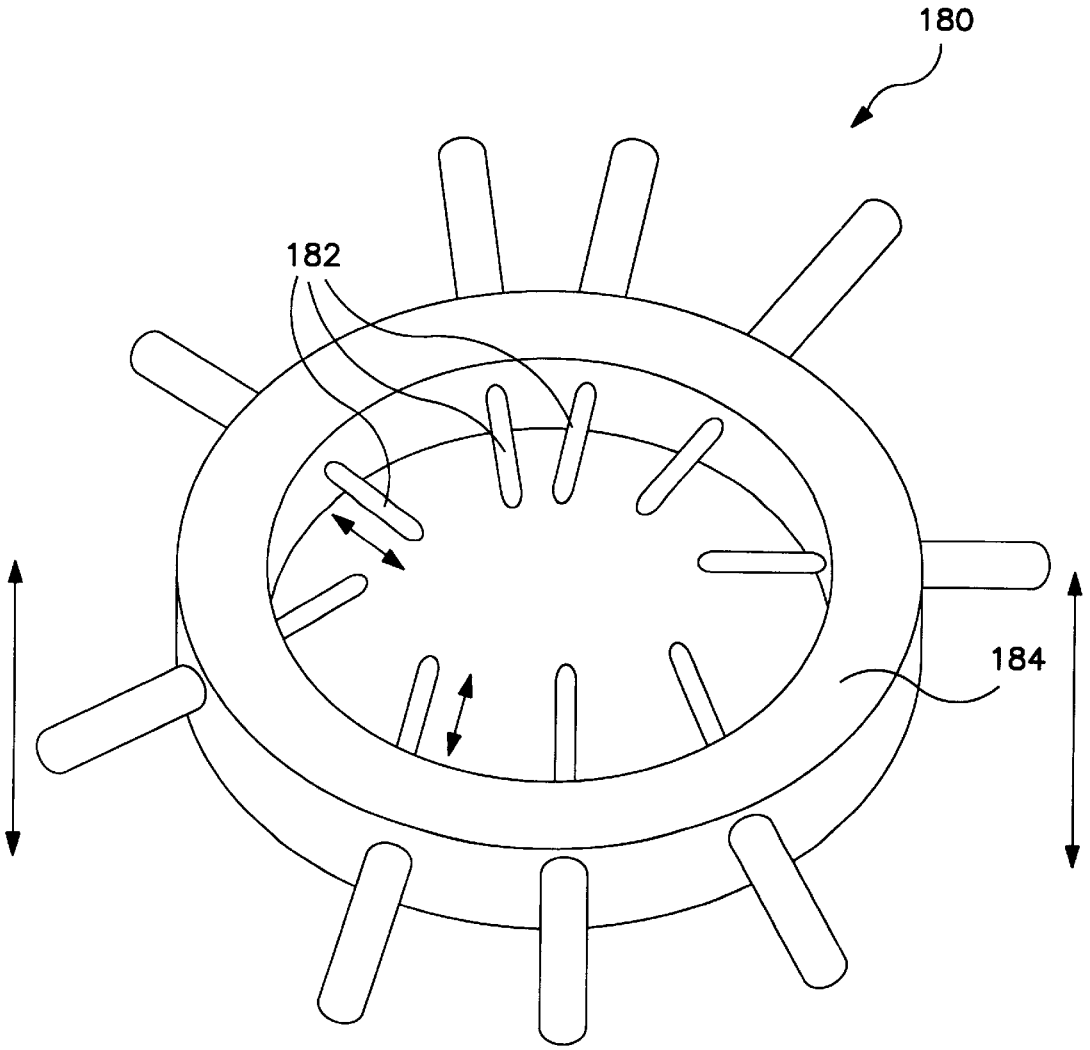
FIG. 13 is a schematic perspective view of the beat-up assembly of the weaving apparatus of FIG. 9.

The back surface of the machine bed 138 is shown in FIG. 10(*c*). In this surface 138, there are angularly made grooves 138*a* for gears 162. The gears 162 are connected to each circular ring 160. The circular ring 160 has a number of blocks 164 in its circumference depending upon the number of +/−bias yarn carriers 140 or circumferential yarn carriers 150. Between every adjacent block 164, there is a triangular groove 136 for radial yarn carrier 142. The back face of the circular ring 166 has also tooth 168 in its circumference and connects to the gear 162 shown in FIG. 11. The closer perspective view of the circular ring is seen in FIG. 11(*a*) and the side view is also seen in FIG. 11(*b*). The circumferential yarn carrier 150 has a curved guiding rod 152 connected to the back side of the carrier in which it guides the circumferential yarns 16 and provides the yarn correct path during insertion shown in FIG. 11(*c*). As a matter of design choice a longer guiding rod can be used to help the beating-up action for the circumferential yarns 16 as well.

Figure 12:
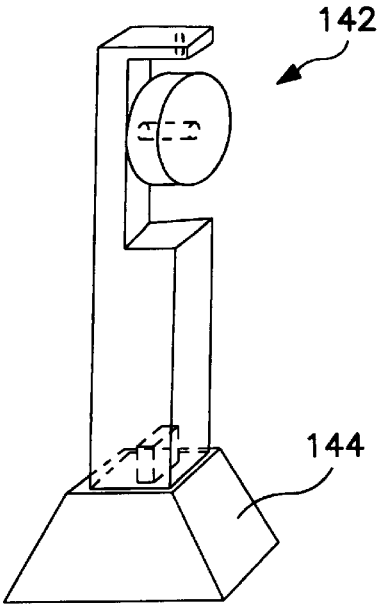
FIG. 12 is a schematic perspective view of the radial yarn carrier of the weaving apparatus of FIG. 9.

The radial yarn carrier 142 is mounted on pyramidal block 144 shown in FIG. 12. The beat-up unit 180 has a number of rods 182. They are placed in the rod carrier ring 184. Each rod independently moves backwardly and forwardly to the radial direction of the rod carrier ring shown in FIG. 13. Also, the rod carrier ring 184 moves upwardly and downwardly to the longitudinal direction of 3-D multiaxial circular weaving.

Most suitably, each element on 3-D multiaxial circular weaving 100 can be actuated by pneumatic cylinders (not shown). The circular rings 160 for +/−bias yarn carrier and circumferential yarn carriers can be moved by a gearing assembly driven by stepping motors (not shown). The timing sequence of each motion can also be controlled by a programmable personal computer (not shown).

The steps in the operation of 3-D multiaxial circular weaving apparatus 100 can be considered step-by-step as follows:

1. Positive bias yarn carrier and negative bias yarn carriers are rotated just one carrier distance (shown in FIG. 9(*b*)).

2. Circumferential yarn carriers are also rotated just one carrier distance in the counterclockwise direction depending upon the carrier number on the circular ring 160. (If, for instance, there are 36 yarn carrier place on each circular ring and just 6 circumferential yarn carriers are located on the circular ring, circumferential yarn carriers should be rotated 6 carrier distances.)

3. Radial yarn carriers are moved from both edges of the machine bed reversibly (e.g., odd number of radial yarn carriers move from outside edge of the machine bed to innerside edge of the machine bed shown in FIG. 10(*b*) but even number of radial yarn carriers move from innerside edge of the machine bed to outside edge of the machine bed) and the radial yarns are inserted.

4. Beat-up unit beats the inserted yarns towards the woven line.

5. Take-up unit removes 3-D multiaxial circular woven preform from the weaving zone.

6. Step 1 is repeated.

7. Step 2 is repeated.

8. Radial yarn carriers are moved from both edges of the machine bed reversibly (e.g., odd number of radial yarn carriers move from innerside edge of the machine bed to outside edge of the machine bed whereas even number of radial yarn carriers move from outside edge of the machine bed to inner side edge of the machine bed) and one again radial yarns are inserted.

9. Step 4 is repeated.

10. Step 5 is repeated.

The operation of 3-D multiaxial circular weaving apparatus can be considered alternatively step-by-step as follows:

1. Step 1 is repeated as explained in the previous operation.

2. Step 2 is repeated as explained in the previous operation.

3. All radial yarn carriers are moved from outside edge of the machine bed to inner side edge of the machine bed.

4. Step 4 is repeated as explained in the previous operation.

5. Step 5 is repeated as explained in the previous operation.

6. Step 5 is repeated.

7. Step 2 is repeated.

8. All radial yarn carriers are moved from inner side edge of the machine bed to outside edge of the machine bed.

9. Step 4 is repeated.

10. Step 5 is repeated.

It is possible to produce all pre for ms at different +/−bias yarn orientations according to the present invention. The +/−bias yarn orientations at the preforms can be varied at +/−10° to 80°.

The step-by-step operation of 3-D multiaxial circular weaving apparatus 100 according to the first embodiment of the apparatus will be further described by reference to drawings FIGS. 14 to 14(*h*).

The starting position of the weaving for producing preform F and machine bed arrangement according to first embodiment are shown in FIG. 14. FIGS. 14(*a*) and 14(*b*) show +/−bias yarn movement and circular yarn rotation, respectively. The enlarged view of the inserted yarn in the weaving zone are also drawn each step at the upper left side corner of the side view of the weaving apparatus. The movement of the radial yarn and beat-up operation are seen in FIGS. 14(*c*) and 14(*d*), respectively. Again, +/−bias yarn movement and circular yarn rotation are shown in FIG. 14(*e*)–FIG. 14(*f*), respectively. Finally, radial yarn movement and beat-up operation are shown in FIGS. 14(*g*)–14(*h*), respectively.

The starting position of the weaving for producing the preform F1 and machine bed arrangement according to first embodiment of apparatus 100 are shown in FIG. 15. FIGS. 15(*a*) and 15(*b*) show +/−bias yarn movement and circular yarn rotation, respectively. The enlarged view of the inserted yarn in the weaving zone are also drawn each step at the upper left side corner of the side view of the weaving apparatus.

The movement of the radial yarn and beat-up operation are seen in FIGS. 15(*c*) and 15(*d*), respectively. Again, +/−bias yarn movement and circular yarn rotation are seen in FIG. 15(*e*)–FIG. 15(*f*), respectively. And finally, radial yarn movement and beat-up operation are shown in FIG. 15(*g*)–FIG. 15(*h*), respectively.

The starting position of the weaving process for producing the preform F2 and machine bed arrangement according to first embodiment of apparatus 100 are shown in FIG. 16. FIGS. 16(*a*) and 16(*b*) show +/−bias yarn movement and circular yarn rotation, respectively. The enlarged view of the inserted yarn in the weaving zone are also drawn each step at the upper left side corner of the side view of the weaving apparatus.

The movement of the radial yarn and beat-up operation are seen in FIGS. 16(*c*) and 16(*d*), respectively. Again, +/−bias yarn movement and circular yarn rotation are shown in FIG. 16(*e*)–FIG. 16(*f*), respectively. And finally, radial yarn movement and beat-up operation are shown in FIG. 16(*g*)–FIG. 16(*h*), respectively.

The starting position of the weaving process for producing the preform F2*a* and machine bed arrangement according to first embodiment of apparatus 100 are shown in FIG. 17. FIGS. 17(*a*) and 17(*b*) shown +bias yarn movement and circular yarn rotation, respectively. The enlarged view of the inserted yarn in the weaving zone are also drawn each step at the upper left side corner of the side view of the weaving apparatus.

The movement of the radial yarn and beat-up operation are seen in FIGS. 17(*c*) and 17(*d*), respectively. Again, +bias yarn movement and circular yarn rotation are shown in FIG. 17(*e*)–FIG. 17(*f*), respectively. And finally, radial yarn movement and beat-up operation are shown in FIG. 17(*g*) –FIG. 17(*h*), respectively.

The starting position of the weaving process for producing the preform F4 and machine bed arrangement according to first embodiment of apparatus 100 are shown in FIG. 18. FIG. 18(*a*) shows circular yarn rotation. The enlarged view of the inserted yarn in the weaving zone are also drawn in each step at the upper left side corner of the side view of the weaving apparatus.

The movement of the radial yarn and beat-up operation are seen in FIG. 18(*b*) and FIG. 18(*c*), respectively. Again, the circular yarn rotation is shown in FIG. 18(*d*). And finally, radial yarn movement and beat-up operation are shown in FIG. 18(*e*)–FIG. 18(*f*), respectively.

The starting position of the weaving for producing the preform F5 and machine bed arrangement according to the first embodiment of apparatus 100 are shown in FIG. 19. FIGS. 19(*a*) and 19(*b*) show +/−bias yarn movement and circular yarn rotation for both circular basement and section, respectively. The enlarged view of the inserted yarn in the weaving zone are also drawn each step at the upper part of the side view of the weaving apparatus.

The movement of the radial yarn and beat-up operation are seen in FIG. 19(*c*) and FIG. 19(*d*), respectively. Again, +/−bias yarn movement and circular yarn rotation for both circular basement and section are shown in FIG. 19(*e*)–FIG. 19(*f*), respectively. And finally, radial yarn movement and beat-up operation are shown in FIG. 19(*g*)–FIG. 19(*h*), respectively.

According to the second embodiment of the weaving apparatus, 3-D multiaxial circular weaving apparatus 300 has mainly six units comprising feeding unit 310 yarn guiding units 20, machine bed 330, needle-rod unit 340, beat-up unit 360, and take-up unit 370 shown in FIG. 20. In feeding unit 310, axial yarns 14 and radial yarns 18 are fed to the weaving zone. Feeding unit 310 has a number of bobbins 312 for axial and radial yarns and feeding basement plate 314. Guiding disc 320 has a number of holes depending upon the number of radial yarns 18 and has circular rings 322 for guiding the axial yarns 14 towards the weaving zone.

The preform F2*b* producing from the second embodiment of the weaving apparatus is seen in FIG. 21. The preform according to second embodiment 300 is similar to that of first 3-D multiaxial circular weaving apparatus 100. The only difference is that radial yarns in the preform F2*b* are doubled and have a radial loop 18*a* section as shown in FIG. 21.

It is important that preform produced by first weaving prototype 100 are also fabricated by using second weaving prototype 300. It is further possible that +/−bias yarns in all preforms are also oriented at different angle compared to the longitudinal direction of the preform. Also, +/−bias yarn orientation in the preform can be varied +/−10° to 80°.

The machine bed 330 includes a number of circular rings 332 for +/−bias yarn carriers and circumferential yarn carriers and tubes 334 for axial yarns 14 shown in FIG. 22. The machine bed 330 has grooves 336 for placement of each circular ring 332.

The circular ring 332 has a number of blocks 332*a* in its circumference depending upon number of +/−bias yarn carriers or circumferential yarn carriers between every adjacent block 332*a*. There is an empty space 332*b* for each needle 346 for radial yarn insertion shown in FIG. 23. The needle-rod unit 340 has needle part 342 and rod part 344. The needle-rod unit was developed to insert the radial yarns 18 into the preform F2*b*. The needle part consists of needles 346 which has a needle eye 347 and circular needle bed 348 shown in FIG. 24. The rod part 344 also has a number of rods 350 and basement 352. The rod 350 number is equal to that of needle 346 shown in FIG. 24(*a*). The needle-rod unit 340 is positioned at the apparatus 300 as shown in FIG. 25. As it is seen in second embodiment, the needle-rod unit was replaced to the radial yarn carrier which is used in the first embodiment.

The insertion of the radial yarns are shown step-by-step in FIGS. 26–26(*c*). The starting position of the needle-rod unit is seen in FIG. 26. In FIG. 26(*a*), the needles move inwardly radial direction of the apparatus 300 and insert the radial yarns. In FIG. 26(*b*), the rods move in the forwardly axial direction of the apparatus 300 and hold the radial yarn loops. In FIG. 26(*c*), the needles move in the outwardly radial direction of the apparatus 300 and then the insertion of the radial yarns are completed.

The steps in the operation of the 3-D multiaxial circular weaving apparatus 300 can be described as follows:

1. Positive bias yarn carrier and negative bias yarn carriers are rotated just one carrier distance at clockwise and counterclockwise directions, respectively.

2. Circumferential yarn carriers are also rotated just one carrier distance to counterclockwise direction depending upon the carrier number on the circular ring 322.

3. Needles insert the radial yarns to the preform F2*b* and rods hold the radial yarn loops, and needles move outwardly and the machine bed is cleared.

4. Beat-up unit beats the inserted yarns to the weaving line.

5. Take-up unit removes the woven preform from the weaving zone.

6. Step 1 is repeated.

7. Step 2 is repeated and previously inserted radial loops are additionally firmly holding in the preform by newly inserted circumferential yarns.

8. Step 3 is repeated.

9. Step 4 is repeated.

10. Step 5 is repeated.

It will be understood that various details of the invention may be changed without departing from the scope of the invention. Furthermore, the foregoing description is for the purpose of illustration only, and not for the purpose of limitation—the invention being defined by the claims.

What is claimed is:

1. A three-dimensional (3-D) fabric of a generally cylindrical shape with a core defined therein and the fabric having a central axis, the fabric comprising:

(a) a plurality of concentric axial yarn layers extending radially outwardly in spaced-apart relationship from the central axis of the fabric, wherein each of said layers comprises a plurality of axial yarns extending generally parallel to the central axis of the fabric;

(b) a plurality of radially spaced-apart circumferential yarns extending outwardly from the central axis of the fabric so as to define a plane substantially perpendicular to the central axis, wherein each of a selected number of said plurality of circumferential yarns is woven between a corresponding plurality of next adjacent and successive concentric axial yarn layers; and (c) a plurality of radial yarns wherein each of a selected number of said plurality of radial yarns is woven between a corresponding plurality of next adjacent and successive axial yarns in each axial yarn layer of a plurality of concentric axial yarn layers, each of said pair of radial yarns contains a radially extending row of axial yarns therebetween comprising a single axial yarn from each of a plurality of next adjacent radially spaced-apart axial yarn layers.

2. The three-dimensional fabric according to claim 1, wherein said concentric axial yarns, said circumferential yarns and said radial yarns are woven together so as to define said open core along the length of the central axis of said fabric.

3. The three-dimensional fabric according to claim 2, wherein the horizontal profile of the core is substantially annular and smooth.

4. The three-dimensional fabric according to claim 2, wherein the horizontal profile of the core is substantially annular and irregular, said core comprising a predetermined plurality of spaced-apart woven proturbences extending radially inwardly towards the central axis of said fabric.

5. The three-dimensional fabric according to claim 1, comprising at least one out bias thread layer positioned adjacent the outside surface of said cylindrically-shaped fabric and comprising a plurality of continuous bias threads arranged so that the layer is inclined symmetrically with respect to said axial yarns, said bias thread layer being locked in said fabric at least by said radial yarns.

6. The three-dimensional fabric according to claim 5, wherein said at least one bias thread layer comprises a pair of bias thread layers wherein each layer is inclined symmetrically with respect to the other layer.

7. The three-dimensional fabric according to claim 1, comprising at least one inner bias thread layer positioned adjacent the inside surface defined by said core of said cylindrically-shaped fabric and comprising a plurality of continuous bias threads arranged so that the layer is inclined symmetrically with respect to said axial yarns, said bias thread layer being locked in said fabric at least by said radial yarns.

8. The three-dimensional fabric according to claim 7, wherein said at least one inner bias thread layer comprises a pair of bias thread layers wherein each layer is inclined symmetrically with respect to the other layer.

9. A three-dimensional (3-D) fabric of a generally cylindrical shape with a core defined therein and said fabric having a central axis, the fabric comprising:

(a) a plurality of concentric axial yarn layers extending radially outwardly in spaced-apart relationship from the central axis of the fabric, wherein each of said layers comprises a plurality of axial yarns extending generally parallel to the central axis of the fabric;

(b) a plurality of radially spaced-apart circumferential yarns extending outwardly from the central axis of the fabric so as to define a plane substantially perpendicular to the central axis, wherein each of a selected number of said plurality of circumferential yarns is woven between a corresponding plurality of next adjacent and successive concentric axial yarn layers;

(c) a plurality of radial yarns wherein each of a selected number of said plurality of radial yarns is woven between a corresponding plurality of next adjacent and successive axial yarns in each axial yarn layer of a plurality of concentric axial yarn layers, each of said pair of radial yarns contains a radially extending row of axial yarns therebetween comprising a single axial yarn from each of a plurality of next adjacent radially spaced-apart axial yarn layers;

(d) at least one outer bias thread layer positioned adjacent the outside surface of said cylindrically-shaped fabric and comprising a plurality of continuous bias threads arranged so that the layer is inclined symmetrically with respect to said axial yarns, said bias thread layer being locked in said fabric at least by said radial yarns; and (e) at least one inner bias thread layer positioned adjacent the inside surface defined by said core of said cylindrically-shaped fabric and comprising a plurality of continuous bias threads arranged so that the layer is inclined symmetrically with respect to said axial yarns, said bias thread layer being locked in said fabric at least by said radial yarns.

10. The three-dimensional fabric according to claim 9, wherein said concentric axial yarns, said circumferential yarns and said radial yarns are woven together so as to define said open core along the length of the central axis of said fabric.

11. The three-dimensional fabric according to claim 9, wherein said at least one outer bias thread layer comprises a pair of bias thread layers wherein each layer is inclined symmetrically with respect to the other layer.

12. The three-dimensional fabric according to claim 9, wherein said at least one inner bias thread layer comprises a pair of bias thread layers wherein each layer is inclined symmetrically with respect to the other layer.

13. A three-dimensional (3-D) fabric of a generally cylindrical shape with a core defined therein and having a central axis, the fabric comprising:

(a) a plurality of concentric axial yarn layers extending radially outwardly in spaced-apart relationship from the central axis of the fabric, wherein each of said layers comprises a plurality of axial yarns extending generally parallel to the central axis of the fabric;

(b) a plurality of radially spaced-apart circumferential yarns extending outwardly from the central axis of the fabric so as to define a plane substantially perpendicular to the central axis, wherein each of a selected number of said plurality of circumferential yarns is woven between a corresponding plurality of next adjacent and successive concentric axial yarn layers;

(c) a plurality of radial yarns wherein each of a selected number of said plurality of radial yarns is woven between a corresponding plurality of next adjacent and successive axial yarns in each axial yarn layer of a plurality of concentric axial yarn layers, each of said pair of radial yarns contains a radially extending row of axial yarns therebetween comprising a single axial yarn from each of a plurality of next adjacent radially spaced-apart axial yarn layers; and (d) at least one outer bias thread layer positioned adjacent the outside surface of said cylindrically-shaped fabric and comprising a plurality of continuous bias threads arranged so that the layer is inclined symmetrically with respect to said axial yarns, said bias thread layer being locked in said fabric at least by said radial yarns.

14. The three-dimensional fabric according to claim 13, wherein said concentric axial yarns, said circumferential yarns and said radial yarns are woven together so as to define said open core along the length of the central axis of said fabric.

15. The three-dimensional fabric according to claim 13, wherein said at least one bias thread layer comprises a pair of bias thread layers wherein each layer is inclined symmetrically with respect to the other layer.

* * * * *